US006483079B2

(12) United States Patent
Sato et al.

(10) Patent No.: US 6,483,079 B2
(45) **Date of Patent: *Nov. 19, 2002**

(54) GLOW PLUG AND METHOD OF MANUFACTURING THE SAME, AND ION CURRENT DETECTOR

(75) Inventors: Yasuyuki Sato, Kasugai; Masamichi Shibata, Toyota; Hiroyuki Murai, Anjou; Atsushi Kurano, Kuwana, all of (JP)

(73) Assignee: Denso Corporation, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 10 days.

(21) Appl. No.: 08/973,799

(22) PCT Filed: Apr. 10, 1997

(86) PCT No.: PCT/JP97/01254

§ 371 (c)(1),
(2), (4) Date: Dec. 9, 1997

(87) PCT Pub. No.: WO97/38223

PCT Pub. Date: Oct. 16, 1997

(65) Prior Publication Data

US 2002/0036192 A1 Mar. 28, 2002

(30) Foreign Application Priority Data

| | | |
|---|---|---|
| Apr. 10, 1996 | (JP) | 8-88006 |
| Jun. 10, 1996 | (JP) | 8-147132 |
| Jun. 26, 1996 | (JP) | 8-166469 |
| Jun. 26, 1996 | (JP) | 8-166470 |
| Jul. 9, 1996 | (JP) | 8-179470 |
| Aug. 9, 1996 | (JP) | 8-227733 |
| Aug. 9, 1996 | (JP) | 8-227734 |
| Aug. 9, 1996 | (JP) | 8-227735 |
| Aug. 29, 1996 | (JP) | 8-228604 |
| Sep. 11, 1996 | (JP) | 8-263672 |
| Sep. 11, 1996 | (JP) | 8-263673 |
| Sep. 11, 1996 | (JP) | 8-263674 |
| Sep. 11, 1996 | (JP) | 8-263675 |
| Sep. 11, 1996 | (JP) | 8-263676 |
| Sep. 18, 1996 | (JP) | 8-269371 |
| Sep. 18, 1996 | (JP) | 8-269372 |
| Mar. 4, 1997 | (JP) | 8-49258 |
| Mar. 4, 1997 | (JP) | 9-49259 |
| Mar. 11, 1997 | (JP) | 9-56241 |
| Mar. 18, 1997 | (JP) | 9-86026 |
| Mar. 19, 1997 | (JP) | 9-85784 |
| Mar. 19, 1997 | (JP) | 8-85785 |

(51) Int. Cl.[7] ..... F23Q 7/22

(52) U.S. Cl. ..... 219/270; 219/544; 123/145 A; 123/145 R; 361/264; 361/265; 361/266

(58) Field of Search ..... 219/270, 544; 123/145 A, 145 R; 361/264–266

(56) References Cited

U.S. PATENT DOCUMENTS

| | | | | |
|---|---|---|---|---|
| 4,739,731 A | | 4/1988 | Habich et al. | |
| 5,893,993 A | * | 4/1999 | Kurano | 219/270 |
| 5,922,229 A | * | 7/1999 | Kurano | 219/270 |
| 6,062,185 A | * | 5/2000 | Chiu et al. | 123/145 A |
| 6,144,015 A | * | 11/2000 | Chiu et al. | 219/270 |
| 6,150,634 A | * | 11/2000 | Haussner et al. | 219/270 |

FOREIGN PATENT DOCUMENTS

| | | | |
|---|---|---|---|
| JP | 60-13983 | | 1/1985 |
| JP | 2-176322 | | 7/1990 |
| JP | 7-259597 | | 10/1995 |
| JP | 10-89228 | * | 4/1998 |
| JP | 10-89687 | * | 4/1998 |
| JP | 10-110950 | * | 4/1998 |
| JP | 10-110951 | * | 4/1998 |

OTHER PUBLICATIONS

Patent Abstracts of Japan, vol. 009, No. 011 (M–351), Jan. 1985, re JP 59–160046.

* cited by examiner

*Primary Examiner*—John A. Jeffery
(74) *Attorney, Agent, or Firm*—Nixon & Vanderhye P.C.

(57) ABSTRACT

The present invention is to provide a glow plug (1) with an ion current detecting function, which is mounted in a combustion chamber of a Diesel engine. The glow plug includes an insulator (8); a heating element (6) embedded in the insulator and energized through a pair of lead wires (11*a,* 11*b*) to generate heat; and an ion current detecting electrode (14) embedded in the insulator with a portion exposed into a flame in the combustion chamber so that an ionization state in the flame can be detected. The heating element of the glow plug promotes ignition and combustion of fuel in the combustion chamber (7) due to its heating action caused when running the heating element hot. The ion current detecting electrode detects an ionization state in the combustion flame. When detecting ion current, the ion current detecting electrode and the adjacent inner wall of the combustion chamber form two electrodes for capturing positive and negative ions existing between both when burning the fuel. In such structure, the ion current can be detected precisely in spite of very simple structure. It is therefore possible to effectively use the information for combustion control. Further, since the ion current detecting function is added to the glow plug, an inexpensive ion current detecting sensor can be provided.

86 Claims, 98 Drawing Sheets

FIG. 59
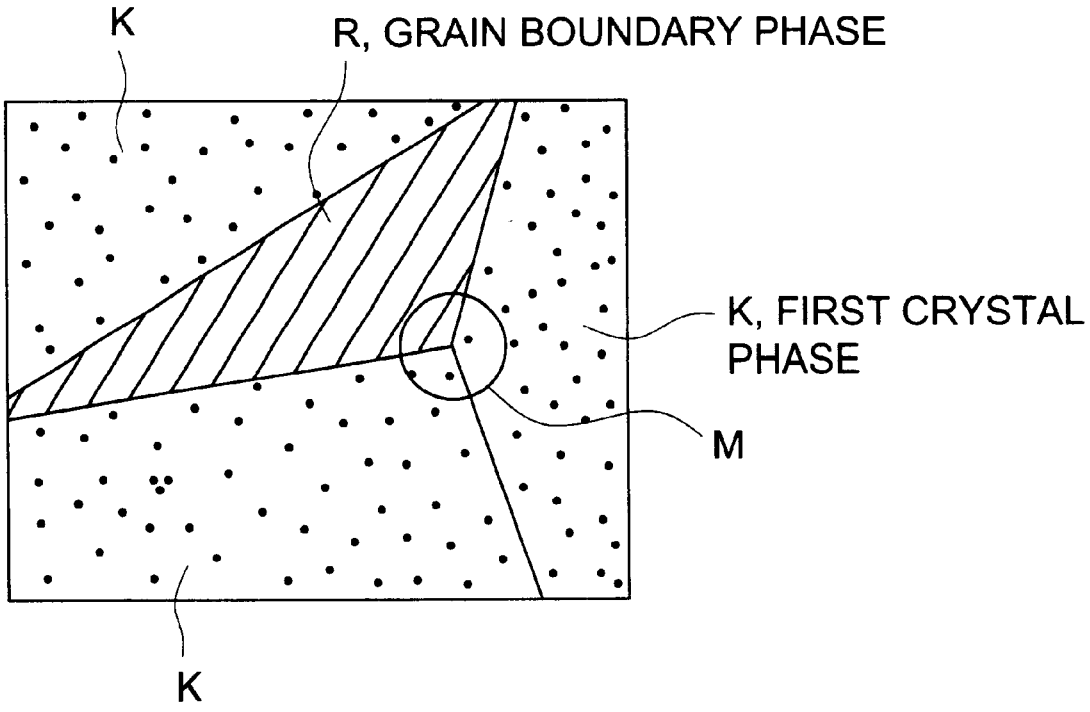
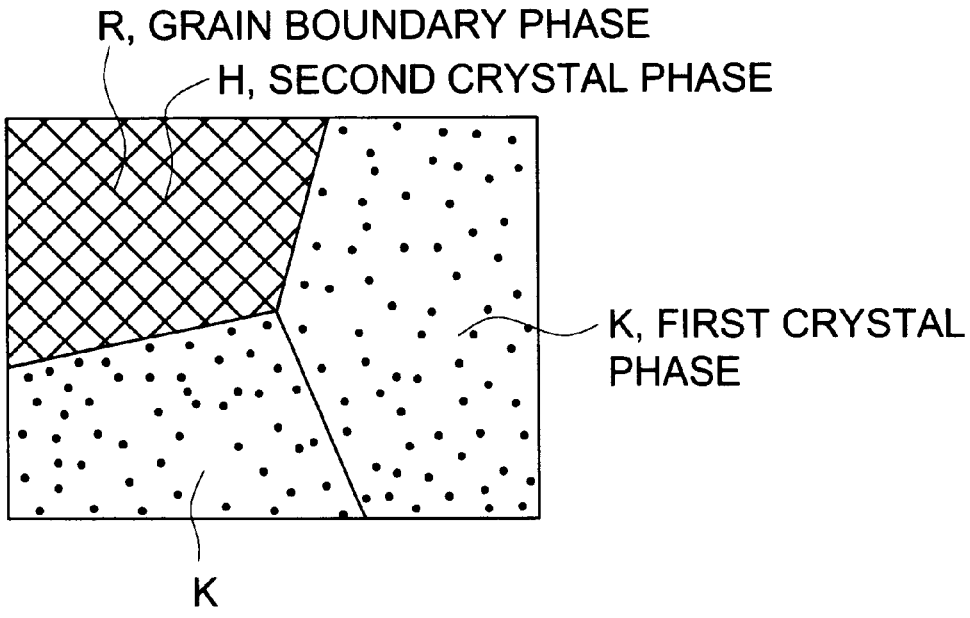
FIG. 60

START

11
ENGINE HAS BEEN WARMED UP AND GLOW RELAY IS TURNED OFF ?
YES
NO
READ WATER TEMP. Tw AND ENGINE SPEED Ne
12
13
Tw≧60°C?
YES
NO
14
Ne≧2000 rpm ?
YES
NO
15
16
TURN GLOW RELAY ON
TURN GLOW RELAY OFF
RETURN

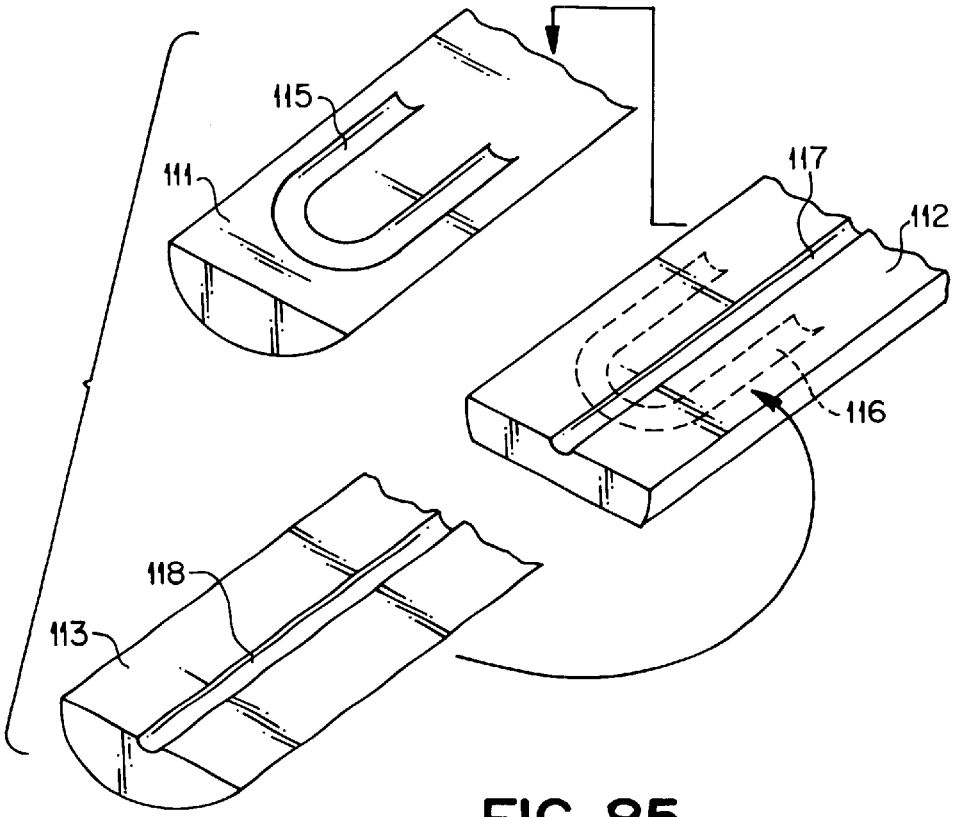
FIG. 85
FIG. 86A
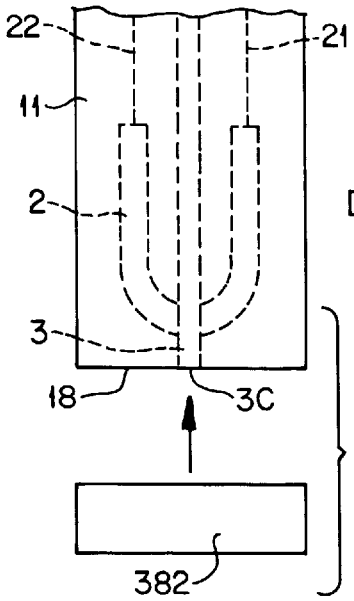
FIG. 86B
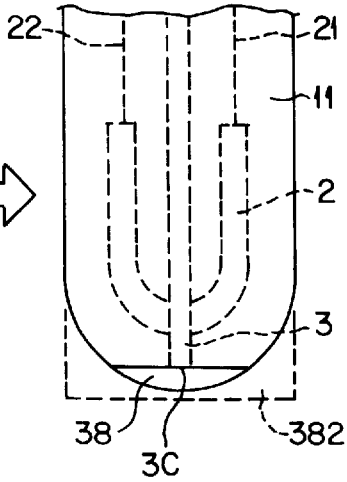

COEFFICIENT OF LINEAR EXPANSION ($10^{-6}$/°C)

GLOW PLUG AND METHOD OF MANUFACTURING THE SAME, AND ION CURRENT DETECTOR

This application is the national phase of international application PCT/JP97/01254 filed Apr. 10, 1997 which designated the U.S.

FIELD OF THE INVENTION

The present invention relates to a glow plug for promoting ignition and combustion of fuel, an ion current detector using the glow plug and a method of manufacturing the glow plug.

BACKGROUND ART

From the standpoint of the environmental protection, further reduction of the discharged quantity of exhaust gas or soot has been recently required in not only gasoline engines but also Diesel engines. To meet the requirements, consideration has been given to improvements on various points such as improvements of engine, a reduction in emission gas by the post processing (using a catalyst or the like), improvements in characteristics of fuel or lubricating oil and improvements of engine combustion control systems.

In connection with the above countermeasures, it is required to detect engine combustion conditions during engine operation. Such engine combustion conditions are to be detected by measuring cylinder internal pressure, combustion light, ion current and such. Of all the measuring methods for detecting the engine combustion conditions, the ion current measurement has been considered to be highly useful because it can be used for directly observing a chemical reaction resulting from the engine combustion, and therefore various types of ion current detecting methods have been proposed.

Japanese Patent Laid-Open Application (JP-A) No. 7-259597 discloses a method for detecting ion current (ionization degree of fuel gases) due to combustion of fuel by a sleeve-like electrode attached to a mounting seat for a fuel injection nozzle, the sleeve-like electrode electrically insulated from the injection nozzle and a cylinder head of the engine, and connected to an external detection circuit.

U.S. Pat. No. 4,739,731 discloses a sensor provided with a ceramic glow plug for detecting ion current (conductivity of ionized fuel gases). In this technique, an electric conductive layer made of platinum is formed on a surface of a heater (heating element) of the ceramic glow plug, and electrically insulated from a combustion chamber and a glow plug clamping fixture. An external power source (for 250-volt DC voltage) is provided for applying the voltage to the electric conductive layer to detect ion current resulting from the fuel combustion.

In typical ion current detectors with a glow plug having such an ion current detecting function, ignition and combustion of fuel are generally promoted by a heating action of the heating element when the engine starts at low temperature. In this case, such a heating state of the heating element usually continues after warm-up of the engine has been completed until the combustion is stabilized (generally, referred to as "afterglow"). After completion of the afterglow, the heating action of the glow plug is stopped and the processing step of detecting ion current is started.

However, the following drawbacks are present in the above conventional techniques. With the former technique (JP-A No. 7-259597), there is a need for ion current detection to provide a sleeve-like electrode insulated from the other portions, and this forces complicated work in preparing electrode materials and machining the electrode. Such an electrode for ion current detection is thus very expensive, and besides, becomes unusable earlier because of short-circuit between the electrode and the fuel injection nozzle or the cylinder by carbon generated in the combustion chamber.

With the latter technique (U.S. Pat. No. 4,739,731), since the electrode for detecting ion current is provided on the heating element, and the electrode and the heating element are connected to different power sources through individual electric circuits, respectively, the circuit structure is complicated. In addition, since a large amount of expensive noble metal such as platinum is needed for ensuring heat and wear resistance of the electrode, the glow plug itself becomes very expensive. Further in this sensor, the electrode is almost completely exposed into the combustion chamber and the space between the housing and the electrode is narrow. For this reason, there is a danger that the electrode is shorted to the ground and the housing is made conductive due to adhesion of carbon to the electrode surface, resulting in an error in detecting ion current.

Existing ion current detectors display only a heating action and cannot detect ion current during the afterglow period. Since in this period any result of ion current detection can not be used for performing combustion control, the combustion cannot be controlled optimally. Stated more specifically, it is difficult to control the combustion optimally during the afterglow period because such a result of ion current detection cannot be used in individual combustion operations, e.g., for performing feedback control of ignition stage and flame failure detection.

When using the above conventional glow plug, carbon adheres to the circumference of the ceramic heating portion to reduce insulation resistance between the exposed electrode for ion current detection and the grounded portion (plug housing and cylinder head) insulated from the electrode. In this case, a flow of leakage current may be created through the adhered carbon even if no ion is derived from the combustion gases. When this happens, the ion current detected shows a waveform different from a desired one due to occurrence of the leakage current, and such an incorrect detection result causes deterioration in the accuracy of ignition stage and flame failure detections. The electric insulation between the exposed electrode and the ground portion is dependent on pressure in the combustion chamber. Especially, in the engine compressing process the insulation resistance drops and the leakage current becomes easy to flow.

Also when using the glow plug, a sharp temperature change runs the danger that the ion current detecting electrode is broken by thermal vibration. Since a large amount of expensive noble metal such as platinum is needed for ensuring heat and wear resistance of the electrode, the glow plug itself becomes very expensive.

Further, since the ion current detecting electrode supported at the tip of the glow plug directly touches a flame having a high temperature, stresses tend to be concentrated in the neighborhood of the ion current detecting electrode and could damage the ceramic glow plug such as to crack it.

Therefore, it is an object of the present invention to provide a glow plug capable of detecting ion current precisely with a simple structure, an ion current detector using the glow plug, and a method of manufacturing the glow plug.

Another object of the present invention is to provide an ion current detector capable of detecting ion current precisely even for a period of glow of the glow plug and hence maintaining proper combustion of fuel based on the detection results.

Still another object of present invention is to provide an ion current detector capable of detecting ion current precisely and hence performing precise control of individual processings such as ignition stage detection and flame failure detection based on the detection results.

Yet another object of the present invention is to provide a relatively inexpensive glow plug having excellent durability, which can detect ion current precisely without any trouble from carbon adhesion and any damage to the ion current detector.

Yet another object of the present invention is to provide a glow plug having excellent durability without suffering any damage such as a crack and showing ease of manufacture, and a method of manufacturing the same.

The term "ion current" used here means current passing through ionized fuel gases in a combustion chamber. The ion current detecting electrode may be referred to as the ion current detecting electrode.

DISCLOSURE OF THE INVENTION

To achieve the above objects, a glow plug according to the invention as claimed in claim 1 comprises a heat resisting insulator, a heating element embedded in the heat resisting insulator and energized through a pair of lead wires, and an ion current detecting electrode embedded in the heat resisting insulator with a portion of the ion current detecting electrode exposed to a flame produced in a combustion chamber so that an ionization state in the flame can be detected.

In this case, the heating element of the glow plug acts to promote ignition and combustion of fuel in the combustion chamber by a heating action of the heating element. The ion current detecting electrode embedded in the heat resisting insulator detects the ionization state in the combustion flame. When detecting ion current, the ion current detecting electrode and the inner wall of the combustion chamber adjacent to the ion current detecting electrode form two electrodes for capturing positive and negative ions existing therebetween during fuel combustion. According to the glow plug, the ion current can be detected precisely with very simple structure, and information detected can be effectively used for combustion control. Further, since the glow plug is given an ion current detecting function, an inexpensive ion sensor can be provided.

Since the glow plug of the invention is constructed such that the majority of the ion current detecting electrode is embedded in the heat resisting insulator except only a portion exposed to the outside, an amount of carbon adhered to the outer surface of the glow plug cannot establish an electric connection between the electrode and a housing (grounded side) to cause error detection of the ion current that may occur in the prior art (U.S. Pat. No. 4,739,731). The exposed portion of the ion current detecting electrode is preferably provided at the tip of the glow plug so that the exposed portion and the housing (inner wall side of the combustion chamber) will be separated as far from each other as possible.

Although it is considered that some carbon adheres to the outer surface of the glow plug during operation, the carbon adhered is burnt off by a heating action of the heating element 7 (e.g., due to glowing when the engine starts at low temperature). As a result, the glow plug can maintain its performance in detecting ion current for long periods.

Further, since the heating element itself is embedded inside the heat resisting insulator, it never change its heating characteristics due to lowering of resistance or the like to maintain high heating performance for long periods. In other words, since such a construction could resist oxidation to wear the heating element, the sectional area is kept constant and the resistance does not vary. The construction also avoids damaging the heating element under thermal action such as thermal shock in the combustion chamber.

In the glow plug of the invention, the heating element and the ion current detecting element is constructed as follows. The invention as claimed in claim 2 recites that the heating element and the ion current detecting electrode is electrically connected to each other. Stated more specifically, in the invention as claimed in claim 3 the heating element and the ion current detecting electrode are integrally formed, while in the invention as claimed in claim 4 lead wires reside between the heating element and the ion current detecting electrode. In all of claims 2 to 4, both the heating performance of the heating element and the performance in detecting ion current can be maintained for long periods as mentioned above. From the standpoint of the manufacturing process, it is considered that the invention as claimed in claim 3 shows the simplest way to manufacture the glow plug.

The glow plug as claimed in claim 5 is such that the heating element and the ion current detecting electrode are insulated from each other. Since the heating element and the ion current detecting electrode are energized through individual paths, the ion current detecting electrode can detect ion current synchronously with the heating action of the heating element (i.e., the combustion condition can be grasped constantly).

The invention as claimed in claim 6 recites that at least the portion of the ion current detecting electrode exposed to the flame is made of a conductive ceramic material. It is therefore possible to minimize oxidation wearing of the ion current detecting electrode even when it is exposed to hot combustion gases, and hence to further improve the durability of the performance in detecting ion current by the glow plug.

The invention as claimed in claim 7 recites that the heating element and the ion current detecting electrode are produced dividedly from each other by using mixtures having different components or different particle sizes. Such divided production can change the resistance between the heating element and the ion current detecting electrode to provide a glow plug (ion current sensor) according to the application. In the case where the result of ion current detection is used for flame failure detection, only the present or absence of ion current is required for the determination. In such a case, it is possible to increase the resistance of the ion current detecting electrode to a relatively large value, e.g., about 5 MΩ or less (1Ω or so with the heating element). In the case where the result of ion current detection is used for ignition stage detection, it is desirable to reduce the resistance of the ion current detecting electrode as small as possible (500 kΩ or less) since the leading edge of ion current must be detected for an instant.

Although the above description was made to the glow plug featured in that the glow plug itself can prevent the ion current detecting electrode and the housing (inner wall side of the combustion chamber) from conducting even when some carbon adheres thereto, the carbon may become adhered and accumulated during a long period of operation. To eliminate such a problem, an ion current detector as claimed in claim 8 features that the adhered carbon is removed without stopping the ion current detection by using the glow plug of claim 5 that can carry out the ion current detection by the ion current detecting electrode simultaneously with the heating action of the heating element. Specifically, the ion current detector comprises switching means for turning on or off the power supply to the heating element, leakage current detection means for detecting a leakage current flowing from the ion current detecting electrode in a predetermined stage before fuel combustion, and operation means for operating the switching means to temporarily energize the heating element when the leakage current detected is larger than a predetermined threshold.

When the carbon adheres to the outer portion of the glow plug in the combustion chamber, the exposed portion of the ion current detecting electrode and the housing side are electrically conducted to reduce the insulation resistance. Consequently, a leakage current flows and a desired ion current waveform cannot be obtained. As shown in FIG. 24B, the leakage current flows before its ion current waveform is obtained (before point A in FIGS. 24A and 24B). On the contrary, in the invention the carbon adhered state of the outer surface of the glow plug is estimated based on the leakage current, and if it is such a carbon adhered state, the adhered carbon will be burnt off by running the heating element hot. As a result, a desired waveform of ion current (e.g., the waveform shown in FIG. 24A) can be obtained at all times, and the detection result can be used for precise processings such as ignition stage detection and flame failure detection.

When the carbon adheres to the outer surface of the glow plug, the insulation resistance between the ion current detecting electrode and the housing side depends on the pressure in the combustion chamber. In the invention as claimed in claim 9, since the detection of leakage current is carried out when the pressure in the combustion chamber rises, the presence or absence of the leakage current can be detected securely. The timing period of the pressure rise corresponds to the compression stage in a Diesel engine, for example. The leakage current may also be detected in correspondence to the timing period of fuel injection into the combustion chamber. The timing period of fuel injection corresponds to a period that elapses between the moment the pressure in the combustion chamber of the Diesel engine rises and the moment just before the fuel burns. It is therefore possible to detect the leakage current more securely under such a condition that the carbon adhered.

The invention as claimed in claim 10 relates to a method of manufacturing the glow plug. In the manufacturing method, the heating element and the ion current detecting electrode are first produced, surrounded with the heat resisting insulator, and hot-pressed at a predetermined temperature. A portion of the heat resisting insulator is then cut to expose the ion current detecting electrode to the outside. According to the above manufacturing technique, the glow plug having such special structure can be made up without requiring any complicated process, thereby providing the glow plug having such an excellent ion current detecting function through the simple manufacturing method.

The invention related to the manufacturing method for the glow plug may be replaced by those as claimed in claims 11 and 12. The glow plug having the special structure and the excellent ion current detecting function as aforementioned can be manufactured even by the manufacturing methods of these claims without requiring any complicated process.

In the invention as claimed in claim 11, the heating element and the ion current detecting electrode are provided on a thin-plate like heat resisting insulation sheet to be wrapped around a rod-shaped heat resisting insulation solid-shaft. The heat resisting insulation sheet and the heat resisting solid shaft are heat-treated, and a portion of the heat-treated body of the heat resisting insulation sheet and the heat resisting solid shaft is cut so that the ion current detecting electrode will be exposed to the outside.

On the other hand, the invention as claimed in claim 12 is such that the heating element and the ion current detecting electrode are provided on certain one of plural layer members. Then the plural layer members are so superposed that the layer member having the heating element and the ion current detecting electrode thereon will reside in a central portion. After that, the plural layer members put on top of each other are heat-treated, and a portion of superposed layer members is cut so that the ion current detecting electrode will be exposed to the outside.

For solving the above problems, the present invention uses a glow plug having a heating element energized through a pair of conductive wires to generate heat, and the following ion current detector is constructed by using an ion current detecting function of the glow plug. In the glow plug, the conductive wire pair (lead wire pair) and the heating element are insulated from the grounded side such as a cylinder head.

An ion current detector as claimed in claim 13 includes switching means for switching over between a first state and a second state, in which the first state is for applying a supply voltage from a power source to the conductive wire pair, and the second state is for shutting the electric path between the conductive wire pair and the power source and applying the supply voltage between the heating element and a wall portion of a combustion chamber. Further, ion current detection means is provided for detecting ion current resulting from fuel combustion by using the voltage supplied from the power source in the second state.

In the first state, the supply voltage is applied from the power source to the conductive wire pair to run the heating element hot. This state corresponds to the state in which ignition and combustion of fuel is being promoted when the engine starts at low temperature. In the second state, the electric path between the conductive wire pair and the power source is shut and the supply voltage is applied between the heating element and the wall portion of the combustion chamber. This state corresponds to the state in which ion current is detected. The ion current is detected by the ion current detection means.

In such structure, the voltage application to the heating element is performed through the common conductive wire pair in both states, and the switching between both states is selectively performed by the switching means. It is therefore possible to simplify the structure of the ion current detector that uses the glow plug having the ion current detecting function, such as wiring of the conductive wires connected to the heating element, and other circuit arrangements associated with ion current detection, and hence to provide an inexpensive ion current detector. In this case, the ion current detection accuracy is never reduced in spite of such simple structure.

For more concrete structure of the ion current detector, the invention as claimed in claim 14 recites that the power source is connected through the switching means to an electric path between the heating element and the wall portion of the combustion chamber, while the invention as claimed in claim 15 recites that the power source is connected directly to the electric path between the heating element and the wall portion of the combustion chamber. Both sufficiently meet requirements for realizing simplification of the structure. However, since the invention as claimed in claim 15 is to apply the voltage between the heating element and the wall portion of the combustion chamber directly without the switching means, it can show the following special effect.

Although the ion current due to fuel combustion is originally weak, since the power supply circuit is constructed without passing through the switching means, the ion current can be detected more precisely. The switching means can be materialized by a switching circuit with plural switch contacts, or a semiconductor switching element (transistor, thyristor or the like), with some resistance thereon.

The power source for applying voltage to the conductive wire pair in the first state and the power source for applying voltage between the heating element and the wall portion of the combustion chamber in the second state may be provided separately as recited in claim 16, or a common power source may be used therebetween as recited in claim 17. In either case, the ion current can be detected precisely. In particular, the invention as claimed in claim 17 does not require an power source exclusively used for the ion current detection, e.g., a power source other than the vehicle battery, thus simplifying the structure.

The invention as claimed in claim 18 recites that one end of the power source is connected to one conductive wire coupled to the heating element while the other is connected to a cylinder head of the Diesel engine for holding the glow plug. In this case, the structure for applying voltage between the heating element and the wall portion of the combustion chamber can be simplified when it is used in the Diesel engine.

The invention as claimed in claim 19 recites that a constant voltage circuit is provided between the power source and one wire of the conductive wire pair for regulating the supply voltage of the power source to a constant value. Since the ion current is originally weak, the ion current value detected is susceptible to variation of the applied voltage to cause a detection error when the applied voltage largely varies. The detection error also causes various problems. For example, when the output information of the ion current (wave height, area, etc.) is used for flame failure detection, the accuracy of the flame failure detection must be lowered. In contrast, the above structure permits the improvement in accuracy of the ion current detection and hence the improvement in accuracy of individual processings such as flame failure detection.

The invention as claimed in claim 20 recites that a plurality of glow plugs are connected in parallel and power-supply paths to individual glow plugs are switched at the same time by the switching means. In such structure, the switching circuit as the switching means and the detecting resistor as the ion current detection means can be shared by the glow plugs, thereby further simplifying the structure. For example, when the glow plugs are provided in the combustion chambers of a multiple cylinder engine, ion current can be detected for each cylinder in time series.

The ion current detector can also be simplified with structure other than the above, and such structure is preferably materialized as recited in claims 21 to 23. The invention as claimed in claim 21 is such that an voltmeter for ion current detection is provided between one conductive wire of the glow plug and the ground contact. In this case, the voltmeter can be constructed by an amplifier measuring a potential difference from the ground with relatively simple structure, rather than by a differential amplifier having relatively complicated internal structure.

In addition, the invention as claimed in claim 21 is preferably constructed as recited in claim 22, i.e., it is preferably constructed such that a capacitor is provided between one conductive wire of the glow plug and the voltmeter. In this case, the DC component of the supply voltage is cut by the capacitor. Therefore, even when a power source of a relatively high voltage (e.g., 50 volts) is used exclusively for the ion current detection, the voltage applied to the voltage detector (amplifier) never exceeds the withstand voltage since the high voltage of the power source is not directly applied to the voltage detector. As a result, inconvenient things such as damage to the voltage detector can be prevented. It should be noted that this structure becomes more effective in the case the supply voltage for the ion current detection is 30 volts or higher.

The invention as claimed in claim 23 is such that an ion current detecting resistor is provided on the grounded side of the power source for detecting ion current from a potential difference between both terminals of the ion current detecting resistor. In this case, the voltage waveform corresponding to the ion current waveform detected is plotted on a reference level of 0 volt. It is therefore unnecessary to use an expensive, complicated voltage detector even when using a supply voltage exceeding the withstand voltage of the voltage detector. Such structure is preferably materialized as recited in claim 16, i.e., it is preferably materialized such that the heating-element power source and the ion current detecting power source are provided separately with the ion current detecting resistor provided on the grounded side of the latter power source. This is because the heating performance of the heating element may be lowered at heating time when the heating element and the ion current detecting resistor are connected in series.

On the other hand, a glow plug as recited in claim 24 can be used for the glow plug in the above ion current detector, in which a heating element portion having a heating element is so provided that it projects into the combustion chamber for burning fuel. An ion current detecting electrode to the inner wall of the combustion chamber is formed in the heating element. In this case, the heating element of the glow plug acts to promote ignition and combustion of fuel in the combustion chamber due to the heating action when the heating element is running hot. When detecting ion current rather than running the heating element hot, the heating element acts as the ion current detecting electrode for detecting the ion current resulting from the fuel combustion. In other words, when detecting ion current, the heating element and the inner wall of the combustion chamber adjacent to the heating element form two electrodes for capturing positive and negative ions existing therebetween when burning the fuel. It is therefore possible to detect the ion current precisely in spite of such simple structure, and hence to effectively use the information on the detected ion current for various combustion control. Further, since the ion current detecting function is given to the glow plug, an inexpensive ion current sensor can be provided.

A glow plug as recited in claim 25 comprises a heating element portion provided with a heat resisting insulator and a heating element embedded in the heat resisting insulator, in which a portion of the heating element is exposed from the heat resisting insulator and the exposed portion is used as an ion current detecting electrode to the inner wall of the combustion chamber. In such a case, since the exposed portion of the heating element effectively acts as the ion current detecting electrode, the same effects as of claim 25 can be obtained, and beside, the following effect can be newly obtained. Although it is considered that some carbon adheres to the exposed portion of the heating element during operation of the glow plug, the adhered carbon is burnt off by the heating action of the heating element (e.g., due to glowing when the engine starts at low temperature). As a result, life of the glow plug is never reduced even in such structure in which an exposed portion is provided in the heating element for use as an ion current detecting electrode, so that the glow plug adds excellent durability that are useful for long periods.

The heating element is preferably made of a ceramic material as recited in claim 26. In this case, if the heating element made of a ceramic material is so arranged that a portion of the heating element will be exposed into the combustion chamber, oxidation wearing of the heating element can be minimized even when it is exposed to hot combustion gases, thereby further improving the durability of the glow plug.

In the invention as claimed in claim 27, the heating-element running state of the glow plug and the ion current detecting state of the glow plug are switched (switching means). In the ion current detecting state of the glow plug, combustion ions are captured between the glow plug electrode portion and the inner wall of the combustion chamber, and ion current is detected by current detection means such as an ion current detecting resistor.

The present invention also features that the switching means is operated to temporarily switch over to the ion current detecting state at least immediately after the fuel ignition stage (operation means). Since the function of the glow plug for promoting ignition and combustion of fuel is given top priority in all the functions of the glow plug, for example, during the afterglow period when the engine starts at low temperature, the ion current detection has not been performed during the afterglow period in the prior art. In contrast, according to the present invention, the ion current detection period is temporarily provided within a range in which the heating function of the glow plug is never damaged even under the heating-element running state such as in the afterglow period. It is therefore possible to detect ion current precisely even in the glow period of the glow plug, and hence to maintain the fuel combustion properly using the result of the ion current detection.

In the invention as claimed in claim 28, the operation means operates the switching means to switch over to the ion current detecting state for a predetermined period of time after each event of the fuel injection into the combustion chamber. In this case, since the ion current detection period is set based on the fuel injection timing, the ion current can be detected securely by setting the ion current detection period as short as possible, thereby minimizing lowering of the glow function of the glow plug.

In the invention as claimed in claim 29, the operation means operates at a predetermined frequency to switch over between the heating-element running state and the ion current detecting state. Even in such a case, the ion current detecting function and the heating-element running function can be united in the afterglow period.

In the invention as claimed in claim 30, the glow plug comprises a heating element energized through a pair of lead wires to generate heat, a heat resisting insulator embedding the heating element therein, and an ion current detecting electrode integrally formed with the heating element. Such a glow plug is used to detect ion current produced when burning fuel. In this case, the ion current can be detected precisely in spite of such very simple structure, and the information on the ion current detected can be effectively used for combustion control.

In the invention as claimed in claim 31, the heating-element running state of the glow plug and the ion current detecting state of the glow plug are switched (switching means). Brief description of the normal switching action is as follows. For example, when the glow plug is held in the heating-element running state at the time of low-temperature start of the engine, and warm-up of the engine is completed by the heating action of the heating element, the glow plug is switched from the heating-element running state to the ion current detecting state. In other words, combustion ions are captured between the exposed electrode portion of the glow plug and the inner wall of the combustion chamber, and the ion current is detected by the current detection means such as an ion current detecting resistor.

The present invention also features that a leakage current flowing from the exposed electrode portion is detected in a predetermined stage before fuel ignition under the ion current detecting state of the glow plug (leakage current detection means). When the leakage current detected by the leakage current detection means is larger than a given threshold, the switching means is operated to temporarily switch over from the ion current detecting state to the heating-element running state (operation means).

The carbon adhered to the outer portion of the glow plug in the combustion chamber can cause a reduction in insulation resistance between the exposed electrode and the grounded portion, and hence a flow of leakage current. In this case, a desired waveform of the ion current may not be obtained. As shown in FIG. 6(*b*), the leakage current flows before a real waveform of the ion current is plotted (before point A in FIG. 6). In contrast, according to the present invention, the leakage current is detected in a predetermined stage (in the timing period of fuel injection in FIG. 6), so that the carbon adhesion to the outer glow plug can be estimated based on the leakage current. If such a carbon adhesion occurs, the glow plug is changed to the heating-element running state and the adhered carbon is burnt off. It is therefore possible to constantly detect a desired ion current waveform (e.g., the waveform shown in FIG. 24A), and hence to perform ignition detection or flame failure detection precisely using the detection result.

When the carbon adheres to the outer glow plug, the insulation resistance between the exposed electrode and the grounded side depends on the pressure in the combustion chamber. For this reason, as the pressure rises, the insulation resistance is reduced and the leakage current tends to flow. To avoid such an inconvenient thing, the invention as claimed in claim 32 is such that the leakage current is detected when the pressure in the combustion chamber rises. In this case, the presence or absence of the leakage current can be detected securely. The pressure rise in the combustion chamber corresponds to the compression process in the Diesel engine.

The invention as claimed in claim 33 is such that the leakage current is detected in response to the timing of fuel injection into the combustion chamber. For example, the timing period of fuel injection corresponds to a period that elapses between the moment the pressure in the combustion chamber of the Diesel engine rises and the moment just before the fuel burns. It is therefore possible to detect the leakage current more securely under such a condition that the carbon adhered.

On the other hand, the invention as claimed in claim 34 is such that the operation means holds the switching means in the heating-element running state for a period of time according to the leakage current value detected by the leakage current detection means. In other words, the more the carbon adheres to the outer glow plug, the larger the leakage current value will be. It is therefore possible to burn off the adhered carbon securely by setting the hold time of the heating-element running state according to the leakage current value.

The invention as claimed in claim 35, which is dependent on claims 31 to 34, recites that a high-pass filter is provided to the signal output portion of the ion current detector for detecting ion current, and the detection signal is input to the signal processor. According to the claim, since the high-pass filter is incorporated in the system circuitry, the ion current due to combustion can be separated from the leakage current due to a failure of insulation even when the carbon adheres to the ion current detecting electrode of the glow plug, thereby detecting the ion current securely. If the combustion condition information such as ignition stage is judged from the output waveform of the high-pass filter, the judgment processing becomes easy to perform. The inventor's study confirms that the cut-off frequency of the high-pass filter is preferably set from 50 Hz to 5 kHz, more preferably 100 to 500 Hz.

The invention as claimed in claim 35 can be materialized as described in claims 6 and 7. In the invention as claimed in claim 36, the threshold for use in judging leakage current by the operation means is set to a value near the acceptable maximum value. When the switching means is operated mainly aiming at removal of the adhered carbon, the threshold for use in judging leakage current should be set small. However, the use of the structure as recited in claim 35 permits separation between the leakage current and the ion current even when some leakage current flows. If the threshold for use in judging leakage current is set large within the acceptable range, the number of times the adhered carbon is burnt off will be reduced. It is therefore possible to detect ion current frequently, and hence to detect the combustion conditions frequently.

The invention as claimed in claim 37 comprises comparison means for inputting an output signal of the high-pass filter and comparing the input signal with the threshold for use in detecting combustion conditions. Since the output of the high-pass filter is compared with the threshold for use in detecting combustion conditions, the processing for detecting combustion conditions can be easily carried out.

The invention as claimed in claim 38 is such that the conductive heating-element and the ion current detecting electrode are provided inside the insulator. At least the exposed portion contacting the flame is constructed of the above conductive mixed-sinter with adding a sintering auxiliary made of more than one kind of oxide of rare-earth element. The structure of the mixed sinter is composed of a first crystal phase and a grain boundary phase between the first crystal phases. Portion of the grain boundary phase or the entire grain boundary phase is crystallized into a second crystal phase containing the sintering auxiliary.

The ion current detecting electrode of the present invention is thus composed of the first crystal phase as a crystal phase of either the conductive ceramic material or the nonconductive ceramic material or both, and the grain boundary phase between the crystal phases (FIGS. 56 to 59). The most important feature of the invention is that portion of the grain boundary phase or the entire grain boundary phase is crystallized into the second crystal phase (FIG. 60) while the grain boundary phase in the conventional or typical conductive mixed-sinter are made into glass phase in whole.

The conductive heating-element and the ion current detecting electrode are provided in the insulator in either way that molded parts of them are produced separately, embedded in the ceramic powder material for the insulator and molded integrally, or that the molded parts of the conductive heating-element and the ion current detecting electrode are inserted between two molded parts of insulator produced in advance.

The molded parts of the insulator, the conductive heating-element and the ion current detecting electrode are made up such that main composition of ceramic powders for the molded parts is mixed with paraffin wax and other resin and the mixture is injection-molded.

The ion current detecting electrode is produced of a mixed material that contains a sintering auxiliary made of an oxide or oxides of rare-earth element in addition to the conductive ceramic powder and the nonconductive ceramic powder. As discussed above, the mixed sinter made of such a material is composed of the first crystal phase and the grain boundary phase between the first crystal phases, with portion of the grain boundary phase or the entire grain boundary phase crystallized into the second crystal phase.

As is similar to the ion current detecting electrode, for the conductive heating-element and the insulator, it is also preferable to use such a material that contains a sintering auxiliary made of an oxide or oxides of rare-earth element in addition to the conductive ceramic powder and the nonconductive ceramic powder. The conductive heating-element and the insulator can thus be made in excellent structure with portion of the grain boundary phase or the entire grain boundary phase crystallized into the second crystal phase.

As is similar to the above inventions, the glow plug of the present invention is run hot by the current passing therethrough to promote ignition and combustion of fuel in the combustion chamber, while the ion current detecting electrode form two electrodes with the inner wall of the combustion chamber adjacent to the ion current detecting electrode to detect ion current in the combustion flame. In such structure, the present invention permits precise detection of the ion current and hence the effective use of the information for combustion control. Further, since the glow plug has the ion current detecting function in addition to the original heating function, it can be manufactured with compact structure and at low cost.

Although some carbon may adhere onto the surface of the ion current detecting electrode during burning fuel, such adhered carbon can be burnt off by the heating action of the conductive heating-element (e.g., due to glowing when the engine starts at low temperature). As a result, the glow plug can detect ion current precisely for long periods.

In the present invention, at least the exposed portion contacting the flame is constructed of the mixed sinter having the above structure. In other words, the structure of the mixed sinter is composed of the first crystal phase and the grain boundary phase between the first crystal phases (FIG. 59), with portion of the grain boundary phase or the entire grain boundary phase crystallized into a second crystal phase containing the sintering auxiliary (FIG. 60).

For this reason, the melting point of the grain boundary phase and the corrosion resistance can be improved more largely than the conventional structure composed of amorphous glass phases without the second crystal in each grain boundary phase. It is therefore possible to improve the performance of the ion current detecting electrode that could resist thermal shock, oxidation and corrosion, and hence to prevent any damage to the ion current detecting electrode, thereby improving reliability of the accuracy in detecting ion current and reliability of the glow plug.

Further, since the glow plug of the present invention is such that the conductive heating-element, the lead wires and ion current detecting electrode are integrally provided inside the insulator, the structure of the glow plug is simplified. It is therefore possible to detect ion current precisely without carbon adhesion and hence to provide a glow plug exhibiting excellent durability without any damage to the ion current detecting electrode.

The content of the sintering auxiliary to the total weight of the conductive ceramic material and the nonconductive ceramic material in the ion current detecting electrode is preferably set in a range from 3 to 25 wt % as recited in claim 39. If less than 3 wt %, the mixed sinter can not improve its compactness and is difficult to form the second crystal phase in each grain boundary phase.

If it exceeds 25 wt %, the grain boundary phase is made into a glass phase without being crystallized. In this case, the melting point of the grain boundary phase is reduced to lower the resistance to thermal shock and corrosion.

The second crystal phase of the ion current detecting electrode preferably exists in each grain boundary phase with a degree of crystallization of more than 5%. If less than 5%, the resistance to oxidation and corrosion can not be so improved since the melting point increases due to existence of the second crystal phase.

As recited in claim 41, the conductive ceramic material is preferably made of more than one kind of the materials such as metallic carbide, nitride and boride. In this case, the second crystal phase can be formed easily.

The ion current detecting electrode provided in the glow plug recited in claim 42 has an exposed portion exposed from the insulator into the flame. The exposed portion also has a ground portion with a surface roughness Rz of 0.1 to 30 $\mu$m (an average roughness of 10 points). The surface roughness Rz of the ground portion is an average roughness of 10 points determined under the provision of JIS B 0601, and the value is in a range of between 0.1 $\mu$m and 30 $\mu$m. If less than 0.1 $\mu$m, the ion current can not be detected sufficiently. If more than 30 $\mu$m, a crack or cracks may be developed due to thermal shock or the like. The ground portion is controlled within the above range by grinding it with a grindstone or the like. In this case a desired surface roughness Rz is obtained by regulating the grain size of the abrasive of the grindstone and other grinding conditions.

In arranging the conductive heating-element and the ion current detecting electrode in the insulator, molded parts for the conductive heating-element and the ion current detecting electrode are previously produced such as ones shown in FIGS. 62 and 63, embedded in the ceramic powder material for the insulator and molded integrally. Alternatively, the conductive heating-element and the ion current detecting electrode may be inserted between two insulator parts separately produced. The above insulator molded parts or the molded body with the conductive heating-element and the ion current detecting electrode may be made up by an injection molding.

The conductive heating-element and the ion current detecting electrode may also be provided inside the insulator by printing formation. As an example, the printing formation is performed such that two products (green sheets) of ceramic material, e.g., for forming the insulator, are prepared, and the conductive heating-element, the associated lead wires and the ion current detecting electrode are printed on the surface of one product with a conductive material in a desired form by a printing technique such as screen printing, pad printing or hot stamp.

The other product is so stacked that it will cover the printed portion and then firing is performed. The conductive heating-element, the lead wires and the ion current detecting electrode may be printed on two or more products. The conductive heating-element and the ion current detecting electrode may also be printed on different products and laminated together. The insulator with the conductive heating-element, the lead wires and the ion current detecting electrode printed and built therein is thus obtained.

The insulator is cut as required and the ground portion is ground in the exposed portion of the ion current detecting electrode in a manner described above. Such a glow plug as the ground portion of a specific surface roughness Rz is provided in the exposed portion of the ion current detecting electrode can thus be obtained.

As is similar to the above inventions, the glow plug of the present invention having the above structure is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame. It is therefore possible for the structure of the present invention to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, the ground portion is provided in the exposed portion of the ion current detecting electrode. The ground portion has a surface roughness Rz ranging from 0.1 to 30 $\mu$m. Since the ground portion has lots of micron size irregularities (FIG. 75), electric flux in the electric field between the ion current detecting electrode and the adjacent cylinder head is concentrated to the convexities in the irregularities, and potential gradients become sharp in the neighborhood of the convexities to which the electric flux is concentrated. Such sharp potential gradients attract charged particles of combustion gases into the neighborhood of the convexities. Consequently, the ion current detecting electrode having the ground portion of the specific surface roughness Rz attracts the charged particles in the combustion chamber due to considerable force, thereby further improving the accuracy in detecting ion current.

Further, since in the glow plug of the present invention the conductive heating-element, the lead wires and the ion current detecting electrode are integrally provided inside the insulator, the structure is simplified. It is therefore possible for the present invention to detect ion current precisely without any trouble from carbon adhesion, and hence to provide a glow plug having excellent durability.

The area of the exposed portion provided at the tip of the ion current detecting electrode is preferably set in a range from $1\times10^{-6}$ to 0.5 $cm^2$ as recited in claim 43. Although the ion current detecting electrode can detect ion output as long as the area (S) of the exposed portion of the ion current detecting electrode is larger than 0, if the area of the exposed portion is less than $1\times10^{-6}$ $cm^2$, the dimensions of the exposed portion will be very small such as 10 $\mu$m×10 $\mu$m or smaller when it is formed by a printing technique, resulting in decreased productivity. On the other hand, if larger than 0.5 $cm^2$, the area occupied by the ion current detecting electrode will become too large and hence the conductive heating-element will be made small, resulting in decreased productivity.

The ion current detecting electrode can be electrically connected to the conductive heating-element as recited in claim 44. In this case, since the ion current detecting electrode and the conductive heating-element can be integrally molded, the manufacturing process becomes simple.

The invention as claimed in claim 45 is made to the glow plug in which the conductive heating-element, the lead wires and the ion current detecting electrode are provided inside the insulator. According to the invention, at least top portion of the ion current detecting electrode is covered with a nonconductive porous layer.

The nonconductive porous layer has a communication hole opening from the surface of ion current detecting electrode into the flame. The porous layer has electrical nonconductivity. The nonconductive porous layer is made up by sintering nonconductive ceramic powder containing a main component such as $Si_3N_4$, $Al_2O_3$ or $SiO_2$.

As the embodiment shows, the conductive heating-element and the ion current detecting electrode can be provided in the insulator in the following manner: The conductive heating-element and the ion current detecting electrode are previously produced while the insulator having grooves for accommodating them are prepared. The conductive heating-element and the ion current detecting electrode are then embedded in the grooves and integrally baked. The conductive heating-element the ion current detecting electrode and the insulator may be made of ceramic powder.

As is similar to the above inventions, the glow plug of the present invention having the above structure is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame.

Since the top portion of the ion current detecting electrode is covered with the nonconductive porous layer, the ion current detecting electrode is never exposed to the direct fire of the flame. For this reason, the ion current detecting electrode is not subjected to stress concentration due to thermal shock by the hot flame, and hence any damage such as crack development. Further, since the nonconductive porous layer has the communication hole, ions flow into a space between the ion current detecting electrode and the cylinder head through the communication hole, thereby detecting the ions accurately.

It is therefore possible for the structure of the present invention to detect ion current precisely and hence to effectively use the information for combustion control. Further, since the glow plug has the ion current detecting function in addition to the original heating function (glow function), it can be manufactured with compact structure and at low cost.

Furthermore, since the conductive heating-element is embedded in the insulator, it is never corroded by the combustion flame, so that excellent durability and good heating performance can be displayed for long periods without any reduction in the resistance and changes in heating characteristic. In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided.

Although some carbon may adhere onto the surface of the insulator during burning fuel, such adhered carbon can be burnt off by the heating action of the conductive heating-element (e.g., due to glowing when the engine starts at low temperature). As a result, the glow plug can detect ion current precisely for long periods.

In the glow plug of the present invention, since the conductive heating-element, the lead wires and the ion current detecting electrode are integrally provided inside the insulator, the structure is simplified. It is therefore possible for the present invention to detect ion current precisely without any trouble from carbon adhesion, and hence to provide a glow plug having excellent durability and easy to manufacture.

The thickness of the nonconductive porous layer is preferably between 0.2 mm and 1.5 mm as recited in claim 46. If less than 0.2 mm, damage such as crack development may be caused due to thermal shock by the flame. If more than 1.5 mm, the thickness will become too large and a crack or cracks may be developed due to stress concentration by the hot flame.

The nonconductive porous layer and the insulator are preferably made of the same material as recited in claim 47. In this case, the junction between both is improved, and the resistance to thermal shock is also improved since both has the same coefficient of linear expansion.

The ion current detecting electrode and the conductive heating-element can be combined as recited in claim 48 (FIG. 88) In this case, the conductive heating-element is covered with the nonconductive porous layer at the tip of the glow plug main body.

The ion current detecting electrode can be made of a conductive ceramic material containing $MoSi_2$, WC, TiN or the like, or refractory metal such as W, Mo or Ti.

The top portion of the insulator is preferably formed into a semi-spherical shape. In this case, since the acute angle portion is removed from the tip of the insulator, the turbulence of combustion flame can be prevented in the neighborhood of the ion current detecting electrode to stabilize the detection performance. Further, since thermal stress concentration is prevented, the resistance to thermal shock can also be improved.

The communication hole formed in the nonconductive porous layer can have any hole diameter as long as it is penetrated from the surface of the nonconductive porous layer to the surface of the ion current detecting electrode. For example, the communication hole has only to pass current when the tip of the glow plug is immersed in an alcoholic solution containing water at a ratio of 50 to 50 and a voltage of 12 volt or so is applied between the tip and the solution.

In the invention as claimed in claim 49, the glow plug is so constructed that the ion current detecting electrode will be electrically connected to the midway of the heating element, and that, when R1 denotes electric resistance of a first heating section of the heating element from a first end of the heating element, corresponding to a positive side in passing a DC current through the heating element, to a center of a first connecting portion, at which the ion current detecting electrode is first connected to the heating element; R2 denotes electric resistance of a second heating section of the heating element from the center of the first connecting portion, where a connection between the heating element and the ion current detecting electrode is first established, to a second end of the heating element corresponding to a negative side in passing a DC current through the heating element; and r denotes electric resistance between the first connecting portion and the opening end of the ion current detecting electrode, it will satisfy the relationship of R2>r.

The first connecting portion is a portion at which the ion current detecting electrode is first connected to the conductive heating-element in a path from the positive end to the negative end of the conductive heating-element. Such definition is made by taking into account both a single ion current detecting electrode (FIG. 90) and a plurality of ion current detecting electrodes (FIG. 91) provided for the conductive heating-element. When a plurality of ion current detecting electrodes are provided, the first heating section corresponds a path from the positive end to the closest ion current detecting electrode and the second heating section is a path from the negative end to the adjacent ion current detecting electrode (FIG. 91). In other words, the second heating section may be connected to one or plural ion current detecting electrodes.

To set the relationship between the electric resistance R2 of the second heating section and the electric resistance of the ion current detecting electrode to R2>r, both materials, or width, thickness or length of the conduction path can be changed. As an example of material change, the second heating section and the ion current detecting electrode can be constructed at different mixing rates between the conductive ceramic powder and the nonconductive ceramic powder.

As a material for the conductive heating-element and the ion current detecting electrode, at least one kind of metallic silicide, carbide, nitride or boride such as $MoSi_2$, $Mo_5Si_3$, $Mo_xSi_3c_y$ (x=4–5; y=0–1), MoB, WC or TiN is used. As a nonconductive ceramic material, $Si_3N_4$, $Al_2O_3$, BN or the like is used. As a sintering auxiliary, more than one kind of oxide of rare-earth element is added.

Hereinbelow, the use of $MoSi_2$ as a conductive ceramic material, $Si_3N_4$ as a nonconductive ceramic material and a mixture of $Y_2O_3$ and $Al_2O_3$ as a sintering auxiliary is shown.

To achieve conductivity, the conductive heating-element and the ion current detecting electrode is constructed by making the grain size of $Si_3N_4$ larger than that of $MoSi_2$ so that conductive particles of $MoSi_2$ will be linked together around a nonconductive particle of $Si_3N_4$.

Specifically, $MoSi_2$ having a mean diameter of 1 $\mu$m and $Si_3N_4$ having a mean diameter of 15 $\mu$m are used. With the sintering auxiliary, the mean diameter is 1 $\mu$m as well. The mixing ratio of $MoSi_2$ to $Si_3N_4$ is properly selected within a range of 10–60 to 90–40 (wt%). If the mixing ratio is set as $MoSi_2$:$Si_3N_4$=20:80 in the second heating section of the conductive heating-element and as $MoSi_2$:$Si_3N_4$ =40:60 ion current detecting electrode, the relationship of R2>r will be achieved. The sintering auxiliary of $Y_2O_3$ and $Al_2O_3$ is added at a total rate of 10% per weight. As the sintering auxiliary, more than one kind of oxide of rare-earth element other than $Y_2O_3$, such as $Yb_2O_3$, $La_2O_3$ or $Nd_2O$, may be used.

Although the mixture of the conductive ceramic material and the nonconductive ceramic material is used for the conductor, there may be used only the conductive ceramic material or a mixture of the nonconductive ceramic material and metal powder instead of the conductive ceramic material, or only metal powder or a metal wire is also possible.

The insulator is made of a ceramic sinter that is constructed by adding a sintering auxiliary of $Y_2O_3$ and $Al_2O_3$ to the main composition of conductive ceramic $MoSi_2$ and nonconductive ceramic $Si_3N_4$. To achieve nonconductivity, the insulator is constructed by making the grain size of $Si_3N_4$ equal to or slightly smaller than that of $MoSi_2$ so that the conductive particles of $MoSi_2$ are surrounded with the nonconductive particles of $Si_3N_4$ and divided into parts. Specifically, $MoSi_2$ having a mean diameter of 0.9 $\mu$m and $Si_3N_4$ having a mean diameter of 0.6 $\mu$m can be used.

It is preferable to select an identical or similar mixing ratio among the conductive heating-element, the ion current detecting electrode and the insulator because such a case makes differences small such as in thermal expansion coefficient. As the sintering auxiliary, more than one kind oxide of rare-earth element other than $Y_2O_3$, such as one combined with, yttrium, lanthanum and neodymium, may be used.

From the standpoint of heater characteristics of the glow plug, it is also preferable to set the electric resistance R2 of the second heating section in a range of between 0.1Ω and 5Ω and the electric resistance r in a range of between 0.05Ω and 2.5Ω.

In arranging the conductive heating-element and the ion current detecting electrode in the insulator, a molded body for the conductive heating-element and the ion current detecting electrode is previously produced such as one shown in FIG. 100, embedded in the insulator and molded integrally. The lead wires are connected simultaneously with this molding process. Refractory metal or its alloy such as tungsten and molybdenum can be used for the lead wires.

Alternatively, the molded body of the conductive heating-element and the ion current detecting electrode may be inserted between two insulator parts separately produced. The above insulator molded parts or the molded body with the conductive heating-element and the ion current detecting electrode may be made up such that main materials of ceramic powders are premixed with a binder of resin and the like, and the mixture is injection-molded. The molded parts are then baked.

The conductive heating-element and the ion current detecting electrode may also be provided inside the insulator by printing formation. As an example, the printing formation is performed such that a product (green sheet) of ceramic material, e.g., for forming the insulator, are prepared, and the conductive heating-element, the associated lead wires and the ion current detecting electrode are printed on the surface of the product with a conductive material by a printing technique such as screen printing, pad printing or hot stamp. The product is then rolled and baked. The insulator with the conductive heating-element, the lead wires and the ion current detecting electrode printed and built therein is thus obtained.

The firing of the injection-molded body or printed body is performed by a hot press method. For example, the body is pressurized at 400 kg/cm$^2$ under one atmosphere of Ar gas and baked at a temperature of 1800 ° C. for 60 min.

Next, operation and effects of the invention as claimed in claim 49 will be described. The glow plug of the present invention is energized to generate heat by passing current therethrough so that ignition and combustion of fuel in the combustion chamber can be promoted by the heating action. In this case, the ion current detecting electrode forms two electrodes with the adjacent inner wall of the combustion chamber to detect an ionization state in the flame.

It is therefore possible to detect ion current precisely and hence to effectively use the information for combustion control. Further, since the glow plug has the ion current detecting function in addition to the original heating function (glow function), it can be manufactured with compact structure and at low cost.

In the present invention, the electric resistance R2 of the second heating section is set larger than the electric resistance r of the ion current detecting electrode. For this reason, when the carbon adhered to the surface of the insulator of the glow plug and caused an electrical short between the ion current detecting electrode and the cylinder head (see FIG. 90), the carbon between the ion current detecting electrode and the cylinder head can be burnt off securely by applying a DC current across the conductive heating-element.

According to the present invention, when burning off the carbon, the DC current flows from the positive end to the cylinder head through the first heating section, the ion current detecting electrode and the adhered carbon since the relationship between the electric resistance R2 of the second heating section of the conductive heating-element and the electric resistance r of the ion current detecting electrode exhibits R2>r. For this reason, the carbon on the surface of the insulator is heated and burnt due to the heat by combination with the air in the combustion chamber. Since the carbon is thus burnt off, the electrical short due to carbon adhesion can be easily eliminated. It is therefore possible to detect ion current accurately for long periods.

Further, since the conductive heating-element is embedded in the insulator, it is never corroded by the combustion flame, so that good heating performance can be displayed for long periods without any reduction in the resistance and changes in heating characteristic. In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided.

In the glow plug of the present invention, since the conductive heating-element, the lead wires and the ion current detecting electrode are provided inside the insulator, the structure is simplified. It is therefore possible for the present invention to detect ion current precisely without any trouble from carbon adhesion, and hence to provide a glow plug having excellent durability.

The electric resistance R2 of the second heating section is preferably set to more than twice the electric resistance r of the ion current detecting electrode as recited in claim 50. In this case, the carbon can be burnt off more securely.

The ion current detecting electrode can be constructed of the main composition of a conductive ceramic material made of more than one kind of metallic silicide, carbide, nitride or boride, or a mixture of a conductive ceramic material and a nonconductive ceramic material as recited in claim 51. In this case, the heat resistance can be improved and the expansion coefficient can be easily adjusted and matched with that of the insulator, so that the resistance to thermal shock can also be improved.

The ion current detecting electrode can also be constructed of the main composition of a material made of one kind of refractory metal having a melting point of 1200° C. or higher, or a mixture of a refractory metal material and a nonconductive ceramic material as recited in claim 52. In the former case, since the metal material can be used in the form of wire, the cost associated with material preparation, machining and assembly can be reduced.

In the latter case, the high-temperature resistance and the resistance to oxidation can be improved, and besides, the coefficient of linear expansion can be easily adjusted and matched with that of the insulator, so that excellent durability can be obtained. Since the conductive heating-element of the glow plug is energized to generate heat up to a temperature from 1000 to 1100° C., the melting point must be set to 1200° C. by taking into account the heat resistance of the ion current detecting electrode.

The exposed portion of the ion current detecting electrode exposed from the insulator preferably has a portion made of more than one kind of noble metal such as Pt, Ir, Rh, Ru and Pd as recited in claim 53. In this case, the resistance to wear and oxidation of the ion current detecting electrode can be improved.

In the invention as claimed in claim 54, the ion current detecting electrode of the glow plug is electrically connected to the midway of the conductive heating-element. The tip of the ion current detecting electrode is exposed from the insulator into the flame, with positioning it more than 2 mm away from the tip of the housing supporting the main body for the insulator and the ion current detecting electrode.

In arranging the conductive heating-element and the ion current detecting electrode inside the insulator, a molded body for the conductive heating-element and the ion current detecting electrode is previously produced such as one shown in FIG. 94, embedded in the ceramic powder material for the insulator and molded integrally. Alternatively, the conductive heating-element and the ion current detecting electrode may be inserted between two insulator parts separately produced. The above insulator molded parts or the molded body with the conductive heating-element and the ion current detecting electrode may be made up by an injection molding.

The conductive heating-element and the ion current detecting electrode may also be provided inside the insulator by printing formation. As an example, the printing formation is performed such that two products (green sheets) of ceramic material, e.g., for forming the insulator, are prepared, and the conductive heating-element, the associated lead wires and the ion current detecting electrode are printed on the surface of one product with a conductive material in a desired form by a printing technique such as screen printing, pad printing or hot stamp.

The other product is so stacked that it will cover the printed portion and then firing is performed. The conductive heating-element, the lead wires and the ion current detecting electrode may be printed on two or more products and laminated together. The conductive heating-element and the ion current detecting electrode may also be printed on different products and electrically conducted in the laminating process or after baked. The insulator with the conductive heating-element the lead wires and the ion current detecting electrode printed and built therein is thus obtained.

As is similar to the above inventions, the glow plug of the present invention having the above structure is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame. It is therefore possible for the structure of the present invention to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, the tip of the ion current detecting electrode is located more than 2 mm away from the top portion of the housing. For this reason, even when some carbon is accumulated on the surface of the glow plug main body, the ion current detection can be performed securely. As will be described with respect to FIG. 96, if the distance (L, in FIG. 93) between the tip position of the ion current detecting electrode and the top portion of the housing is less than 2 mm, the detection ratio of ion output will be reduced gradually as the distance becomes short. In contrast, the present invention is to set the distance to 2 mm or longer, so that the ion output can be detected securely.

Such a reduction in the detection ratio with less than 2 mm distance seems to be caused as follows. If the distance (L) between the tip position of the ion current detecting electrode and the top portion of the housing is less than 2 mm, the insulation resistance between the ion current detecting electrode and the housing will be reduced largely to be a simulated short state when the carbon has been accumulated on the glow plug main body. It is therefore difficult to detect ion current. In contrast, since the present invention is to set the distance (L) to 2 mm or longer, the insulation resistance is not so much reduced that a simulated short will occur even when the carbon has been accumulated on the glow plug main body. Even if the insulation resistance is reduced due to long-period operation, the carbon can be burnt off by a hating action caused when the conductive heating-element is electrically conducted as will be described later. It is therefore possible for the glow plug of the present invention to detect ion current securely.

In the glow plug of the present invention, since the conductive heating-element, the lead wires and the ion current detecting electrode 9 are provided integrally, the structure is simplified. It is therefore possible for the present invention to detect ion current precisely without any trouble from carbon adhesion, and hence to provide a glow plug having excellent durability.

When R (Ω) denotes the total electric resistance of the conductive heating-element and B (Ω) denotes the electric resistance from the positive end of the conductive heating-element to the tip of the ion current detecting electrode, it is preferable to satisfy the relationship of B (Ω)≧R (Ω)/3 as recited in claim 55. In this case, an optimum current can be passed through a circuit among the conductive heating-element the ion current detecting electrode and the adhered carbon even when the carbon has been so accumulated that a simulated short will occur. For this reason, the carbon can be burnt off by the conductive heating-action of this circuit. After such a simulated short is relieved, the current flows through the conductive heating-element to further promote the carbon burn-off.

If the electric resistance B (Ω) is very large, the resistance of the circuit among the conductive heating-element, the ion current detecting electrode and the adhered carbon becomes large. In this case, almost normal current flows through the entire conductive heating-element and the adhered carbon can be burnt off by the heating action of the conductive heating-element even if the adhered carbon exists. It is therefore possible to easily burn and destroy the carbon accumulated on the glow plug main body with maintaining the original heating function of the glow plug constantly.

To set the relationship between R (Ω) and B (Ω) to B (ΩQ)≧R (Ω)/3, materials for the conductive heating-element and the ion current detecting electrode, or width, thickness or length of the conduction path can be changed. As an example of material change, the mixing ratio between raw materials of the conductive ceramic powder and the nonconductive ceramic powder is controllable. The length of the conduction path may also be changed by changing the connect position of the ion current detecting electrode to the conductive heating-element.

The invention as claimed in claim 1 is applied to the glow plug constituted of the housing and the main body retained in the housing. The main body includes the insulator; the conductive heating-element provided inside the insulator; the pair of lead wires electrically connected to both ends of the conductive heating-element, drawn out to the outside of the insulator; and the ion current detecting electrode provided inside the insulator for detecting an ionization state in the flame. The tip of the ion current detecting electrode is exposed from the insulator so that it will contact the flame. The glow plug of the present invention features that when K denotes the coefficient of linear expansion of the ion current detecting electrode, H denotes the coefficient of linear expansion of the conductive heating-element and S denotes the coefficient of linear expansion of the insulator, the relationship among them is defined as H≧S and H≧K.

If the coefficient of linear expansion H is smaller than S or K, tensile stress will be set up on the surface of the glow plug main body because such compressive stress as will be described later can not be applied thereon. For this reason, there is high possibility of crack development in the glow plug main body to make it difficult to improve the durability of the glow plug.

In arranging the conductive heating-element and the ion current detecting electrode inside the insulator, a molded body for the conductive heating-element and the ion current detecting electrode is previously produced. The molded body is then embedded in the powder material for the insulator and molded integrally. Alternatively, the molded body of the conductive heating-element and the ion current detecting electrode may be inserted between two insulator molded parts separately produced.

The insulator molded parts or the molded body with the conductive heating-element and the ion current detecting electrode may be made up by mixing resin containing main components of the molded body such as ceramic powder and paraffin wax and injection molding the mixture. After that, pressure firing is performed including degreasing, and the baked body is cut to be a ceramic heater with an ion current detecting function.

As is similar to the above inventions, the glow plug of the present invention having the above structure is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame. It is therefore possible for the structure of the present invention to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, the relationship among the coefficients of linear expansion H, K and S of the conductive heating-element, the ion current detecting electrode and the insulator is defined as H≧S and H≧K. In other words, the conductive heating-element has a coefficient of linear expansion larger than those of the ion current detecting electrode and the insulator. For this reason, compressive stress is maintained on the surface of the glow plug main body when in use. As mentioned above, the glow plug main body is manufactured by molding the powder material and sintering it at a high temperature of about 1800° C. Such a sinter is considered not to have any internal stress in a high-temperature state immediately after sintering.

However, since the glow plug is usually used in a range of between room temperature and 100020 C. lower than the sintering temperature, the glow plug main body shrinks compared to the state immediately after sintering. At this time, the relationship among the coefficients of linear expansion H, K and S of the conductive heating-element, the ion current detecting electrode and the insulator is as H≧S and H≧K, i.e. the coefficient of linear expansion H of the conductive heating-element embedded inside is larger than the coefficients K and S of the insulator and the ion current detecting electrode exposed on the surface of the main body, so that compressive stress acts on the surface of the main body constantly.

In the present invention, the compressive stress acts on the surface of the glow plug main body constantly when in use. As is well known, such compressive stress can be resistant to damage such as crack development much more than tensile stress. It is therefore possible for the glow plug of the present invention to prevent damage to the main body surface.

Further, since the conductive heating-element is embedded in the rod-like insulator, it is never corroded by the combustion flame, so that good heating performance can be displayed for long periods without any reduction in the resistance and changes in heating characteristic. In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided.

In the glow plug of the present invention, since the conductive heating-element, the lead wires and the ion current detecting electrode are integrally provided inside the insulator, the structure is simplified.

It is therefore possible for the present invention to detect ion current precisely without any trouble from carbon adhesion, and hence to provide a glow plug having excellent durability.

The coefficients of linear expansion K, H and S preferably satisfy the following relationship: $O \leqq H-S \leqq 2.0\times10^{-6}$(/°C.) and $O \leqq H-K \leqq 2.0\times10^{-6}$(/°C.).

The case H−S is less than O is as described above. On the other hand, if H−S exceeds $2.0\times10^{-6}$, the tensile stress of the conductive heating-element will become large to cause a sharp rise of the resistance of the conductive heating-element in long-period operation. The case H−K is less than O is as described above. On the other hand, if H−K exceeds $2.0\times10^{-6}$, such a sharp rise of the resistance of the conductive heating-element will also be caused in long-period operation.

The ion current detecting electrode can be constructed of a conductive ceramic material containing the main composition of more than one kind of metallic silicide, carbide, nitride or boride, or a mixture of a conductive ceramic material and a nonconductive ceramic material as recited in claim 58. In this case, the heat resistance can be improved and the expansion coefficient can be easily adjusted and matched with that of the insulator, so that the resistance to thermal shock can also be improved.

The ion current detecting electrode can also be constructed of a refractory metal material containing the main composition of more than one kind of metal having a melting point of 1200° C. or higher, or a mixture of the refractory metal material and a nonconductive ceramic material as recited in claim 59. In the former case, since the metal material can be used in the form of wire, the cost associated with material preparation, machining and assembly can be reduced.

In the latter case, the high-temperature resistance and the resistance to oxidation can be improved, and besides, the coefficient of linear expansion can be easily adjusted and matched with that of the insulator, so that excellent durability can be obtained. Since the conductive heating-element of the glow plug is energized to generate heat up to a temperature from 1000 to 1100° C., the melting point must be set to 1200° C. by taking into account the heat resistance of the ion current detecting electrode.

The invention as claimed in claim 60 is applied to the glow plug including the insulator, the conductive heating-element provided inside the insulator, and the ion current detecting electrode provided inside the insulator for detecting an ionization state in the flame. In the glow plug of the present invention, a conductive layer is provided on the surface of the insulator so as to cover the exposed portion of the ion current detecting electrode exposed from the insulator, with establishing an electrical connection to the ion current detecting electrode.

The conductive layer is provided on an area wider than the area of the exposed portion so that the exposed portion of the ion current detecting electrode exposed from the insulator can be covered with the conductive layer. While the conductive layer is electrically connected to the ion current detecting electrode, the conductive layer has conductivity itself. For this reason, the conductive layer can act to effectively extend the area of the exposed portion of the ion current detecting electrode.

In arranging the conductive heating-element and the ion current detecting electrode in the insulator, a molded body for the conductive heating-element and the ion current detecting electrode is previously produced, such as one shown in FIG. 100, while joining the lead wires thereto. The molded body is then embedded in the ceramic powder material for the insulator and molded integrally. Alternatively, the conductive heating-element and the ion current detecting electrode may be inserted between two insulator parts separately produced.

The above insulator molded parts or the molded body with the conductive heating-element and the ion current detecting electrode may be made up such that the powder materials are mixed with resin containing paraffin wax for its main ingredients and the mixture is injection-molded. Pressure firing is then performed including degreasing, and after that, the baked body is cut to be a cylindrical shape with round tip, thus manufacturing a ceramic heater with an ion current detecting function.

The conductive heating-element and the ion current detecting electrode may also be provided inside the insulator by printing formation. As an example, the printing formation is performed such that a product (green sheet) of ceramic material, e.g., for forming the insulator, are prepared, and the conductive heating-element, the associated lead wires and the ion current detecting electrode are printed on the surface of the product with a conductive material in a desired form by a printing technique such as screen printing, pat printing or hot stamp. The product is then rolled and baked.

The insulator with the conductive heating-element, the lead wires and the ion current detecting electrode built therein is thus obtained. In either technique, the ion current detecting electrode is manufactured to be exposed on the surface of the insulator.

To form the conductive layer on the surface of the insulator, for example, the conditions of the insulator such as shape and roughness are first tailored according to the need. The conductive layer is then printed out on the surface of the insulator in a desired form by a printing technique such as pat printing or a cylinder-screen printing. Other techniques such as plasma coating and evaporation coating can also be used for formation of the conductive layer.

As is similar to the above inventions, the glow plug of the present invention having the above structure is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame. It is therefore possible for the structure of the present invention to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, the conductive layer electrically connected to the ion current detecting electrode is provided on the surface of the insulator. For this reason, the conductive layer acts as the exposed portion of the ion current detecting electrode to extend the area of the exposed portion. It is therefore possible to detect ion current more securely and precisely compared to an ion current detecting electrode with no conductive layer, and hence to further improve the fuel control.

In the glow plug of the present invention, since the conductive heating-element, the lead wires and the ion current detecting electrode are integrally provided inside the insulator, the structure is simplified. It is therefore possible for the present invention to detect ion current precisely without any trouble from carbon adhesion while effectively extending the area of the ion current detecting electrode exposed to the flame.

It is preferable to make the insulator partially exposed from the conductive layer so that an edged portion or portions will be formed on the conductive layer as recited in claim 61. In this case, the edged portion displays a tendency to absorb ions (edge effect) compared to the flat portion. For this reason, the ion current detection can be performed in quick response to make it possible, as will be described later, to sharpen the angle of leading edge in the ion current detection stage and to increase the peak value.

As will also be described later, the edged portion formed by partially exposing the insulator from the conductive layer includes not only a case where the conductive layer has a pattern such as a net so that the insulator will be exposed from meshes of the net, but also a case where the conductive layer is made into a solid layer so that the edged portion is formed on the boundary between the solid layer and the exposed portion of the insulator.

The edged portion is preferably rectangle in cross section as recited in claim 62. Such a rectangular-edged portion can be formed in steps without smoothing the boundary with the insulator. In this case, the edge effect can be further amplified.

The conductive layer can be made in net structure so that the insulator will be exposed from meshes of the net (FIGS. 103 to 106) as recited in claim 63. In this case, many rectangular-edged portions can be formed in the meshes and this make it possible to display the edge effect more securely.

The conductive layer can be constructed of metal or conductive ceramic material as recited in claim 64. As such metal, a mixed material of refractory metal and active metal is preferably used. In this case, the active metal improves adhesion of the conductive layer to the insulator while the refractory metal improves the durability.

For such refractory metal, platinum, noble metal such as gold, nickel, steel and chrome are cited, which can be used alone or by mixing them. For such active metal, titanium, zirconium, hafnium and vanadium are cited, which can also be used alone or by mixing them. A preferable combination is of gold and nickel of more than 90 wt % with active vanadium for the remainder. In such a combination, gold and nickel maintain the durability while vanadium improves adhesion to the insulator.

As the conductive ceramic material, various kinds of metallic silicide, carbide, nitride or boride can be used. Silicide is preferably selected in view of the oxidation resistance. It is also preferable to mix an oxide-type ceramic material such as aluminum oxide or silicon dioxide so as to improve adhesion to the insulator.

The thickness of the conductive layer is preferably between 1 $\mu$m and 20 $\mu$m as recited in claim 65. If less than 1 $\mu$m, waves or waste matters due to combustion will collide with or crash the conductive layer to wear it heavily, resulting in loss of durability. The thickness is preferably 5 $\mu$m or thicker If more than 20 $\mu$m, the thermal expansion coefficient is made largely different from that of the insulator, so that crack development can occur due to thermal changes to cause the conductive layer to come off from the insulator. The thickness is preferably 15 $\mu$m or thinner.

The invention as claimed in claim 66 is a modification of the glow plug as claimed in claim 1, in which the insulator includes a first insulating substrate, a covering insulating substrate provided on the front face of the first insulating substrate, and a second insulating substrate stacked on the back face of the first insulating substrate, the heating element is formed by printing between the front face of the first insulating substrate and the covering insulating substrate, the pair of lead wires are formed by printing between the front face of the first insulating substrate and the covering insulating substrate so as to be connected to both ends of the heating element, and the ion current detecting electrode is provided between the first and second insulating substrates.

Since the conductive heating-element and the lead wires are formed by printing between the front face of the first insulating substrate and the covering insulating substrate while the ion current detecting electrode is provided between the first and second insulating substrates, the glow plug is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame.

It is therefore possible to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, since the conductive heating-element is printed and embedded between the first insulating substrate and the covering insulating substrate, it is never corroded by the combustion flame, so that good heating performance can be displayed for long periods without any reduction in the resistance and changes in heating characteristic, thereby improving the durability.

In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided.

Although the ion current detecting electrode may be subjected to carbon adhesion, such adhered carbon can be burnt off by the heating action of the conductive heating-element (e.g., due to glowing when the engine starts at low temperature). As a result, the glow plug can detect ion current precisely for long periods.

In the present invention, the conductive heating-element is formed by printing, e.g., on the front face of the first insulating substrate. Such printing formation is performed according to the following exemplary procedure. The conductive heating-element and the lead wires are formed on the front face of a product (green sheet) with a conductive material in desired forms by a printing technique such as screen printing, pad printing or hot stamp. The product is composed of ceramic material for the first insulating substrate as will be described later. The conductive heating-element and the lead wires can also be formed by printing on the covering insulating substrate.

The second insulating substrate, the first insulating substrate and the covering insulating substrate are stacked in this order. Junction among them is made as will also be discussed in the following 51st embodiment. In other words, the substrates are all made into products of ceramic material, stacked one on another and joined by firing. Alternatively, the substrates may be joined with adhesive.

As discussed above, according to the present invention, the conductive heating-element and the lead wires are formed by printing between the first insulating substrate and the covering insulating substrate. For this reason, the conductive heating-element and the lead wires can be provided inside the glow plug with a thin layered state of between 0.005 mm and 0.02 in thickness, thereby making the glow plug compact. Since the conductive heating-element and the lead wires are never exposed into the combustion flame, the durability of the glow plug can also be improved.

Further, since the conductive heating-element, the lead wires and the ion current detecting electrode are provided integrally together with the covering insulating substrate, the first insulating substrate and the second insulating substrate, the structure is simplified. It is therefore possible for the present invention to detect ion current precisely without any trouble from carbon adhesion, and hence to provide a glow plug having excellent durability.

Each outer surface of the first insulating substrate and the covering insulating substrate can have a curved surface portion as recited in claim 67. In this case, the curved surface portion is used to easily cut the laminated body of the first insulating substrate, the second insulating substrate and the covering insulating substrate to be a cylindrical shape in cross section (see FIG. 4).

The invention as claimed in claim 68 features that the glow plug is formed by stacking the first insulating and the second insulating substrate together with the conductive heating-element, the lead wires connected to both ends of the conductive heating-element and the ion current detecting electrode for detecting an ionization state in the flame being provided therebeteen. In this case, the conductive heating-element, the lead wires and the ion current detecting electrode can be provided in parallel between the first insulating and the second insulating substrate (see 55th embodiment). For this reason, the glow plug can be manufactured easily.

The ion current detecting electrode is preferably formed by printing on the front face of the second insulating substrate as recited in claim 69. In this case, since the ion current detecting electrode is previously formed by printing on the second insulating substrate, the first insulating substrate can be stacked thereon to make the manufacturing process simple.

The ion current detecting electrode is preferably made of a conductive wire and provided between the front face of the second insulating substrate and the back face of the first insulating substrate as recited in claim 70. In this case, since the ion current detecting electrode is previously made into a wire, it can be provided merely by inserting the wire between the first insulating substrate and the second insulating substrate. For this reason, the glow plug can be manufactured easily. For the conductive wire, a metal wire and a sinter of ceramic material may be cited.

The tip of the ion current detecting electrode is preferably exposed at the top portion of the second insulating substrate so as to be exposed into the flame as recited in claim 71. In this case, the responsiveness of ion current detection and the detection accuracy (S/N ratio) can be improved.

The ion current detecting electrode can be made of more than one kind of ceramic material such as $MoSi_2$, WC and TiN as recited in claim 72. In this case, the heat resistance can be improved, and besides, the coefficient of linear expansion can be easily adjusted and matched with that of the insulator, so that the resistance to thermal shock can also be improved.

The ion current detecting electrode can be made of refractory metal containing more than one kind of metals W, Mo and Ti as recited in claim 73. In this case, since the material can be used in the form of wire, the cost associated with material preparation, machining and assembly can be reduced.

The exposed portion of the ion current detecting electrode exposed from the second insulating substrate is preferably provided with more than one kind of noble metal such as Pt, Ir, Rh, Ru and Pd as recited in claim 74. In this case, the ion current detecting electrode can have improved resistance to wear and oxidation.

The top portion of the rod-like insulator is preferably made into a semi-spherical shape as recited in claim 75. In this case, since the acute angle portion is removed from the tip of the rod-like insulator, the turbulence of combustion flame can be prevented in the neighborhood of the ion current detecting electrode to stabilize the detection performance.

The invention as claimed in claim 76 is a modification of the glow plug of claim 1, in which the insulator is a rod-like insulator, the heating element is formed by printing inside the rod-like insulator, the pair of lead wires are electrically connected to both ends of the heating element and drawn out to the outside of the rod-like insulator, and the ion current detecting electrode is provided inside the rod-like insulator with electrical insulation from the heating element established.

The ion current detecting electrode forms two electrodes with the adjacent inner wall of the combustion chamber to detect an ionization state in the flame.

It is therefore possible for the structure of the present invention to detect ion current precisely and hence to effectively use the information for combustion control. Further, since the glow plug has the ion current detecting function in addition to the original heating function (glow function) in the combustion chamber, it can be manufactured with compact structure and at low cost.

Furthermore, since the conductive heating-element is printed and embedded inside the rod-like insulator, it is never corroded by the combustion flame, so that good heating performance can be displayed for long periods without any reduction in the resistance and changes in heating characteristic. In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided.

Although the surface of the ion current detecting electrode may be subjected to carbon adhesion during fuel combustion, such adhered carbon can be burnt off by the heating action of the conductive heating-element (e.g., due to glowing when the engine starts at low temperature). As a result, the glow plug can detect ion current accurately for long periods.

In the present invention, the conductive heating-element is formed by printing inside the rod-like insulator. Such printing formation is performed according to the following exemplary procedure. The conductive heating-element and the lead wires are formed on the front face of a product (green sheet) with a conductive material in desired forms by a printing technique such as screen printing, pad printing or hot stamp. The product may be composed of ceramic material for the first insulating substrate. The product is then rolled and baked.

The rod-like insulator with the conductive heating-element and the lead wires printed and built therein can thus be obtained.

On the other hand, the ion current detecting electrode is inserted in and fixed to a hollow portion of the rod-like insulator, formed at the axial center of the product in the rolling process or other stage, through an electrically non-conductive material before firing or after firing.

In the present invention, the conductive heating-element and the lead wires are thus formed by printing inside the rod-like insulator. For this reason, the conductive heating-element and the lead wires can be provided inside the glow plug with a thin layered state of between 0.005 mm and 0.02 in thickness, thereby making the glow plug compact. Since the conductive heating-element and the lead wires are never exposed into the combustion flame, the durability of the glow plug can also be improved.

Further, since the conductive heating-element, the lead wires and the ion current detecting electrode are provided integrally inside the rod-like insulator, the structure is simplified. It is therefore possible for the present invention to detect ion current precisely without any trouble from carbon adhesion, and hence to provide a glow plug having excellent durability.

The invention as claimed in claim 77 is a modification of the glow plug of claim 1, in which the insulator is a rod-like insulator constituted of an electrically insulating core shaft with a hollow portion therein and an insulating substrate covering the outer core shaft, the heating element is formed by printing between the core shaft and the insulating substrate inside the rod-like insulator, the pair of lead wires are electrically connected to both ends of the heating element and drawn out to the outside of the rod-like insulator, and the ion current detecting electrode is inserted in and fixed to the hollow portion of the core shaft with electrical insulation from the heating element established. In this case, since the rod-like insulator is constituted of the core shaft and the insulating substrate, the glow plug can be made easily. The same effects as in claim 76 can also be obtained.

The conductive heating-element is preferably formed by printing on the inside surface of the insulating substrate. In this case, since the conductive heating-element and the lead wires can be previously formed by printing on the insulating substrate in the form of sheet, the glow plug can be manufactured easily because the sheet-like insulator has only to be wound around the core shaft.

The invention as claimed in claim 79 shows a method of manufacturing the glow plug of claim 77, which comprises the steps of preparing the product of the core shaft having the hollow portion and composed of electrically nonconductive ceramic material, and inserting the ion current detecting electrode into the hollow portion, forming the conductive heating-element and the lead wires on the surface of the product of the insulating substrate composed of electrically nonconductive ceramic material by using a printing technique, placing the product of the core shaft on the printed surface of the insulating substrate and winding the insulating substrate around the outer core shaft, and heating and baking the core shaft and the insulating substrate. In this case, the glow plug having such effects as discussed in claims 76 and 77 can be easily manufactured.

The invention as claimed in claim 80 is a modification of the glow plug of claim 1, in which the insulator is a rod-like insulator; the heating element is provided inside the rod-like insulator; the pair of lead wires are electrically connected to both ends of the heating element and drawn out to the outside of the rod-like insulator; and the ion current detecting electrode is put in a groove with electrical insulation from the heating element established, the groove provided axially on the outer surface of the rod-like insulator.

As will be described later, the conductive heating-element and the lead wires may be provided inside the rod-like insulator by printing them on the surface of a product (green sheet) of conductive material for the rod-like insulator with a conductive material in desired forms by a printing technique such as screen printing, pad printing or hot stamp. The product is then wound around the core shaft separately produced and the rolled body is baked (see FIGS. 126A through 126D of a 58th embodiment). Alternatively, a laminating method in which an upper sheet with a groove thereon is stacked on the product with the printed portions such as conductive heating-element formed thereon (see FIG. 127 of a 59th embodiment) can be used. The rod-like insulator with the conductive heating-element and the lead wires printed and built therein is thus obtained.

On the other hand, the ion current is inserted in and fixed to a hollow portion of the rod-like insulator before firing or after firing, the hollow portion formed axially on the outer surface of the rod-like insulator.

In the present invention, the glow plug is operated to generate heat by passing current through the conductive heating-element so that ignition and combustion of fuel in the combustion chamber can be promoted by the heating action. In this case, the ion current detecting electrode forms two electrodes with the adjacent inner wall of the combustion chamber to detect an ionization state in the flame.

It is therefore possible to detect ion current precisely and hence to effectively use the information for combustion control. Further, since the glow plug has the ion current detecting function in addition to the original heating function (glow function) in the combustion chamber, it can be manufactured with compact structure and at low cost.

In the present invention, since the conductive heating-element is embedded inside the rod-like insulator, it is never corroded by the combustion flame, so that good heating performance can be displayed for long periods without any reduction in the resistance and changes in heating characteristic, thereby improving the durability. In other words, since the conductive heating-element could resist oxidation wearing, the sectional area is maintained constantly and the resistance is kept at a constant level. Further, the danger of occurrence of inconvenient things such as damage to the conductive heating-element due to a thermal action such as thermal shock in the combustion chamber can be avoided. Furthermore, since the ion current detecting electrode has only to be put in the groove on the rod-like insulator, the glow plug can be easily manufactured.

Although the surface of the ion current detecting electrode may be subjected to carbon adhesion during fuel combustion, such adhered carbon can be burnt off by the heating action of the conductive heating-element (e.g., due to glowing when the engine starts at low temperature). As a result, the glow plug can detect ion current precisely for long periods.

In the present invention, since the conductive heating-element, the lead wires and the ion current detecting electrode are provided integrally inside the rod-like insulator, the structure is simplified. It is therefore possible for the present invention to detect ion current precisely without any trouble from carbon adhesion, and hence to provide a glow plug having excellent durability.

The groove with the ion current detecting electrode therein is preferably filled with a nonconductive coating material so that the ion current detecting electrode can be covered therewith as recited in claim 81. In this case, the ion current detecting electrode can be easily fixed to the rod-like insulator. As such a nonconductive coating material, an electrically nonconductive ceramic material may be used.

The conductive heating-element and the lead wires are preferably formed by printing on the inside surface of the insulator as recited in claim 82. In this case, since the conductive heating-element and the lead wires can be previously formed by printing on the insulating substrate in the form of sheet, the glow plug can be manufactured easily because the sheet-like insulator has only to be wound around the core shaft. Further, since the conductive heating-element and the lead wires can be provided inside the glow plug with a thin layered state of between 0.005 mm and 0.02 in thickness, thereby making the glow plug compact.

The tip of the ion current detecting electrode is preferably exposed at the top portion of the rod-like insulator so as to be exposed into the flame as recited in claim 83. In this case, the responsiveness of ion current detection and the detection accuracy (S/N ratio) can be improved.

The ion current detecting electrode can be made of more than one kind of ceramic material such as $MoSi_2$, WC and TiN as recited in claim 84. In this case, the heat resistance can be improved, and besides, the coefficient of linear expansion can be easily adjusted and matched with that of the insulator, so that the resistance to thermal shock can also be improved.

The ion current detecting electrode can be made of refractory metal containing more than one kind of metals W, Mo and Ti as recited in claim 85. In this case, since the material can be used in the form of wire or plate, the cost associated with material preparation, machining and assembly can be reduced.

The exposed portion of the ion current detecting electrode exposed from the second insulating substrate is preferably provided with more than one kind of noble metal such as Pt, Ir, Rh, Ru and Pd as recited in claim 86. In this case, the ion current detecting electrode can have improved resistance to wear and oxidation.

The top portion of the rod-like insulator is preferably made into a semi-spherical shape as recited in claim 87. In this case, since the acute angle portion is removed from the tip of the rod-like insulator, the turbulence of combustion flame can be prevented in the neighborhood of the ion current detecting electrode to stabilize the detection performance. Further, since thermal stress concentration is prevented, the resistance to thermal shock can also be improved.

The invention as claimed in claim 88 shows a method of manufacturing the glow plug of claim 80, which comprises the steps of forming the conductive heating-element and the lead wires on the surface of the product of the insulating substrate composed of electrically nonconductive ceramic material by using a printing technique, placing the product of the core shaft of electrically nonconductive ceramic material on the printed surface of the insulating substrate and winding the insulating substrate around the outer core shaft while forming a groove axially among both of rolled-directional end surfaces of the insulating substrate and the core shaft, arranging the ion current detecting electrode inside the outer groove, and heating and baking the core shaft and the insulating substrate.

In this case, the ion current detecting electrode can be joined more tightly to the substrate since the width of the substrate narrows due to shrinking of the substrate by firing. In this method, the glow plug having such effects as discussed in claim 80 can be easily manufactured.

BRIEF DESCRIPTION OF DRAWINGS

The present invention will be more apparent by reference to the following detailed description when considered in connection with the accompanying drawings.

FIG. 59 is a diagram explaining the structure of the mixed sinter for the ion current detecting electrode according to the 19th embodiment;

FIG. 60 is an enlarged view of portion M of FIG. 59;

FIG. 85 is a diagram for explaining a glow plug manufacturing method in the 32nd embodiment;

FIGS. 86A and 86B are diagrams following FIG. 85 for explaining the glow plug manufacturing method;

FIG. 110A is a sectional view of a glow plug main body according to a 51st embodiment;

FIG. 110B is a sectional view taken along the line A—A of FIG. 110A;

FIG. 111 is a diagram showing general structure of a glow plug according to the 51st embodiment;

FIG. 112 is a diagram for explaining a glow plug manufacturing method in the 51st embodiment;

Figure 112:
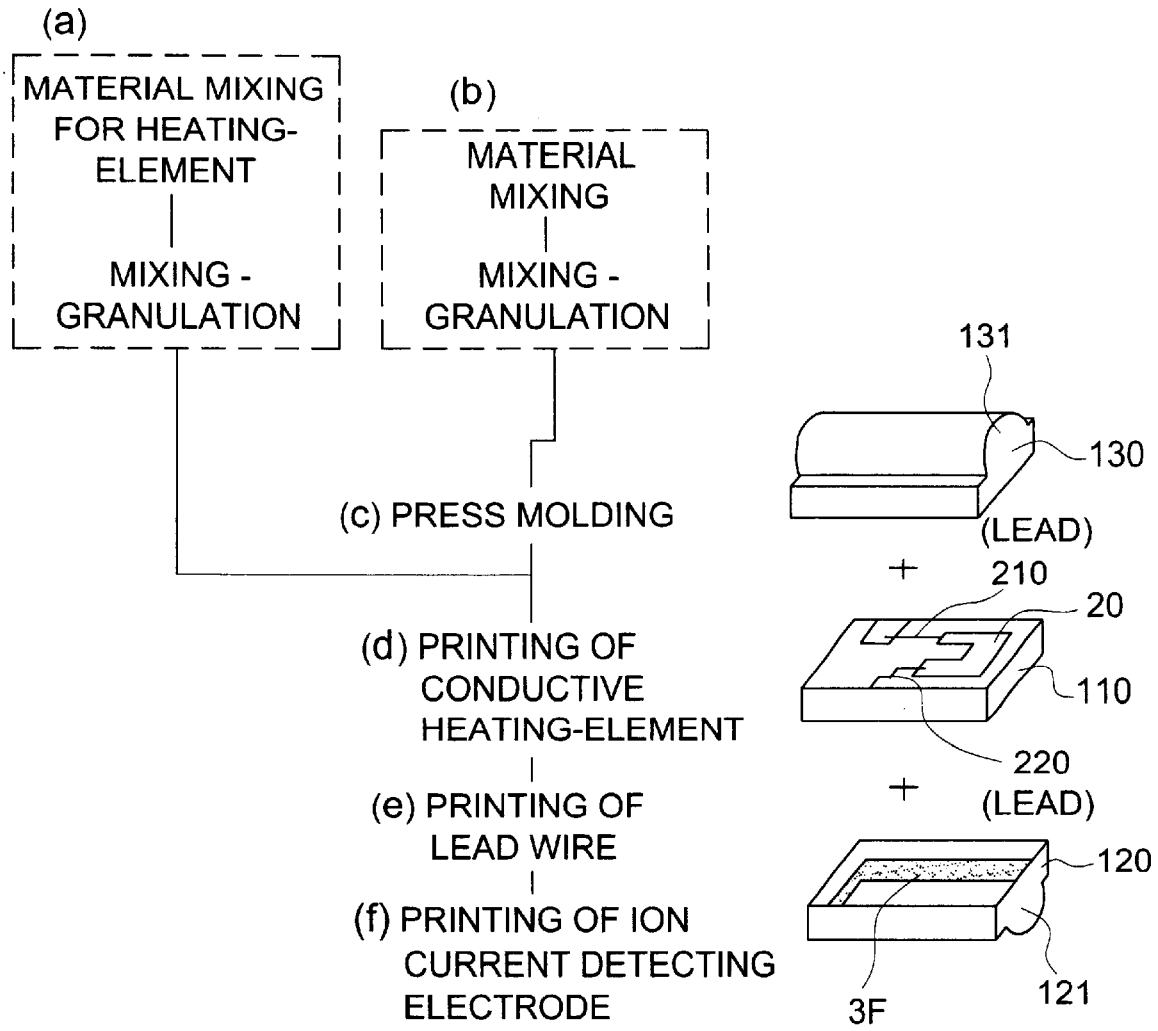
Figure 113A:
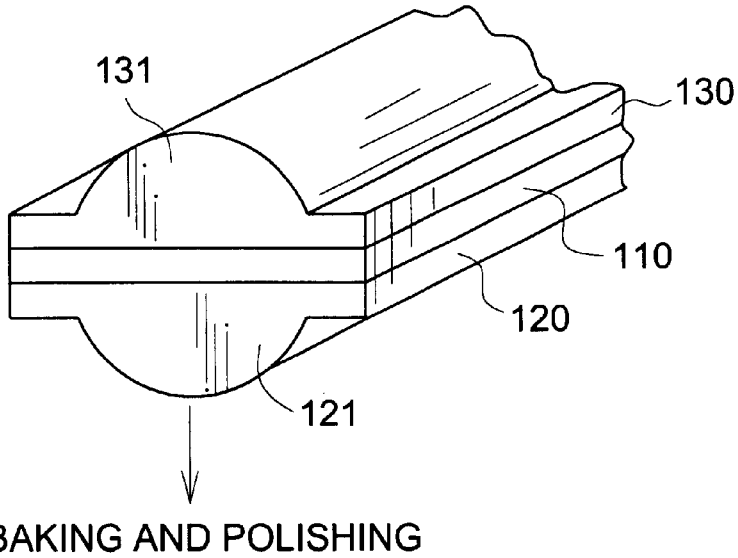
Figure 113B:
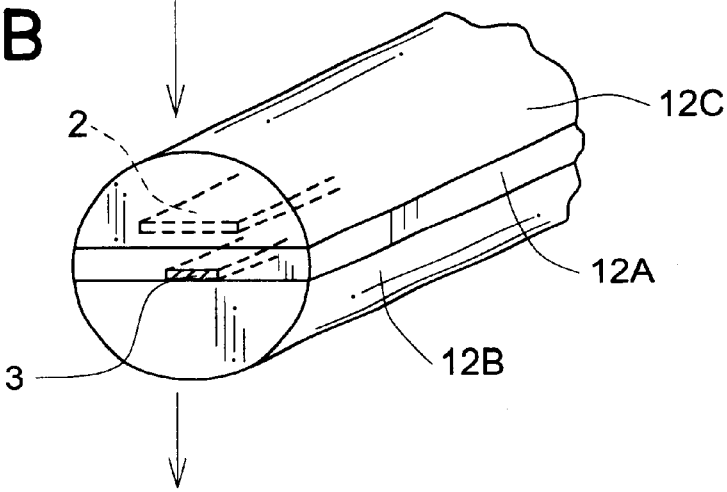
Figure 113C:
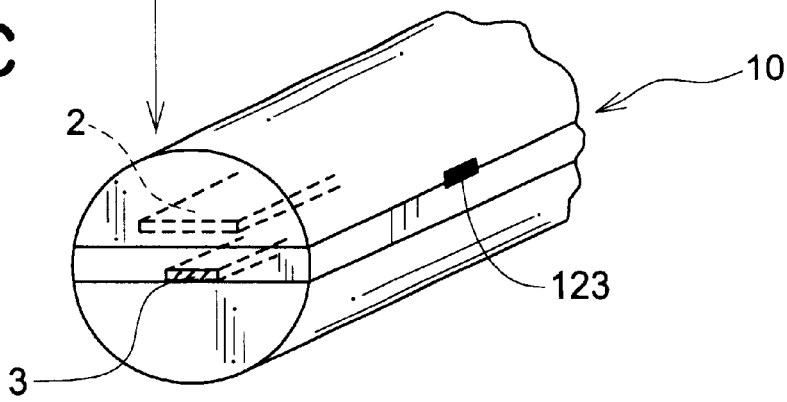
Figure 114:
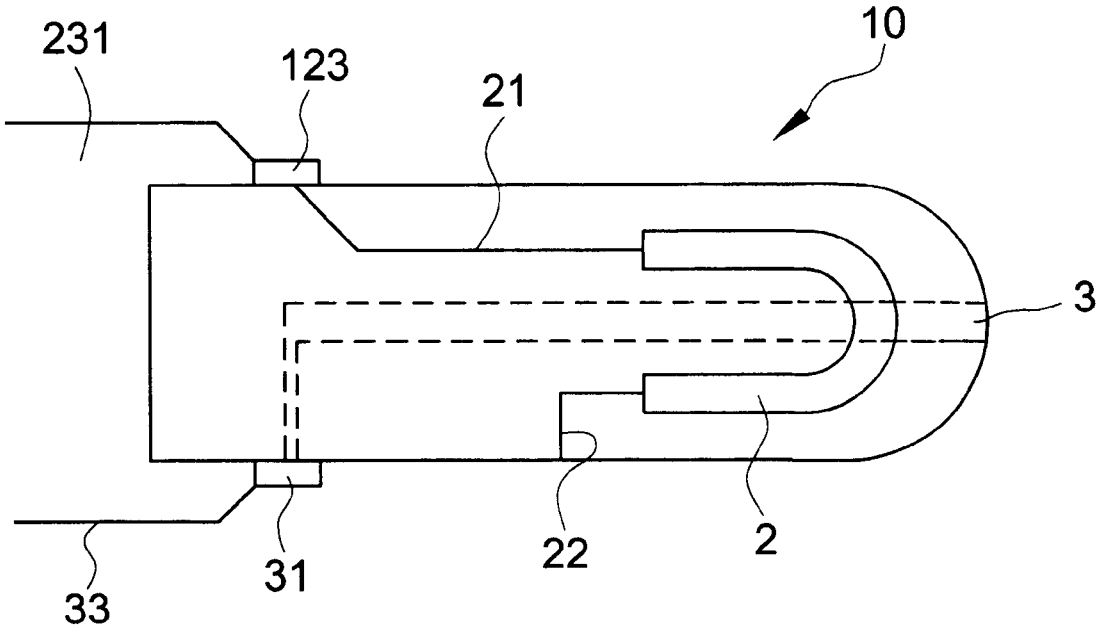
Figure 115A:
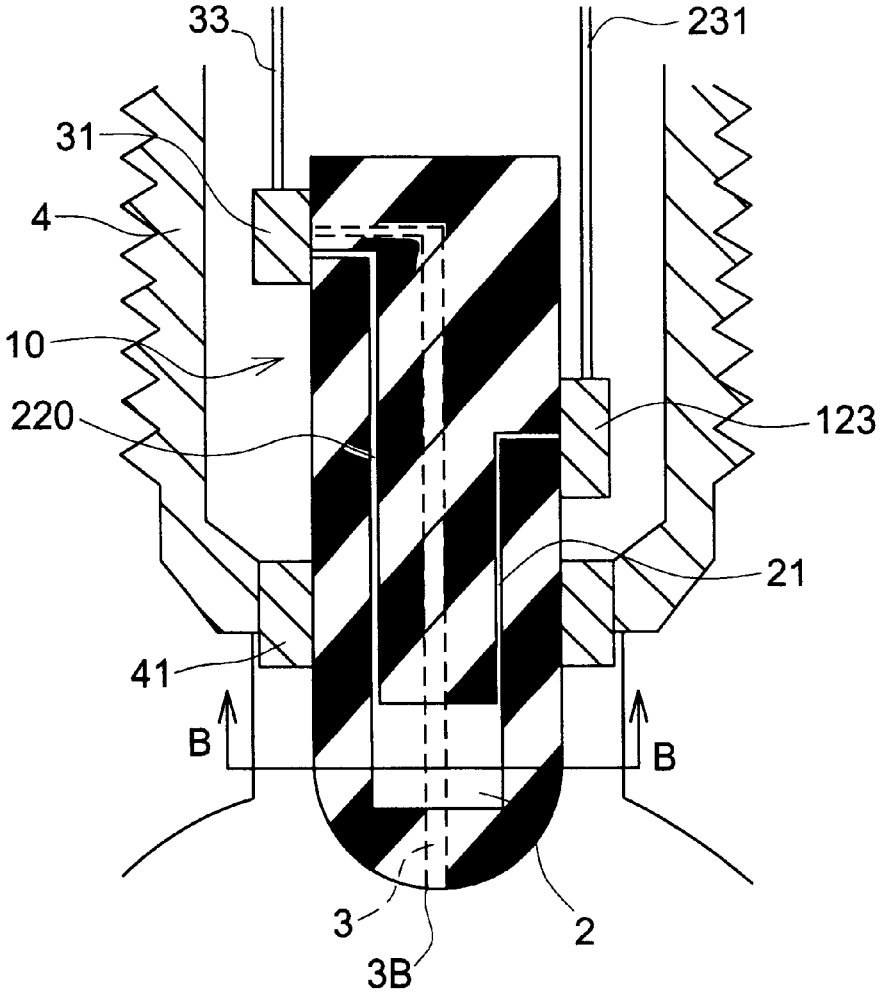
Figure 115B:
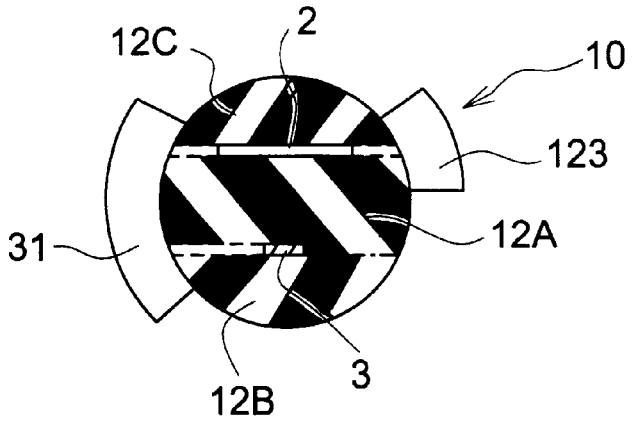
Figure 116A:
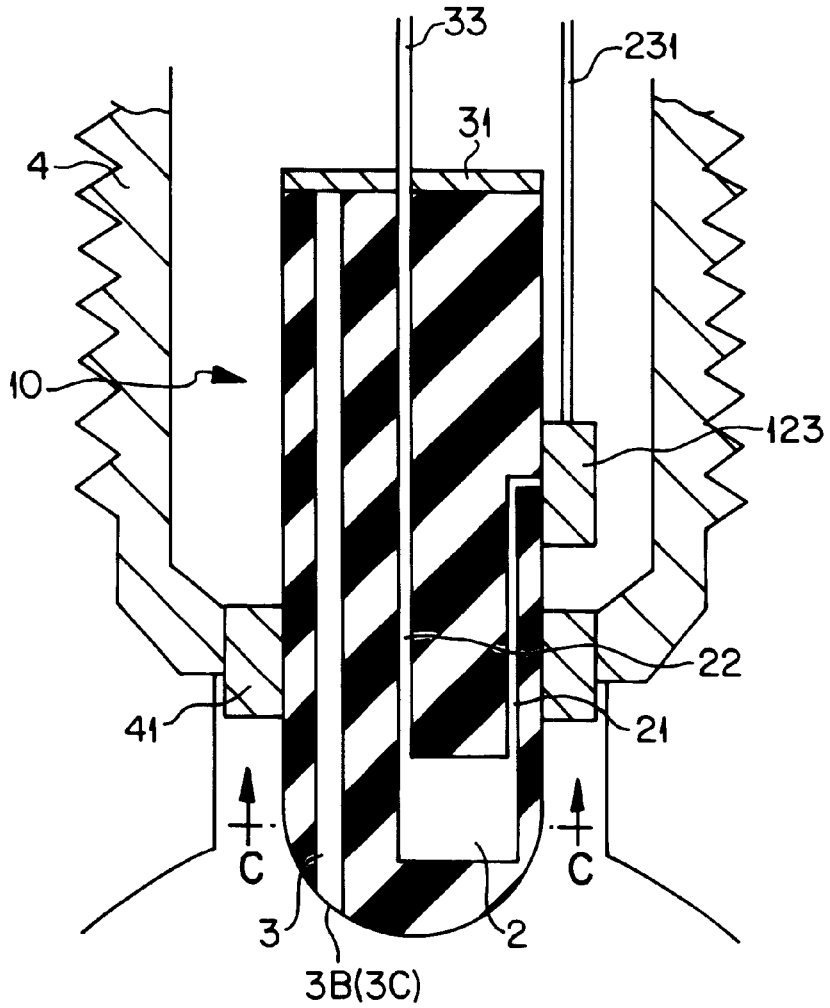
Figure 116B:
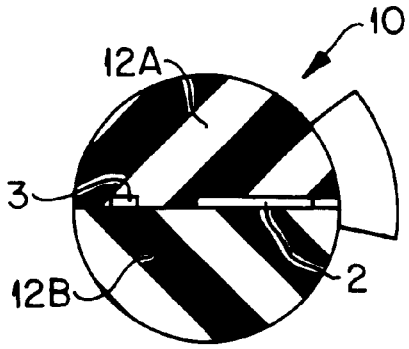
Figure 117A:
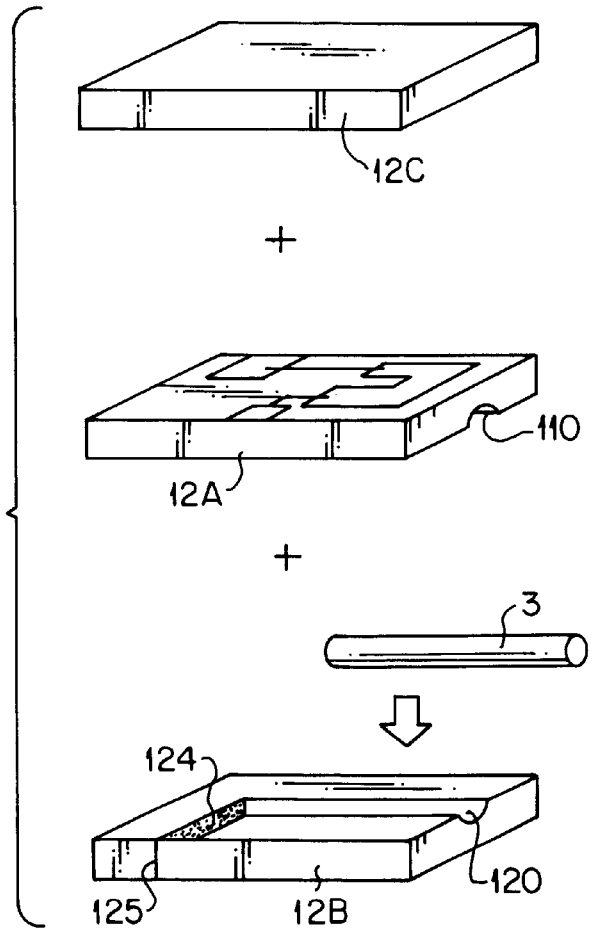
Figure 117B:
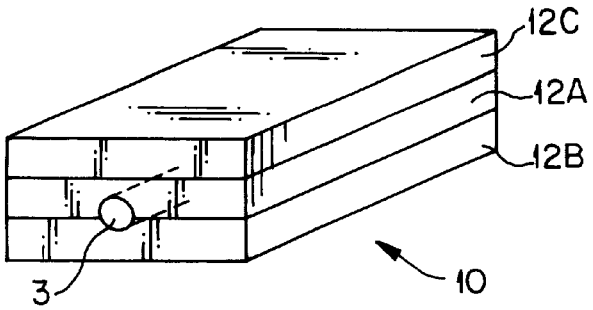
Figure 118A:
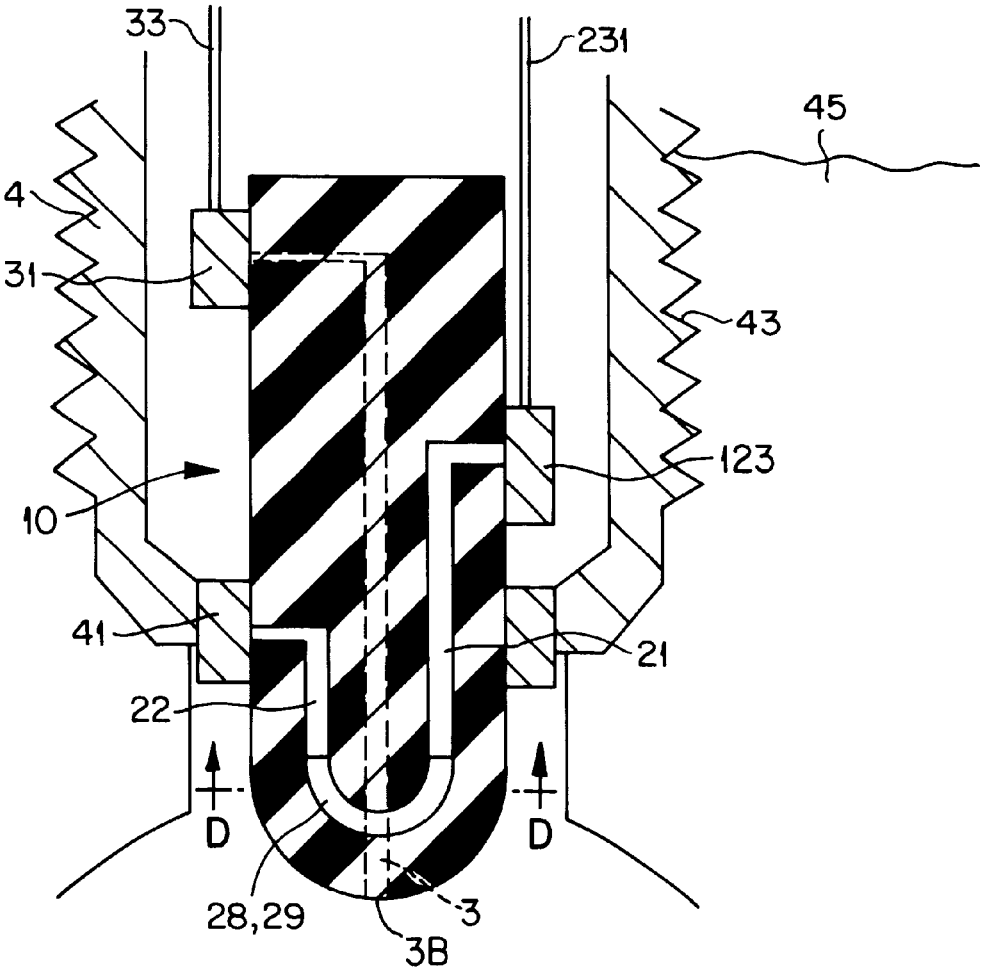
Figure 118B:
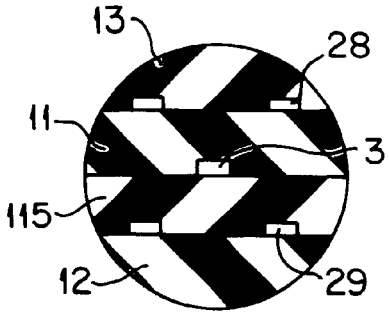
Figure 119:
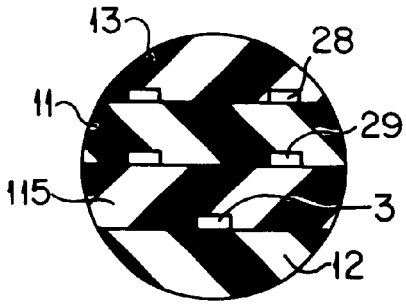
Figure 120A:
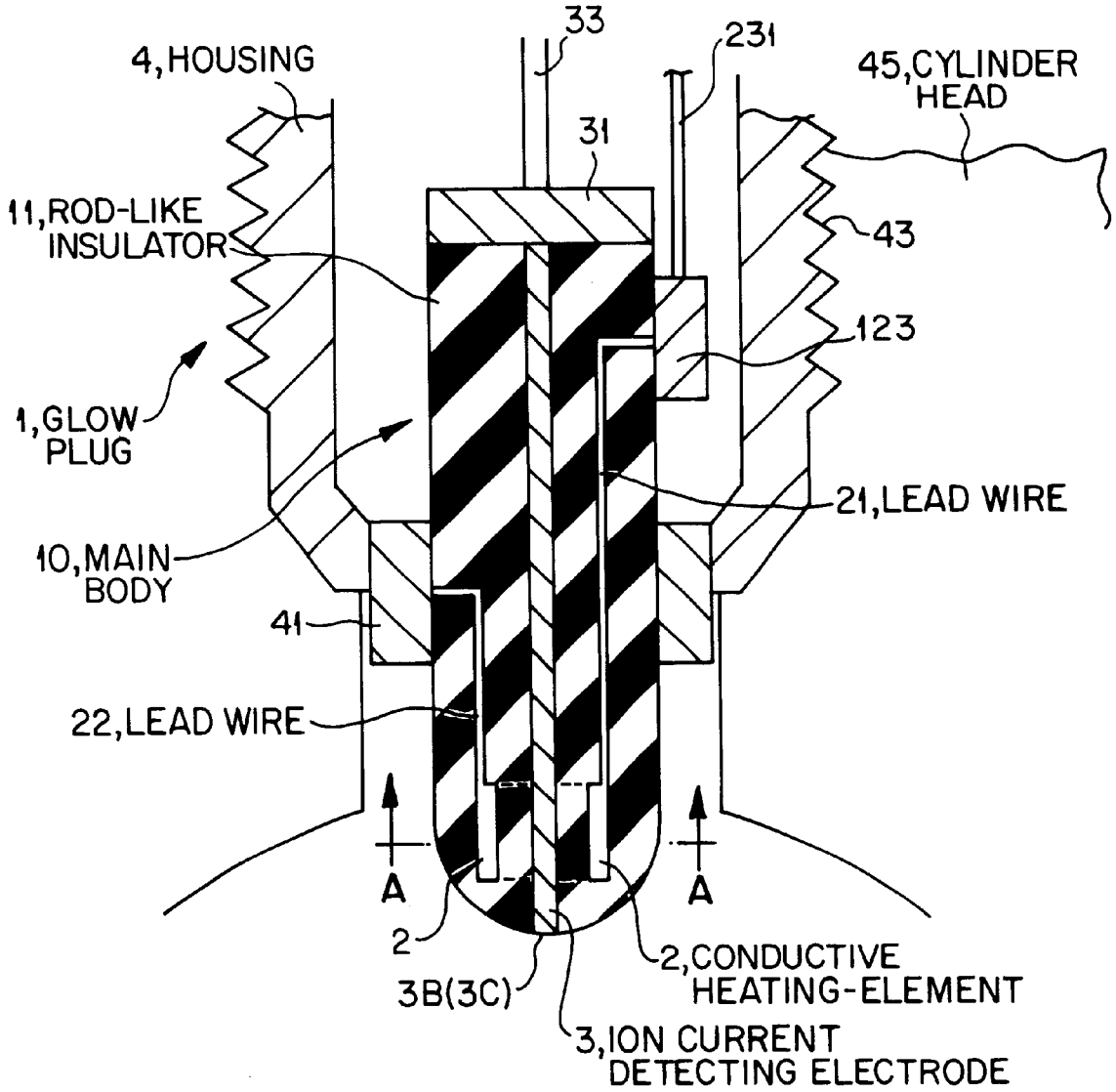
Figure 120B:
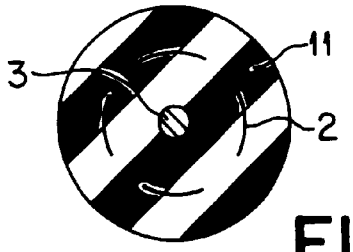
Figure 121:
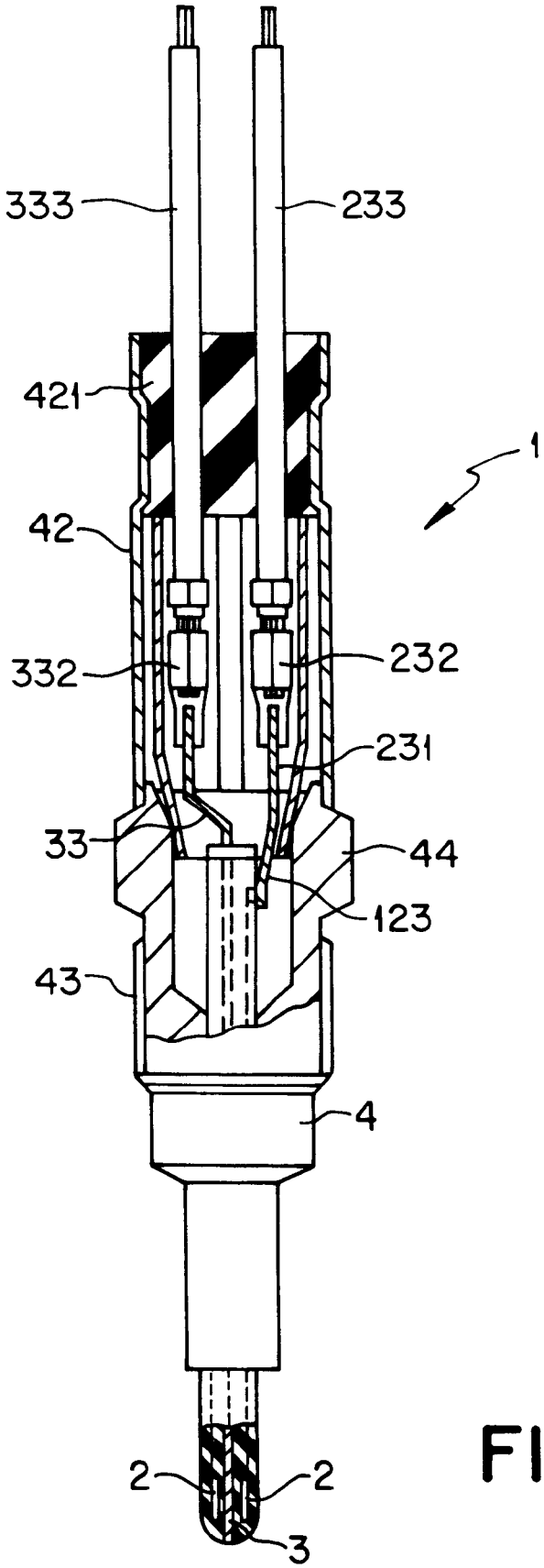
Figure 122:
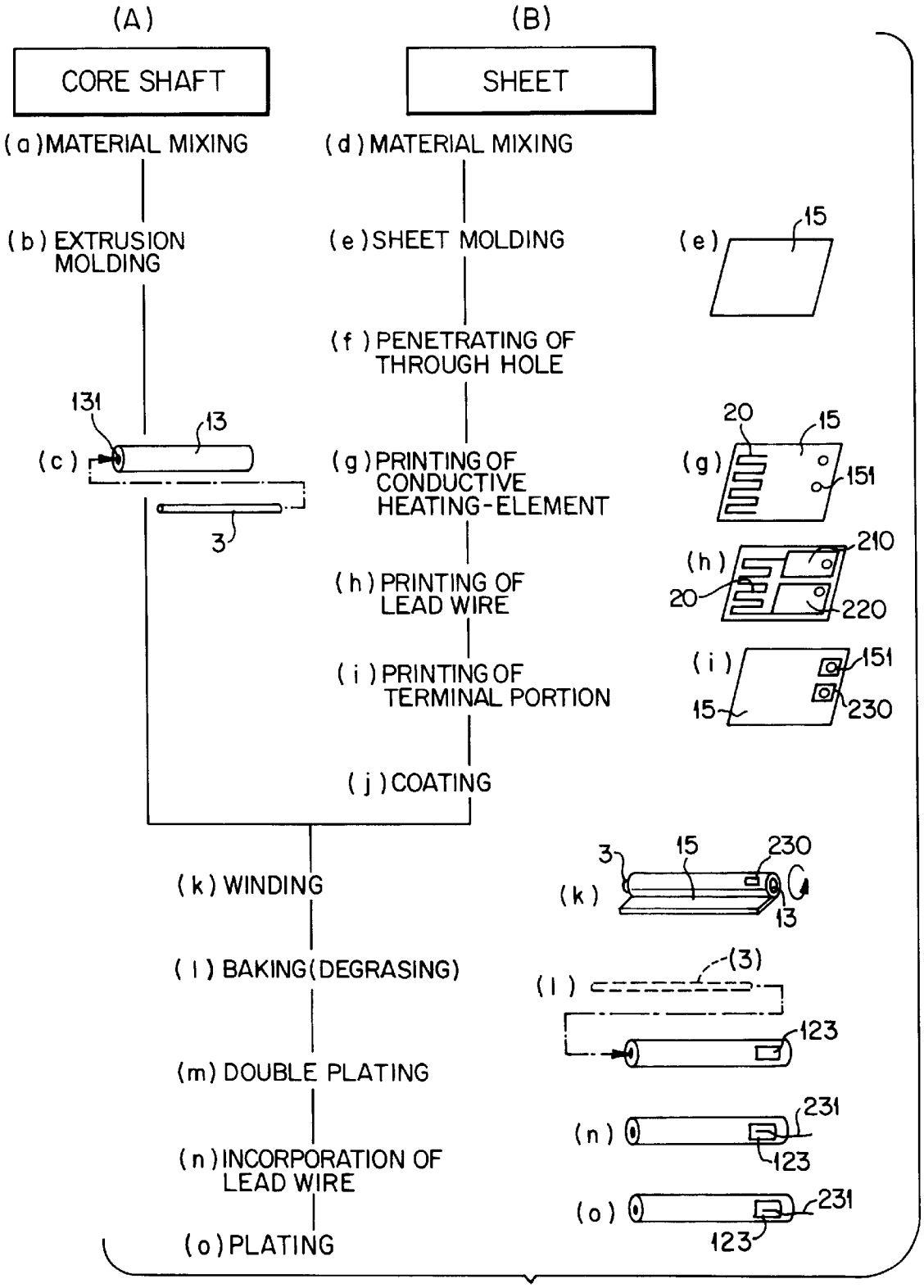
Figure 123A:
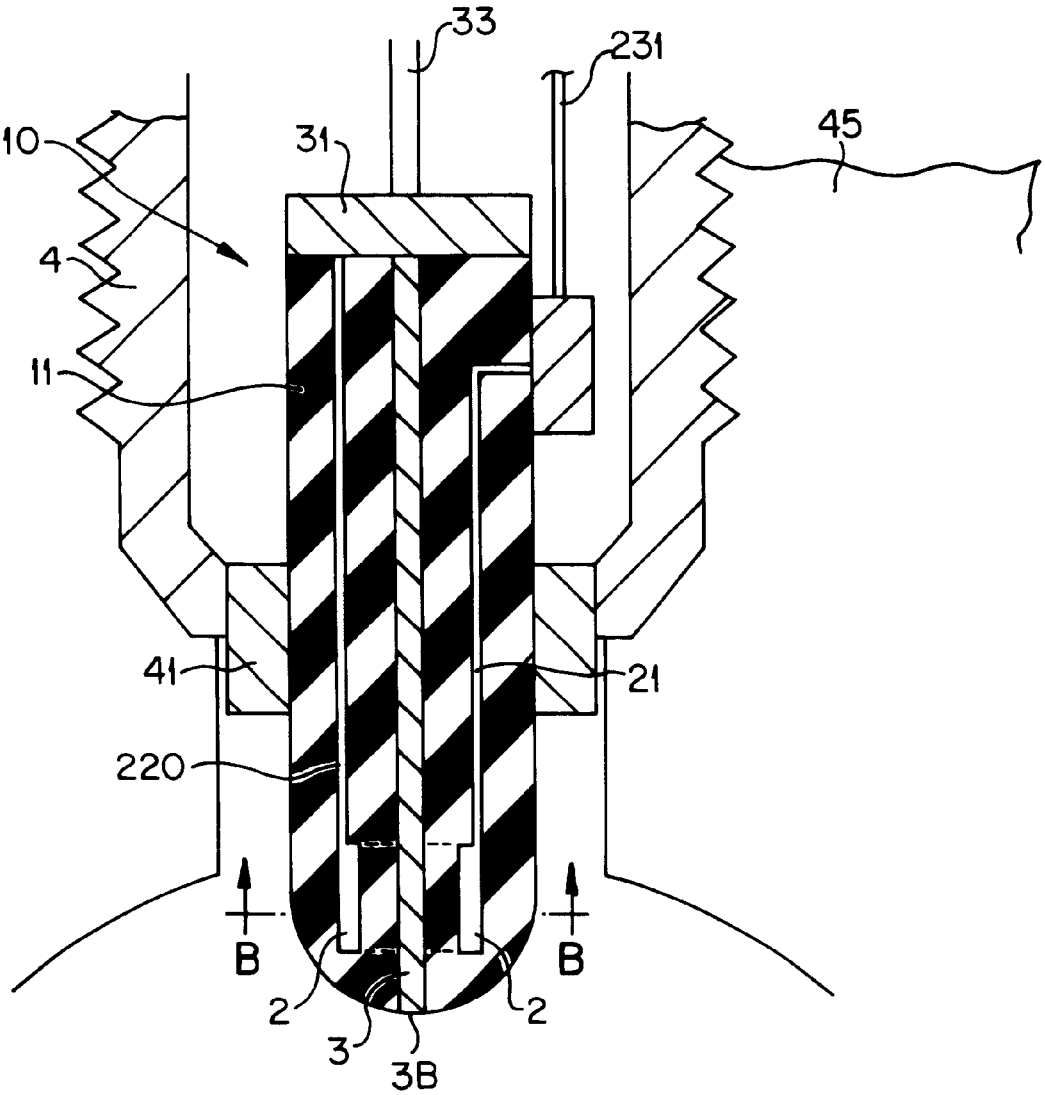
Figure 123B:
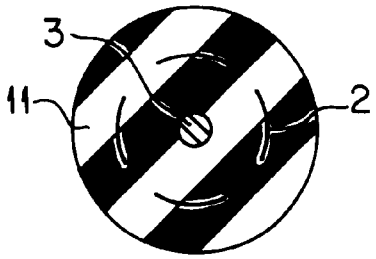
Figure 124A:
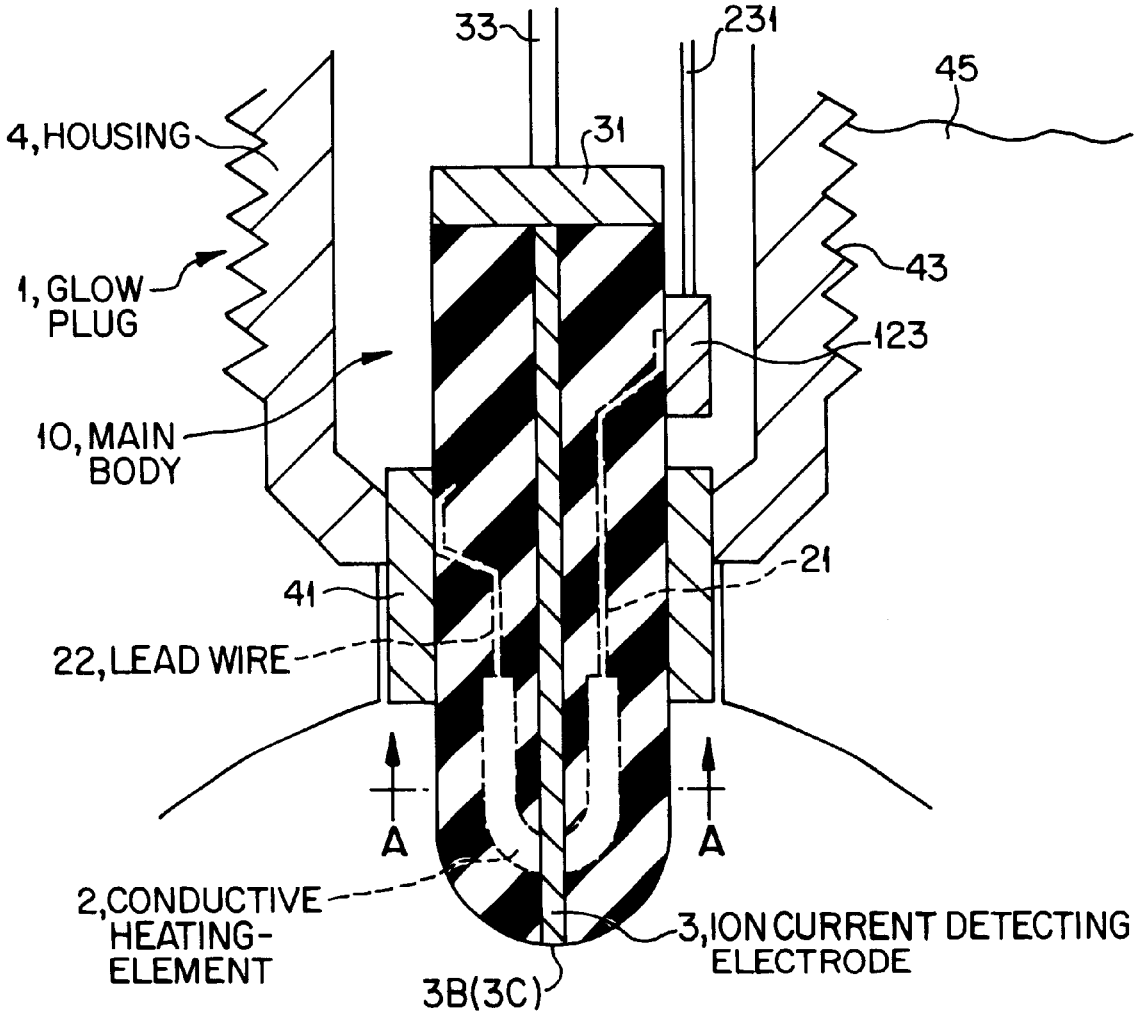
Figure 124B:
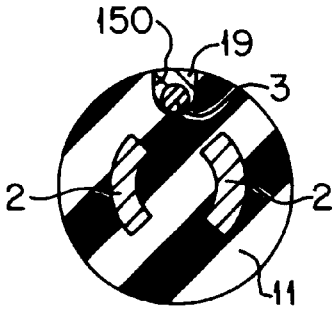
Figure 125:
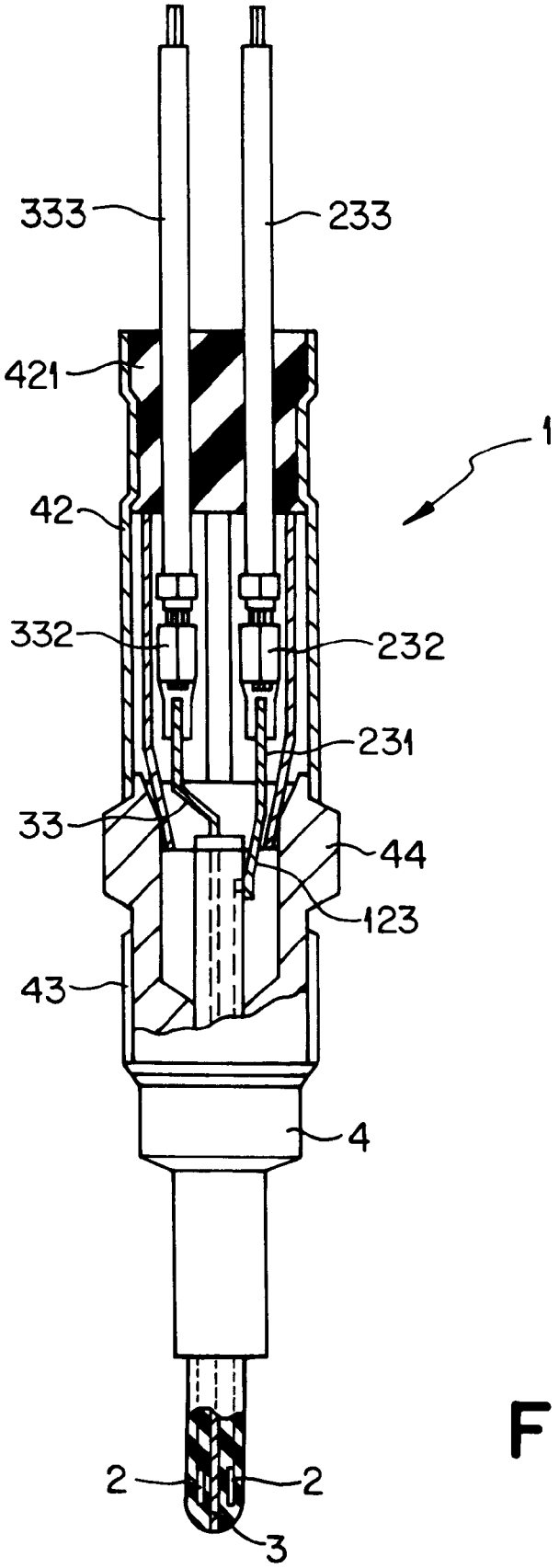
Figure 126A:
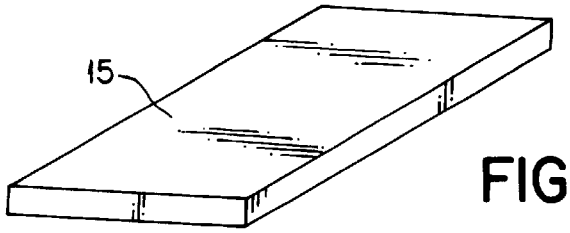
Figure 126B:
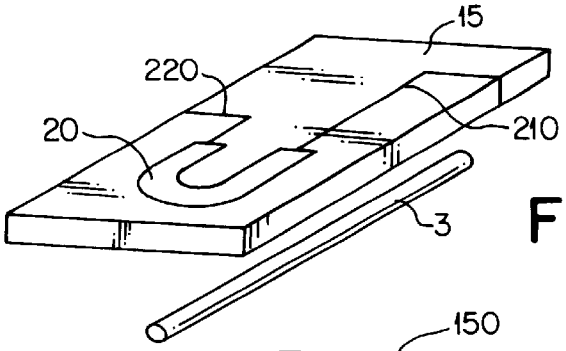
Figure 126C:
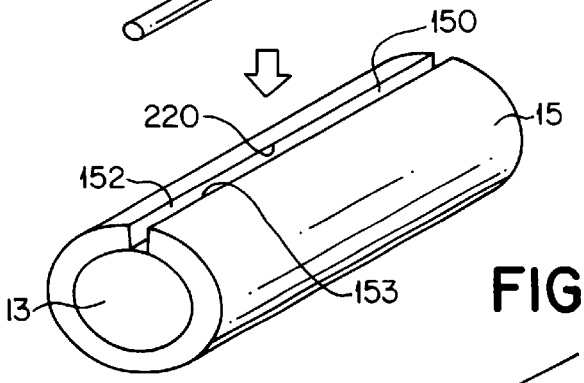
Figure 126D:
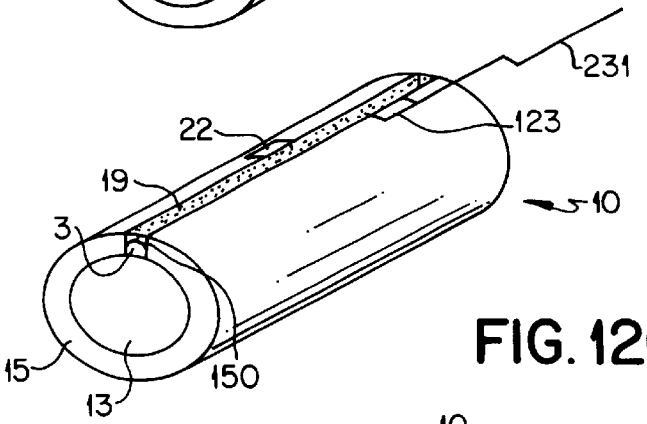
Figure 127:
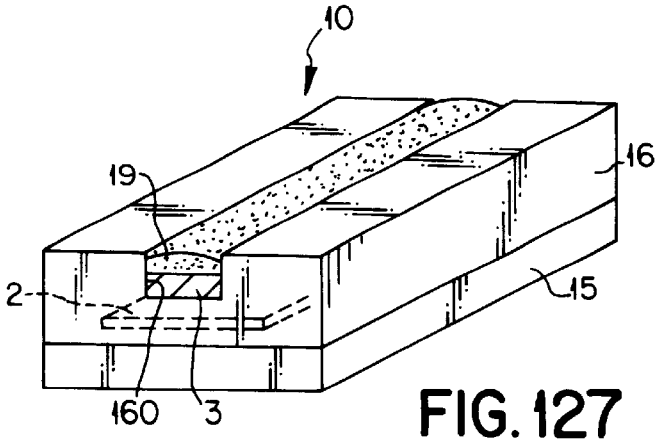

FIGS. 113(A) to 113(C) are diagrams following FIG. 112 for explaining the glow plug manufacturing method;

FIG. 114 is a diagram following FIGS. 113(A) to 113(C) for explaining the glow plug manufacturing method;

FIG. 115A is a sectional view of a glow plug main body according to a 52nd embodiment;

FIG. 115B is a sectional view taken along the line B—B of FIG. 115A;

FIG. 116A is a sectional view of a glow plug main body according to a 53rd embodiment;

FIG. 116B is a sectional view taken along the line C—C of FIG. 116A;

FIGS. 117A and 117B are diagrams for explaining a glow plug manufacturing method in a 54th embodiment;

FIG. 118A is a sectional view of a glow plug main body according to a 55th embodiment;

FIG. 118B is a sectional view taken along the line D—D of FIG. 118A;

FIG. 119 is a sectional view of another glow plug main body according to the 55th embodiment, which is taken along the line corresponding to the line D—D of FIG. 118A;

FIG. 120A is a sectional view of a glow plug main body according to a 56th embodiment;

FIG. 120B is a sectional view taken along the line A—A of FIG. 120A;

FIG. 121 is a diagram showing general structure of a glow plug according to the 56th embodiment;

FIG. 122 is a diagram for explaining a glow plug manufacturing method in the 56th embodiment;

FIG. 123A is a sectional view of a glow plug main body according to the 56th embodiment;

FIG. 123B is a sectional view taken along the line B—B of FIG. 123A;

FIG. 124A is a sectional view of a glow plug main body according to a 58th embodiment;

FIG. 124B is a sectional view taken along the line A—A of FIG. 124A;

FIG. 125 is a diagram showing general structure of a glow plug according to the 58th embodiment;

FIGS. 126A through 126D are diagrams for explaining a glow plug manufacturing method in the 58th embodiment; and FIG. 127 is a sectional view of a glow plug main body according to a 59th embodiment.

BEST MODES FOR CARRYING OUT THE INVENTION

Hereinbelow, the best modes for carrying out the invention will be described by referring to preferred embodiments. In discussing the preferred embodiments, the correspondences among the preferred embodiments, the drawings and the claims are shown in the following table. The table is incorporated herein as reference and it should not be restrictedly interpreted.

Embodiment/Drawing/Claim Correspondence Table

| Embodiment | Specification Page | Drawing | Claim |
|---|---|---|---|
| 1~7 | 101 | 1~33 | 1~12 |
| 8~15 | 150 | 34~45 | 13~26 |
| 16, 17 | 167 | 46~50 | 27~30 |
| 18 | 185 | 51~53 | 31~37 |
| 19~27 | 192 | 54A~73 | 38~41 |
| 28~31 | 220 | 74~80 | 42~44 |
| 32~36 | 227 | 81A~89B | 45~48 |
| 37~41 | 237 | 90, 91 | 49~53 |
| 42~44 | 249 | 92A~96 | 54, 55 |
| 45, 46 | 261 | 97 | 56~59 |
| 47~50 | 267 | 98A~109B | 60~65 |
| 51~55 | 275 | 110A~119 | 66~75 |
| 56, 57 | 287 | 120A~123B | 76~79 |
| 58, 59 | 296 | 124A~127 | 80~89 |

<<First Embodiment>>

Referring to the accompanied drawings, description will be made below with respect to the first embodiment which embodies the present invention in a ceramic glow plug (hereinafter, simply called a glow plug) used as part of starting aids of a Diesel engine. The glow plug of the embodiment is provided in a combustion chamber (turbulence chamber) formed in a cylinder head of the Diesel engine, with portion of the glow plug being exposed into the combustion chamber. When the engine starts at low temperature, the glow plug acts to promote ignition and combustion of fuel sprayed from a fuel injection nozzle. In the embodiment, the glow plug also acts to detect active ions existing in the flame front during fuel combustion.

Figure 1:
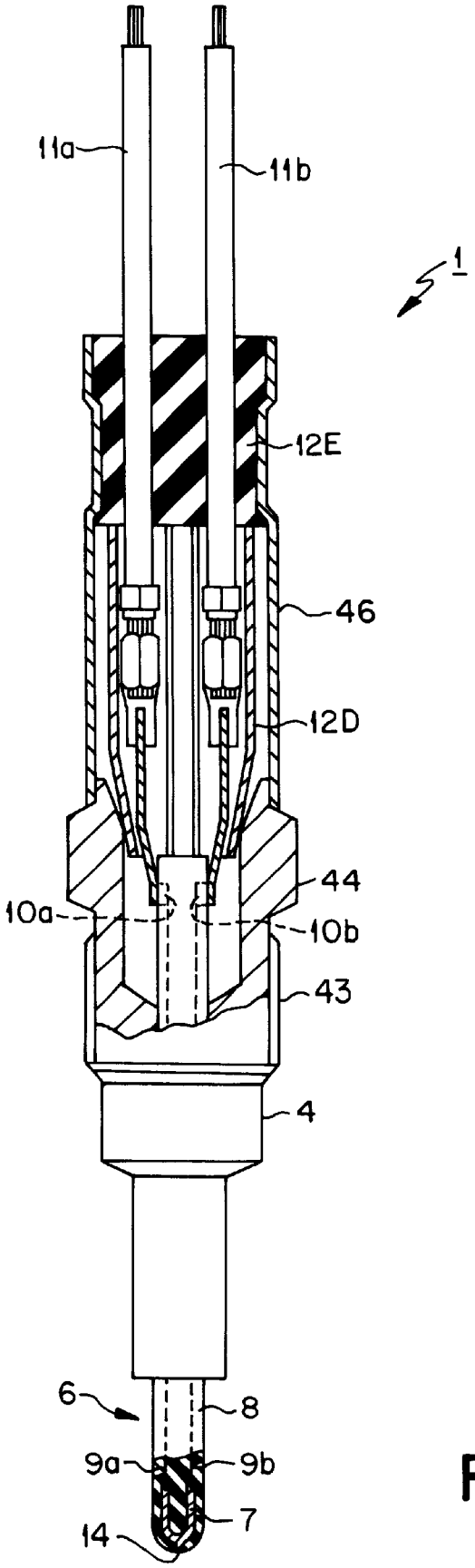
FIG. 1 is a diagram showing general structure of a glow plug according to a first embodiment of the present invention.

FIG. 1 shows general structure of a glow plug 1 according to the embodiment. In the drawing, the glow plug 1 has a cylinder-like metal housing 4. A male screw portion 43 and a hex-head portion 44 are formed on the outer surface of the housing 4 so that the glow plug can be mounted in a cylinder head, as described later. An annular protection tube 46 is deposited in the upper portion of the housing 4.

A ceramic heating unit 6 is retained in the housing 4, which is constituted of a U-type conductive heating element 7; a heat resisting insulator 8 having electrical nonconductivity; an ion current detecting electrode 14 formed integrally with the heating element 7; and two tungsten lead wires 9*a*, 9*b* embedded in the insulator 8 and connected to both ends of the heating element 7, respectively.

Figure 2:
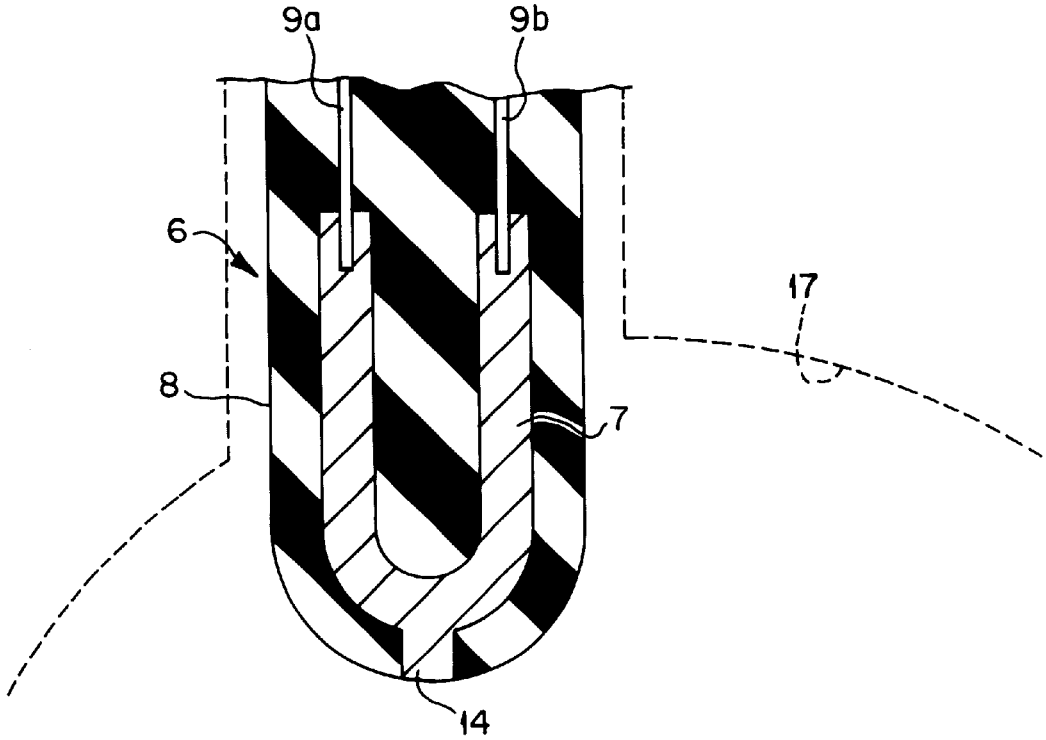
FIG. 2 is an enlarged cross-sectional view of the main parts of the glow plug according to the first embodiment.

Stated more in detail, the majority of the heating element 7 is embedded in the heat resisting insulator 8 and tightly retained. As shown in an enlarged view of FIG. 2, the end surface of the ion current detecting electrode 14 formed at the tip of the heating element 7 is placed on the same plane as the outer surface of the heat resisting insulator 8. In this case, since the heating element 7 and the ion current detecting electrode 14 are integrally formed, both are electrically connected at all times. In such structure, the exposed portion of the heating element 7 and an inner wall of a turbulence chamber 17 (dashed-line portion) of the Diesel engine, described later, form opposed electrodes for detecting ion current.

Returning to FIG. 1, conductive chips l0*a,* 10*b* are embedded in the heat resisting insulator 8 and connected to upper ends of the tungsten lead wires 9*a,* 9*b,* respectively. Each of the conductive chips 10*a,* 10*b* is connected to a corresponding one of two lead wires 11*a,* 11*b* serving as external signal input lines of the glow plug 1. In addition, the housing 4 and the protection tube 46 are electrically insulated from the lead wires 11*a* and 11*b* by an insulating tube 12D and a rubber bush 12E. The lead wires 11*a,* 11*b* are fixed by a caulking force of the protection tube 46 as well as the rubber bush 12E.

The structure of the ceramic heating unit 6 will be described in detail below. In the heating unit 6, the heating element 7, the ion current detecting electrode 14 and the heat resisting insulator 8 are sintered products made of a mixture of conductive ceramic powder (in the embodiment, molybdenum silicide ($MoSi_2$) powder) and nonconductive ceramic powder (in the embodiment, silicon nitride ($Si_3N_4$) powder). A different point between them is that the heating element 7 and the ion current detecting electrode 14 have a mean diameter of $MoSi_2$ powder smaller than that of $Si_3N_4$ powder, while the heat resisting insulator 8 has a mean diameter of $MoSi_2$ powder equal to or larger than that of $Si_3N_4$ powder. By changing the grain size of each powder, the heating element 7 and the ion current detecting electrode 14 are produced dividedly from the heat resisting insulator 8. The mixing ratio of $MoSi_2$ powder to $Si_3N_4$ powder in the heating element 7 and the ion current detecting electrode 14 is also made different from that in the heat resisting insulator 8.

The actual mean diameter of each powder is as follows: with the heating element 7 and the ion current detecting electrode 14, $MoSi_2$ powder is between 1 $\mu$m and 3 $\mu$m and $Si_3N_4$ powder is between 10 $\mu$m and 20 $\mu$m; and with the heat resisting insulator 8, $MoSi_2$ powder is about 1.1 $\mu$m and $Si_3N_4$ powder is about 0.7 $\mu$m. With the mixing ratio of $MoSi_2$ powder to $Si_3N_4$ powder, $MoSi_2$ powder is from 60 to 70 wt % and $Si_3N_4$ powder is from 40 to 30 wt % in the former (the heating element 7 and the ion current detecting electrode 14); and $MoSi_2$ powder is from 20 to 30 wt % and $Si_3N_4$ powder is from 80 to 70 wt % in the latter (heat resisting insulator 8). In both cases, $Y_2O_3$ and $Al_2O_3$ are added as auxiliaries at a rate of about 10 wt %.

In the ceramic heating unit 6 having the above construction, since the heating element 7 and the ion current detecting electrode 14 are made up such that small particles of $MoSi_2$ powder (conductive ceramic powder) are linked together around a large particle of $Si_3N_4$ powder (nonconductive ceramic powder), current flows through the heating element 7 and the ion current detecting electrode 14, and thereby the heating element 7 runs hot. On the other hand, since the heat resisting insulator 8 is made up such that small particles of $Si_3N_4$ powder (nonconductive ceramic powder) are put between large particles of $MoSi_2$ powder (conductive ceramic powder), both powders are lined up to form an insulation layer having resistance larger than the heating element 7.

Figure 3:
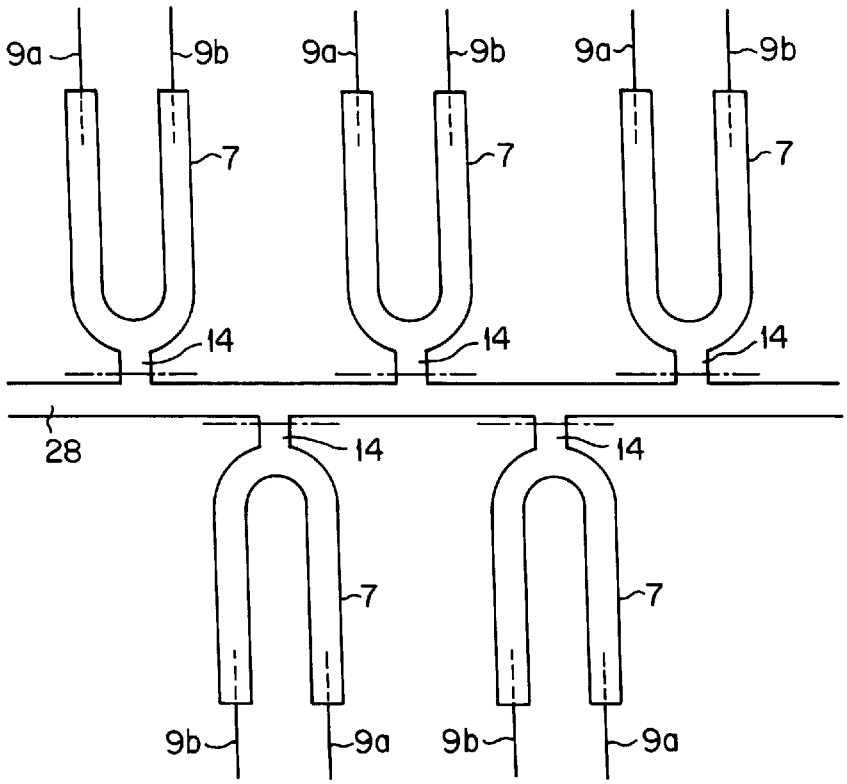
FIG. 3 is a diagram showing the procedure for manufacturing the glow plug.

Referring next to FIGS. 3 to 6, a method of manufacturing the ceramic heating unit 6 will be described. At first, a binder is kneaded with the respective mixtures of $MoSi_2$ powder and $Si_3N_4$ powder to form pastes. The pastes are then injection-molded into desired shapes of the heating element 7, the ion current detecting electrode 14 and the heat resisting insulator 8, respectively. In this molding process, plural sets of the heating elements 7 and the ion current detecting electrodes 14 are coupled together through a connecting bar 28 as shown in FIG. 3, with the tungsten lead wires 9*a* and 9*b* connected to each set. The ion current detecting electrode 14 is cut part-way off (along the dot-dash line of FIG. 3) to separate each set of the heating element 7 and the ion current detecting electrode 14 from the connecting bar 28.

Figure 4:
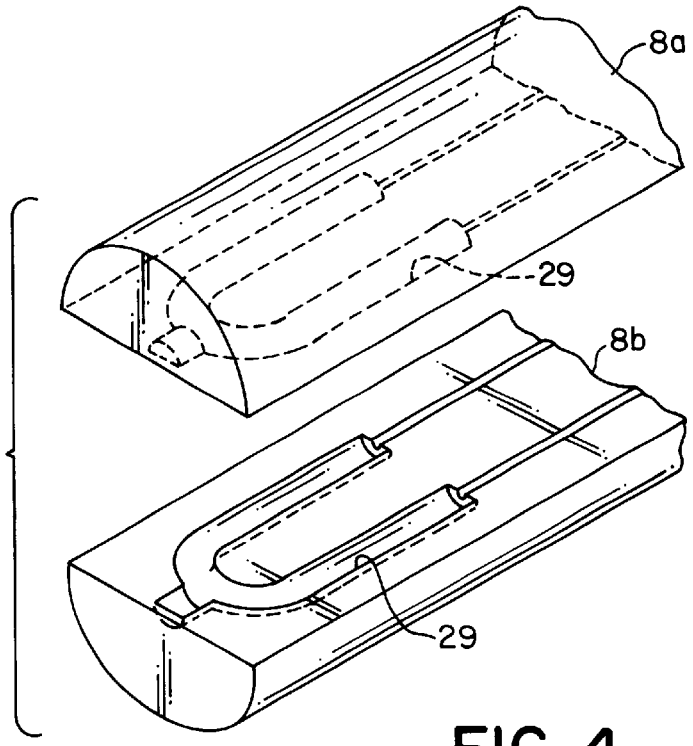
FIG. 4 is a diagram showing the procedure for manufacturing the glow plug.

On the other hand, as shown in FIG. 4, two insulation parts 8*a,* 8*b* constituting the heat resisting insulator 8 are formed into a pair of semicylinders. Each mating surface of the insulation parts 8*a,* 8*b* has a groove portion 29 for accommodating the heating element 7, the lead wires 9*a,* 9*b,* and the ion current detecting electrode 14.

Figure 5:
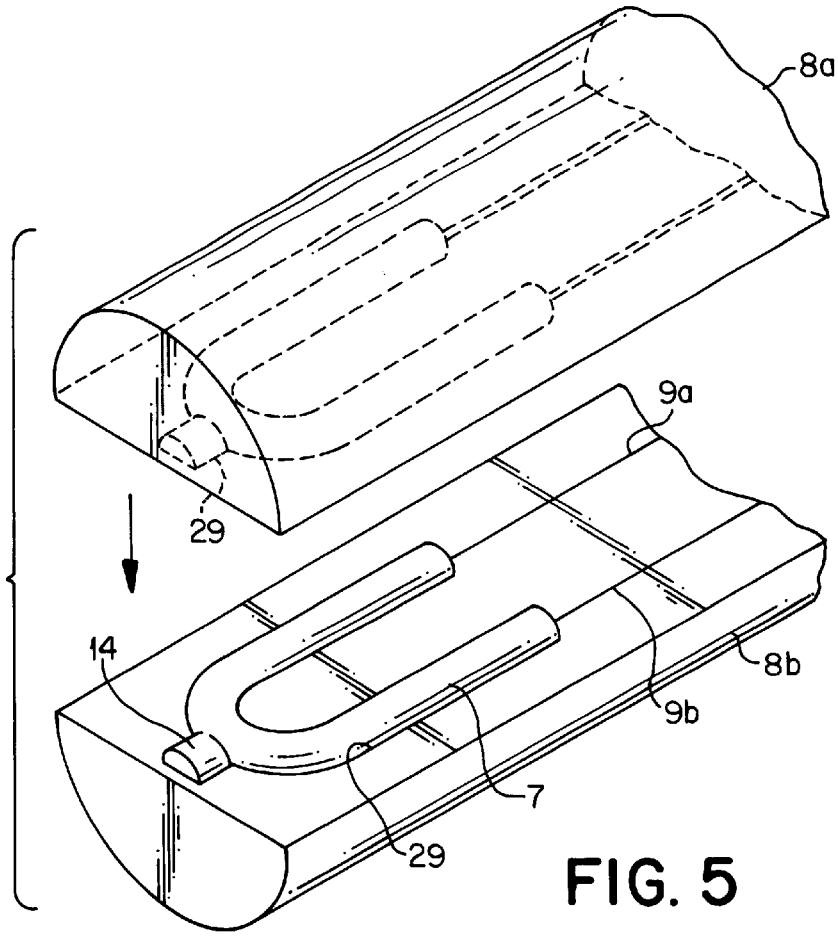
FIG. 5 is a diagram showing the procedure for manufacturing the glow plug.
Figure 6:
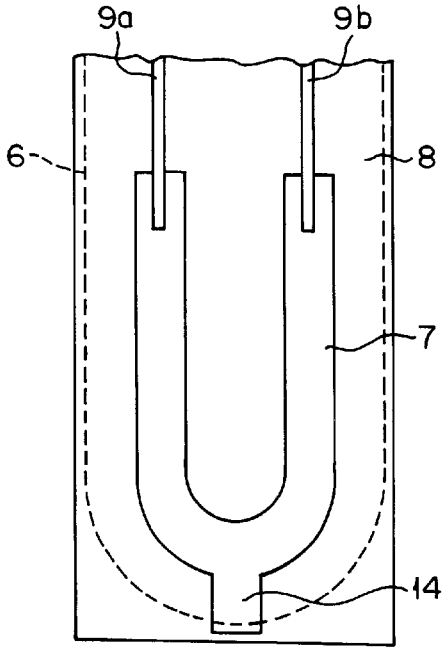
FIG. 6 is a diagram showing the procedure for manufacturing the glow plug.

As shown in FIG. 5, the integrated body of the heating element 7 and the ion current detecting electrode 14 is placed in the groove portion 29 so that they will be surrounded with the insulation parts 8*a,* 8*b,* and then hot-pressed at a temperature of between 1700° C. and 1800° C. After that, the outer portion of the ceramic heating unit 6 is cut along the broken line of FIG. 6 to be a cylinder-like shape with a round tip. At this time, the heating element 7 is completely embedded in the heat resisting insulator 8, while the end surface of the ion current detecting electrode 14 is exposed at the tip of the ceramic heating unit 6.

Figure 7:
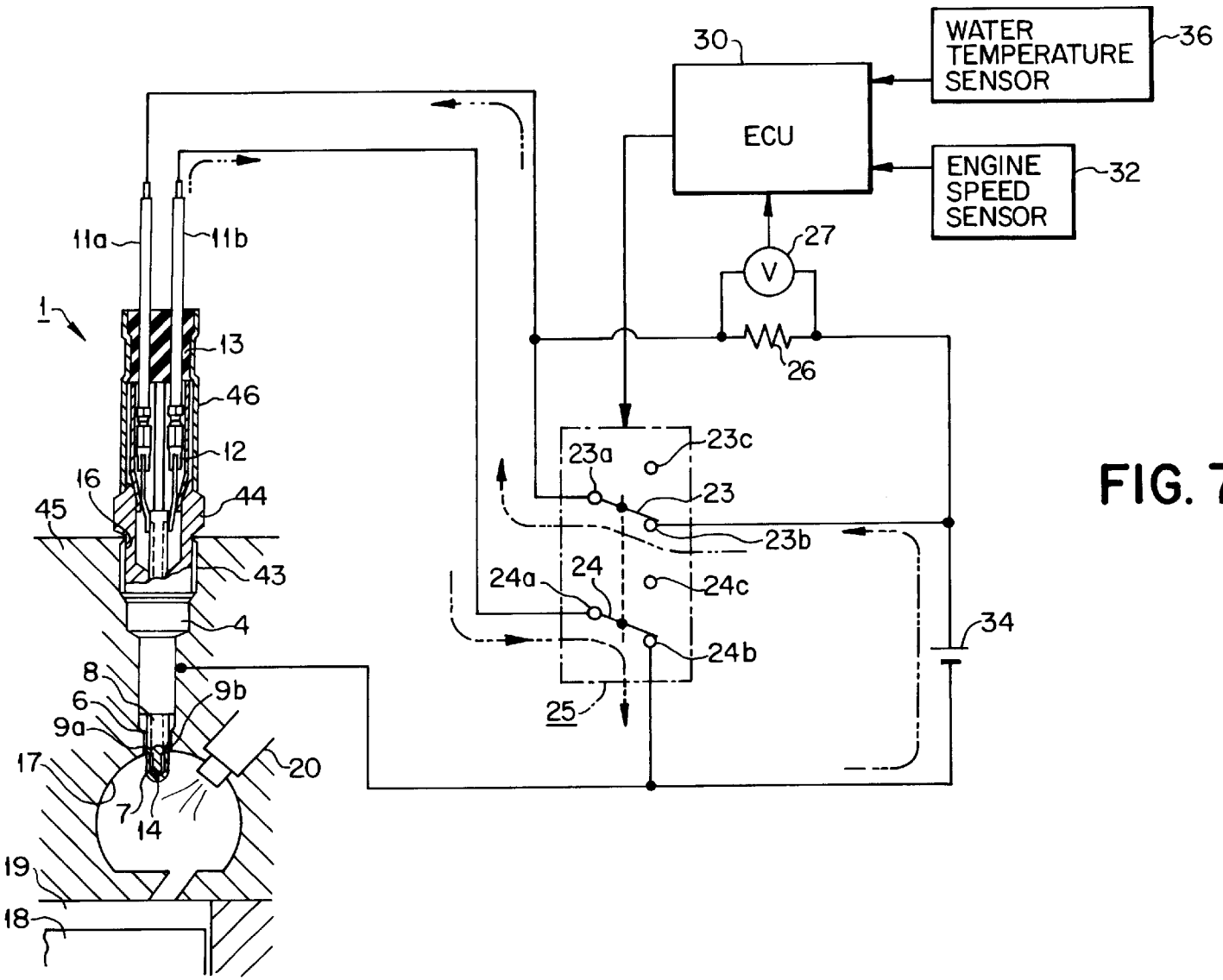
FIG. 7 is a diagram of general structure of an ion current detecting system, which shows a heating-element running state.
Figure 8:
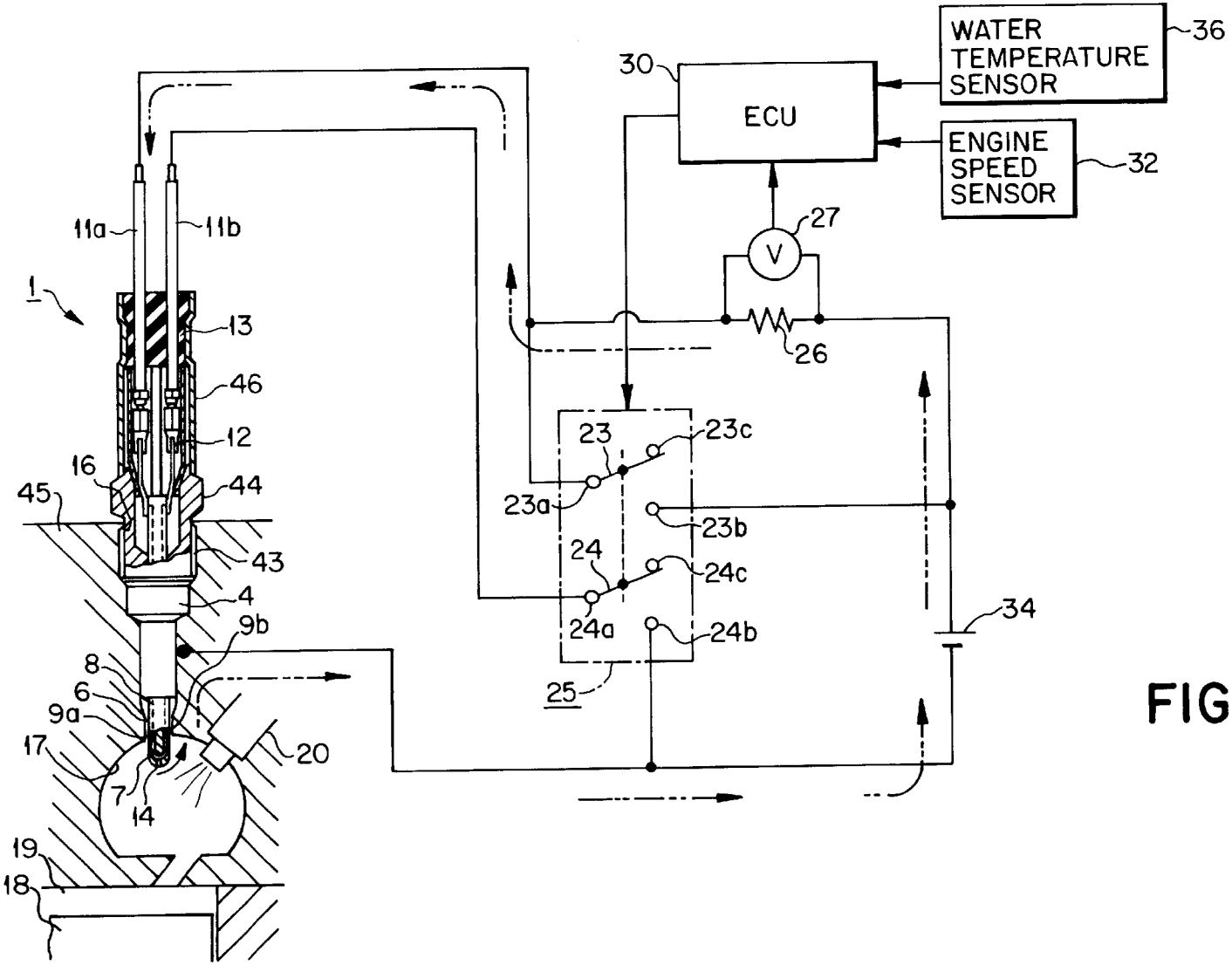
FIG. 8 is a diagram of general structure of the ion current detecting system, which shows an ion current detecting state.

Referring next to FIGS. 7 and 8, an ion current detecting system using the above glow plug 1 will be described. FIGS. 7 and 8 are diagrams showing general structure of an ion current detecting system according to the embodiment. FIG. 7 shows a state in which the glow plug 1 (heating element 7) is running hot, i.e., where the glow plug 1 is promoting ignition and combustion of fuel at starting of the engine. FIG. 8 shows a state in which the glow plug 1 detects ion current resulting from fuel combustion.

In both figures, a screw hole 16 is formed in a cylinder head 45 of the Diesel engine, and the glow plug 1 is screwed tightly in the screw hole 16. In fastening the glow plug 1 to the cylinder head 45, the hex-head portion 44 is held with a given tool and the male screw portion 43 of the plug 1 is screwed into the screw hole 16.

The tip of the ceramic heating unit 6 of the glow plug 1 projects into the turbulence chamber 17 formed in the cylinder head 45. The turbulence chamber 17 communicates with a main combustion chamber 19 provided above a piston 18, and forms part of the combustion chamber. In the turbulence chamber 17, a tip of a fuel injection nozzle 20 is so arranged that the fuel will be sprayed from the fuel injection nozzle 20 into the turbulence chamber 17.

A switching circuit 25 is provided between a 12-volt DC battery 34 and the glow plug 1, which switches the electric path between the battery 34 and the glow plug 1 according to the operating state of two 2-position switches 25. The switching circuit 25 maintains a heating-element running state (the state shown in FIG. 7) in normal operation in which no command signal is input from an electronic control unit (hereinafter, referred to as ECU) 30. When a command signal is input from the ECU 30, the heating-element running state goes to an ion current detecting state (the state shown in FIG. 8). At this time, two movable pieces of the switches 25 are interlocked.

Terminals 23*a* and 24*a* of the switches 25 are connected to the lead wires 11*a* and 11*b* of the glow plug 1, respectively. Each of the switches 25 has a pair of contacts 23*b*, 23*c* or 24*b*, 24*c* to be selectively connected to the terminal 23*a* or 24*a*.

As shown in FIG. 7, the heating-element running state is such that the terminal 23*a* and the contact 23*b* are closed and the terminal 24*a* and the contact 24*b* are closed. At this time, one lead wire 11*a* of the glow plug 1 is connected to the positive side of the battery 34 through the terminal 23*a* and the contact 23*b*, while the other wire 11*b* is connected to the negative side of the battery 34 through the terminal 24*a* and the contact 24*b*. The heating element 7 is thus maintained in the running state (i.e., current flows along the path indicated by the double-dot-and-dash arrows in FIG. 7). The contact 24*b* is also connected to a portion of the cylinder head 45.

As shown in FIG. 8, the ion current detecting state is such that the terminal 23*a* and the contact 23*c* are closed and the terminal 24*a* and the contact 24*c* are closed, i.e., the switches 25 are both in the open state. In this case, the battery voltage is applied to the lead wire 11*a* through an ion current detecting resistor 26 existing in the electric path (the path indicated by the double-dot-and-dash arrows in FIG. 8) provided in parallel with one switch 23. In other words, the battery voltage is applied between the cylinder head 45 and the ion current detecting electrode 14 formed at the tip of the ceramic heating unit 6. As active ions are created in the flame front during combustion, application of the battery voltage accompanies an ion current flowing in the path as indicated by the double-dot-and-dash arrows in FIG. 8.

The resistance of the ion current detecting resistor 26 is about 500 kΩ. The ion current flowing through the ion current detecting resistor 26 is detected by a potentiometer 27 as a potential difference between both ends of the resistor 26.

The principle of ion current detection will be described in brief. When the fuel is fed to the turbulence chamber 17 through the fuel injection nozzle 20 and a combustion event occurs, a large number of positive and negative ions of ionized gases are created in the flame front due to combustion. Application of the battery voltage between the ion current detecting electrode 14 and the cylinder head 45 facing the electrode 14 causes the ion current detecting electrode 14 to capture the negative ions and the cylinder head 45 to capture the positive ions. As a result, the current path shown in FIG. 8 is formed, and an ion current flowing in the current path is detected as a potential difference between both ends of the ion current detecting resistor 26.

The ECU 30 mainly includes a well-known microcomputer and an A/D converter, not shown, the microcomputer including a CPU, a ROM, a RAM, an I/O circuit and such. The ECU 30 receives a detection signal from the potentiometer 27. The ECU 30 also receives a detection signal from a water temperature sensor 36 for sensing temperature of engine cooling water, and a detection signal from an engine speed sensor 32 for sensing engine speed according to the crank angle of the engine. The ECU 30 thus detects a water temperature Tw and an engine speed Ne based on the detection signals from the sensors 36 and 32, respectively.

When the Diesel engine starts at low temperature, the ECU 30 instructs the glow plug 1 to run the heating element 7 hot and to promote ignition and combustion of fuel. When warm-up of the Diesel engine is completed, the ECU 30 sends a switching command signal to the switching circuit 25 to change the system circuitry to the ion current detecting state so that the ion current due to combustion can be detected. At the beginning of engine start, the switching circuit 25 keeps the heating element in the running state. Hereinbelow, the switching process of the switching circuit 25 will be described with reference to a flowchart of FIG. 9. Such a switching action as shown in FIG. 9 is taken by an interrupt occurring at given timing.

Figure 9:
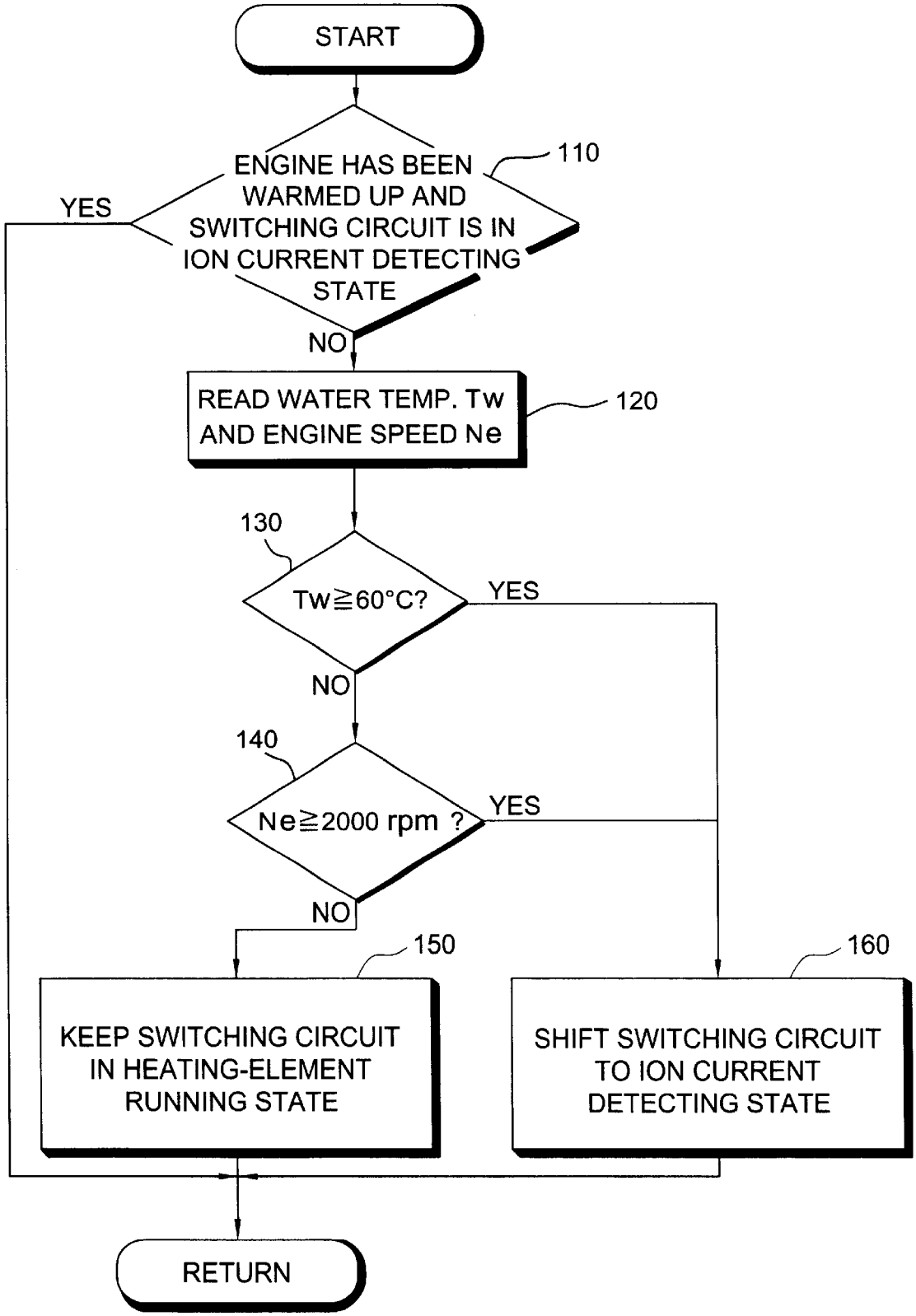
FIG. 9 is a flowchart of switching processing of a switching circuit.

When starting the processing of FIG. 9, the ECU 30 determines at step 110 whether or not warm-up of the engine has been completed and the switching circuit 25 is in the ion current detecting state. Since a negative determination is made at step 110 at the beginning of engine start, the ECU 30 reads the water temperature Tw and the engine speed Ne at the subsequent step 120.

The ECU 30 then determines at step 130, whether or not the water temperature Tw is higher than a predetermined warm-up temperature (60° C. in the embodiment), and at step 140, whether or not the engine speed Ne reaches a predetermined engine speed (2000 rpm in the embodiment) or more. If negative determinations are made at both steps, the ECU 30 regards the engine as not warmed up completely so further heating by the glow plug 1 (heating element 7) is necessary, and advances the processing to step 150. If a positive determination is made at either step 130 or step 140, the ECU 30 regards the engine as having been warmed up completely, or the heating by the glow plug 1 (heating element 7) as being unnecessary, and advances the processing to step 160.

In the case the processing goes to step 150, the ECU 30 keeps the switching circuit 25 in the heating-element running state (the state of FIG. 7), and it ends the processing. In this state, ignition and combustion of fuel is promoted by the heating action of the glow plug 1.

In the case the processing goes to step 160, the ECU 30 changes the switching circuit 25 from the heating-element running state to the ion current detecting state (the state of FIG. 8), and it ends this processing routine. In this state, an ion current produced when burning the fuel is detected by the ion current detecting resistor 26.

The case where a positive determination is made at step 140 and the processing goes to step 160 includes a case, for example, where the engine is in a racing state and the engine speed Ne temporarily rises. In such a case, since the engine has not been warmed up completely, even if the switching circuit 25 has been changed once to the ion current detecting state, the ECU 30 will make a negative determination at step 110 in the next processing cycle, and goes to steps 130 and 140 again to execute the determinations. Once the engine speed Ne stops its temporal rise and starts to decrease (i.e., when the engine speed Ne becomes Ne<2000 rpm), the ECU 30 returns the switching circuit 25 to the heating-element running state (step 150).

The ECU 30 makes a positive determination at step 110 when the water temperature Tw becomes equal to or higher than 60° C. and warm-up of the engine is completed. The ECU 30 gives the positive determination every time at step 110 after the engine has been warmed up completely and the switching circuit 25 is changed to the ion current detecting state. The switching circuit 25 is thus maintained in the ion current detecting state (the state of FIG. 8).

Figure 10:
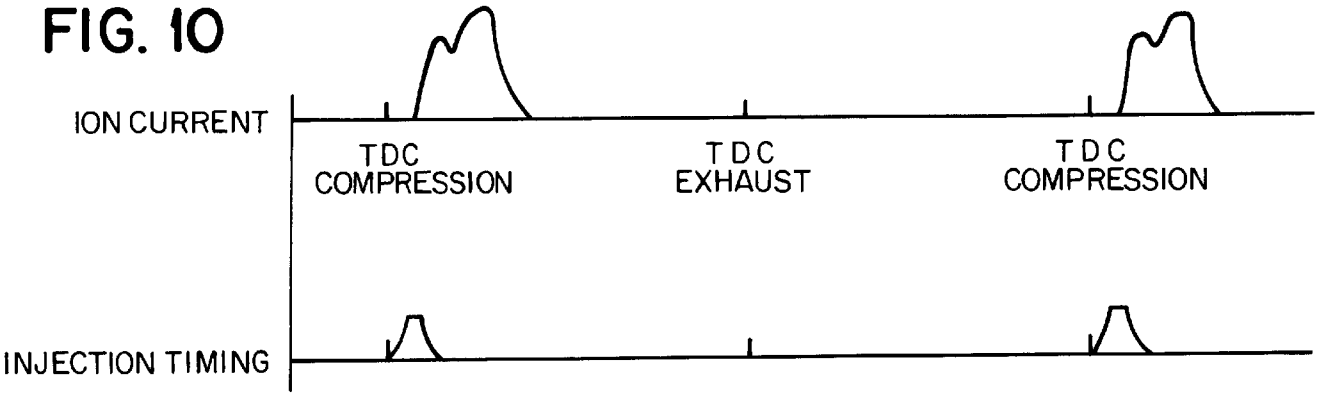
FIG. 10 is a chart showing an example of ion current waveforms.

FIG. 10 is a chart of a current waveform resulting from the observation of ion current with an oscilloscope, the ion current produced when burning the fuel. In the drawing, a portion of the waveform with the voltage suddenly rising immediately after compression TDC (immediately after fuel injection) is of an ion current due to fuel combustion. In this waveform, point A shows a combustion start position, which corresponds to an ignition stage. The waveform has two peaks: the one, first peak B1, created by active ions in the diffused flame front, is observed early in the combustion event; and the other, second peak B2, created by a re-ionization effect due to an increase in internal pressure of the cylinder, is observed in the middle and late stages of the combustion event.

The ECU 30 detects an actual ignition stage from the first peak B1 of the ion current waveform to perform feedback control of the ignition stage in such a manner that the actual ignition stage detected is made correspondent to a target ignition stage. The ECU 30 also detects a combustion condition, such as abnormal combustion or flame failure, from the second peak B2 of the ion current waveform to reflect the detection result on the fuel injection control. The result of the ion current detection is thus reflected on the fuel injection control so that the engine operation can be controlled precisely.

Next, the effects of the embodiment will be described.

(a) The glow plug 1 of the embodiment includes the heat resisting insulator 8; the heating element 7 embedded in the heat resisting insulator 8 and energized through the lead wire pair 9*a,* 9*b* (11*a,* 11*b*) to generate heat; and the ion current detecting electrode 14, formed integrally with the heating element 7, for detecting the ionization state in the combustion flame. The ion current detecting electrode 14 is constructed such that a portion (end surface) is exposed to the flame in the turbulence chamber 17. When detecting ion current, the ion current detecting electrode 14 and the adjacent inner wall of the turbulence chamber 17 form two electrodes (an electrode couple) for capturing combustion ions (positive and negative ions). It is therefore possible to detect ion current precisely with such very simple structure, and hence to provide the glow plug 1 for use as an inexpensive ion sensor.

(b) Since the glow plug 1 is constructed such that the majority of the ion current detecting electrode 14 is embedded in the heat resisting insulator 8 except only a portion exposed to the outside, an amount of carbon adhered to the outer surface of the glow plug 1 cannot establish an electrical connection between the electrode and the housing (grounded side) to cause error detection of the ion current that may occur in the prior art (U.S. Pat. No. 4,739,731). Especially in the embodiment, since the exposed portion of the ion current detecting electrode 14 is provided at the tip of the glow plug 1, the exposed portion and the turbulence chamber 17 are spaced enough to solve the above problem more properly.

The carbon adhered to the outer surface of the glow plug 1 is burnt off by a heating action of the heating element 7 (e.g., due to glowing when the engine starts at low temperature). As a result, the glow plug 1 can maintain its performance in detecting ion current for long periods.

Figure 11:
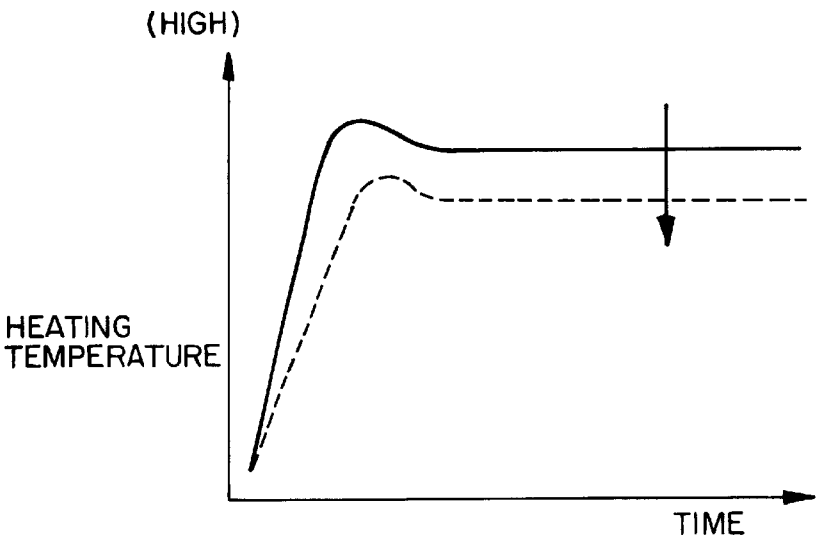
FIG. 11 is a graph showing heating characteristics of the glow plug.

(c) Since the heating element 7 itself is embedded inside the heat resisting insulator 8, it could resist oxidation to wear the heating element 7. As a result, the heating element 7 cannot change its heating characteristics to maintain high heating performance for long periods. This construction also avoids damaging the heating element 7 under thermal action such as thermal shock in the turbulence chamber 17. Oxidation wearing of the heating element 7 causes a change in resistance to lower its heating performance as shown in FIG. 11 (see the broken line). In contrast, such lowering can be avoided in the embodiment (i.e., a characteristic indicated by the solid line is maintained).

(d) In the glow plug 1 of the embodiment, the ion current detecting electrode 14 (and the heating element 7) is produced by molding a conductive ceramic material. It is therefore possible to minimize oxidation wearing of the ion current detecting electrode 14 even when it is exposed to hot combustion gases, and hence to further improve the durability of the performance in detecting ion current by the glow plug 1.

(e) The ceramic heating unit 6 of the glow plug 1 (consisting of the heating element 7, the ion current detecting electrode 14 and the heat resisting insulator 8) is formed of a mixture of conductive ceramic powder ($MoSi_2$ powder) and nonconductive ceramic powder ($Si_3N_4$ powder). It is therefore possible to provide a ceramic heating unit 6 having excellent resistance to heat and wear. Such a ceramic heating unit 6 can maintain a proper starting aid function when the engine starts at low temperature.

(f) In the manufacturing process of the glow plug 1, the ceramic heating unit 6 (the heating element 7, the ion current detecting electrode 14 and the heat resisting insulator 8) is produced by molding a mixture of conductive ceramic powder and nonconductive ceramic powder, and then the ion current detecting electrode 14 is exposed to the outside by cutting the outer surface of the heat resisting insulator 8. According to this manufacturing process, the glow plug 1 having the ion current detecting function can be manufactured with such an easy way that any complicated step is not required.

(g) In the ion current detector of the embodiment, the switching circuit is provided for switching over between the heating-element running state and the ion current detecting state. Application of voltage in the two states is carried out through the common lead wire pair 11*a,* 11*b,* and switching of both states is selectively performed by the switching circuit 25. It is therefore possible to simplify the structure of the ion current detector such as wiring of the lead wires 11*a,* 11*b* connected to the heating element 7, and other circuit arrangements associated with ion current detection, thereby providing an inexpensive ion current detector.

(h) In the embodiment, the ion current detector is applied to a Diesel engine, in which one end of the battery 34 is connected to one lead wire 11*a* coupled to the heating element 7 with the other end connected to the cylinder head 45. It is therefore possible to simplify the structure of the opposed electrodes (the ion current detecting electrode 14 and the wall portion of the turbulence chamber 17) needed for detecting ion current.

(i) Since the ion current detector of the embodiment is mainly designed to detect active ions in the flame front burning in the combustion chamber of the Diesel engine, the ion current can be detected with maintaining high combustion-ion density to increase the detection accuracy. It is therefore possible to detect the combustion condition precisely, and hence to reflect the detection result on fuel injection control.

(j) In the embodiment, the battery 34 is provided for applying the supply voltage between the ion current detecting electrode 14 and the cylinder head 45 directly without passing through the switching circuit 25 (contact 23*c*). It is therefore possible to eliminate adverse effects such as noise caused by the switching action of the switching circuit 25. Resistance at each contact of the switching circuit 25 increases under oxidation, and in such a case, an increase in contact resistance involves a difficulty in detecting ion current that is originally weak. Such a difficulty, however, can be avoided according to the embodiment.

(k) In the embodiment, since a normal vehicle battery 34 is used to detect the ion current, another power source does not need to be provided for ion current detection, thereby implementing the ion current detector without complicated arrangements.

Referring next to FIGS. 12 to 25, the structure of glow plugs according to second to seventh embodiments. In each embodiment, portions common to those in the first embodiment are given identical numbers and detailed description thereof is omitted. The following embodiments will be described mainly with respect to points different from the first embodiment.

<<Second Embodiment>>

Figure 12:
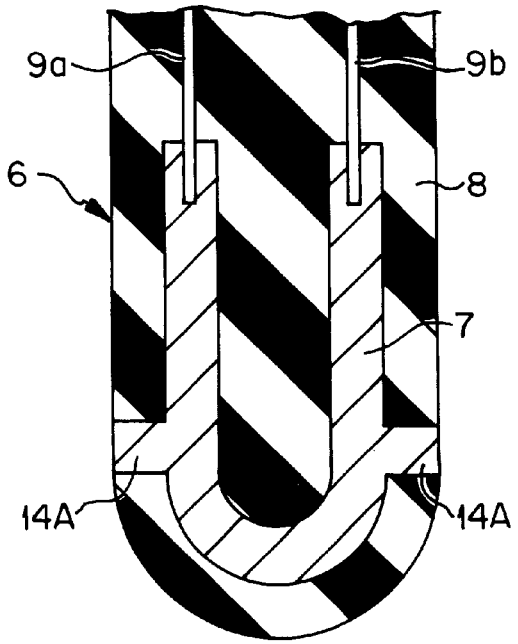
FIG. 12 is an enlarged sectional view of a glow plug according to a second embodiment.

FIG. 12 is sectional view showing the main parts of a glow plug according to the second embodiment. The glow plug 1 of the first embodiment is provided with the ion current detecting electrode 14 at the tip (round portion) of the heat resisting insulator 8, whereas the glow plug of the second embodiment is provided with an ion current detecting electrode 14A around the side of the heat resisting insulator 8. The end surface of the ion current detecting electrode 14A is exposed on the same plane as the side of the heat resisting insulator 8. Even in this case, the objects of the present invention can be achieved. The ion current detecting electrode 14A is molded as a body with the heating element 7, and both members 14A and 7 are electrically connected at all times. Since the heating element 7 itself is protected by the heat resisting insulator 8, there is no danger of impairing its heating characteristics.

<<Third Embodiment>>

Figure 13:
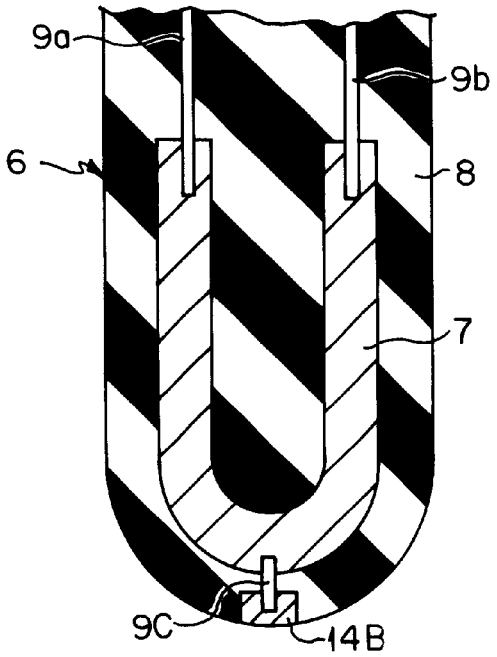
FIG. 13 is an enlarged sectional view of a glow plug according to a third embodiment.

FIG. 13 is a sectional view showing the main parts of a glow plug according to the third embodiment. In the glow plug of FIG. 13, an ion current detecting electrode 14B is electrically connected at the tip of the heat resisting insulator 8 to the heating element 7 through a lead wire 9*c*. In this case, the composition of the ion current detecting electrode 14B is the same as that of the heating element 7. Even such structure can achieve the objects of the present invention.

<<Fourth Embodiment>>

Figure 14:
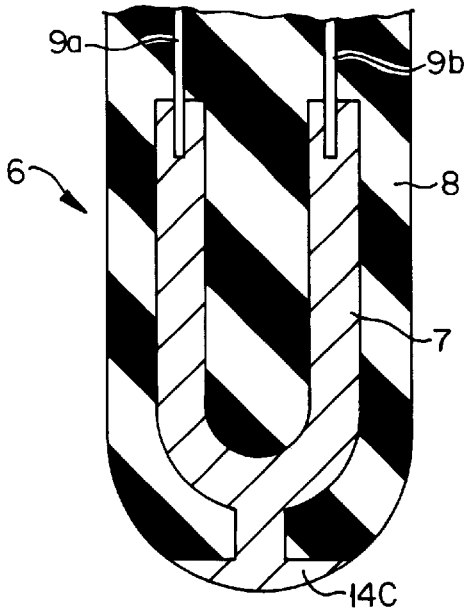
FIG. 14 is an enlarged sectional view of a glow plug according to a fourth embodiment.

FIG. 14 is a sectional view showing the main parts of a glow plug according to the fourth embodiment. As shown in FIG. 14, the glow plug of the embodiment features that the end surface of an ion current detecting electrode 14C has a relatively large area in the top portion of the heat resisting insulator 8. The ion current detecting electrode 14C is formed laterally in a straight line (not shown) as seen from the lower side. Even such structure can achieve the objects of the present invention. In particular, since the area of the ion current detecting electrode 14C exposed to the combustion flame is large, the glow plug of this embodiment can detect ion current more precisely.

Figure 15:
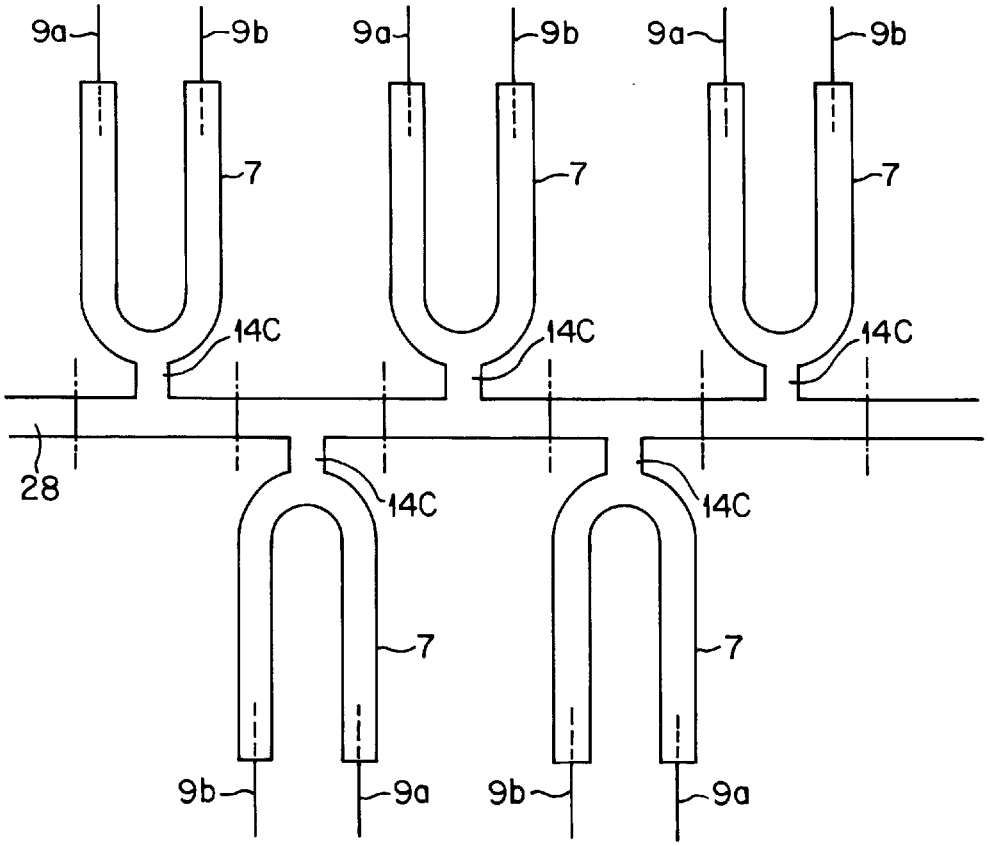
FIG. 15 is a diagram explaining the procedure for manufacturing the glow plug according to the fourth embodiment.
Figure 16:
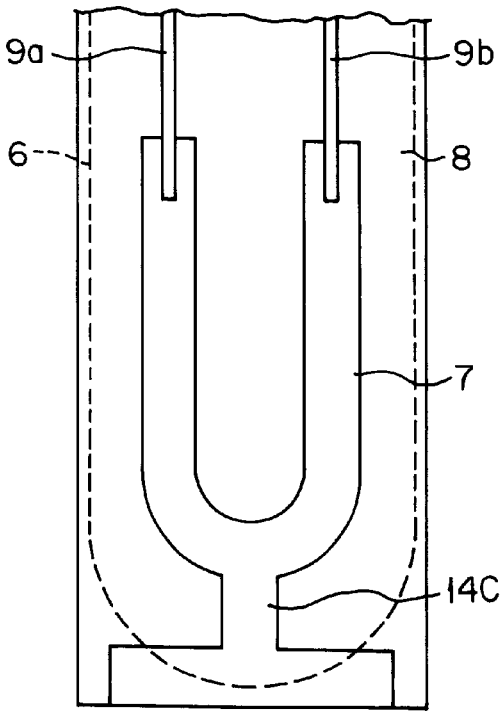
FIG. 16 is a diagram explaining the procedure for manufacturing the glow plug according to the fourth embodiment.

Description will be made here with respect to featured points of a method of manufacturing the glow plug of FIG. 14 with reference to FIGS. 15 and 16. At the beginning of the manufacturing process, the heating element 7 and the ion current detecting electrode 14C is made in the form such as shown in FIG. 15, by injection-molding a mixture of $MoSi_2$ powder and $Si_3N_4$ powder. As shown in FIG. 15, the molding process is such that plural sets of the heating elements 7 and the ion current detecting electrodes 14C are coupled together through a connecting bar 28. The connecting bar 28 is then cut part-way off (along the dot-dash line of FIG. 15) to separate each set of the heating element 7 and the ion current detecting electrode 14C from the connecting bar 28.

The set of the heating element 7 and the ion current detecting electrode 14C is surrounded with the heat resisting insulator 8 and hot-pressed at a temperature of between 1700° C. and 1800° C. The outer portion of the ceramic heating unit 6 is then cut off along the broken line of FIG. 16 to be a cylindrical shape with a round tip. At this time, the heating element 7 is completely embedded in the heat resisting insulator 8, while the end surface of the ion current detecting electrode 14C is exposed laterally in a straight line in the top portion of the ceramic heating unit 6.

<<Fifth Embodiment>>

Figure 17:
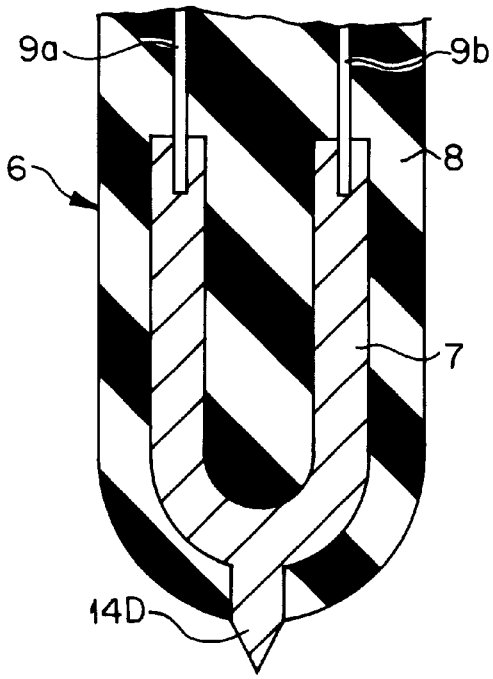
FIG. 17 is an enlarged sectional view of a glow plug according to a fifth embodiment.

FIG. 17 is a sectional view showing the main parts of a glow plug according to the fifth embodiment. Although in the above embodiments the exposed end surface of the ion current detecting electrode is formed on the same plane as the outer surface of the heat resisting insulator 8, an ion current detecting electrode 14D of this embodiment projects from the outer surface of the heat resisting insulator 8. Even such a case can achieve the objects of the present invention as is similar to the above embodiments. Besides, the ion current detection in such structure can be further improved since the exposed area of the ion current detecting electrode 14D is large. The projection of the ion current detecting electrode 14D can be formed into any shape, such as a conic, pyramid-like, cylindrical, J-type or inverted T-type shape. Plural projecting electrode may also be provided.

<<Sixth Embodiment>>

FIGS. 18A, 18B, 19A and 19B are sectional views showing the main parts of a glow plug according to the sixth embodiment. In the above embodiments, the heating element and the ion current detecting electrode are electrically connected either by molding them as a body (except in the third embodiment) or through the common lead wire pair (in the third embodiment). In contrast, this embodiment is such that the heating element and the ion current detecting electrode are separately formed and electrically connected by drawing out individual lead wires from both members (the heating element and the ion current detecting electrode), respectively.

Figure 18A:
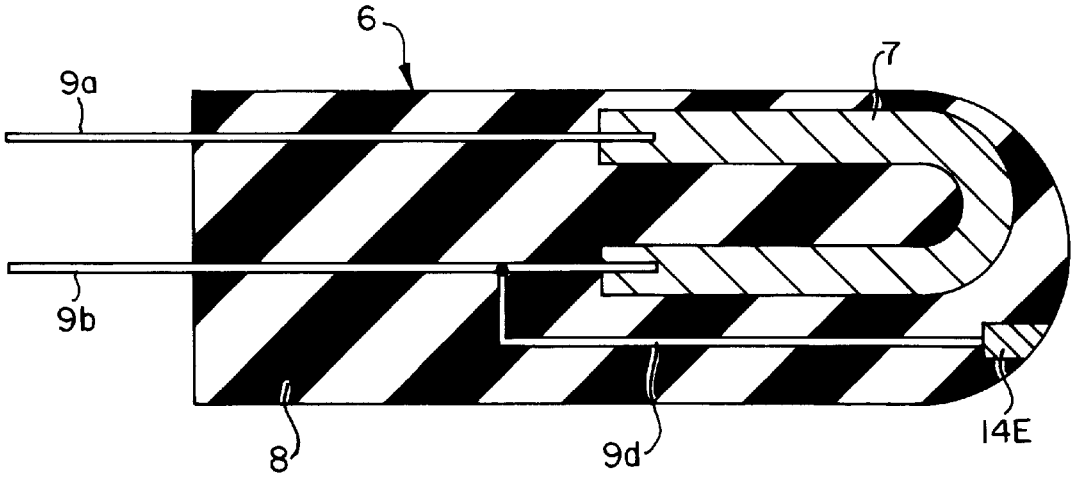
FIGS. 18A, 18B, 19A and 19B are enlarged sectional views of glow plugs according to a sixth embodiment.
Figure 18B:
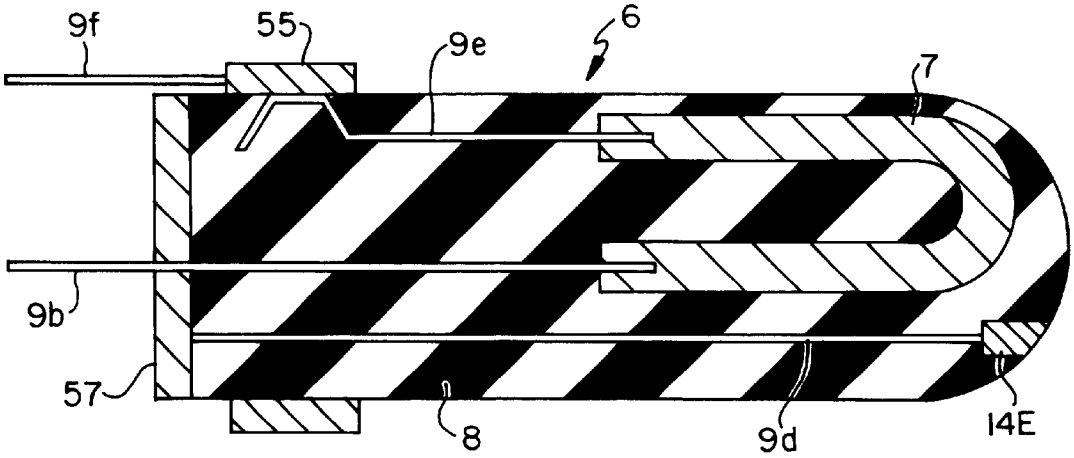

FIGS. 18A and 18B show a case in which an ion current detecting electrode 14E is provided at the tip (round portion) of the heat resisting insulator 8. In FIG. 18A, lead wires 9*a*, 9*b* are drawn out of both ends of the U-type heating element 7, with one lead wire 9*b* connected to a lead wire 9*d* from the ion current detecting electrode 14E. The connection is established inside the heat resisting insulator 8.

FIG. 18B shows slightly different structure in which wiring of the lead wires 9*b*, 9*d* and 9*e* to the heating element 7 and the ion current detecting electrode 14E are almost the same as those in FIG. 18A, but an arrangement of an external signal input portion is different. Specifically, the lead wire 9*e* is exposed on the side of the heat resisting insulator 8, and the exposed portion is connected to an external lead wire 9*f* through an annular conductor 55. The lead wires 9*b* and 9*d* are electrically connected through a conductive layer 57 provided on the end surface of the heat resisting insulator 8.

Figure 19A:
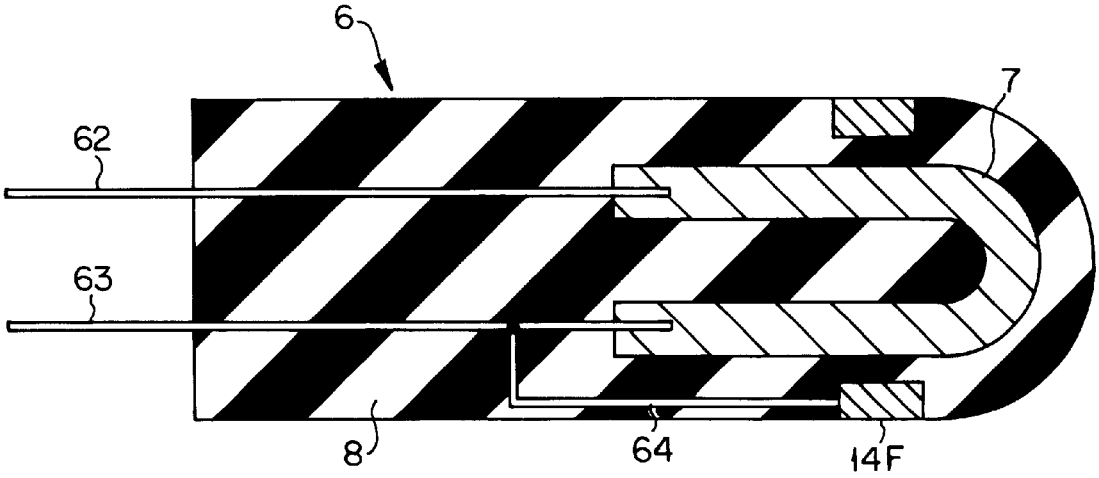
Figure 19B:
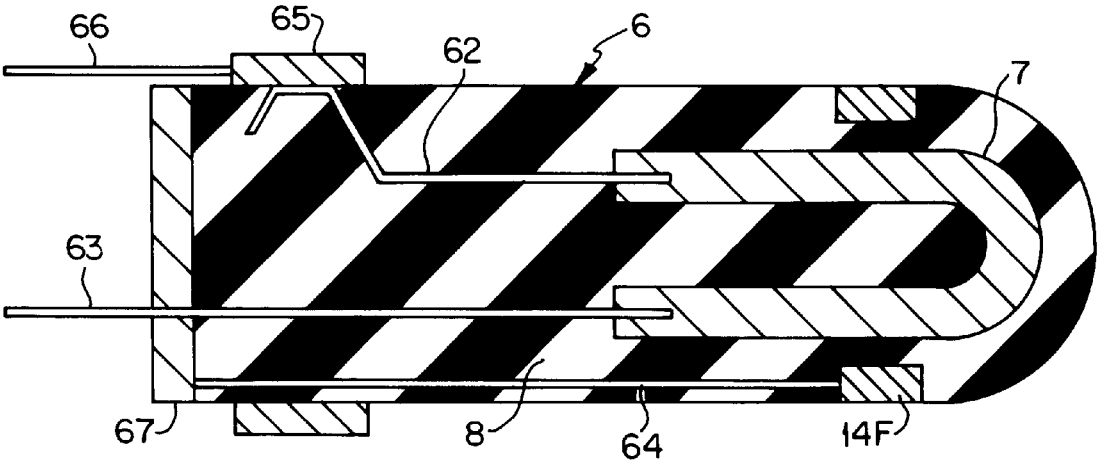

On the other hand, FIGS. 19A and 19B show a case in which an ring-shaped ion current detecting electrode 14F is provided around the side of the heat resisting insulator 8. In FIG. 19A, lead wires 62, 63 are drawn out of both ends of the U-type heating element 7, with one lead wire 63 connected to a lead wire 64 from the ion current detecting electrode 14F. The connection is established inside the heat resisting insulator 8.

In FIG. 19B, wiring of the lead wires 62–64 to the heating element 7 and the ion current detecting electrode 14F are almost the same as those in FIG. 19A, but an arrangement of an external signal input portion is different. Specifically, the lead wire 62 is exposed on the side of the heat resisting insulator 8, and the exposed portion is connected to an external lead wire 66 through an annular conductor 65. The lead wires 63 and 64 are electrically connected through a conductor 67 provided on the end surface of the heat resisting insulator 8.

In either of such cases as shown in FIGS. 18A, 18B, 19A and 19B, the glow plug can detect ion current precisely with simple structure and maintain the heating performance of the heating element 7 for long periods, as is similar to those of the above embodiments, thus obtaining desired effects of the present invention.

<<Seventh Embodiment>>

The seventh embodiment as claimed in claims 5, 8 and 9 will be next described. Although in the first to sixth embodiments the heating element and the ion current detecting electrode are electrically connected, they are electrically insulated in this embodiment. This embodiment is to embody the present invention in an ion current detector using such a glow plug.

Figure 20:
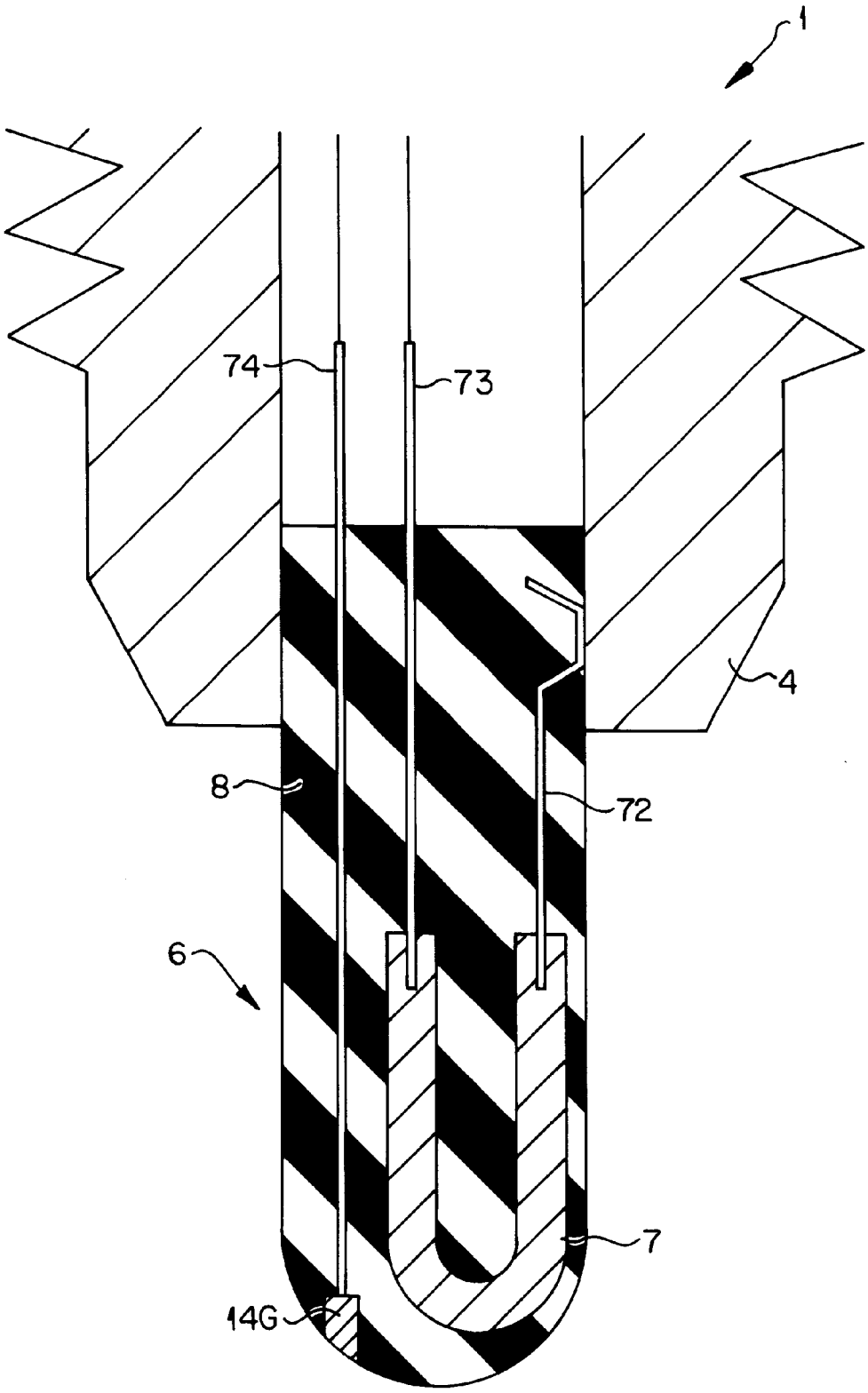
FIG. 20 is an enlarged sectional view of a glow plug according to a seventh embodiment.

FIG. 20 is a sectional view showing the main parts of a glow plug 1 according to the embodiment. In the drawing, the heating element 7 and an ion current detecting electrode 14G are embedded separately in the heat resisting insulator 8 of the ceramic heating unit 6, with a portion (top end surface) of the ion current detecting electrode 14G exposed at the tip of the heating unit 6. A pair of lead wires 72, 73 are connected to both ends of the heating element 7. One lead wire 72 is drawn out from the side of the heat resisting insulator 8 and electrically connected to the housing 4, and the other lead wire 73 is electrically insulated from the housing 4 and led to the outside of the heat resisting insulator 8. A lead wire 74 connected to the ion current detecting electrode 14G is electrically insulated from the housing 4 and the lead wire 73 of the heating element 7 and led to the outside of the heat resisting insulator 8.

Figure 21:
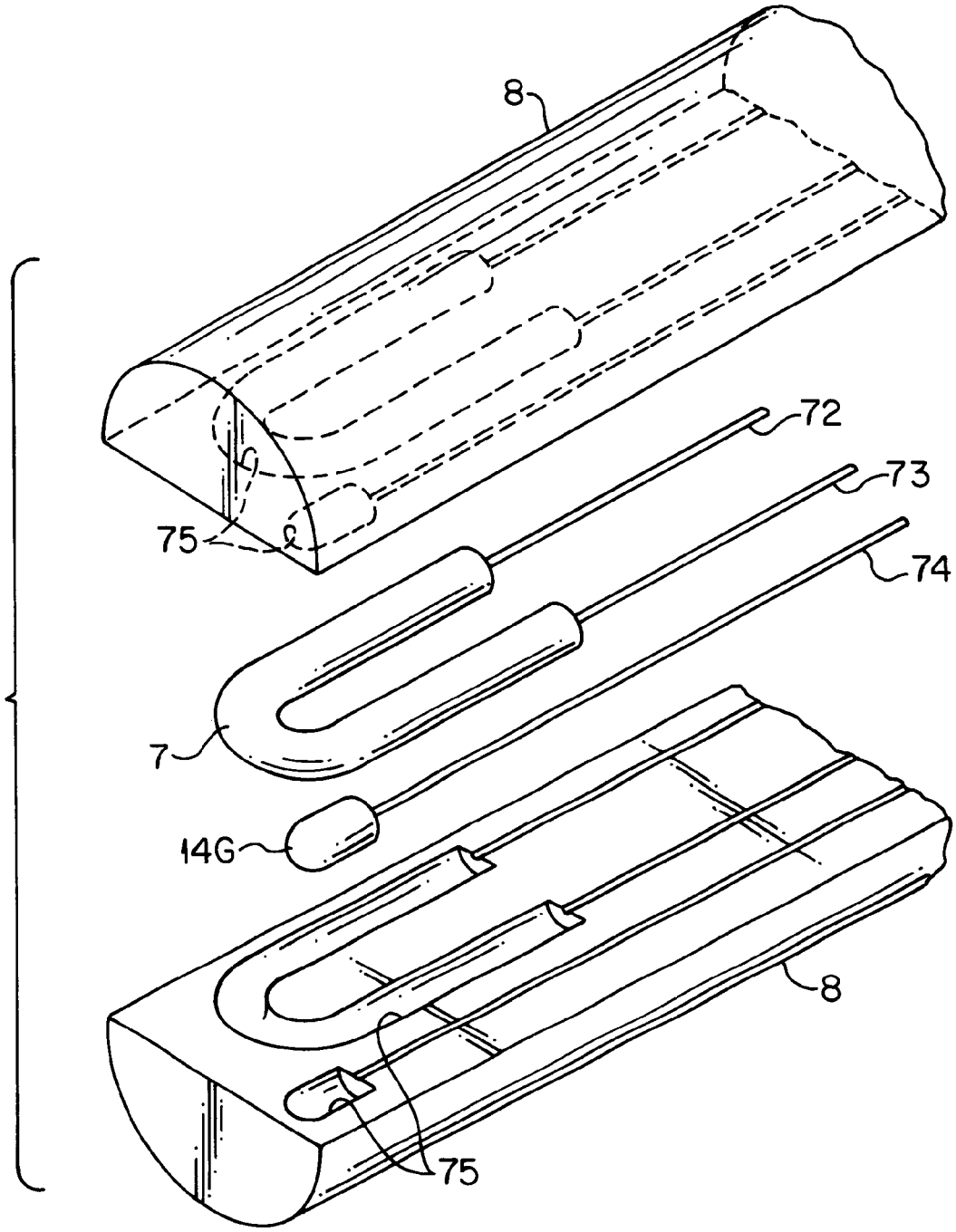
FIG. 21 is a diagram explaining the procedure for manufacturing the glow plug according to the seventh embodiment.

Description will be made here in brief with respect to the manufacturing process of the ceramic heating unit 6 with reference to FIG. 21. As is similar to the above embodiments, a binder is kneaded with respective mixtures of $MoSi_2$ powder and $Si_3N_4$ powder to form pastes. The pastes are then injection-molded into desired shapes of the heating element 7, the ion current detecting electrode 14G and the heat resisting insulator 8, respectively. In this molding process, the heat resisting insulator 8 is formed into divided semicylinders between which the heating element 7, the lead wires 72, 73 connected to the heating element 7, the ion current detecting electrode 14G and the lead wire 74 connected thereto are put in place. In other words, they are positioned and accommodated in groove portions 75 formed in the heat resisting insulator 8. After all the members, such as the heating element 7 and the ion current detecting electrode 14G, are assembled and surrounded with the heat resisting insulator 8, the assembly is hot-pressed at a temperature of between 1700° C. and 1800° C. After that, the outer portion of the ceramic heating unit 6 is cut to obtain a cylinder-like shape with a round tip. At this time, as shown in FIG. 20, the heating element 7 is completely embedded in the heat resisting insulator 8, while the end surface of the ion current detecting electrode 14G is exposed in the top portion of the ceramic heating unit 6.

Figure 22:
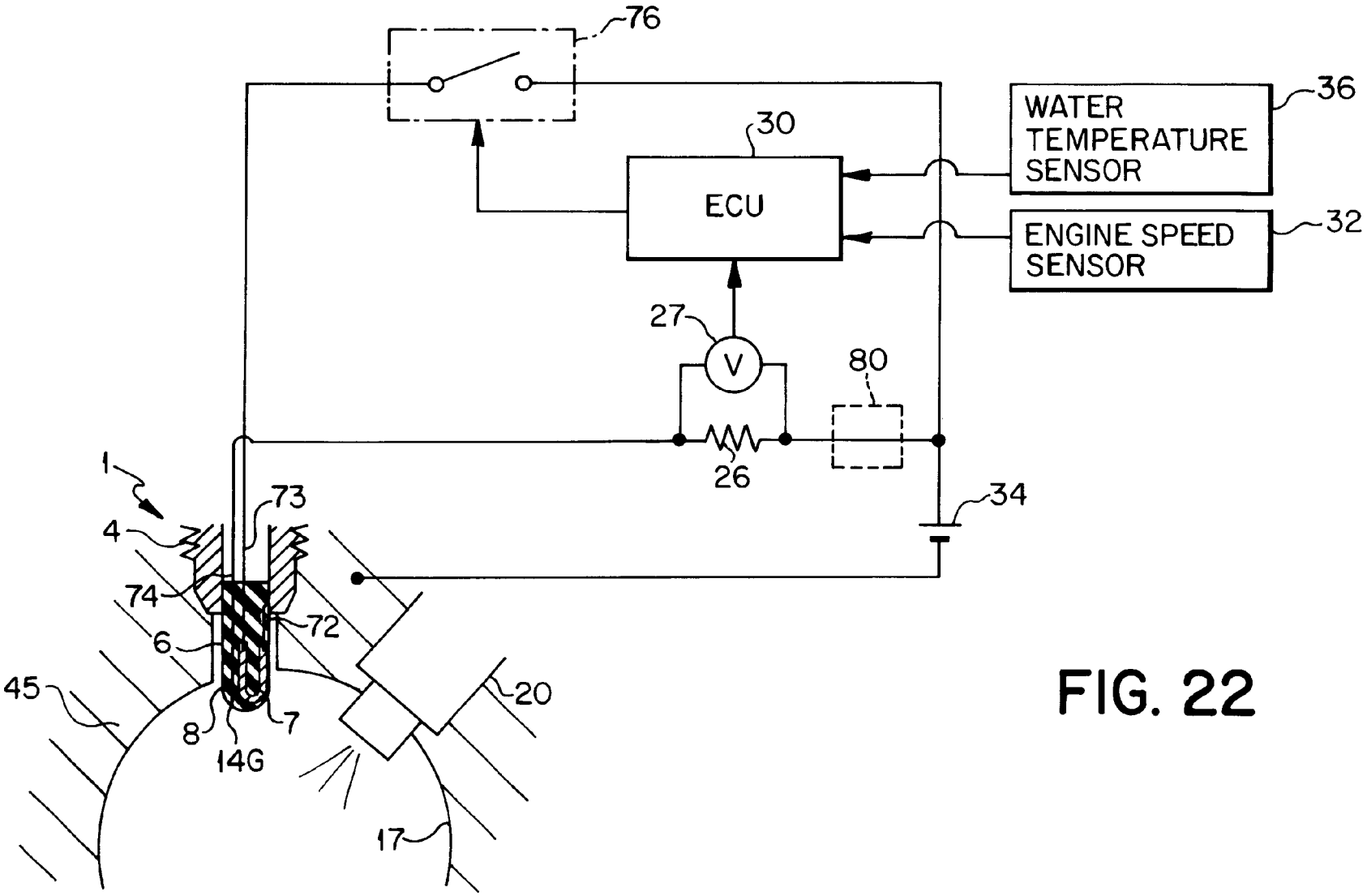
FIG. 22 is a diagram showing general structure of an ion current detecting system according to the seventh embodiment.

Referring next to FIG. 22, an ion current detecting system using the above glow plug 1 will be described. In the drawing, the housing 4 of the glow plug 1 is screwed in the cylinder head 45, and the tip of the ceramic heating unit 6 of the glow plug 1 is so arranged that it projects into the turbulence chamber 17 of the cylinder head 45. The tip of the fuel injection nozzle 20 is also provided in the turbulence chamber 17 for spraying the fuel into the turbulence chamber 17.

One lead wire 72 of the heating element 7 is grounded through the housing 4, while the other lead wire 73 is connected through a glow relay 76 to the positive side of the battery 34 having a rating of 12 volts. Although the glow relay 76 is turned ON or OFF in response to a command signal from the ECU 30, it is maintained in the OFF state in normal operation. When the glow relay 76 is turned ON in response to the command from the ECU 30, the battery 34 supplies the heating element 7 with power to make the heating element 7 run hot. When the relay 76 is turned OFF, the running state of the heating element 7 is stopped.

The lead wire 74 coupled to the ion current detecting electrode 14G is always connected to the positive side of the battery 34 through the ion current detecting resistor 26. Therefore, the ion current detection is performed each time the fuel injection nozzle 20 splays the fuel and a combustion event occurs.

The resistance of the ion current detecting resistor 26 is about 500 kΩ. The ion current flowing through the ion current detecting resistor 26 is detected by the potentiometer 27 as a potential difference between both ends of the resistor 26.

Hereinbelow, the switching process of the glow relay 76 will be described with reference to a flowchart of FIG. 23. Such processing as shown in FIG. 23 is executed by the ECU 30 when the ignition key is turned on to provide power for the engine.

Figure 23:
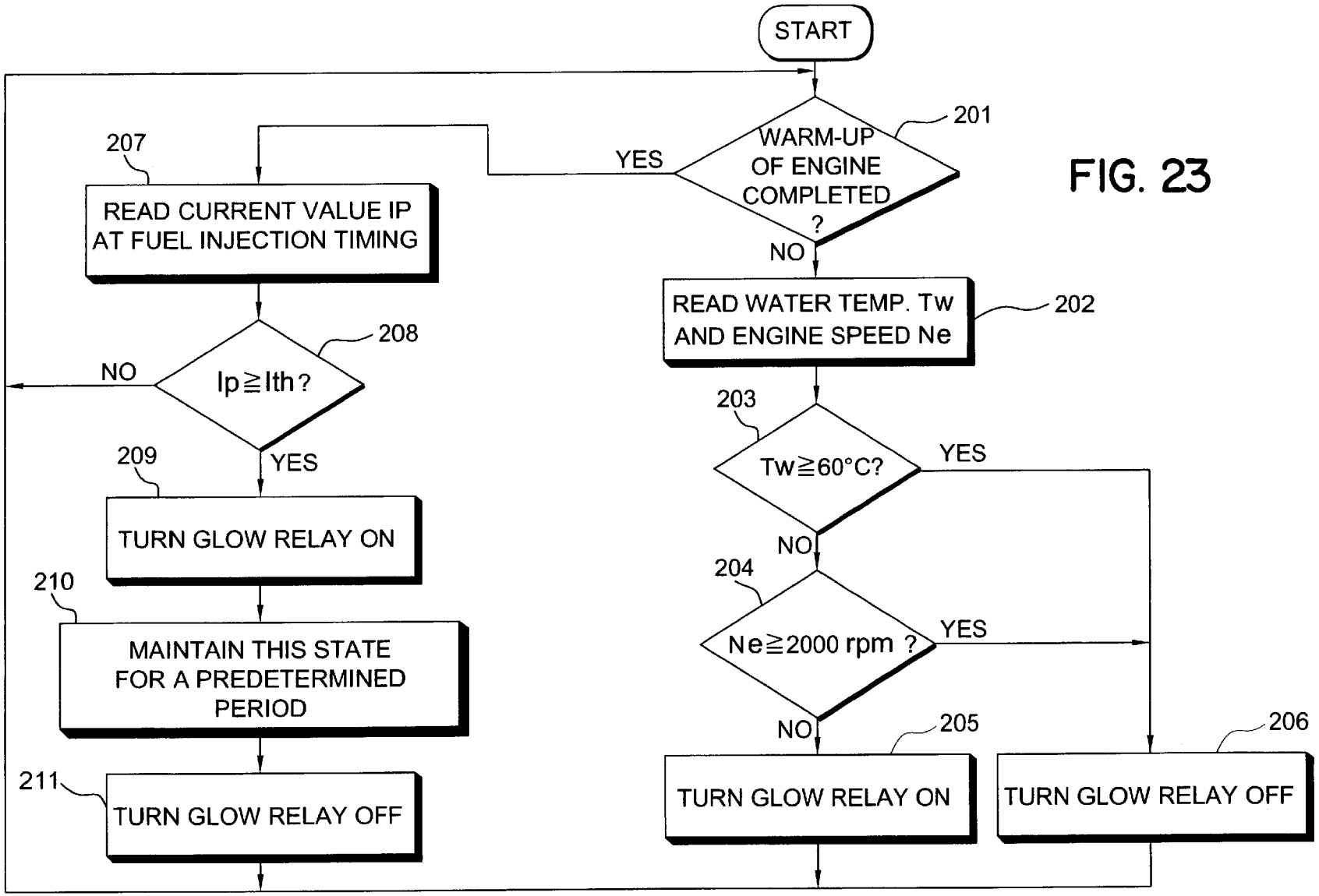
FIG. 23 is a flowchart of switching processing of a glow relay.

When starting the processing of FIG. 23, the ECU 30 determines at step 201 whether or not warm-up of the engine has been completed. Since a negative determination is made at step 201 at the beginning of engine start, the ECU 30 reads the water temperature Tw and the engine speed Ne at the subsequent step 202.

The ECU 30 then determines at step 203, whether or not the water temperature Tw is higher than a predetermined warm-up temperature (60° C. in the embodiment), and at step 204, whether or not the engine speed Ne reaches a predetermined engine speed (2000 rpm in the embodiment) or more. If negative determinations are made at both steps, the ECU 30 regards the engine as not warmed up completely so further heating by the glow plug 1 (heating element 7) is necessary, and advances the processing to step 205. If a positive determination is made at either step 203 or step 204, the ECU 30 regards the engine as having been warmed up completely, or heating by the glow plug 1 (heating element 7) as being unnecessary, and advances the processing to step 206.

In the case the processing goes to step 205, the ECU 30 keeps the glow relay 76 in the On state, and returns the processing to step 201. In this state, ignition and combustion of fuel is promoted by the heating action of the glow plug 1.

In the case the processing goes to step 206, the ECU 30 changes the glow relay 76 from the ON state to the OFF state, and returns the processing to step 201. The case where a positive determination is made at step 204 and the processing goes to step 206 includes a case, for example, where the engine is in a racing state and the engine speed Ne temporarily rises. In such a case, the glow relay 76 is returned to the ON state (heating-element running state) again (step 205) once the engine speed Ne stops its temporal rise.

When the water temperature Tw becomes equal to or higher than 60° C. and warm-up of the engine is completed, the ECU 30 turns the glow relay 76 to be OFF state (step 206), makes a positive determination at step 201, and advances the processing to step 207. Then, at step 207, the ECU 30 reads a current value Ip, detected by the ion current detecting resistor 26, at the timing of fuel injection at which the fuel injection nozzle 20 sprays the fuel, and at the subsequent step 208, it determines whether or not the current value Ip is a given threshold Ith or more. The current value Ip corresponds to a leakage current due to the carbon adhered to the outer surface of the ceramic heating unit 6.

In the case a negative determination is made at step 208 (Ip<Ith), the ECU 30 returns the processing to step 201. In this case, the ECU 30 regards the carbon as not adhering to the outer surface of the ceramic heating unit 6, or as being allowable, so that the glow relay 76 is maintained in the OFF state.

In the case a positive determination is made at step 208 (Ip≧Ith), the ECU 30 advances the processing to step 209 and changes the glow relay 76 from the OFF state to the ON state (heating-element running state). In this case, since it is considered that the carbon adhered to the outer surface of the ceramic heating unit 6 exceeds tolerable quantity, the insulation resistance between the ion current detecting electrode 14G and the grounded side (the housing 4 and the cylinder head 45) is reduced by the adhered carbon and a leakage current flows (where Ip≧Ith). Therefore, the glow relay 76 is turned ON and the heating element is made hot to burn off the adhered carbon.

After that, the ECU 30 maintains the glow relay 76 in the ON state for a predetermined period of time (two seconds in the embodiment) at step 210, and returns it to the OFF state at the subsequent step 211. After returning to step 201 again, the ECU 30 performs optimum ON/OFF control of the glow relay 76 while monitoring the leakage current at step 207.

In the embodiment, the glow relay 76 constitutes switching means as claimed. The processing step 207 corresponds to leakage current detecting means as claimed and the processing steps 208–211 correspond to operation means as claimed.

Figure 24A:
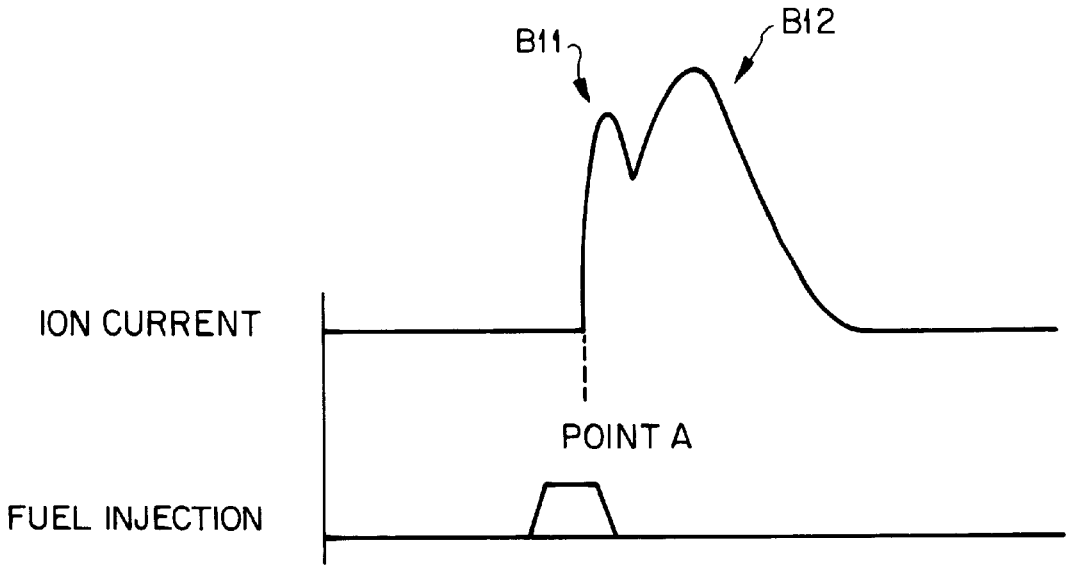
FIGS. 24A and 24B are graphs showing examples of ion current waveforms.
Figure 24B:
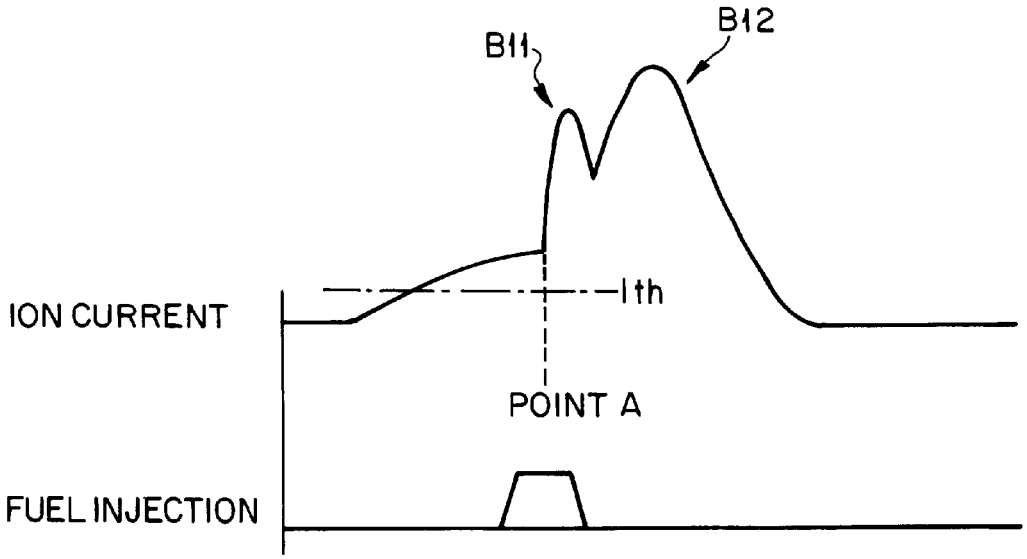

FIGS. 24A and 24B are charts of current waveforms resulting from the observation of ion current with an oscilloscope, the ion current produced when burning the fuel. FIG. 24A shows a case where no carbon adheres to the outer surface of the ceramic heating unit 6, and FIG. 24B shows a case where an amount of carbon adheres to the outer surface of the ceramic heating unit 6.

In FIG. 24A, a portion of the waveform with the voltage suddenly rising immediately after the timing period of fuel injection is of an ion current due to fuel combustion. In this waveform, point A shows a combustion start position, which corresponds to an ignition stage. In the timing period of fuel injection, the current value is kept at about "0". The waveform has two peaks: the one, first peak B11, created by active ions in the diffused flame front, is observed early in the combustion event; and the other, second peak B12, created by a re-ionization effect due to an increase in internal pressure of the cylinder, is observed in the middle and late stages of the combustion event.

The ECU 30 detects an actual ignition stage from the first peak B11 of the ion current waveform to perform feedback control of the ignition stage in such a manner that the actual ignition stage detected is made correspondent to a target ignition stage. The ECU 30 also detects a combustion condition, such as abnormal combustion or flame failure, from the second peak B12 of the ion current waveform to reflect the detection result on the fuel injection control. The result of the ion current detection is thus reflected on the fuel injection control so that the engine operation can be controlled precisely.

In FIG. 24B, a leakage current exceeding the accepted level (the threshold value Ith) is observed in the timing period of the fuel injection. In this state, the adhered carbon is removed by the heating action of the heating element 7 (steps 209 to 211 of FIG. 23). If the adhered carbon is left as it is, the leakage current value gradually increases and the increased value of the leakage current may involve a difficulty in discriminating the second peak B12 from the first peak B11. Such a difficulty, however, can be avoided according to the embodiment.

Figure 25:
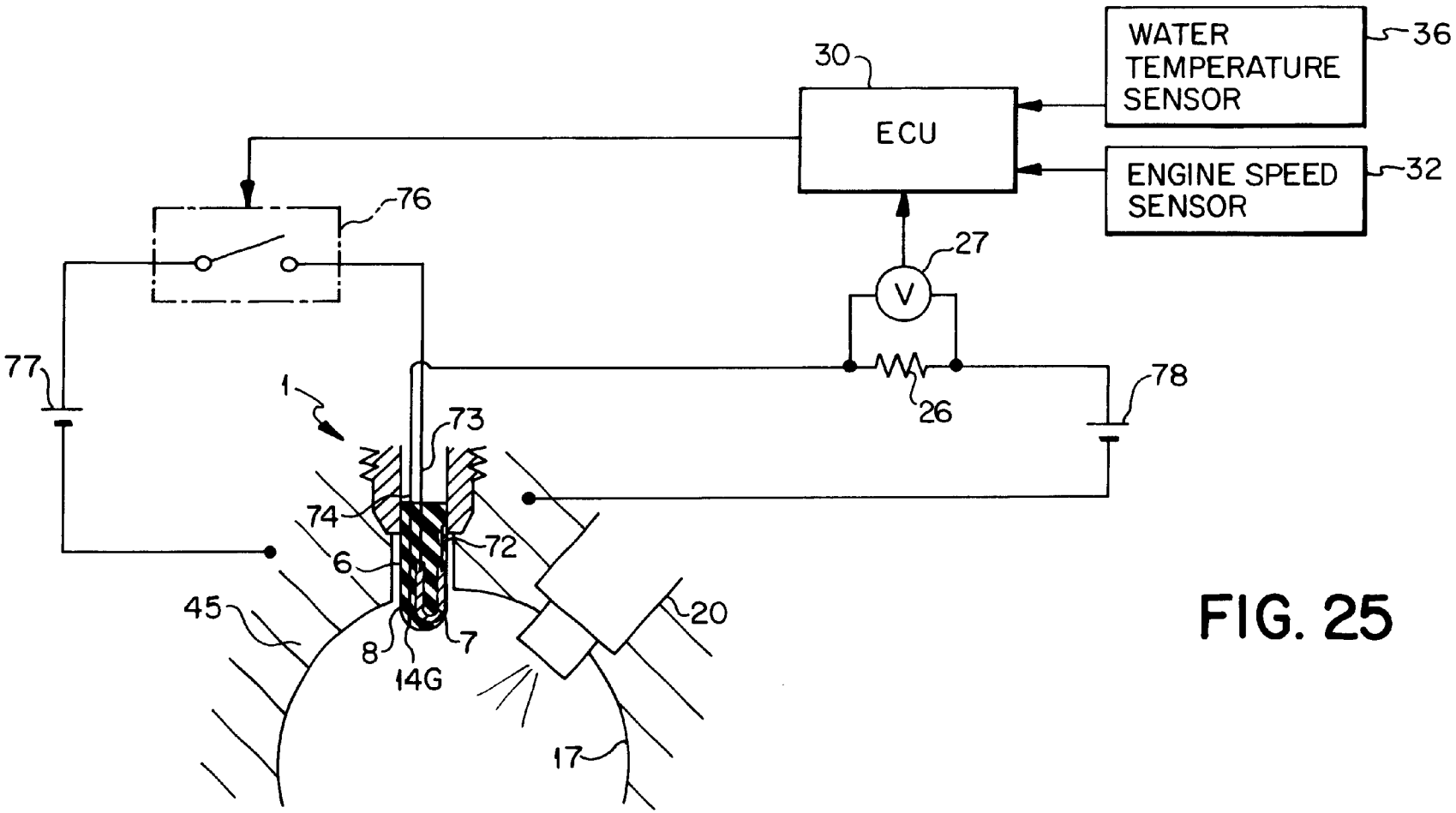
FIG. 25 is a diagram showing general structure of another ion current detecting system according to the seventh embodiment.

The ion current detecting system of the embodiment may be constructed as shown in FIG. 25. In FIG. 25, there are provided two DC power sources: one a heating-element power source 77 for energizing the heating element 7 to generate heat, and the other an ion current detecting power source 78 for detecting ion current. In this case, the glow relay 76 turning the glow plug 1 ON or OFF is provided between one lead wire 73 of the heating element 7 and the heating-element power source 77, while the ion current detecting resistor 26 is provided between the lead wire 74 of the ion current detecting electrode 14G and the ion current detecting power source 78. Even such structure can control the heating action of the heating element 7 while detecting ion current at all times. As an example, a 12-volt DC power source (typical vehicle battery) is used as the heating-element power source 77 and a 50-volt DC power source is used as the ion current detecting power source 78.

As discussed above, according to the seventh embodiment, the ion current can be detected precisely with very simple structure as is similar to the above embodiments, and besides, the following effects can also be obtained.

(I) The glow plug 1 of the embodiment is constructed by insulating the heating element 7 from the ion current detecting electrode 14G. Since the heating element 7 and the ion current detecting electrode 14G are energized through individual paths, respectively, the ion current detecting electrode 14G can detect ion current synchronously with the heating action of the heating element 7 (i.e., the combustion condition can be grasped).

(II) In the embodiment, a current value Ip indicative of a leakage current is detected in the timing period of fuel injection, and if the current value Ip detected is more than a predetermined threshold Ith, the glow relay 76 will be operated to make the heating element 7 generate heat temporarily (steps 209 to 211 of FIG. 23). In other words, the carbon adhered state of the outer surface of the ceramic heating unit 6 is estimated based on the current value Ip indicative of the leakage current, and if the amount of adhered carbon is regarded as exceeding an accepted value, the adhered carbon will be burnt off by the heating action of the glow plug 1. As a result, a desired waveform of ion current can be obtained at all times, and the detection result can be used for precise processings such as ignition stage detection and flame failure detection. Even in this case, the adhered carbon can be removed effectively without stopping the ion current detection.

(III) In the embodiment, the leakage current (current value Ip) is detected in the timing period of fuel injection. The timing period of fuel injection corresponds to a period that elapses between the moment pressure in the combustion chamber of the Diesel engine rises and the moment just before the fuel burns. It is therefore possible to detect a leakage current securely under such a condition that the carbon adhered.

The present invention can also be realized in the following embodiments other than the above embodiments.

(1) Although in the above embodiments the heating element and the ion current detecting electrode are constructed of a mixture (a mixture of small $MoSi_2$ powder and large $Si_3N_4$ powder) having the same composition (same grain size), they may be constructed of individual mixtures having different composition. By changing the composition between both members, the heating element and the ion current detecting electrode can vary in resistance from each other. For example, the grain size of $MoSi_2$ powder used as a conductive ceramic powder in the ion current detecting electrode can be made larger than that in the heating element (or grain size of $Si_3N_4$ powder in the ion current detecting electrode can be made smaller than that in the heating element) to increase the resistance. Such divided production is carried out depending on the application.

Figure 26:
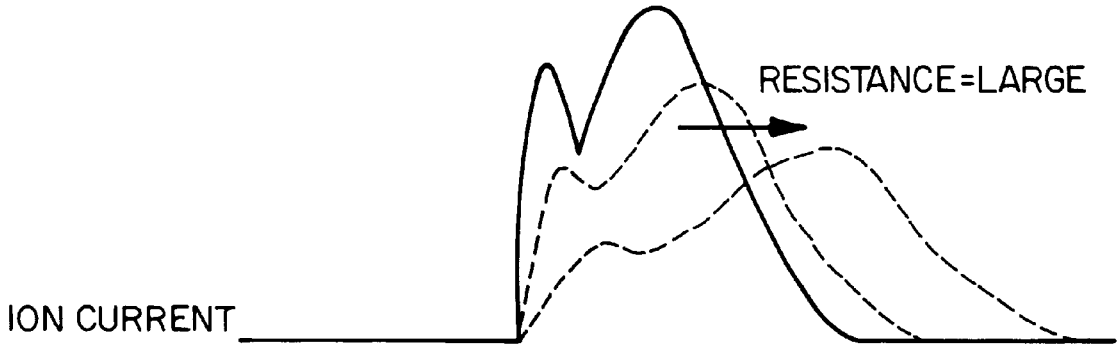
FIG. 26 is a chart explaining a relationship between resistance and ion current waveform of an ion current detecting electrode.

In the case where the result of ion current detection is used for flame failure detection, only the present or absence of ion current is required for the determination. In such a case, it is possible to increase the resistance of the ion current detecting electrode to a relatively large value, e.g., 5 MΩ or less (1Ω with the heating element). In the case where the result of ion current detection is used for ignition stage detection, it is desirable to reduce the resistance of the ion current detecting electrode as small as possible (500 kΩ or less) since the leading edge of ion current must be detected for an instant. As shown in FIG. 26, the leading edge of ion current becomes gentle as the resistance of the ion current detecting electrode increases.

(2) In the above embodiments, the heating element and the ion current detecting electrode are produced dividedly from the heat resisting insulator by changing the grain size and the mixing ratio between $MoSi_2$ powder as a conductive ceramic powder and $Si_3N_4$ powder as a nonconductive ceramic powder. Such production may be changed, e.g., only either the grain size or the mixing ratio may be changed between $MoSi_2$ powder and $Si_3N_4$ powder to produce both members dividedly. If the condition $MoSi_2$ powder<$Si_3N_4$ powder is set in the grain size, the resistance becomes small enough to obtain a material for molding the heating element and the ion current detecting electrode as a conductive member. On the contrary, if the condition $MoSi_2$ powder>$Si_3N_4$ powder is set in the grain size, the resistance becomes large enough to obtain a material for molding the heat resisting insulator as an insulation member. With the change of mixing ratio between powders, the resistance becomes small as the mixing ratio of $MoSi_2$ powder increases, whereas it becomes large as the mixing ratio of $Si_3N_4$ powder increases.

(3) In the above embodiments, the glow plug 1 may be a two-wire glow plug with two terminals provided at one end. In this case, the conductive lead wires 11*a*, 11*b* are electrically connected to the two terminals, respectively.

(4) In the first embodiment, the switching circuit 25 having two 2-position switches 25 is provided in the ion current detecting system for switching over between the heating-element running state and the ion current detecting state (see FIGS. 7 and 8). Such an arrangement in the ion current detecting system may be changed. In other words, other means can be used instead such as a semiconductor switch (transistor, thyristor or the like) capable of handling high DC current, as long as the means has the ability to switch over between the two states. With the ion current detecting system of the seventh embodiment (FIGS. 22 and 25), the glow relay 76 as switching means may also be replaced by other means such as a semiconductor switch.

(5) Although in the first embodiment a common DC power source (vehicle battery 34) is used in both the heating-element running state and the ion current detecting state, two DC power source may be used. Stated more specifically, a heating-element power source for energizing the heating element 7 to generate heat and an ion current detecting power source for detecting ion current are prepared. For example, a 12-volt DC power source (vehicle battery) is used as a heating-element power source and a 50-volt DC power source is used as an ion current detecting power source.

(6) In the first embodiment, the switching circuit 25 is operated to switch over between the heating-element running state and the ion current detecting state according to the control program (routine in FIG. 9) executed by the ECU 30. Such a programmed operation of the switching circuit 25 may be changed. For example the system may be maintained in the heating-element running state only for a predetermined period of time (one or two minutes) after starting the engine, and automatically changed from the heating-element running state to the ion current detecting state when the predetermined time has elapsed. Otherwise, the two states may be switched mechanically, i.e., a bimetal and a switch operated upon deformation of the bimetal may be adopted to switch over between the two states.

(7) In the case the heating element and the ion current detecting electrode are constructed separately as in the sixth and seventh embodiments, the ion current detecting electrode may be produced from the following materials.

(7-1) The ion current detecting electrode is constructed of a refractory metal. Since the heating element generates heat at a temperature of between 1000° C. and 1200° C., the metal preferably has a melting temperature of 1300° C. or higher. As such a refractory metal, noble metals, such as Ir, Rh, Ru and Os, or its alloy are cited. Since such noble metals never form nitride or silicide from silicon nitride, the ion current detecting electrode can exhibit a high degree of sintering and excellent durability.

Use of an alloy of noble metal and base metal. In this case, the thermal expansion coefficient of the ion current detecting electrode can be easily controlled.

Use of a metal or its alloy having a melting temperature of 1300° C. or higher (e.g., Ni, Co, W, Mo or Ti). In this case, the ion current detecting electrode can be manufactured at low cost, and besides, it has the ability to easily control the thermal expansion coefficient as is similar to that in the above case.

Use of a mixture of a powder consisting of a metal or its alloy having a melting temperature of 1300° C. or higher (e.g., Ni, Co, W, Mo or Ti), and a conductive ceramic material. In this case, it is possible to obtain an ion current detecting electrode exhibiting good junction with an insulator.

(7-2) The ion current detecting electrode is constructed of a conductive ceramic material. For such a conductive ceramic material, metallic silicide, boride, carbide and nitride, or a mixture of such compounds are cited. In this case, the ion current detecting electrode can be baked simultaneously with a nonconductive ceramic material to improve the workability. The conductive ceramic material can also be mixed with a nonconductive ceramic material such as $Al_2O_3$, sialon (Si—Al—O—N compounds, e.g., $Si_3N_4$ and $Al_2O_3$) and BN.

(7-3) The ion current detecting electrode is constructed of conductive glass.

(7-4) The ion current detecting electrode is constructed of a semiconductor material (e.g., $SiC+Si_3N_4$). Such a material acts as an insulator at room temperature and as an ion current detecting electrode at a high temperature.

Figure 27:
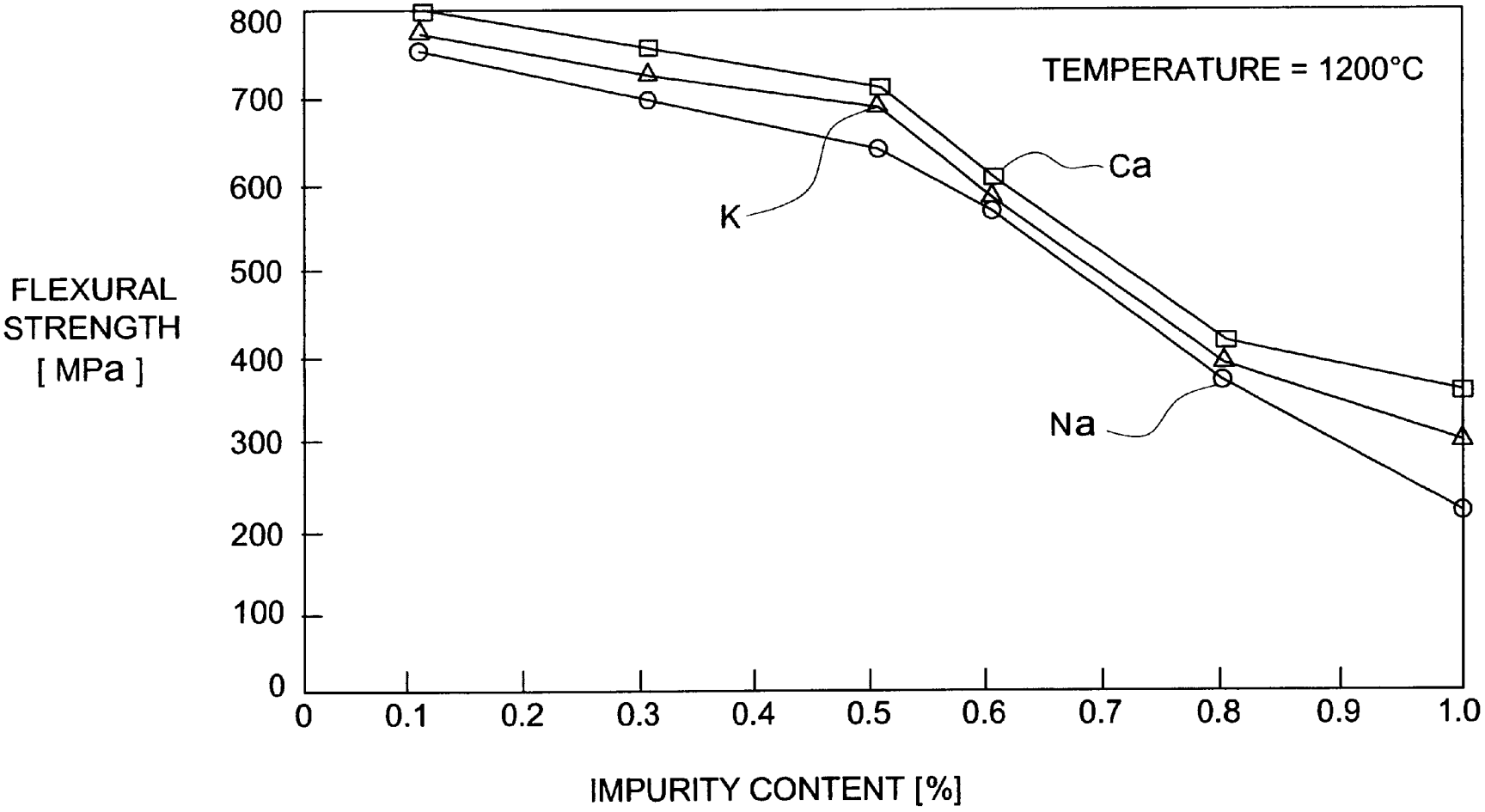
FIG. 27 is a graph showing a relationship between the content of impurities Ca, K and Na and the flexural strength under a high-temperature condition of 1200° C.
Figure 28:
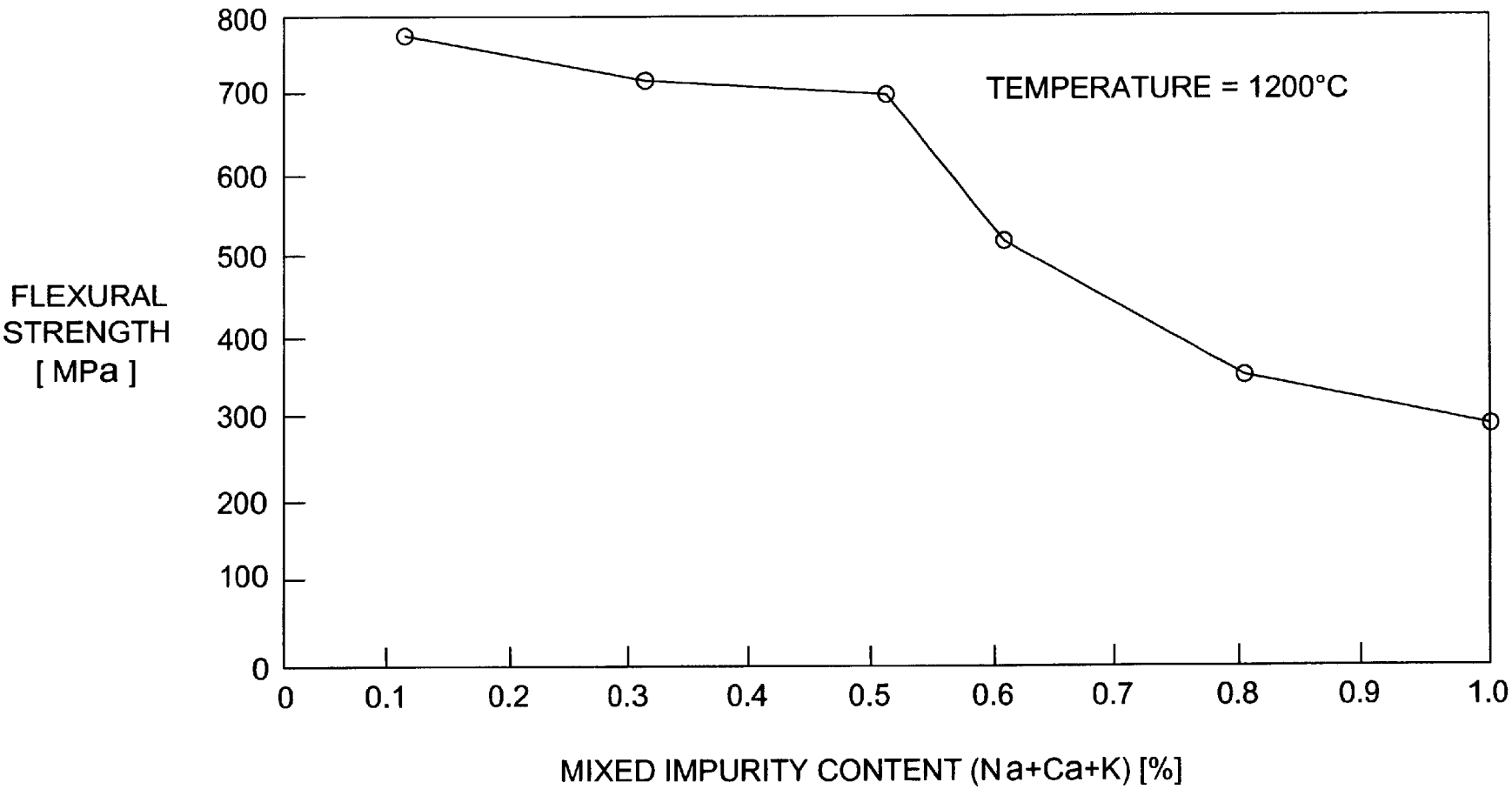
FIG. 28 is a graph showing a relationship between the content of a mixture of Na+Ca+K impurities and the flexural strength under the high-temperature condition of 1200° C.
Figure 29:
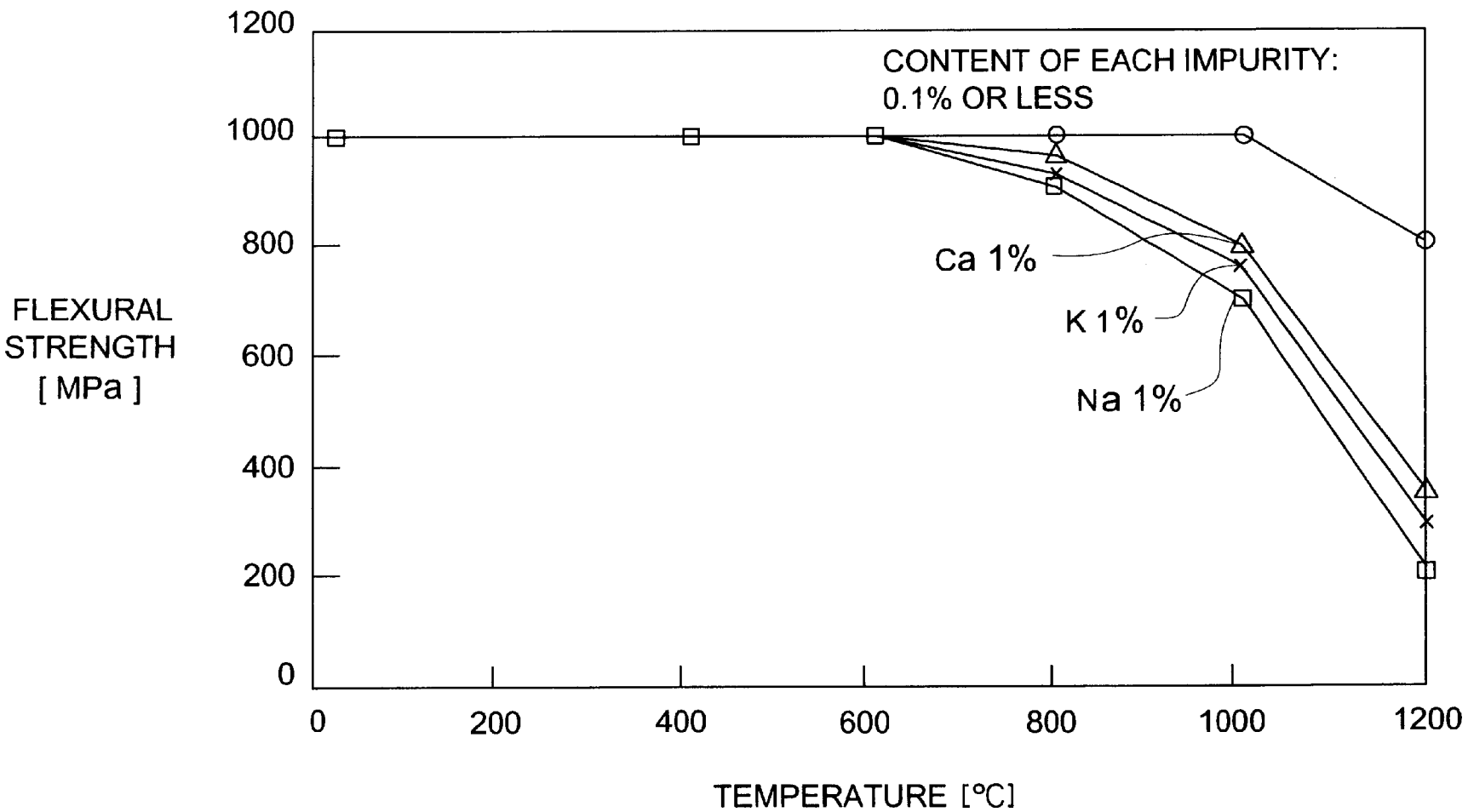
FIG. 29 is a graph showing a relationship of flexural strength of alloys with respect to temperature, each alloy containing less than 0.1% of impurities, 1% Ca, 1% K or 1% Na.

(7-5) The ion current detecting electrode is constructed of an alloy that contains a small percentage of impurities such as Na, Ca, K and Mg, the percentage being less than a given value (e.g., 0.5% or less). In this case, the high temperature resistance of the ion current detecting electrode increases to improve resistance to thermal shock. FIGS. 27 to 29 are graphs of experimental results, each of which shows the relationship between impurity content and flexural strength. FIG. 27 is a graph showing a relationship between the content (%) of impurities Ca, K and Na and the flexural strength (MPa) under a high-temperature condition of 1200° C. According to the graph, a sufficient flexural strength (about 700 MPa) can be obtained in the case each impurity content is 0.5% or less. FIG. 28 is a graph showing a relationship between the content (%) of a mixed impurity of Na+Ca+K and the flexural strength (MPa) under the high-temperature condition of 1200° C. According to the graph, a sufficient flexural strength (about 700 MPa) can be obtained in the case the mixture content is 0.5% or less. FIG. 29 is a graph showing the flexural strength (MPa) of alloys with respect to temperature (° C.), each alloy containing less than 0.1% of impurities, 1% Ca, 1% K or 1% Na. According to the graph, the highest flexural strength (high temperature strength) is found in the alloy with impurity content of 0.1% or less, and this experimental result indicates that the high temperature strength increases as the impurity content decreases.

(8) Although in the above embodiments the ion current detecting electrode is injection-molded, it may be formed by a printing technique (such a printing technique may also be used for formation of the heating element 7). Further, the electrode may be molded as a sinter to be incorporated into the heat resisting insulator. In manufacturing the glow plug 1, the following methods (8-1), (8-2) and (8-3) may be applied as well.

Figure 30A:
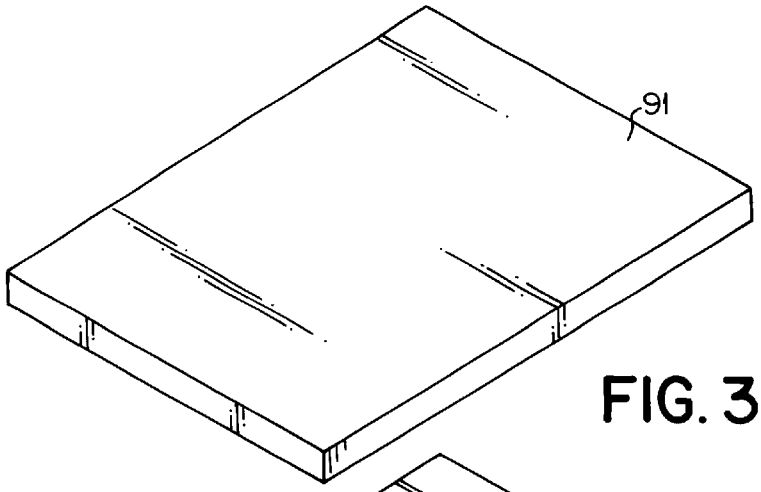
FIGS. 30A, 30B, 30C and 30D are perspective views explaining the procedure for manufacturing the glow plug in other way.
Figure 30B:
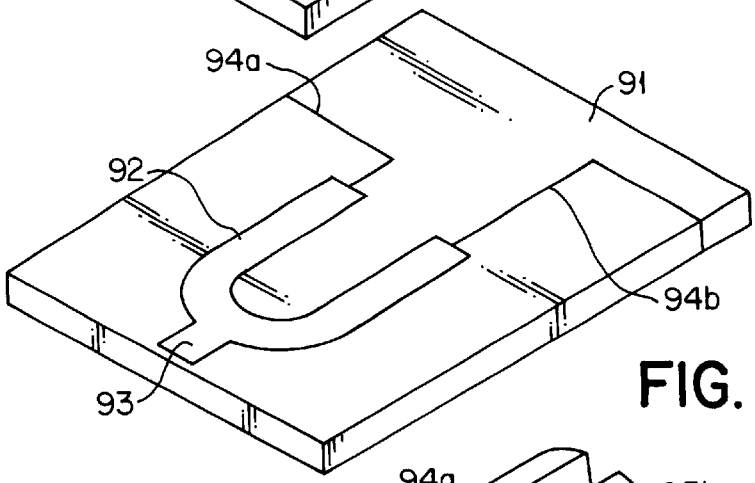

(8-1) FIGS. 30A to 30D show a manufacturing process in which a heat resisting insulation sheet is rolled into a cylindrical shape to form a ceramic heating unit 6. In this process, raw materials such as a ceramic material and a resin binder are mixed and a thin-plate like sheet 91 is formed (FIG. 30A). Then, a heating element portion 92 and an ion current detecting electrode portion 93 are printed on the sheet 91, as shown in FIG. 30B, by a screen printing technique. The ion current detecting electrode 93 is formed into a shape projecting from the tip of the U-type portion of the heating element 92. Lead wire portions 94*a* and 94*b* are also printed thereon. Under such a condition as shown in FIG. 30B, a coating material, composed of a ceramic material and a resin binder, is printed on the face of the sheet 91. Such coating is carried out for the purpose of elimination of difference in step height between the printed portion and the sheet face and improvement in adhesion of the sheet 91 to a solid shaft in the process of rolling the sheet as described later. Terminal portions 95*a* and 95*b* are also printed with a conductive paste on the back face of the sheet 91 so that the lead wire portions 94*a* and 94*b* will be electrically connected thereto.

Figure 30C:
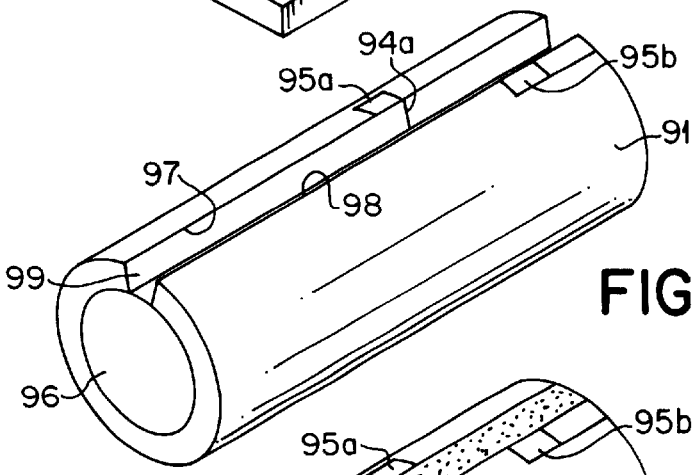

On the other hand, a column-like solid shaft 96 is formed of the same materials as the sheet 91 (i.e., a mixture of ceramic material and a resin binder). The solid shaft 96 is then wrapped with the sheet 91 as shown in FIG. 30C. The sheet 91 is so wrapped around the solid shaft 96 that the sheet face on which the heating element portion 92 and the ion current detecting electrode portion 93 are printed will be rolled inwardly. In FIG. 30C, a groove portion 99 extending in the axial direction is formed between both of rolled-directional end surfaces of the sheet 91. The groove portion 99 is formed by setting the width of the sheet 91 to be smaller than the outside diameter of the solid shaft 96. Alternatively, the groove portion 99 may be formed such that, after both end surfaces of the sheet 91 have been joined together, one end surface, overlapped with the other end surface, is cut axially to form the groove portion 99 between both end surfaces.

Figure 30D:
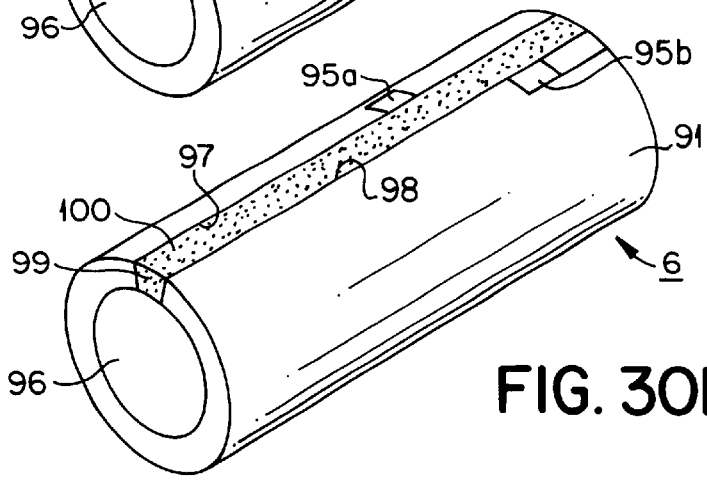
Figure 31:
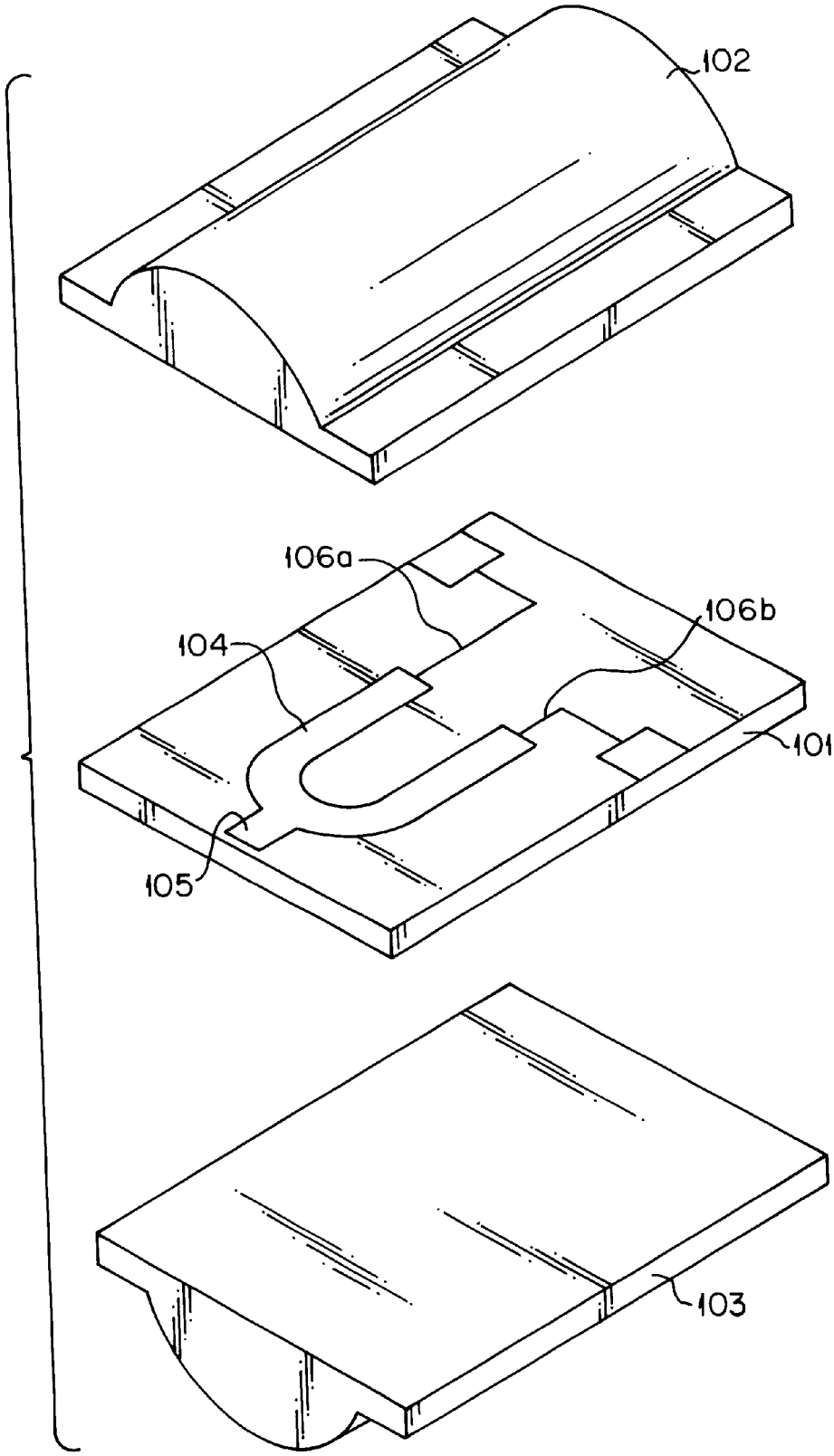
FIG. 31 is a perspective view explaining the procedure for manufacturing the glow plug in other way.

After that, the groove portion 99 is filled with an insulating coating 100, made of a ceramic material, as shown in FIG. 30D. The sheet 91 and the solid shaft 96 are degreased by preheating, then, baked by heating to form one unit. The sheet 91 and the solid shaft 96 are adhered and joined together due to firing shrinking, and hence the groove portion 99 is made narrow. The terminals 95*a* and 95*b* connected to the lead wire portions 94*a* and 94*b* are plated with Cu and Ni. Finally, the top portion of such a column body as shown in FIG. 30D is cut into a spherical shape, thus obtaining a ceramic heating unit 6 like that shown in FIG. 2. In this case, the heating element 7 (heating element portion 92) is completely embedded in the heat resisting insulator 8 (sheet 91; solid shaft 96), while the end surface of the ion current detecting electrode 14 (ion current detecting electrode portion 93) is exposed in the top portion of the ceramic heating unit 6.

(8-2) FIGS. 31 and 32A–32C shows a manufacturing process in which a plurality of heat resisting insulation members are laminated to form a ceramic heating unit 6. In this process, a thin-plate like first layer member 101, and semicylinder-like second and third layer members 102, 103 are first prepared. The first to third layer members 101–103 are products (green sheets) of nonconductive ceramic material which are produced by press-molding a mixture of raw materials such as a ceramic material and a resin binder. With the first layer member 101, a heating element portion 104 and an ion current detection electrode 105 are printed on the face side by a screen printing technique using a conductive paste. The ion current detecting electrode 105 is formed into a shape projecting from the tip of the U-type portion of the heating element 104. Lead wire portions 106*a* and 106*b* are also printed thereon with a conductive paste.

Figure 32A:
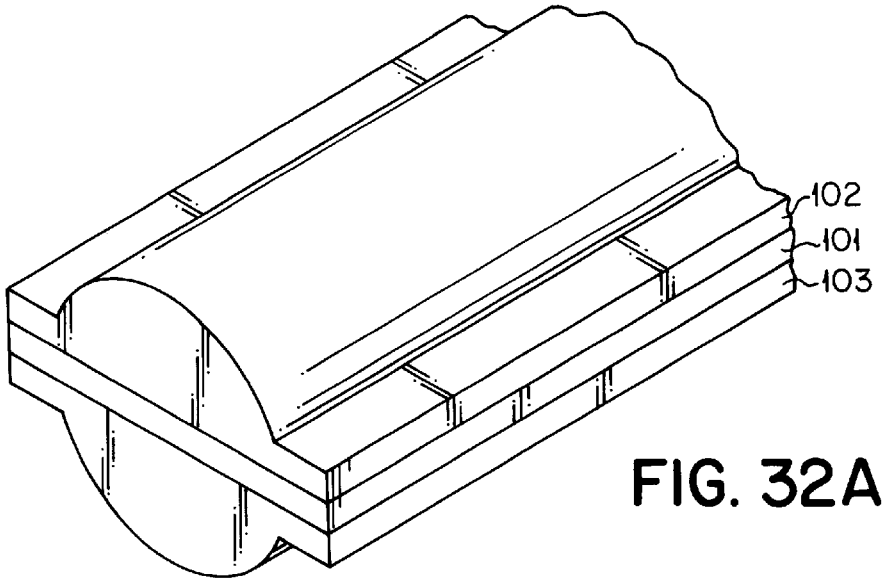
FIGS. 32A, 32B and 32C are perspective views explaining the procedure for manufacturing the glow plug in other way.
Figure 32B:
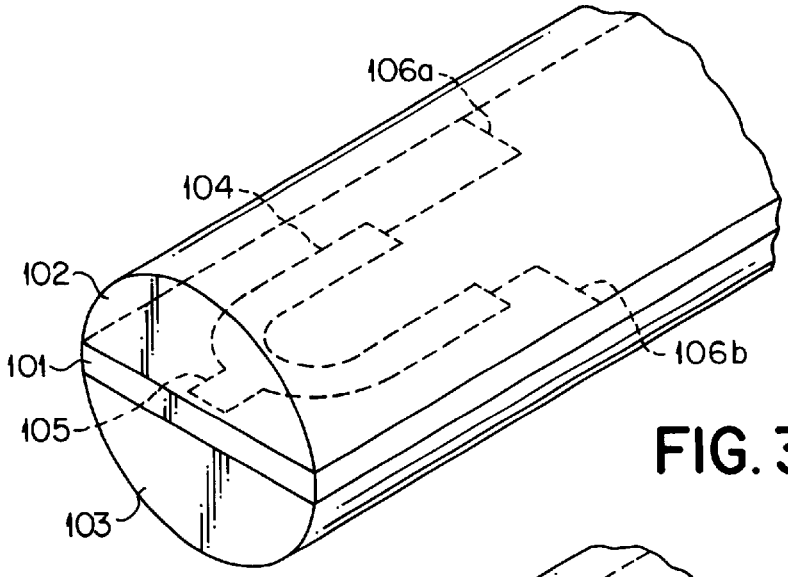
Figure 32C:
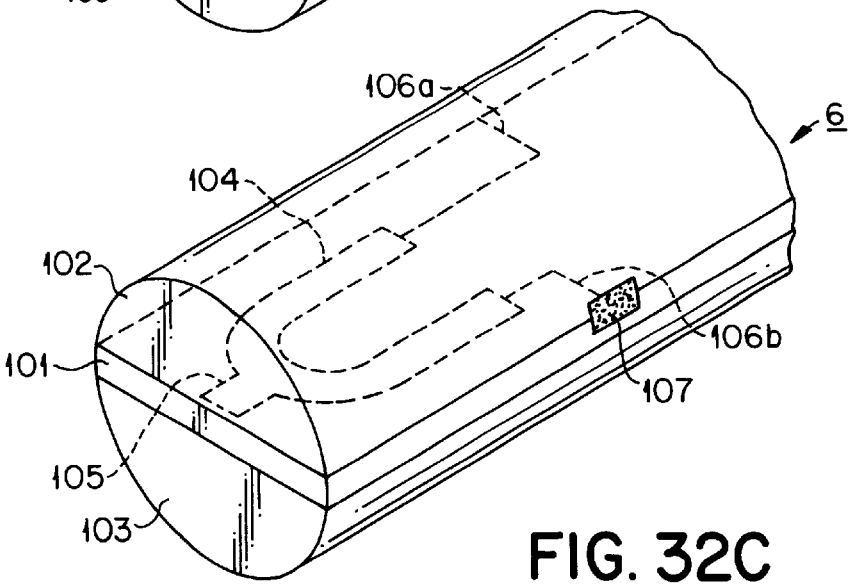

Then, as shown in FIG. 32A, the second and third layer members 102 and 103 are overlaid on both faces of the first layer member 101, respectively. The overlaid members are degreased by preheating, then, baked by heating to form one unit. After that, the integrated body (FIG. 32A) is cut into a column-like shape, as shown in FIG. 32B, and the ends of the lead wire portions 106*a* and 106*b* are plated with Cu and Ni. Finally, the top portion of the column body is cut into a spherical shape, thus obtaining a ceramic heating unit 6 like that shown in FIG. 2. In this case, the heating element 7 (heating element portion 104) is completely embedded in the heat resisting insulator 8 (first to third layer members 101–103), while the end surface of the ion current detecting electrode 14 (ion current detecting electrode portion 105) is exposed in the top portion of the ceramic heating unit 6.

Figure 33:
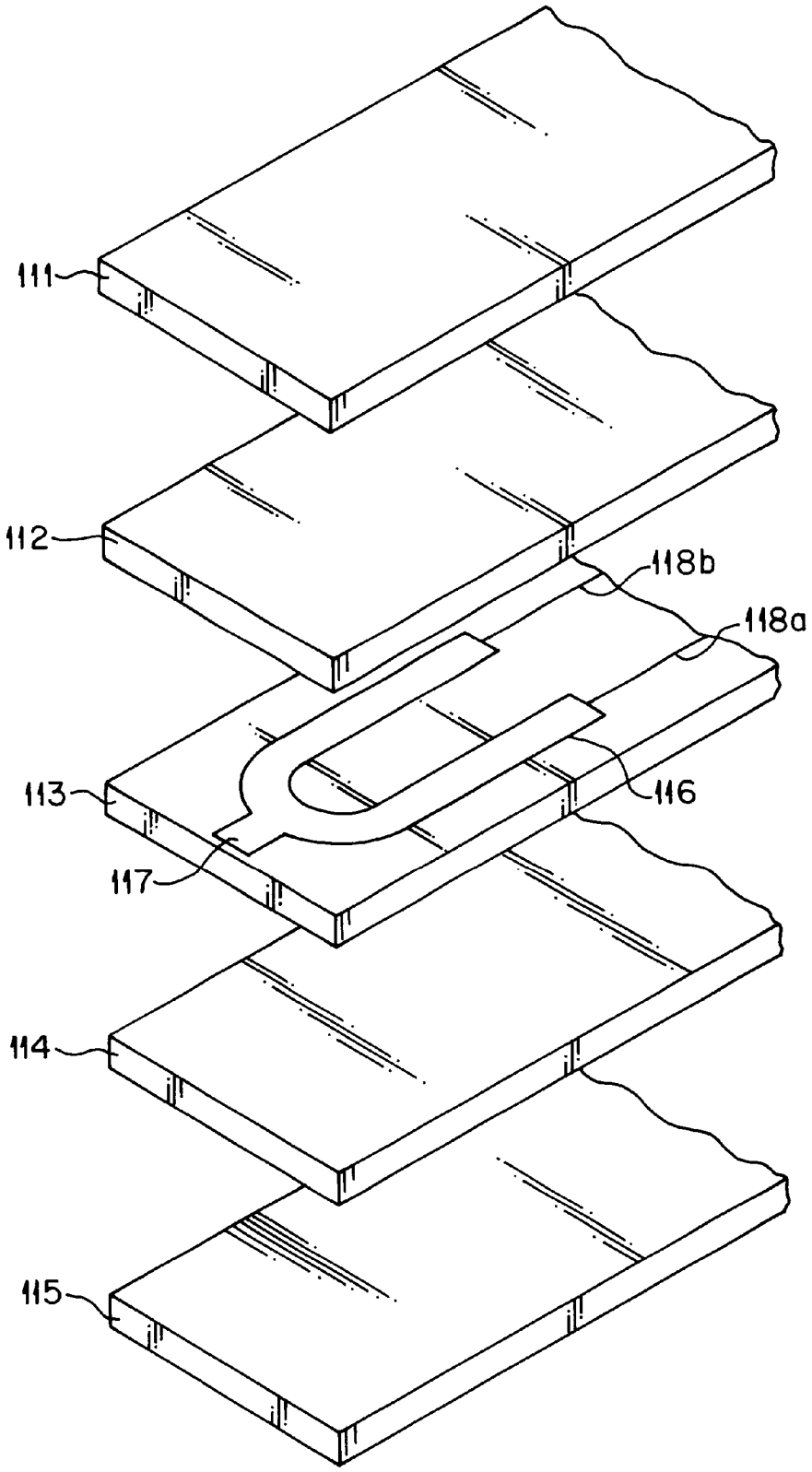
FIG. 33 is a perspective view explaining the procedure for manufacturing the glow plug in other way.

(8-3) In FIG. 33, a plurality of thin-plate like first to fifth layer members 111–115, made of a heat resisting insulation material (a mixture of a ceramic material, a resin binder and such), are first prepared. With the third layer member 113 to be placed in the center, a heating element portion 116 and an ion current detecting electrode portion 117 are printed on the surface by a screen printing technique using a conductive paste. The ion current detecting electrode 117 is formed into a shape slightly projecting from the tip of the U-type portion of the heating element 116. Lead wire portions 118*a* and 118*b* are also printed thereon with a conductive paste.

The first to fifth layer members 111–115 are put on top of each other, degreased by preheating, and then baked by heating to form one unit. After that, the integrated body of the layer members is cut into a column-like shape, and the top portion of the column body is cut into a spherical shape, thus obtaining a ceramic heating unit 6 like that shown in FIG. 2. In this case, the heating element 7 (heating element portion 116) is completely embedded in the heat resisting insulator 8 (first to fifth layer members 111–115), while the H-type end surface of the ion current detecting electrode 14 (ion current detecting electrode portion 117) is exposed in the top portion of the ceramic heating unit 6. According to the embodiment (8-3), the plurality of heat resisting insulation members to be first prepared may be the same type of sheets. It is therefore possible to improve application flexibility of such a heat resisting insulation material to be prepared in advance, compared to the embodiment (8-2).

The glow plug 1 having unique structure as aforementioned and exhibiting an excellent ion current detecting action can be manufactured even by the methods (8-1), (8-2) and (8-3). In such methods, complicated work can be avoided.

In the process of manufacturing the ceramic heating unit 6, a column-like body is formed and the top portion thereof is cut into a spherical shape. Alternatively, a hexahedron or other cubic shape may be used for formation of a ceramic heating unit 6 to be cut into a column-like shape with a round tip. In the manufacturing methods (8-2) and (8-3), the number of layer members, made of a heat resisting insulation material, can be determined arbitrarily as long as the heating element and the ion current detecting electrode are selectively provided on a certain layer member to be placed substantially in the center. Further, the heating element portion and the ion current detecting electrode portion may be provided separately as long as the ion current detecting electrode has an exposed portion after final cutting (in the case the heating element portion and the ion current detecting electrode are provided separately, individual layer members may be used for formation of them).

(9) Although the above embodiments teaches an all ceramic type glow plug, the glow plug may be other types. For example, a coil-like metal wire (e.g., tungsten wire) may be used as a heating element, which is embedded in a heat resisting insulator made of a ceramic material, with a portion of the metal wire electrically connected to an ion current detecting electrode exposed to the combustion flame. Even this case can provide an inexpensive glow plug having an ion current detecting function. The heating performance of the heating element can also be maintained for long periods.

(10) Although in the seventh embodiment a leakage current (current value Ip) is detected at the fuel injection timing (step 207 of FIG. 23), such a detection of leakage current may be carried out in other stage. For example, the leakage current may be detected at a predetermined crank angle before TDC. The predetermined crank angle is given as timing at which a pulse of a predetermined number is output. The pulse of a predetermined number is determined by a detection signal from the engine speed sensor 32. When some carbon adheres to the outer surface of the glow plug, the insulation resistance between the exposed electrode and the grounded side depends on the pressure in the combustion chamber. For this reason, the detection of leakage current may be carried out at any time as long as the pressure in the cylinder is kept high prior to fuel ignition, i.e., at any time in the compression stage. Although the detection of leakage current are preferably carried out in the compression stage, it is not limited by such a timing period since the leakage current can be observed in any timing periods when a large amount of carbon adheres to the outer surface of the glow plug.

(11) In the seventh embodiment, the glow relay 76 is held in the ON state (heating-element running state) for a predetermined period of time (two seconds) at step 210 of FIG. 23, but the hold time may be variable. For example, the hold time of the ON state may be set according to the current value Ip read at step 207 of FIG. 23, i.e., the hold time may be set longer as the current value Ip (leakage current) becomes large. In this case, it is possible to remove adhered carbon more securely.

(12) In the ion current detecting system according to the seventh embodiment (FIG. 22), a constant current/voltage circuit 80 may be provided at a location shown by the broken-line frame. In this case, it is possible to avoid a drop of the voltage applied to the ion current detecting electrode 14G under the condition that the heating element is running hot (under the condition that the glow relay 76 is in the ON state), and hence to stabilize the detection accuracy. Since such an improvement is made by merely adding the constant current/voltage circuit 80, it does not require any complicated circuit arrangement and not involve an increase in cost.

(13) In the above embodiments, the glow plug of the present invention is used in the ion current detector for detecting combustion ions in the combustion chamber of the Diesel engine having the turbulence chamber. However, it may be used in a so-called direct-injection engine which has a mechanism for directly injecting the fuel into the combustion chamber. The glow plug of the present invention may also be used in other types of apparatuses. For example, the glow plug of the present invention can be used in an apparatus for burning unburnt fuel in an exhaust pipe of a gasoline engine. In such an apparatus, the glow plug detects combustion ions produced by burning the unburnt fuel, and the ion current detected is used for judgment on the combustion conditions of the unburnt fuel.

<<Eighth Embodiment>>

Figure 34:
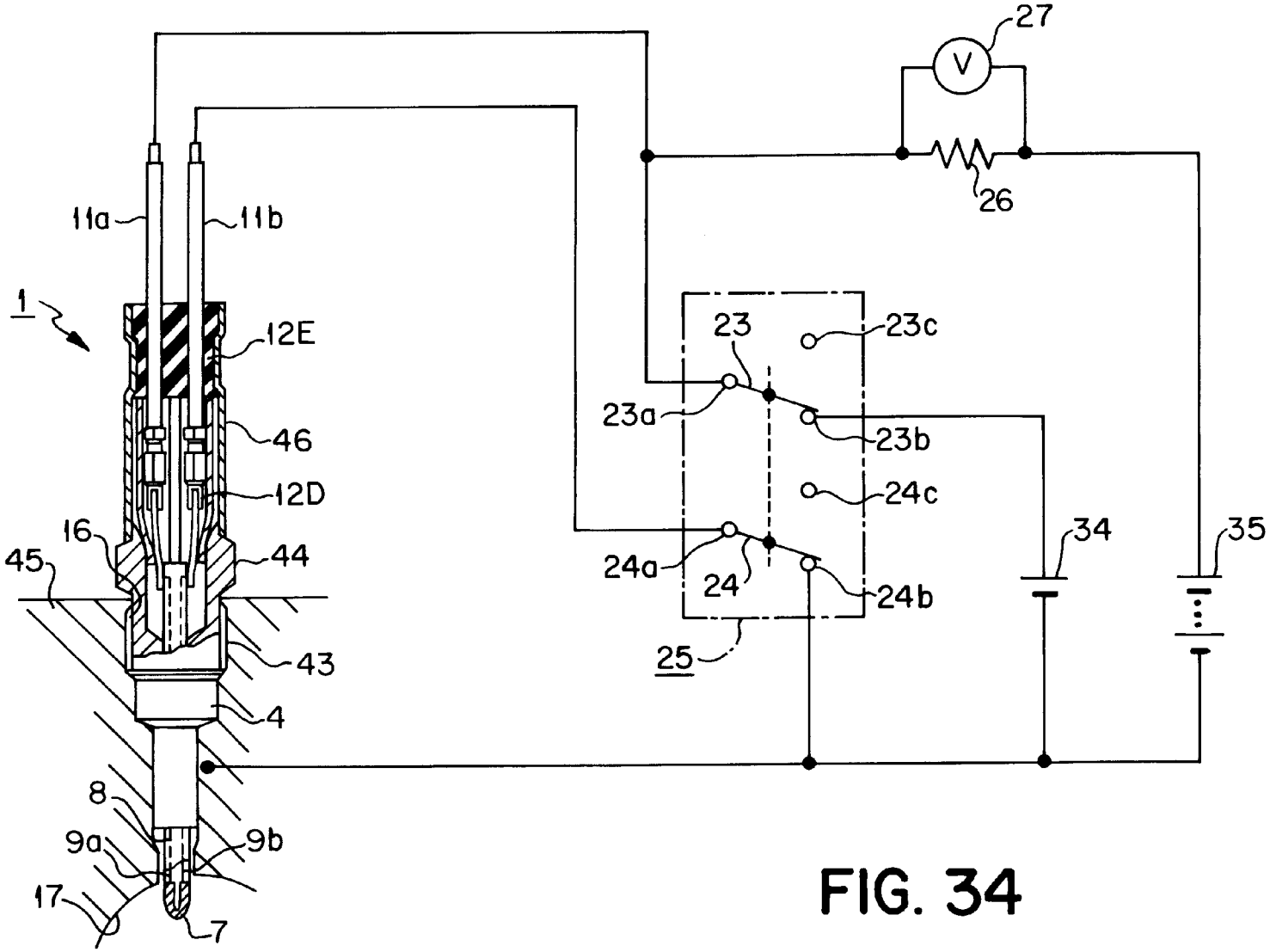
FIG. 34 is a diagram showing general structure of an ion current detecting system according to an eighth embodiment.

The eighth embodiment is a modification of the first embodiment described above with respect to FIGS. 1 to 11. Points in which the eighth embodiment differs from the first embodiment will described below. FIG. 34 is a diagram showing the eighth embodiment. It should be noted that portions common to those in the first embodiment, such as the fuel injection nozzle 20, the ECU 30 and sensors, are not shown in FIGS. 34 to 36 discussed below.

A ceramic heating unit 6 as a heating element portion is retained in the housing 4, which is constituted of a U-type conductive heating element 7; a heat resisting insulator 8 having electrical nonconductivity; and two tungsten lead wires 9*a*, 9*b* embedded in the insulator 8 and connected to both ends of the heating element 7, respectively. The majority of the heating element 7 is embedded in the heat resisting insulator 8 and tightly retained. As shown in an enlarged view of FIG. 37, a portion of the heating element 7 is exposed at the tip of the ceramic heating unit 6 without being covered with the heat resisting insulator 8. In such structure, the exposed portion of the heating element 7 and an inner wall of a turbulence chamber 17 (dashed-line portion), described later, of a Diesel engine form opposed electrodes for detecting ion current. Although in the first embodiment the ion current detecting electrode 14 is formed integrally with the heating element 7, in the eighth embodiment the heating element 7 itself is partially exposed to the outside from the heat resisting insulator 8. Another different point is that while the first embodiment uses a single power source (battery 34) for supplying current to both the heating element 7 and the ion current detecting electrode, the eighth embodiment uses separate power sources.

The structure of the ceramic heating unit 6 will be described in detail below. In the heating unit 6, the heating element 7 and the heat resisting insulator 8 are sintered products, made of a mixture of conductive ceramic powder (in the embodiment, molybdenum silicide ($MoSi_2$) powder) and nonconductive ceramic powder (in the embodiment, silicon nitride ($Si_3N_4$) powder), with substantially the same mixing ratio. A different point between them is that the mean diameter of $MoSi_2$ powder is smaller than that of $Si_3N_4$ powder in the heating element 7, while the mean diameter of $MoSi_2$ powder is equal to or larger than that of $Si_3N_4$ powder in the heat resisting insulator 8. By changing the grain size of each powder, the heating element is produced dividedly from the heat resisting insulator 8.

In the ceramic heating unit 6 having the above construction, since the heating element 7 is made up such that small particles of $MoSi_2$ powder (conductive ceramic powder) are linked together around a large particle of $Si_3N_4$ powder (nonconductive ceramic powder), current flows through the heating element 7, and thereby the heating element 7 runs hot. On the other hand, since the heat resisting insulator 8 is made up such that small particles of $Si_3N_4$ powder (nonconductive ceramic powder) are put between large particles of $MoSi_2$ powder (conductive ceramic powder), both powders are lined up to form an insulation layer having resistance larger than the heating element 7.

The ceramic heating unit 6 is manufactured by the following method: At first, a binder is kneaded with the respective mixtures of $MoSi_2$ powder and $Si_3N_4$ powder to form pastes. The pastes are then injection-molded into desired shapes of the heating element 7 and the heat resisting insulator 8, respectively. Then, the heating element 7 is so arranged that it will be surrounded with the heat resisting insulator 8, and hot-pressed at a temperature of between 1700° C. and 1800° C. After that, the ceramic heating unit 6 is cut to be a column-like shape, and the top portion of the heat resisting insulator 8 is cut so that a portion of the heating element 7 will be exposed to the outside from the heat resisting insulator 8.

Next, an ion current detecting system using the above glow plug 1 will be described. In the first embodiment, FIG. 7 shows the running state of the glow plug 1 (heating element 7) and FIG. 8 shows the state in which the glow plug 1 detects ion current resulting from fuel combustion. In the eighth embodiment, the former heating-element running state (the state of FIG. 7) corresponds to a "first state" and the latter ion current detecting state (the state of FIG. 8) corresponds to a "second state".

The system has two DC power sources: one a heating-element power source 34 for energizing the heating element 7 to generate heat, and the other an ion current detecting power source 35 for detecting ion current. In this embodiment, a 12-volt DC power source (typical vehicle battery) is used as the heating-element power source 34 and a 50-volt DC power source is used as the ion current detecting power source 35.

The power sources 34, 35 are connected to the glow plug 1 through a 2-position switching circuit 25 having two movable pieces 23, 24. The switching circuit 25 acts to switch over between the first and second states. The switching circuit 25 maintains the ion current detecting state in normal operation in which no command signal is input from an electronic control unit (hereinafter, referred to as ECU) 30. When a command signal is input from the ECU 30, the system circuitry becomes the heating-element running state with maintaining the ion current detecting state. At this time, the two movable pieces of the switch 25 are interlocked.

Stated more specifically, terminals 23*a*, 24*a*, respectively connected to the movable pieces 23, 24 of the switch 25, are connected to lead wires 11*a*, 11*b* (and the tungsten lead wires 9*a*, 9*b*) of the glow plug 1, respectively. The switch 25 also has two pairs of contacts 23*b*, 23*c*, and 24*b*, 24*c*, to which the terminals 23*a*, 24*a* are selectively connected.

As shown in FIG. 34, the heating-element running state is such that the terminal 23*a* and the contact 23*b* are closed and the terminal 24*a* and the contact 24*b* are closed. At this time, one lead wire 11*a* of the glow plug is connected to the positive side of the heating-element power source 34 through the terminal 23*a* and the contact 23*b*, while the other wire 11*b* is connected to the negative side of the ion current detecting power source 35 through the terminal 24*a* and the contact 24*b*. The heating element 7 is thus maintained in the running state. The contact 24*b* is also connected to a portion of the cylinder head 45.

In such structure as in FIG. 34, the system circuitry is always in the ion current detecting state. In other words, one lead wire 11*a* of the glow plug 1 is connected to the positive side of the ion current detecting power source 35 through a resistor 26, while the other lead wire 11*b* is either connected to the negative side of the ion current detecting power source 35 through the terminal 24*a* and the contact 24*b*, or opened. In either case, since the ion current detecting power source 35 applies a voltage between the cylinder head 45 and the exposed portion of the heating element 7 formed at the tip of the ceramic heating unit 6, ion current flows due to creation of active ions in the combustion flame front.

The ion current detecting resistor 26 having a given resistance (100 kΩ in the embodiment) is connected between the positive side of the ion current detecting power source 35 and the contact 23*c*. The ion current flowing through the ion current detecting resistor 26 is detected by a potentiometer 27 as a potential difference between both ends of the resistor 26. In the embodiment, the switching circuit 25 corresponds to switching means as claimed and the ion current detecting resistor 26 corresponds to ion current detecting means as claimed.

<<Ninth Embodiment>>

Figure 35:
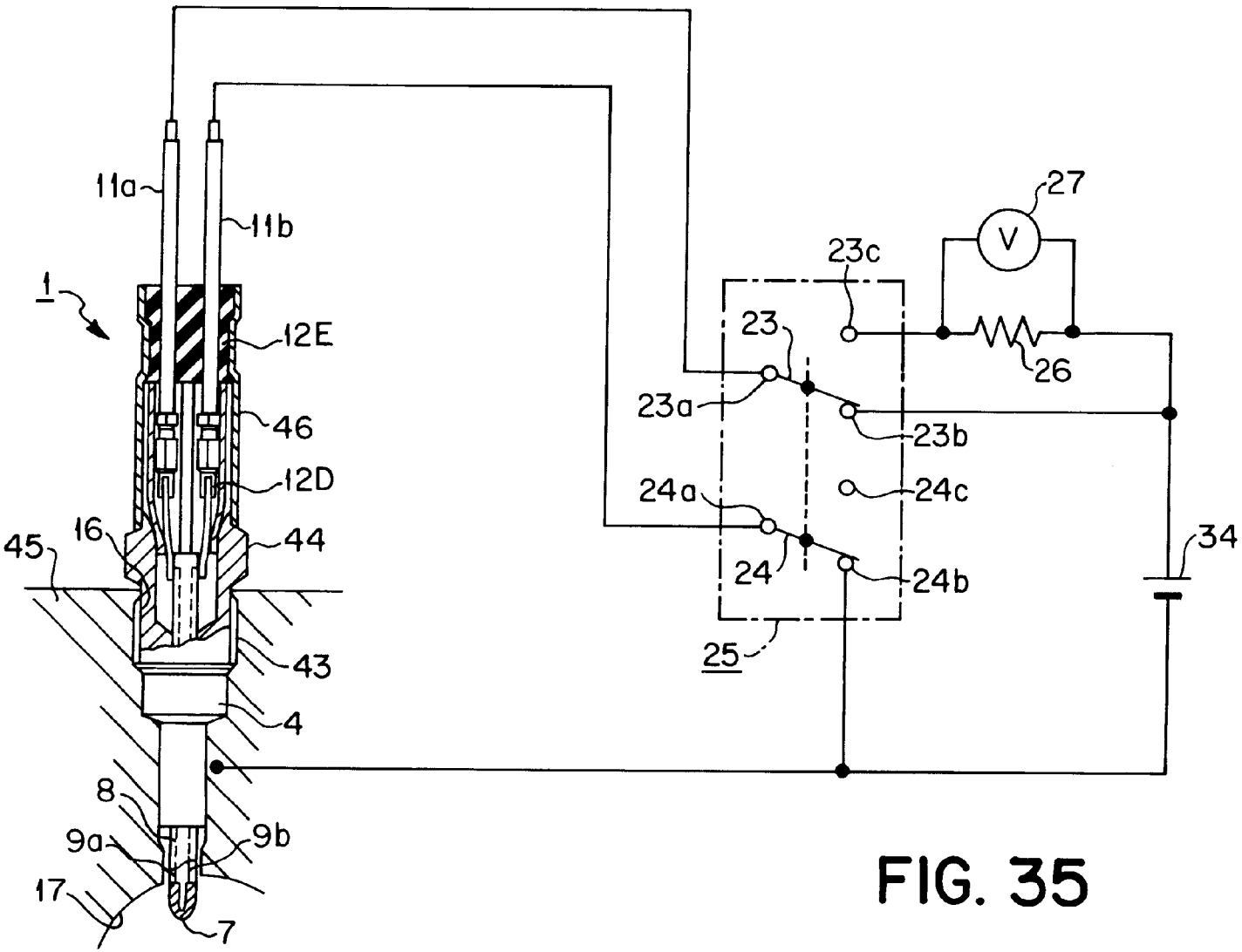
FIG. 35 is a diagram showing general structure of an ion current detecting system according to a ninth embodiment.

FIG. 35 is a diagram showing general structure of an ion current detecting system according to the ninth embodiment. A point in which this embodiment differs from the eighth embodiment is that: the eighth embodiment uses the heating-element power source 34 and the ion current detecting power source 35 separately provided, while the ninth embodiment uses the heating-element power source 34 (vehicle battery) for the ion current detecting power source 35 (similar to the first embodiment in this respect). As shown in FIG. 35, the contacts 23*b*, 23*c* of the switching circuit 25 are commonly connected to the positive side of the heating-element power source 34.

Since a battery having a rated voltage of about 12 volts is typically used as the heating-element power source 34, the resistance of the ion current detecting resistor 26 must be set to an optimum value according to the supply voltage. In the embodiment, the resistance of the ion current detecting resistor 26 is changed to a large value according to the voltage drop (preferably, 400 kΩ or larger).

According to the results of experiments performed by the inventor, ion current detection was performed in this embodiment with substantially the same accuracy as the ion detection in the eighth embodiment. Since in the Diesel engine the combustion pressure is high and liquid droplets of fuel are provided for combustion, the combustion ion density becomes high. This is why the ion current detection can be performed by using a normal battery.

According to the embodiment, it is possible to provide an inexpensive ion current detector with simple structure, thus achieving the objects of the present invention as is similar to the eighth embodiment. In addition to the above, the embodiment exhibits the following effect. Since the heating-element power source 34 is used for the ion current detecting power source 35, any power source except the vehicle battery is not required, thereby realizing an ion current detector at lower cost without requiring complicated structure.

<<Tenth Embodiment>>

Figure 36:
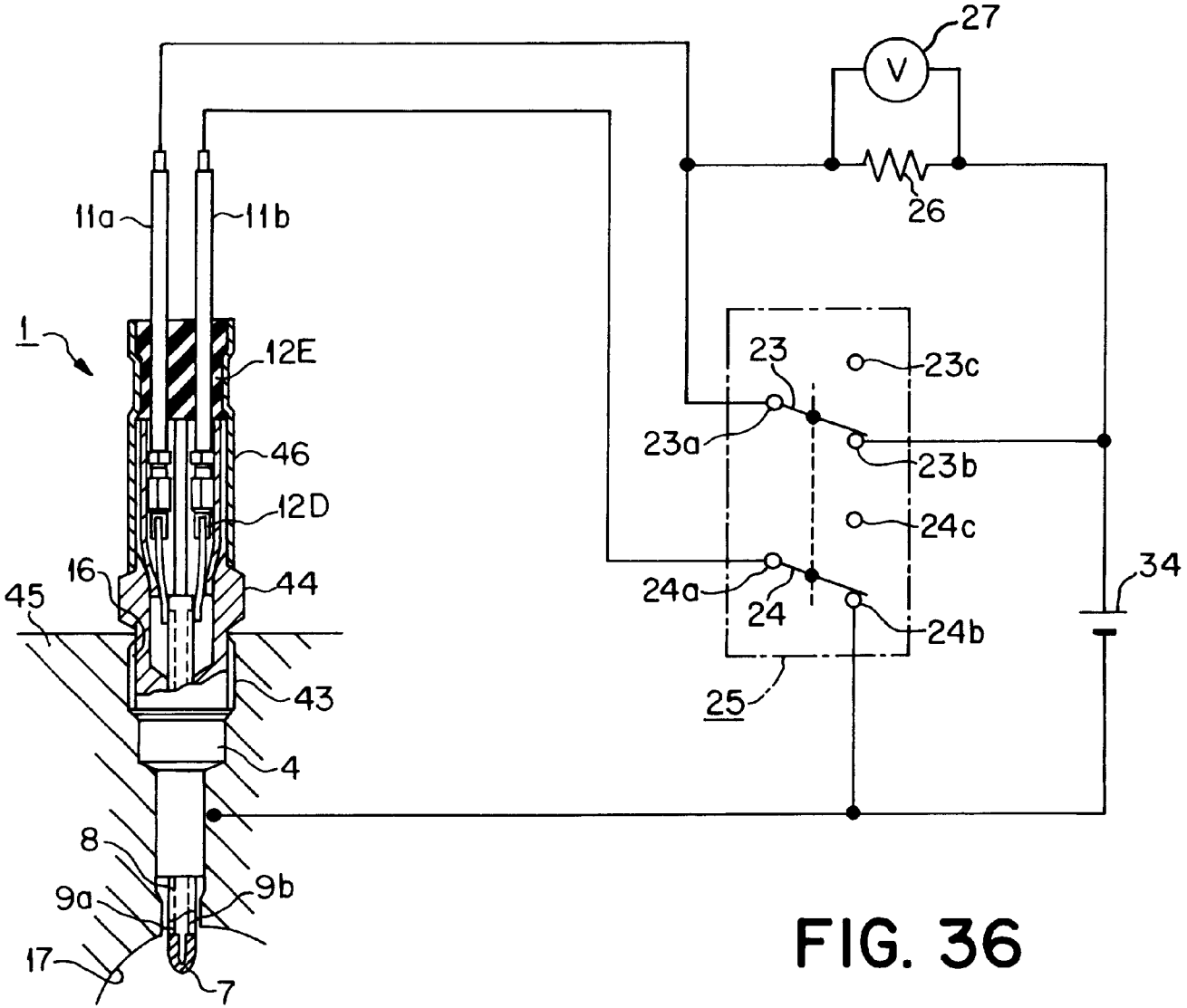
FIG. 36 is a diagram showing general structure of an ion current detecting system according to a tenth embodiment.

FIG. 36 is a diagram showing general structure of an ion current detecting system according to the tenth embodiment. The embodiment features that the ion current detecting power source 35 is directly connected between the heating element 7 and the wall portion of the turbulence chamber 17 in the same way as the eighth embodiment, and besides, the ion current detecting power source 35 is used for the heating-element power source 34 (vehicle battery) as is similar to the ninth embodiment.

According to the embodiment, it is possible to provide an inexpensive ion current detector with simple structure, thus achieving the objects of the present invention as is similar to the eighth and ninth embodiments. Further, the embodiment can prevent lowering of the ion current detection accuracy due to noise or contact resistance of the switching circuit 25, while the use of the common power source enables the simplification of the system circuitry.

<<Eleventh Embodiment>>

Figure 37:
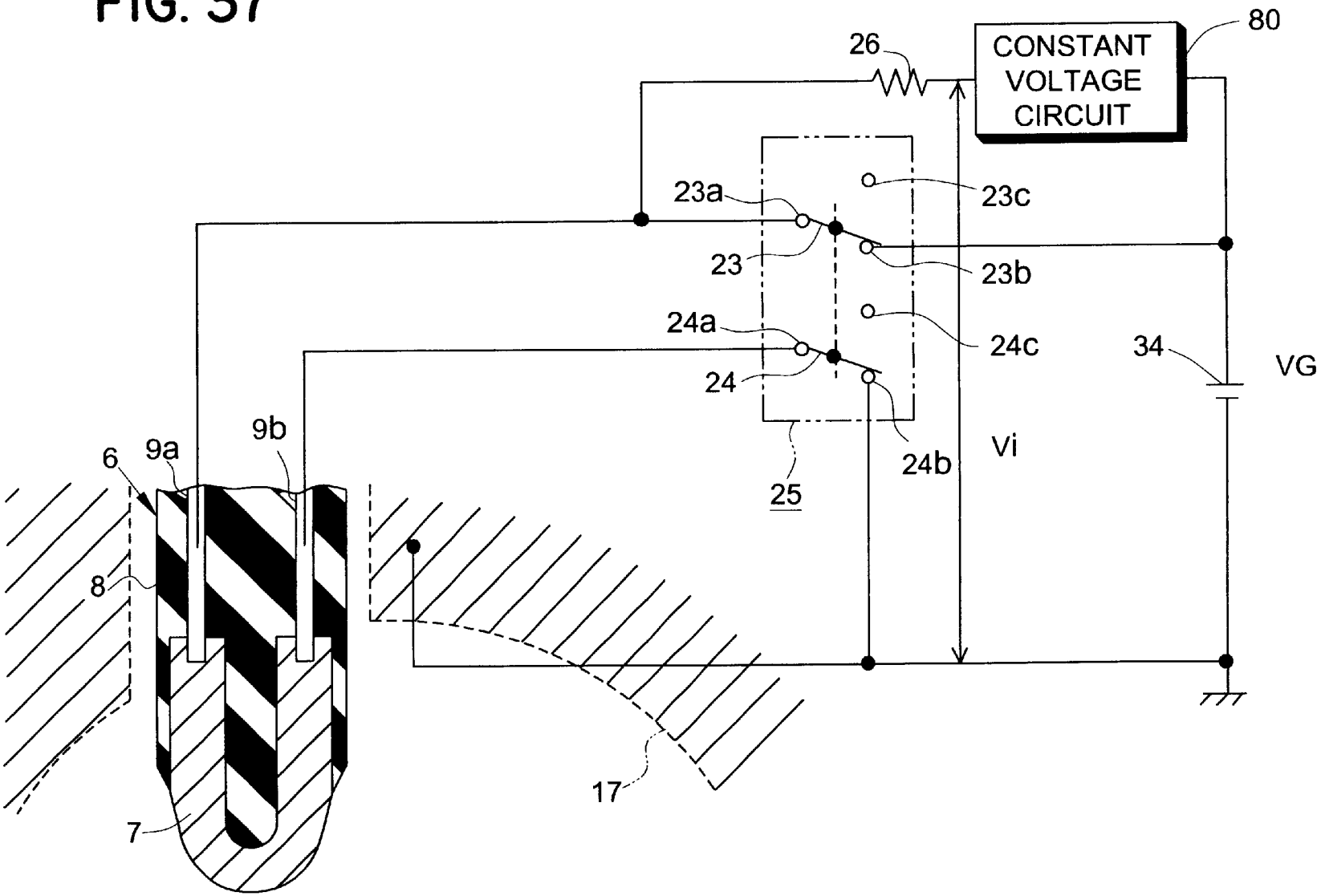
FIG. 37 is a diagram showing general structure of an ion current detecting system according to an eleventh embodiment.

FIG. 37 is a diagram showing general structure of an ion current detecting system according to the eleventh embodiment. The embodiment is a modification of the tenth embodiment (FIG. 36), which features that a constant voltage circuit 80 is provided between the positive side of the heating-element power source 34 (vehicle battery) and the ion current detecting resistor 26.

The constant voltage circuit 80 may use output negative-feedback circuitry including an amplifier circuit for converting the battery voltage VG (e.g., a DC voltage of 12 volts or so) of the heating-element power source 34 to a constant voltage Vi (e.g., 10 volts). In such a construction, the battery voltage VG is applied across the heating element 7 in the heating-element running state as shown in FIG. 37, and the glow plug promotes ignition and combustion of fuel. When the switching circuit 25 switches to the ion current detecting state (not shown), the constant voltage Vi is applied between the exposed portion of the heating element 7 and the adjacent portion of turbulence chamber 17, and ion current is detected under such a condition.

According to the embodiment, weak ion current can be detected precisely even when the battery voltage VG varies. The ion current detection can thus be performed independently of variation of the battery voltage VG, so that occurrence of the detection error can be reduced. For example, when the ion current detection is applied to the flame failure detection requiring information on a wave height and an area of the ion current, a flame failure can be detected precisely to control the engine combustion properly.

<<Twelfth Embodiment>>

Figure 38:
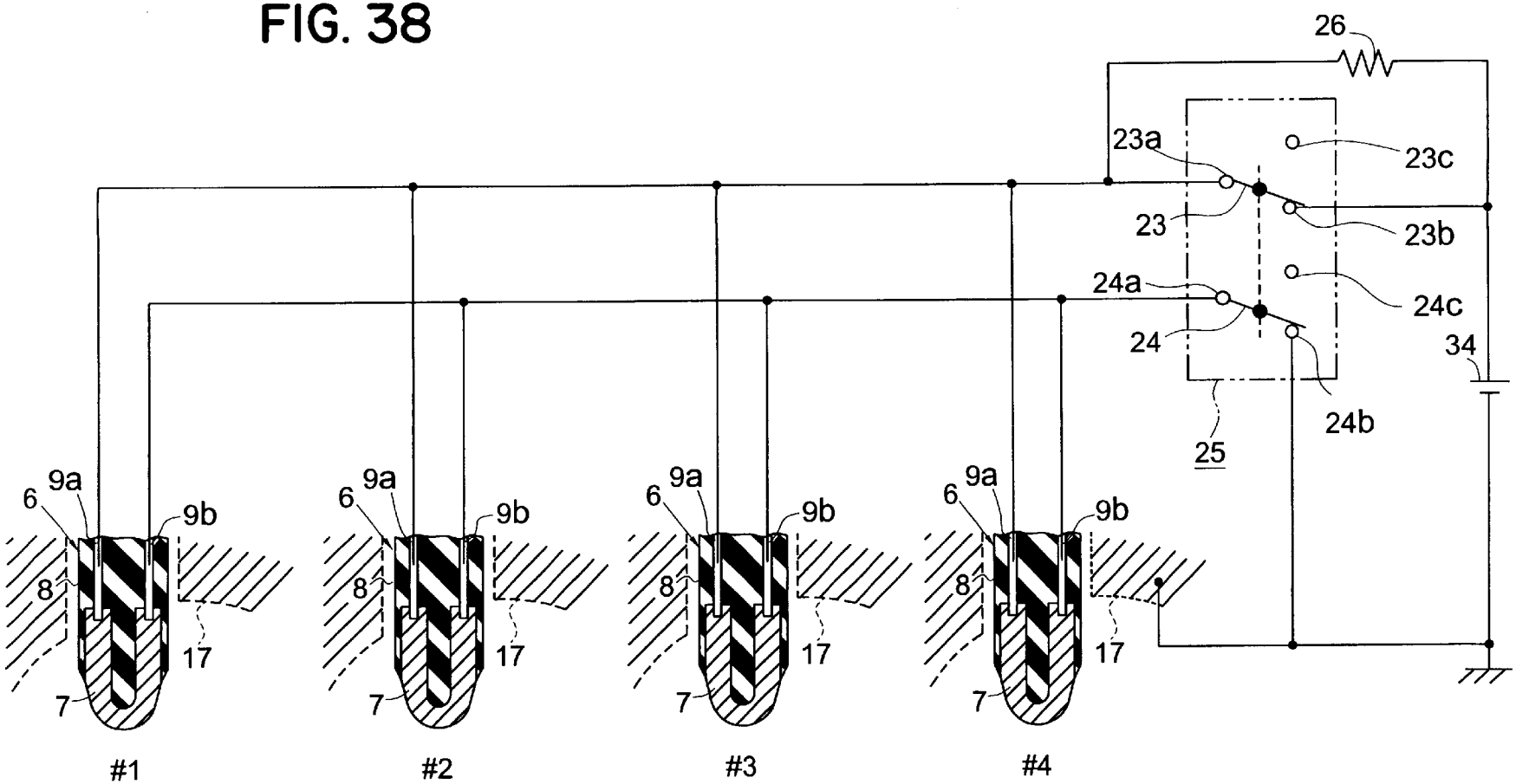
FIG. 38 is a diagram showing general structure of an ion current detecting system according to a twelfth embodiment.

FIG. 38 is a diagram showing general structure of an ion current detecting system according to the twelfth embodiment. In the embodiment, the ion current detector of the present invention is applied to a multiple cylinder engine. The engine has four cylinders #1 to #4. The glow plug in each cylinder is constructed such that a portion of the heating element 7 is exposed from the heat resisting insulator 8 as is similar to those in the above embodiments. The tungsten lead wire 9*a* connected to one end of the heating element 7 for each cylinder is connected to a terminal 23*a* of a switch 23, while the tungsten lead wire 9*b* connected to the other end of the heating element 7 for each cylinder is connected to a terminal 24*a* of a switch 24. In other words, the glow plugs for individual cylinders are connected in parallel to the switching circuit 25.

Figure 39:
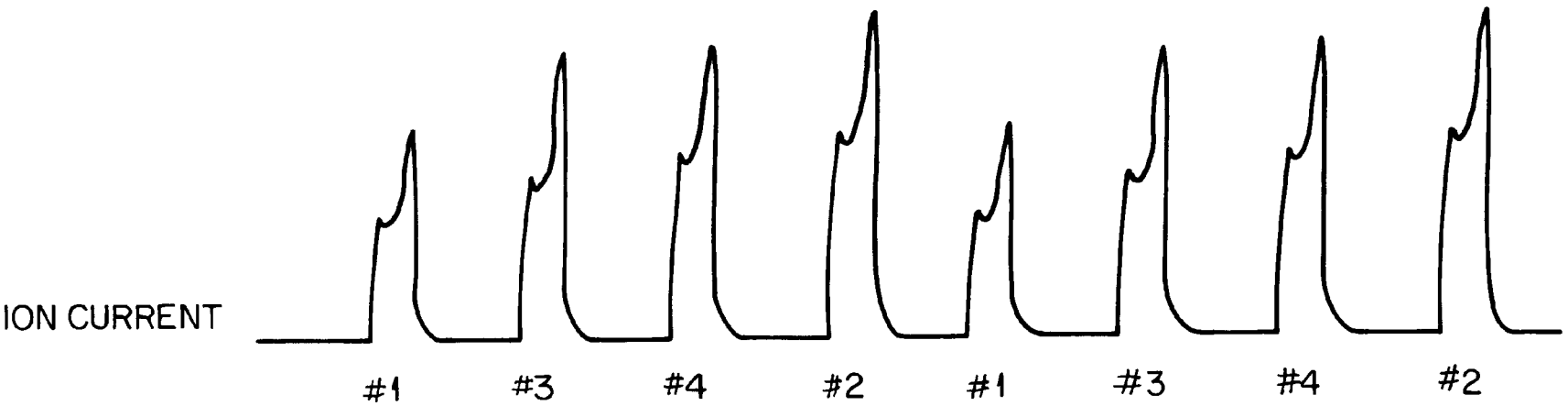
FIG. 39 is a time chart showing a waveform of ion current for each cylinder in the twelfth embodiment.

In the ion current detector as configured such above, the switching action between the heating-element running state and the ion current detecting state is taken to all the cylinders at the same time. As shown in FIG. 39, ion current is detected for each cylinder in time series according to the order of combustion in the cylinders.

According to the embodiment, the switching circuit 25 and the ion current detecting resistor 26 can be shared, so that the structure of the ion current detecting system can be simplified even for application to multiple cylinder engines. In this case, the ion current can be detected for each cylinder in time series so that the detection results will be used for control of the combustion condition of each individual cylinder (such as ignition stage control or flame failure detection control).

<<13th Embodiment>>

Figure 40:
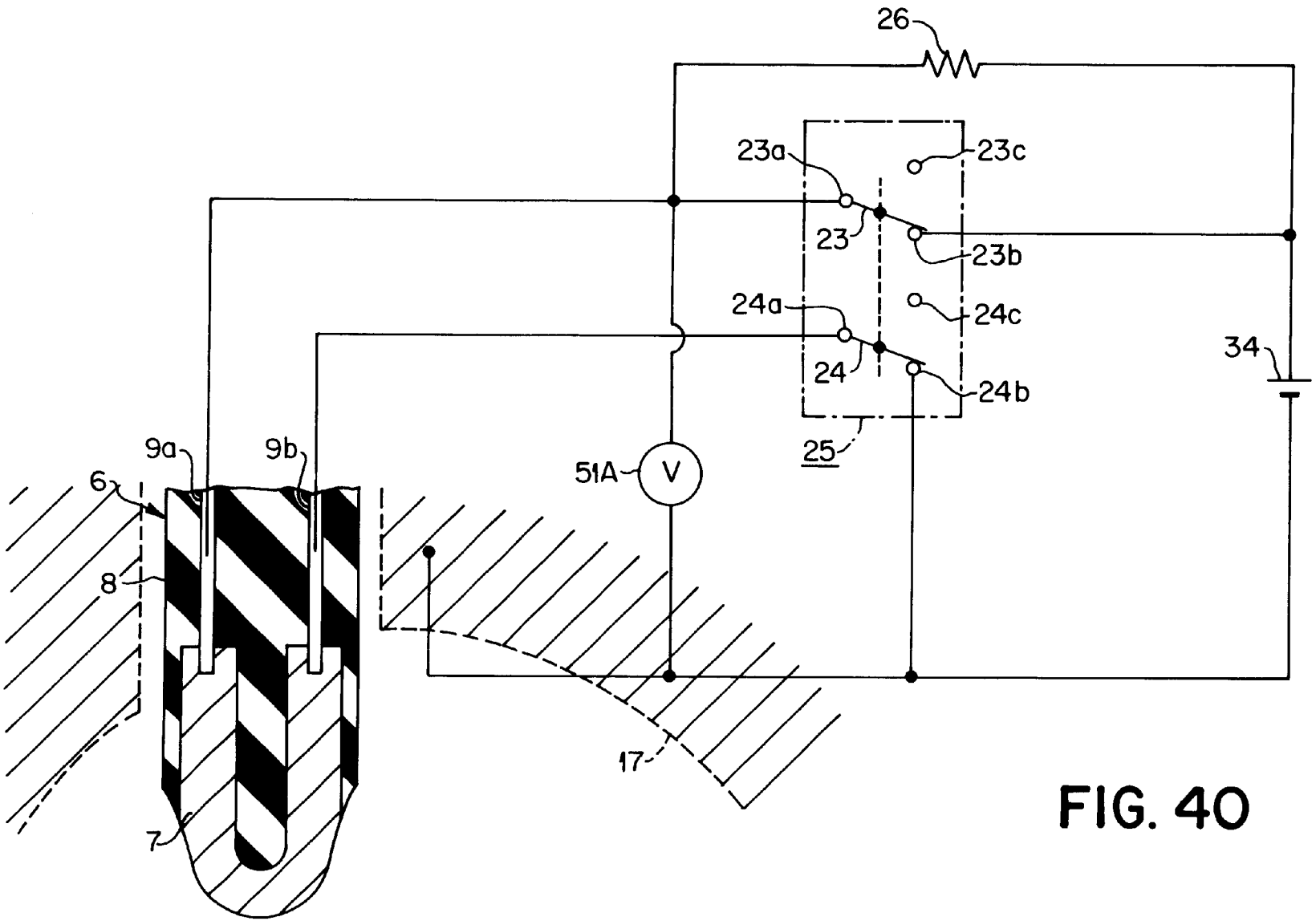
FIG. 40 is a diagram showing general structure of an ion current detecting system according to a 13th embodiment.
Figure 41:
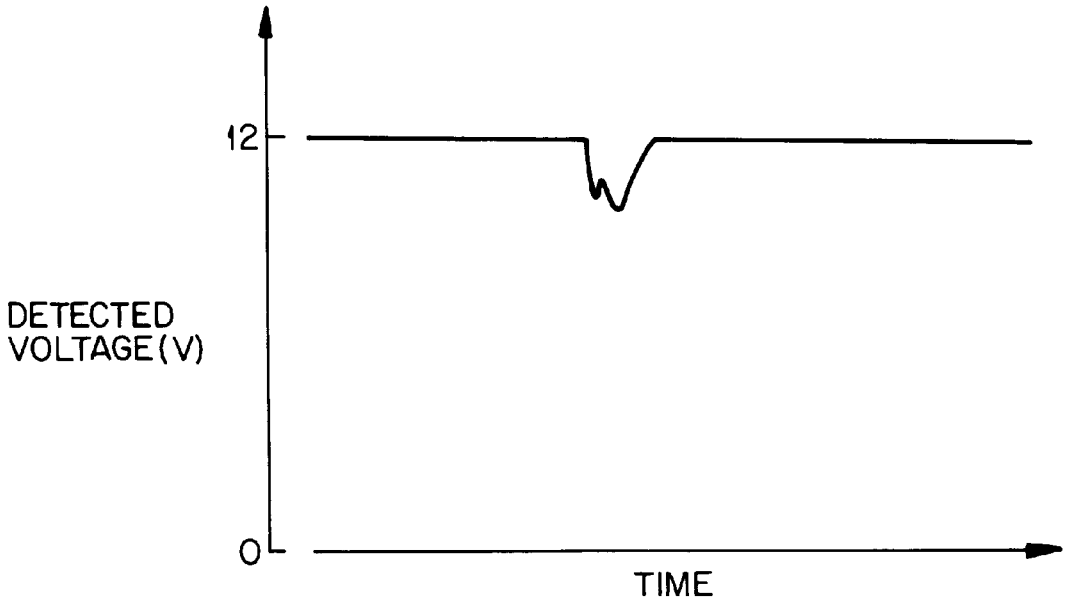
FIG. 41 is a time chart showing a voltage waveform corresponding to the ion current in the 13th embodiment.

Referring next to FIGS. 40 and 41, the 13th embodiment will be described. FIG. 40 is a diagram showing general structure of an ion current detecting system according to the 13th embodiment. The embodiment is to partially modify the tenth embodiment (FIG. 36), which features that a voltmeter 51A constructed by an amplifier is provided between one tungsten lead wire 9*a* and the ground. The output of the voltmeter 51A is input to the ECU 30. In such a construction, an ion current waveform (voltage waveform) shown in FIG. 41 can be obtained with reference to a level of the battery voltage (12 volts) of the heating-element power source 34 when an ion current is produced by the combustion event.

The embodiment shows the following effect. Although in the above embodiments the potentiometer 27 is used for detecting a potential difference between both ends of the ion current detecting resistor 26, the potentiometer 27 is constructed by a differential amplifier having relatively complicated internal structure. On the other hand, since in the embodiment the voltmeter 51A (voltage detector) can be constructed by an amplifier measuring a potential difference from the ground with relatively simple structure, the ion current detector can be simplified.

<<14th Embodiment>>

Figure 43:
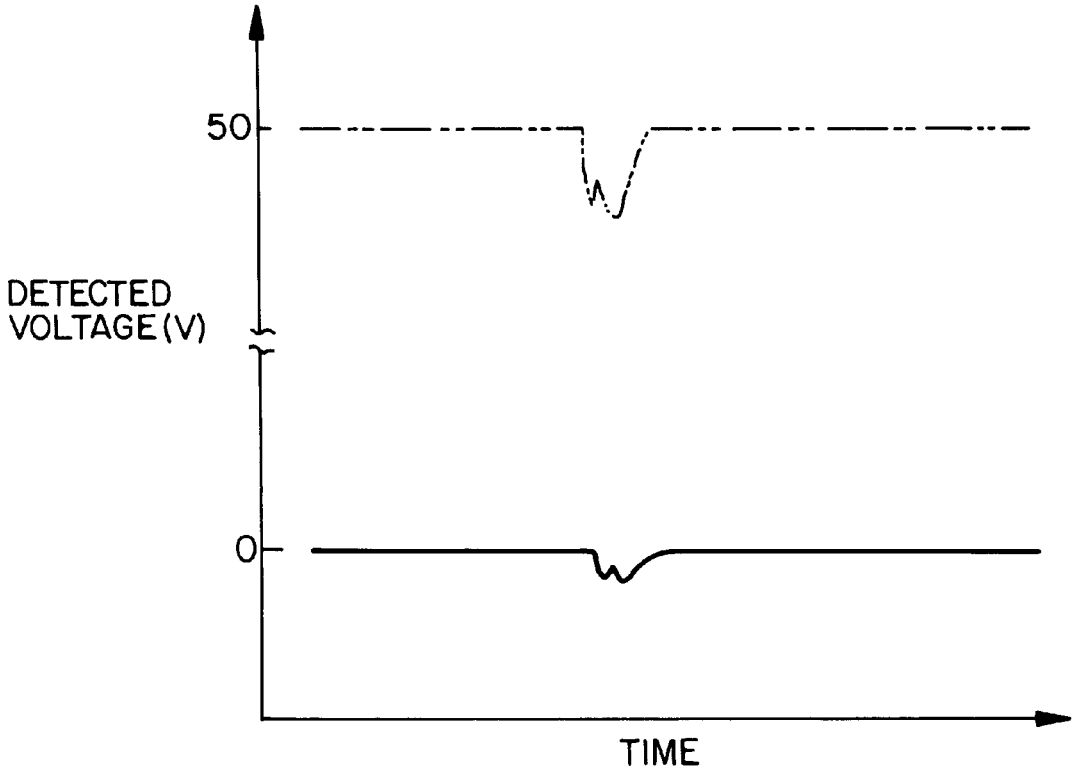
FIG. 43 is a time chart showing a voltage waveform corresponding to the ion current in the 14th embodiment.
Figure 42:
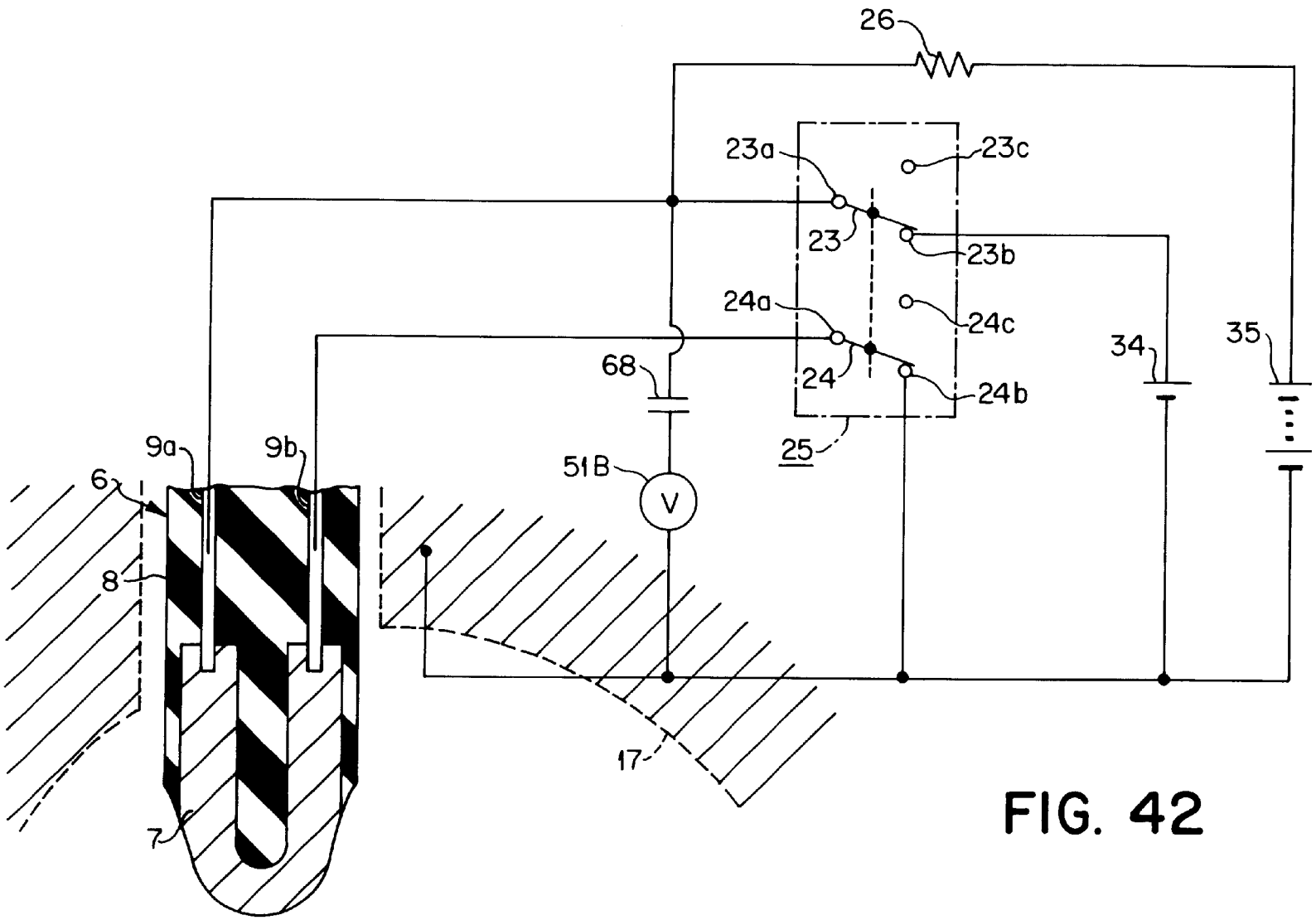
FIG. 42 is a diagram showing general structure of an ion current detecting system according to a 14th embodiment.

Referring next to FIGS. 42 and 43, the 14th embodiment will be described. FIG. 42 is a diagram showing general structure of an ion current detecting system according to the 14th embodiment. The embodiment is to partially modify the eighth embodiment (FIG. 34), which features that a voltmeter 51B constructed by an amplifier is provided between one tungsten lead wire 9*a* and the ground, with a capacitor 68 provided on the positive side of the voltmeter 51B. The output of the voltmeter 51B is input to the ECU 30. In the embodiment there are also provided the heating-element power source 34 of a relatively low voltage (12 volts) and the ion current detecting power source 35 of a relatively high voltage (50 volts).

If the capacitor 68 is not provided, the voltage waveform (current waveform) when detecting the ion current will be plotted on the voltage (50 volts) of the ion current detecting power source 35 as shown by the double-dot-and-dash line in FIG. 43, and a voltage exceeding the withstand voltage must be applied to the voltmeter 51B. In contrast, since the embodiment is such that the DC component of the supply voltage is cut by the capacitor 68, the voltage waveform corresponding to the ion current waveform detected can be plotted on a reference level of 0 volt as shown by the solid line in FIG. 43. As a result, the high voltage (50 volts) of the ion current detecting power source 35 is never applied directly to the voltmeter 51B to prevent application of an excess voltage to the voltmeter 51B over the withstand voltage.

<<15th Embodiment>>

Figure 44:
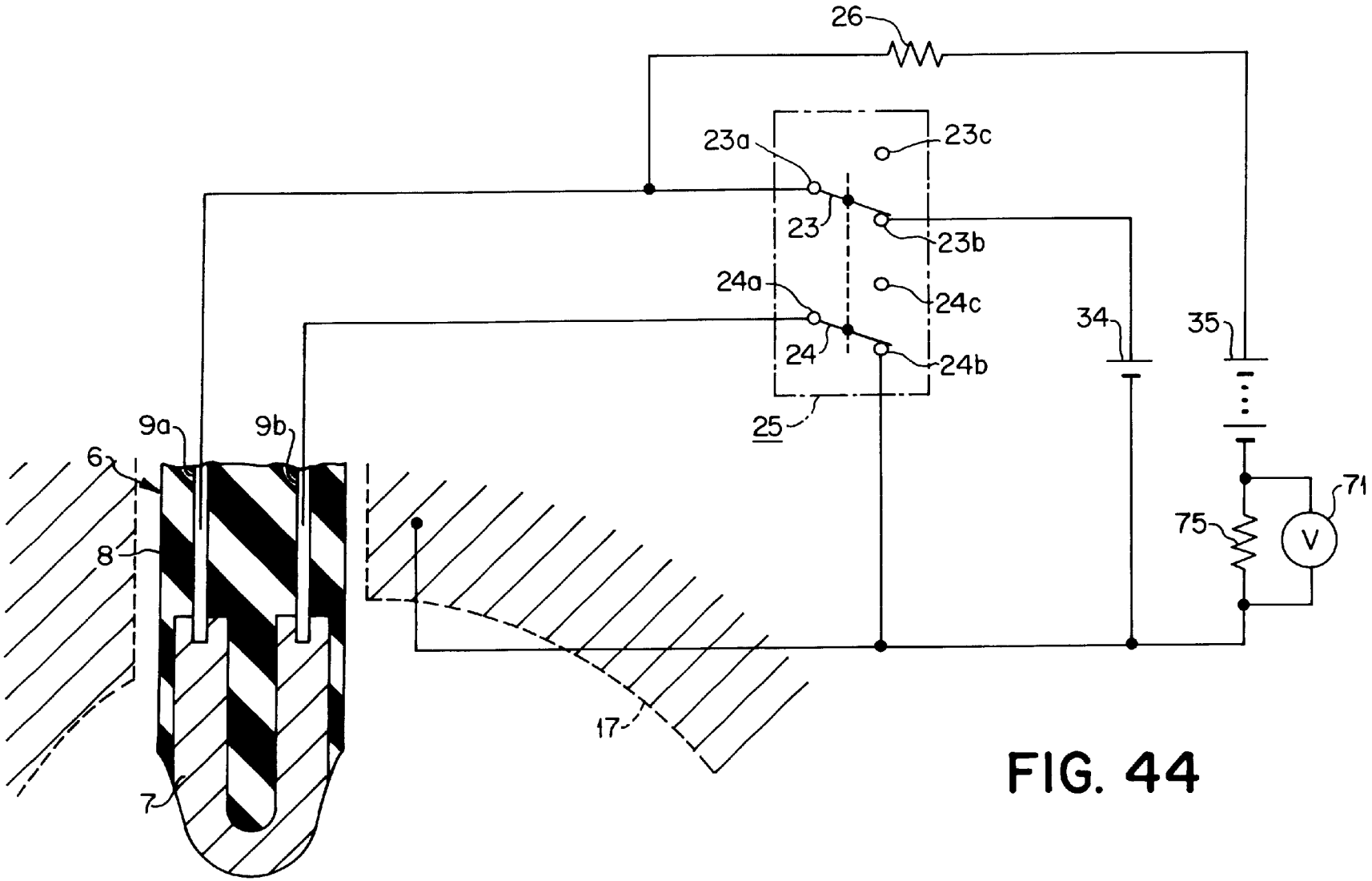
FIG. 44 is a diagram showing general structure of an ion current detecting system according to a 15th embodiment.
Figure 45:
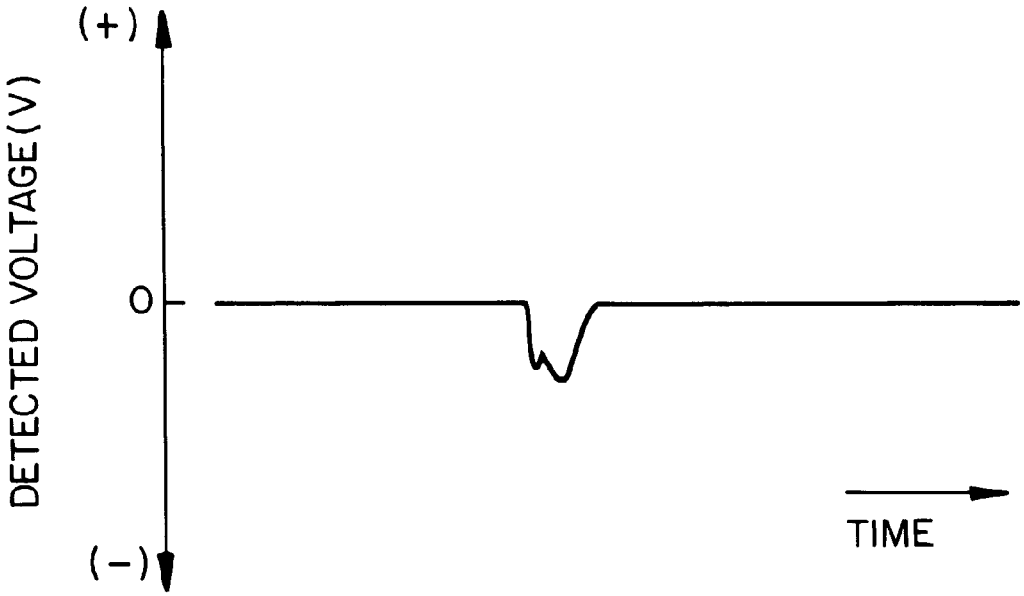
FIG. 45 is a time chart showing a voltage waveform corresponding to the ion current in the 15th embodiment.

Referring next to FIGS. 44 and 45, the 15th embodiment will be described. FIG. 44 is a diagram showing general structure of an ion current detecting system according to the 15th embodiment. The embodiment is to partially modify the eighth embodiment (FIG. 34), which features that an ion current detecting resistor 75 is provided on the grounded side of the ion current detecting power source 35 and a voltmeter 71 is provided between both terminals of the ion current detecting resistor 75. The output of the voltmeter 71 is input to the ECU 30.

In such a construction, the voltage waveform corresponding to the ion current waveform detected is plotted on a reference level of 0 volt as shown in FIG. 45. It is therefore unnecessary to use an expensive, complicated structure for the voltmeter 71 even when using a supply voltage exceeding the withstand voltage of the voltmeter 71 (voltage detector).

The present invention can also be realized in the following embodiments other than the above embodiments.

(1) In the above embodiments, the switching circuit 25 consisting of two 2-position switches 25 is used as switching means for switching over between the heating-element running state (first state) and the ion current detecting state (second state). Such switch structure may be changed. For example, a semiconductor switch (transistor, thyristor or the like) capable of handling high current can be used instead as long as the switch has the ability to switch over between the two states.

(2) Although in the eighth embodiment the polarity of the ion current detecting power source 35 is the same as that of the heating-element power source 34, the two power sources may be of opposite polarities. An AC power source may also be used for the ion current detecting power source. Further, any other structural modifications are possible as long as the means is to provide a potential difference between the heating element 7 of the glow plug 1 and the inner wall of the turbulence chamber 17 (cylinder head 45).

(3) In the above embodiments, the glow plug 1 may be a two-wire glow plug with two terminals provided at one end. In this case, the conductive lead wires l1*a,* 11*b* are electrically connected to the two terminals, respectively.

(4) In the above embodiments, the switching circuit 25 is operated to switch over between the heating-element running state (first state) and the ion current detecting state (second state) according to the control program executed by the ECU 30. Such a programmed operation of the switching circuit 25 may be changed. For example, the system may be maintained in the heating-element running state only for a predetermined period of time (one or two minutes) after starting the engine, and automatically changed from the heating-element running state to the ion current detecting state when the predetermined time has elapsed. Otherwise, the two states may be switched mechanically, i.e., a bimetal and a switch operated upon deformation of the bimetal may be adopted to switch over between the two states.

(5) The heating element and the heat resisting insulator may be produced dividedly from each other by changing the mixing ratio of $MoSi_2$ power as a conductive ceramic powder to $Si_3N_4$ power as a nonconductive ceramic powder. In this case, the heating element is produced at a high mixing ratio of $MoSi_2$ power to reduce the resistance while the heat resisting insulator is produced at a high mixing ratio of $Si_3N_4$ power to increase the resistance.

(6) Although the eleventh embodiment decried that the constant voltage circuit is incorporated into the system in which a single power source is shared between the heating-element power source and the ion current detecting power source, the present invention is not limited by this embodiment. Such a constant voltage circuit can be incorporated into a system in which the heating-element power source and the ion current detecting power source are provided separately (e.g., the system described in the eighth embodiment). In this case, the constant voltage circuit is provided between the positive side of the ion current detecting power source 35 and the ion current detecting resistor 26 l so that a DC voltage of about 50 volts from the ion current detecting power source 35 can be converted to a constant voltage (e.g., 40 volts). In such structure, weak ion current can be detected precisely even when the battery voltage varies.

(7) In the above embodiments, an injection molding method is used for manufacturing the heating element and the heat resisting insulator in the ceramic heating unit of the glow plug. Such a manufacturing method may be changed. For example, the heating element may be printed on the heat resisting insulator by a printing technique.

(8) Although the above embodiments teaches an all ceramic type glow plug, the glow plug may be other types. For example, a coil-like metal wire (e.g., tungsten wire) may be used as a heating element, which is embedded in a heat resisting insulator made of a ceramic material, with a portion of the metal wire exposed into the combustion chamber. Since the portion exposed into the combustion chamber can act as an ion current detecting electrode, an inexpensive glow plug having an ion current detecting function can be provided.

(9) In the above embodiments, the glow plug of the present invention is used in the ion current detector for detecting combustion ions in the combustion chamber of the Diesel engine. However, it may be used in other apparatuses. For example, the glow plug of the present invention can be used in an apparatus for burning unburnt fuel in an exhaust pipe of a gasoline engine. In such an apparatus, the glow plug can detect combustion ions produced by burning the unburnt fuel, and the ion current detected can be used for judgment on the combustion conditions of the unburnt fuel.

(10) In the 13th embodiment, a capacitor may be provided between one tungsten lead wire 9*a* and the voltmeter 51A. In this case, the DC component of the heating-element power source 34 is cut by the capacitor and an ion current waveform is obtained with reference to a level of 0 volt.

<<16th Embodiment>>

Figure 46:
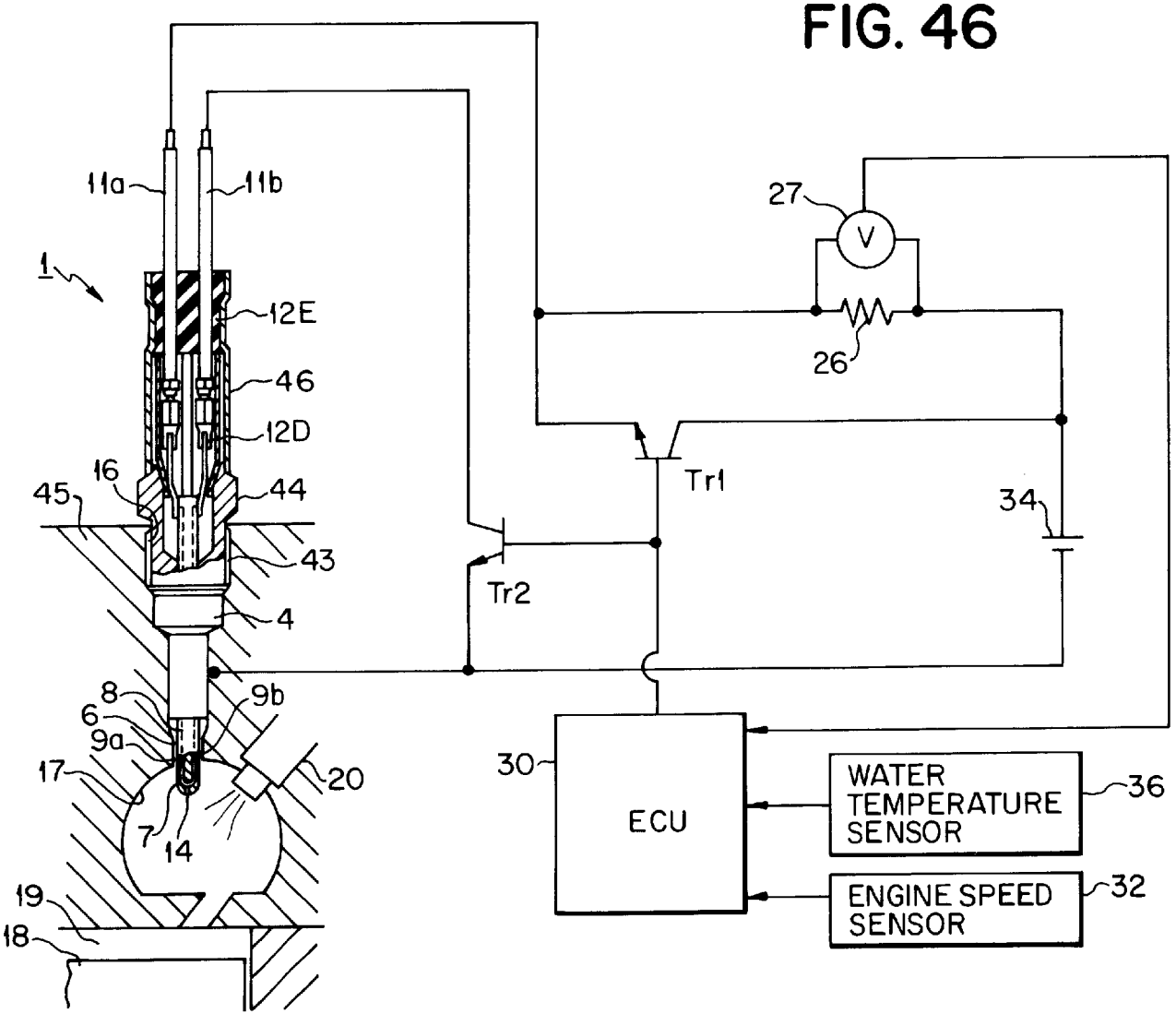
FIG. 46 is a diagram showing general structure of an ion current detecting system according to 16th and 17th embodiments.
Figure 47:
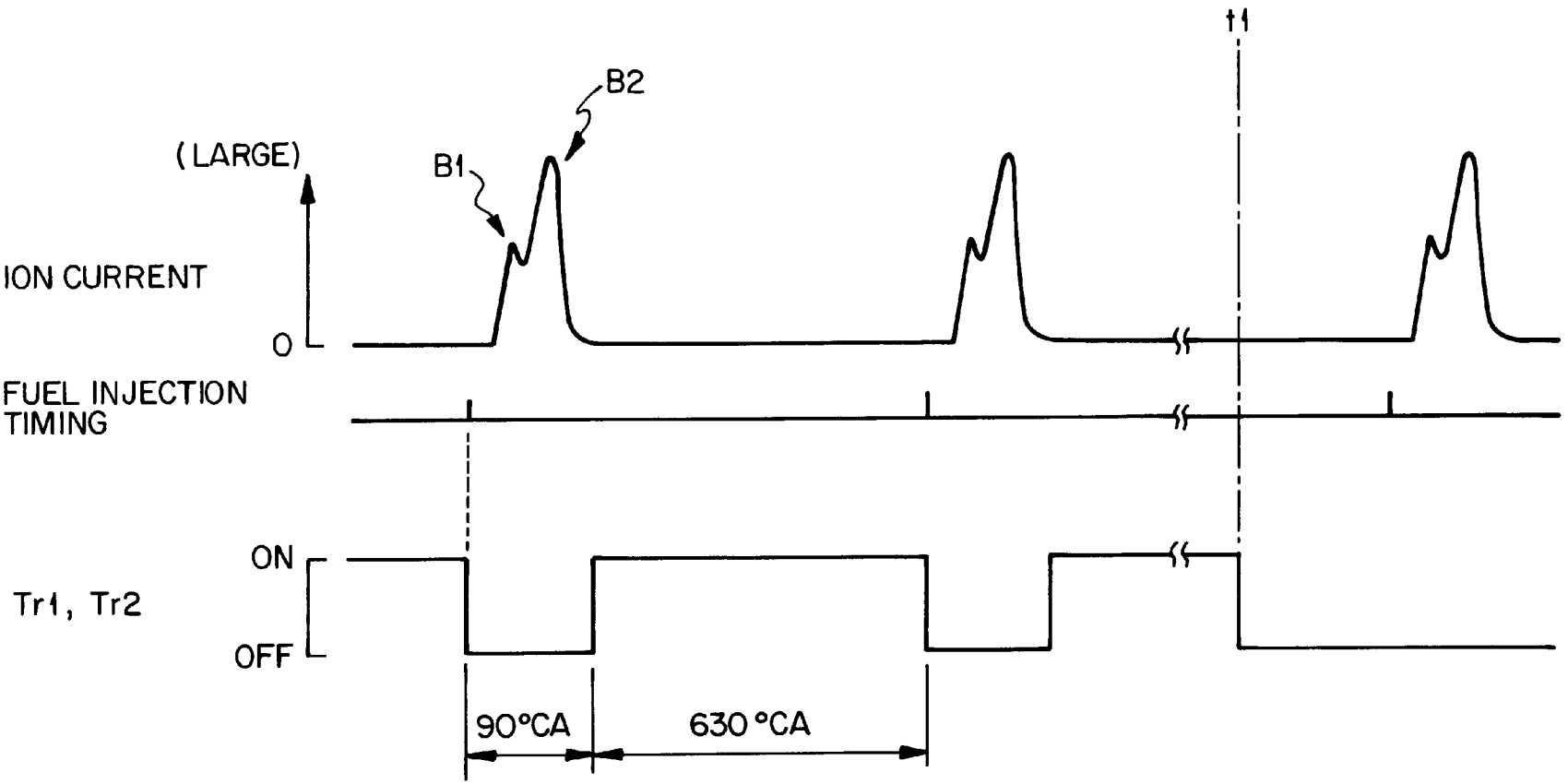
FIG. 47 is a time chart for specifically explaining operation of the 16th embodiment.

Hereinbelow, description will be made to the 16th and 17th embodiments. Referring first to FIGS. 46 and 47, an ion current detecting system commonly used in both embodiments will be described. In FIG. 36, a screw hole 16 is formed in a cylinder head 45 of a Diesel engine, and a glow plug 1 is screwed in the screw hole 16. In fastening the glow plug 1 to the cylinder head 45, a hex-head portion 4 is held with a given tool and a male screw portion 3 of the plug 1 is screwed into the screw hole 16.

Since the glow plug 1 itself can be the glow plug described in the first embodiment, the detailed description is omitted.

The tip of the ceramic heating unit 6 of the glow plug 1 projects into the turbulence chamber 17 formed in the cylinder head 45. The turbulence chamber 17 communicates with a main combustion chamber 19 provided above a piston 18, and forms part of the combustion chamber. In the turbulence chamber 17, a tip of a fuel injection nozzle 20 is so arranged that the fuel will be sprayed from the fuel injection nozzle 20 into the turbulence chamber 17.

In the ion current detecting system, a 12-volt DC battery 34 is provided, and a collector of first transistor Tr1 is connected to the positive side of the battery 34. The emitter of first transistor Tr1 is connected to one lead wire l1*a* of the glow plug 1 and the base is connected to an electronic control unit (hereinafter, referred to as ECU) 30. An emitter of second transistor Tr2 is connected to the negative side of the battery 34, the collector of second transistor Tr2 is connected to the other lead wire 11*b* of the glow plug 1, and the base is connected to the ECU 30. Since an identical command signal from the ECU 30 is input to the bases of first and second transistors Tr1, Tr2, the transistors Tr1 and Tr2 are constantly synchronized with each other. The second transistor Tr2 is also connected to a portion of the cylinder head 45. In the embodiment, the first and second transistors Tr1, Tr2 correspond to switching means as claimed in claims 27 to 29.

When an H-level command signal is input from the ECU 30 to the bases of first and second transistors Tr1, Tr2, the transistors Tr1, Tr2 are turned to be ON-state, and a battery voltage is applied across the heating element 7 through the lead wires 11*a*, 11*b* and tungsten lead wires 9*a*, 9*b*. In other words, when the transistors Tr1, Tr2 are turned ON, the heating element 7 is maintained in a heat-generating sate (this state is referred to as heating-element running state).

When the command signal to the first and second transistors Tr1, Tr2 is changed to an L level, the transistors is turned to be OFF-state, and the battery voltage is applied to the lead wire 11*a* through an electric path provided in parallel to the first transistor Tr1. The battery voltage is thus applied between an ion current detecting electrode 14 formed at the tip of the ceramic heating unit 6 and the cylinder head 45. In this case, an ion current flows due to active ions created in the combustion flame front, and the flow of ion current is detected by an ion current detecting resistor 26 (this state is referred to as ion current detecting state).

The resistance of the ion current detecting resistor 26 is about 100 kΩ. The ion current flowing through the ion current detecting resistor 26 is detected by a potentiometer 27 as a potential difference between both ends of the resistor 26.

The principle of ion current detection will be described in brief. When the fuel is fed to the turbulence chamber 17 through the fuel injection nozzle 20 and a combustion event occurs, a large number of positive and negative ions of ionized gases are created in the flame front due to combustion. Application of the battery voltage between the ion current detecting electrode 14 and the cylinder head 45 (inner wall of the turbulence chamber 17) facing the electrode 14 causes the ion current detecting electrode 14 to capture the negative ions and the cylinder head 45 to capture the positive ions. As a result, the ion current flowing in such a condition is detected as a potential difference between both ends of the ion current detecting resistor 26.

The ECU 30 mainly includes a well-known microcomputer and an A/D converter, not shown, the microcomputer including a CPU, a ROM, a RAM, an I/O circuit and such. The ECU 30 receives a detection signal from the potentiometer 27. The ECU 30 also receives a detection signal from a water temperature sensor 36 for sensing temperature of engine cooling water, and a detection signal from an engine speed sensor 32 for sensing engine speed according to the crank angle of the engine. The ECU 30 thus detects a water temperature Tw and an engine speed Ne based on the detection signals from the sensors 36 and 32, respectively.

When the Diesel engine starts at low temperature, the ECU 30 turns the first and second transistors Tr1, Tr2 to be ON-state, so that the glow plug 1 runs the heating element 7 hot to promote ignition and combustion of fuel (afterglow operation). When warm-up of the Diesel engine is completed, the ECU 30 turns the transistors Tr1, Tr2 to be OFF-state, so that the system circuitry is changed to the ion current detecting state, thus detecting the ion current resulting from combustion.

In particular, the embodiment shows the following feature: To enable the ion current detection from the beginning of engine start (during the afterglow period), the first and second transistors Tr1, Tr2 are temporarily turned OFF for a predetermined period of time after fuel ignition so that the system circuitry can be temporarily shifted from the heating-element running state to the ion current detecting state.

Operation of the embodiment will be described below with reference to FIGS. 47 to 49.

Referring first to a time chart of FIG. 47, the outline of the operation will be described. FIG. 47 shows a waveform of an ion current produced when burning fuel, a fuel injection stage and ON/OFF operations of the transistors Tr1, Tr2, in which the afterglow period appears before time t1 and is ended at time t1.

During the afterglow period (before time t1), the heating-element running state is continued except for a temporal period of ion current detection. The transistors Tr1, Tr2 are initially in the ON-state during the afterglow period and the heating element 7 is in the running state. However, to obtain the ion current waveform shown, the transistors Tr1, Tr2 are turned to be OFF-state temporarily for a predetermined period (90° CA in the embodiment) after fuel injection stage. The result of the ion current detection performed in the temporal period of ion current detection (the period of time while the Tr1 and Tr2 is kept OFF) is used for control of the combustion conditions.

In the drawing, a portion of the waveform with the voltage (voltage detected by the potentiometer 27) suddenly rising immediately after the fuel injection stage (immediately after compression TDC) is of an ion current due to fuel combustion. In this waveform, the leading edge of the ion current indicates a combustion start position, which corresponds to the fuel ignition stage. The waveform has two peaks: the one, first peak B1, created by active ions in the diffused flame front, is observed early in the combustion event; and the other, second peak B2, created by a re-ionization effect due to an increase in internal pressure of the cylinder, is observed in the middle and late stages of the combustion event.

In FIG. 47, the period of ion current detection (90° CA) starting after the fuel injection stage and the heating-element running period (approximately 630° CA) lasting until the next fuel injection stage are repeated (the embodiment shows the ion current waveform for a single cylinder). Since the ion current detection performed in this period is temporal, the fuel ignition and fuel combustion functions of the glow plug 1 is never impaired.

The transistors Tr1, Tr2 are turned to be OFF-state at time t1 to stop the heating action of the heating element 7 (i.e., the afterglow period is ended). The system circuitry is thus changed to the ion current detecting state, and after that, the ion current is detected in each fuel combustion event.

Referring next to flowcharts of FIGS. 48 and 49, data processing executed by the ECU 30 for realizing the afterglow operation and the ion current detection will be described. FIG. 48 shows an ON/OFF switching routine for the transistors Tr1, Tr2, and FIG. 49 shows a feedback control routine in the fuel ignition stage taken by way of example to describe control of the combustion conditions using the result of the ion current detection.

Figure 48:
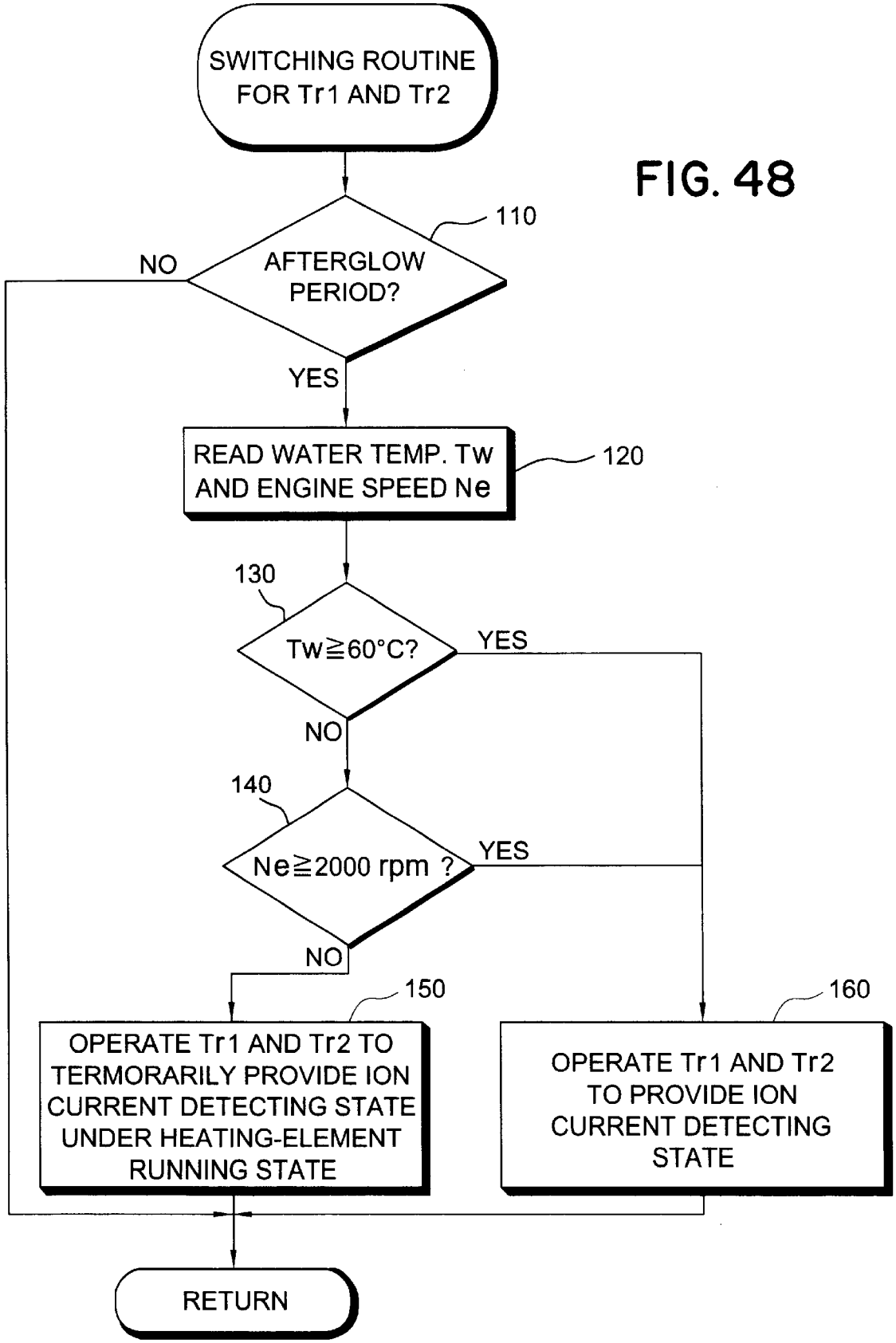
FIG. 48 is a flowchart showing the ON/OFF switching procedure for switching transistors ON or OFF in the 16th embodiment.

At first, description is made to FIG. 48. The processing of FIG. 48 is initiated by an interrupt occurring at given timing. When starting the processing of FIG. 48, the ECU 30 determines at step 110 whether or not the present state is in the afterglow period. The determination may be made with a flag set in the afterglow period (engine cold period). Since a positive determination is made at step 110 at the beginning of low-temperature start of the engine, the ECU 30 reads the water temperature Tw and the engine speed Ne at the subsequent step 120.

The ECU 30 then determines at step 130, whether or not the water temperature Tw is higher than a predetermined afterglow temperature, i.e., a predetermined warm-up temperature (60° C. in the embodiment), and at step 140, whether or not the engine speed Ne reaches a predetermined engine speed (2000 rpm in the embodiment) or more. If negative determinations are made at both steps, the ECU 30 regards the engine as not warmed up completely so further heating by the glow plug 1 (heating element 7) is necessary, and advances the processing to step 150. If a positive determination is made at either step 130 or step 140, the ECU 30 regards the engine as having been warmed up completely, or the heating by the glow plug 1 (heating element 7) as being unnecessary, and advances the processing to step 160.

In the case the processing goes to step 150, the ECU 30 turns ON the first and second transistors Tr1, Tr2 to change the circuit of FIG. 46 to the heating-element running state, while temporarily turning OFF the transistors Tr1, Tr2 under the heating-element running state to change the circuit of FIG. 46 to the ion current detecting state (see FIG. 47). Specifically, the first and second transistors Tr1, Tr2 are turned OFF for a period of 90° CA after the fuel injection stage. The ECU 30 then ends this routine after step 150 In this state, the ion current due to fuel combustion can be detected while ignition and combustion of fuel is promoted by the heating action of the glow plug 1. In the embodiment, the processing step 150 corresponds to operation means as claimed in claims 27 and 28.

In the case the processing goes to step 160, the ECU 30 turns OFF the first and second transistors Tr1, Tr2 to change the circuit of FIG. 46 to the ion current detecting state. In this state, the ion current is continuously detected. The ECU 30 then ends the routine after step 160.

The case where a positive determination is made at step 140 and the processing goes to step 160 includes a case, for example, where the engine is in a racing state and the engine speed Ne temporarily rises. In such a case, since the engine has not been warmed up completely, even if the circuit of FIG. 46 has been changed once to the ion current detecting state, the ECU 30 will make a positive determination as continuation of the afterglow operation at step 110 in the next processing cycle, and goes to steps 130 and 140 again to execute the determinations. Once the engine speed Ne stops its temporal rise and starts to decrease (Ne<2000 rpm), the ECU 30 executes the processing step 150 again.

The ECU 30 makes a negative determination at step 110 when the water temperature Tw becomes equal to or higher than 60° C. and warm-up of the engine is completed The ECU 30 then gives the negative determination every time at step 110. In other words, the first and second transistors Tr1, Tr2 are maintained in the OFF state, and the circuit of FIG. 46 is thus kept in the ion current detecting state.

Figure 49:
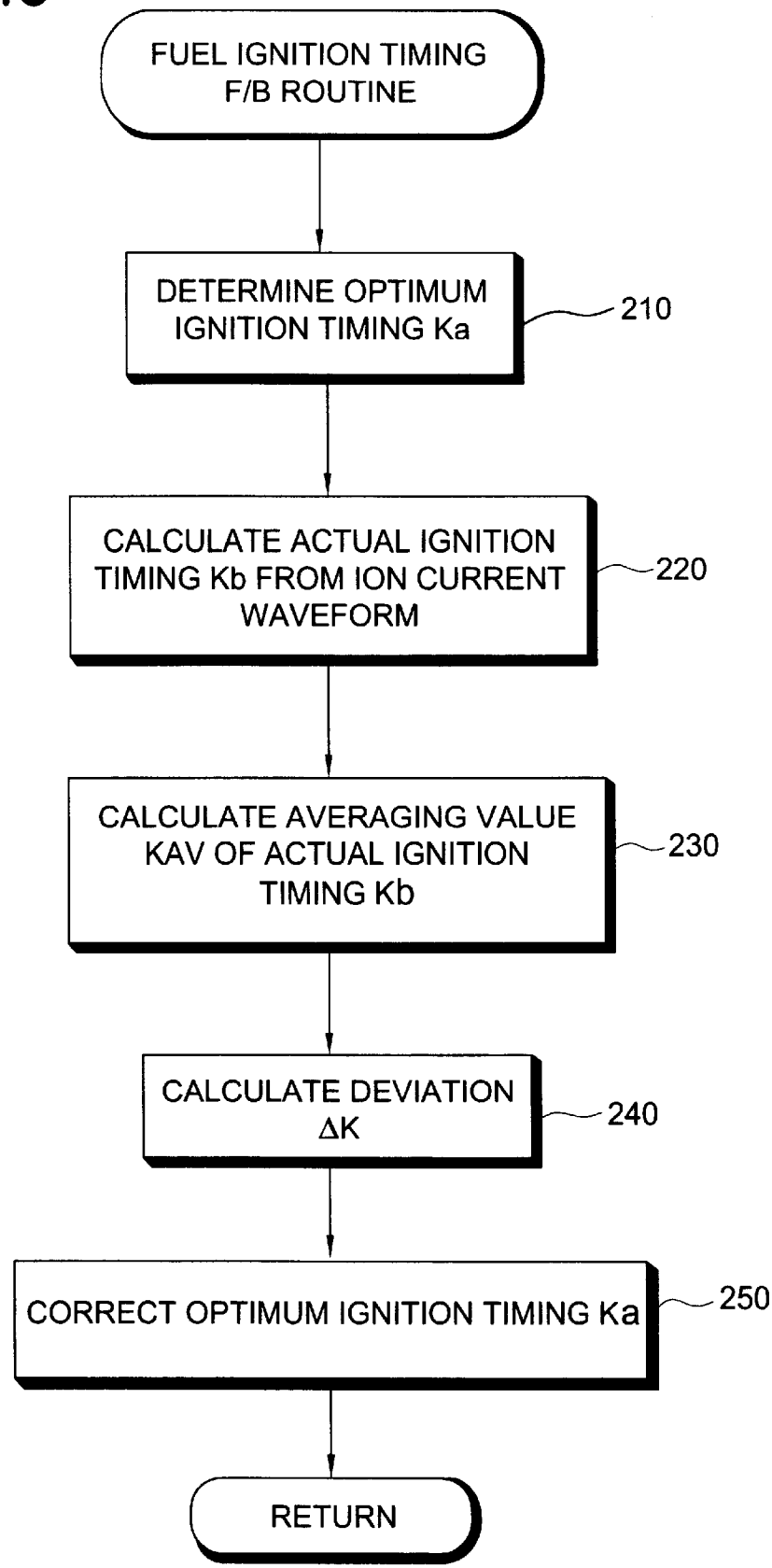
FIG. 49 is a flowchart showing fuel ignition stage feedback procedure in the 16th embodiment.

Referring next to FIG. 49, feedback control of the fuel ignition stage will be described. The flow of the drawing is executed by the ECU 30 in each event of the fuel injection to the cylinder. The control of the fuel ignition stage is carried out by adjusting the fuel injection timing. In the embodiment, the fuel ignition stage is optimally feedback-controlled by optimally adjusting the timing of the fuel injection performed by the fuel injection nozzle.

In FIG. 49, the ECU 30 uses at step 210 a fuel ignition stage map prestored in a memory to determine an optimum fuel ignition stage (optimum ignition stage Ka) according to the engine speed Ne and the nozzle capacity Q. The nozzle capacity Q is calculated from the engine load (e.g., accelerator pedal pressure) and the engine speed.

At step 220, the ECU 30 detects an actual fuel ignition stage (actual ignition stage Kb) based on the ion current waveform (the first peak B1 in FIG. 47), and at the subsequent step 230, it calculates an averaging value KAV of the actual ignition stage Kb from the following equation (1):

$$KAV_i = \{KAV_{i-1} \cdot (n-1) + Kb_i\}/n \quad (1),$$

where the averaging coefficient n is set to "8".

After that, the ECU 30 calculates at step 240 a deviation ΔK (=Ka−KAV) of the averaging value KAV of the actual ignition stage Kb from the optimum ignition stage Ka. At the subsequent step 250, the optimum ignition stage Ka determined at step 210 is corrected according to the deviation ΔK by a known feedback technique (e.g., a PI technique or a PID technique). The actual fuel injection timing is thus controlled based on the optimum ignition stage compensated such above.

Since the ion current is reflected on the fuel injection control of the engine, the engine operation can be controlled precisely. Although the ignition stage control was taken by way of example to describe feedback control using the result of ion current detection, other control of the combustion conditions may be performed using the result of the ion current detection such as to detect a flame failure (not shown). For example, a combustion condition such as abnormal combustion or flame failure can be detected from the second peak B2 of the ion current waveform in FIG. 47. Such a detection result may be reflected on the fuel injection control.

Next, the effects of the embodiment will be described.

(a) As described in detail above, the embodiment is such that the transistors Tr1, Tr2 are operated to temporarily be the ion current detecting state immediately after the fuel injection stage under the heating-element running state of the glow plug. In such structure, the ion current can be detected under the heating-element running state without risking damage to the heating function of the glow plug 1. It is therefore possible to detect ion current precisely even in the glow period of the glow plug 1, and hence to use the result of the ion current detection for maintaining the fuel combustion properly.

(b) In particular, since the embodiment sets the ion current detection period based on the fuel injection timing, the ion current can be detected securely by setting the ion current detection period as short as possible, thereby minimizing lowering of the glow function of the glow plug 1.

(c) The embodiment uses the first and second transistors Tr1, Tr2 as switching means. For this reason, the switching action can be performed in quick response.

(d) In the ion current detector of the embodiment, the switching circuit 25 switches over between the heating-element running state and the ion current detecting state, and a common power source (battery 34) is used in both states. It is therefore possible to simplify the circuit arrangements associated with ion current detection, and hence to provide an inexpensive ion current detector.

(e) Further, the embodiment is such that the ion current detecting electrode 14 is formed integrally with the heating element 7 of the glow plug 1, and ion current produced when burning fuel is detected by two electrodes consisting of the ion current detecting electrode 14 and the cylinder head 45. In this case, the ion current can be detected precisely in spite of very simple structure, and the information on the ion current detected can be effectively used for combustion control.

<<17th Embodiment>>

Figure 50:
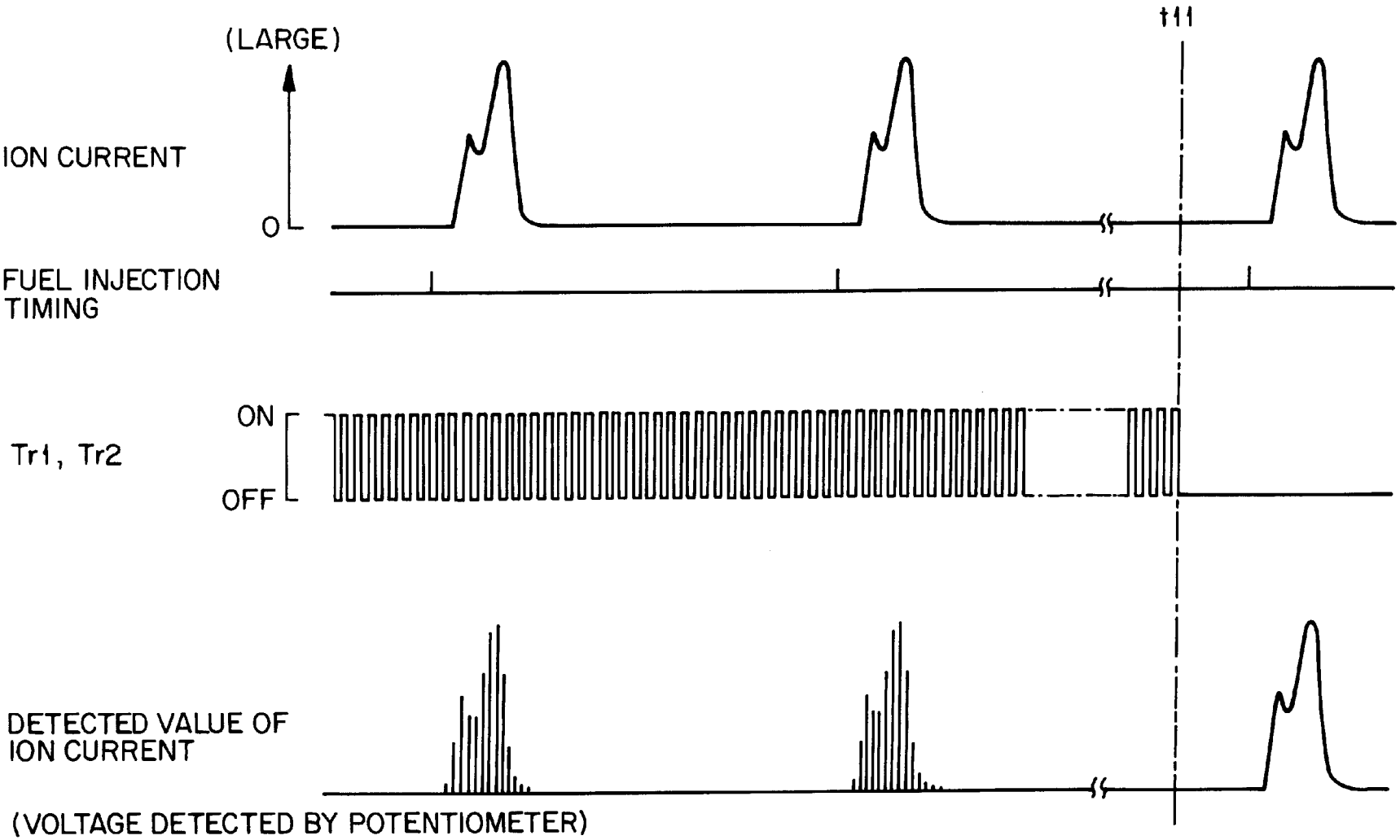
FIG. 50 is a time chart for specifically explaining operation of the 17th embodiment.

Referring next to FIG. 50, the 17th embodiment of the present invention will be described. In the embodiment, portions common to those in the first embodiment are given the same reference numerals or symbols, and the detailed description is omitted. Hereinbelow, the embodiment will be described mainly with respect to points different from the first embodiment.

The embodiment features that the transistors Tr1, Tr2 are turned ON or OFF during the afterglow period in response to an ON/OFF signal of a predetermined frequency. FIG. 50 is a time chart showing the operation of the embodiment, in which the afterglow period appears before time t11 and is ended at time t11.

During the afterglow period (before time t11), the first and second transistors Tr1, Tr2 are switched between the ON state and the OFF state successively. The ON periods of the transistors Tr1, Tr2 correspond to the heating-element running stages, while the OFF periods of the transistors Tr1, Tr2 correspond to the ion current detection stages. In this case, the results of the ion current detection in the ion current detection stages (OFF periods of the transistors Tr1, Tr2) are used for control of the combustion conditions.

With the frequency at which the first and second transistors Tr1, Tr2 is switched, it is desirable to be 10 kHz or higher, for example, when the results of the ion current detection are used for ignition stage detection. If the frequency is lower, the accuracy in detecting the ignition stage may be lowered in a high rotational range of the engine. When the results of the ion current detection are used for detection of other combustion condition such as flame failure or abnormal combustion, the frequency is preferably set to 1 kHz or higher. If the frequency becomes lower than that, the accuracy in detecting the flame failure or the abnormal combustion may be lowered in a high rotational range of the engine. In the embodiment, the frequency is set to about 10 kHz.

In the drawing, a waveform of ion current due to fuel combustion is observed at fixed intervals immediately after each fuel injection stage (immediately after compression TDC). In this case, the individual detection levels can be analyzed to detect various combustion conditions such as fuel ignition stage, flame failure or abnormal combustion.

As discussed above, the second embodiment permits precise detection of the ion current even in the glow periods of the glow plug 1, as is similar to the first embodiment, and hence the results of the ion current detection can be used for maintaining fuel combustion conditions properly.

The present invention can also be realized in the following embodiments other than the above embodiments.

(1) Although in the first embodiment the first and second transistors Tr1, Tr2 are turned OFF for a predetermined period (90° CA period) at step 150 of FIG. 48 to change the system circuitry to the ion current detecting state, this ion current detection period may be set variable. For example, the ion current detection period under the heating-element running state (in the afterglow period) can be set according to the engine load or the engine speed. In this case, the more the engine load increases or the higher the engine speed, the longer the ion current detection period is preferably set. On the other hand, the more the engine load is reduced or the lower the engine speed, the shorter the ion current detection period is preferably set.

(2) In the above embodiments, an ion current detection period is temporarily provided in the afterglow period when the engine starts at low temperature. Such a temporal period of the ion current detection, however, may be provided under the heating-element running state other than the afterglow period. For example, when some carbon adhered to the outer surface of the glow plug needs to be burnt off by the heating action of the heating element, the system circuitry can be temporarily set to the ion current detecting state under the heating-element running state, thereby continuously controlling the combustion conditions without stopping combustion operation.

(3) Although in the above embodiments a single cylinder engine (or one cylinder in a multiple cylinder engine) is taken by way of example to describe the ion current detection procedure, the ion current detection procedure in the embodiments may be applied to each cylinder of the multiple cylinder engine.

(4) Although the above embodiments uses an all ceramic type glow plug, the glow plug may be other types. For example, a coil-like metal wire (e.g., tungsten wire) may be used as a heating element, which is embedded in a heat resisting insulator made of a ceramic material, with a portion of the metal wire electrically connected to an ion current detecting electrode exposed to the combustion flame. Even this case can provide an inexpensive glow plug having an ion current detecting function. The heating performance of the heating element can also be maintained for long periods.

(5) In the above embodiments, the first and second transistors Tr1, Tr2 are used as a semiconductor switch for switching over between the heating-element running state and the ion current detecting state. Such an arrangement may be changed. For example, other semiconductor switch such as of thyristors may be used instead, or the switching system may be a contact type, as long as the switching system has the ability to switch over between the two states.

(6) Although in the above embodiments a common DC power source (vehicle battery 34) is used in both the heating-element running state and the ion current detecting state, two DC power sources may be used. Specifically, a heating-element power source is provided for running the heating element 7 hot and an ion current detecting power source is provided for detecting ion current. For example, a 12-volt DC power source (vehicle battery) is used as the heating-element power source and a 50-volt DC power source is used as the ion current detecting power source.

(7) In the above embodiments, the present invention is applied to the ion current detector for detecting combustion ions in the Diesel engine having the turbulence chamber. However, it may be applied to a so-called direct-injection engine which has a mechanism for directly injecting the fuel into the combustion chamber. The present invention may also be applied to other types of apparatuses. For example, in an apparatus for burning unburnt fuel in an exhaust pipe of a gasoline engine, the ion current detector of the present invention can be used for detecting combustion ions produced by burning the unburnt fuel. In this case, the combustion conditions of the unburnt fuel can be judged from the ion current detected by the ion current detector.

<<18th Embodiment>>

Figure 51:
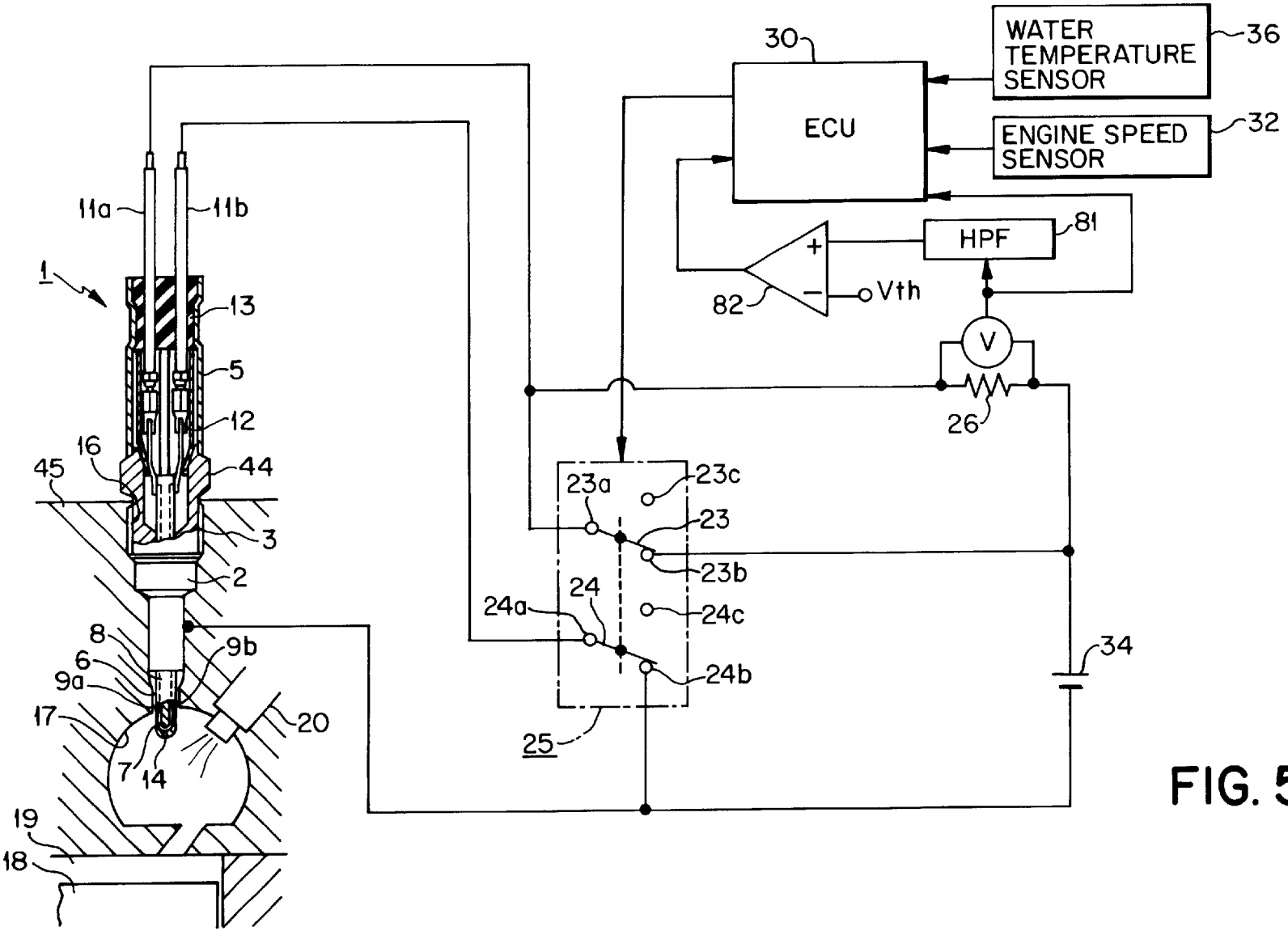
FIG. 51 is a diagram for setting the time of temporarily holding a switching circuit in a heating-element running state under an ion current detecting state.
Figure 52:
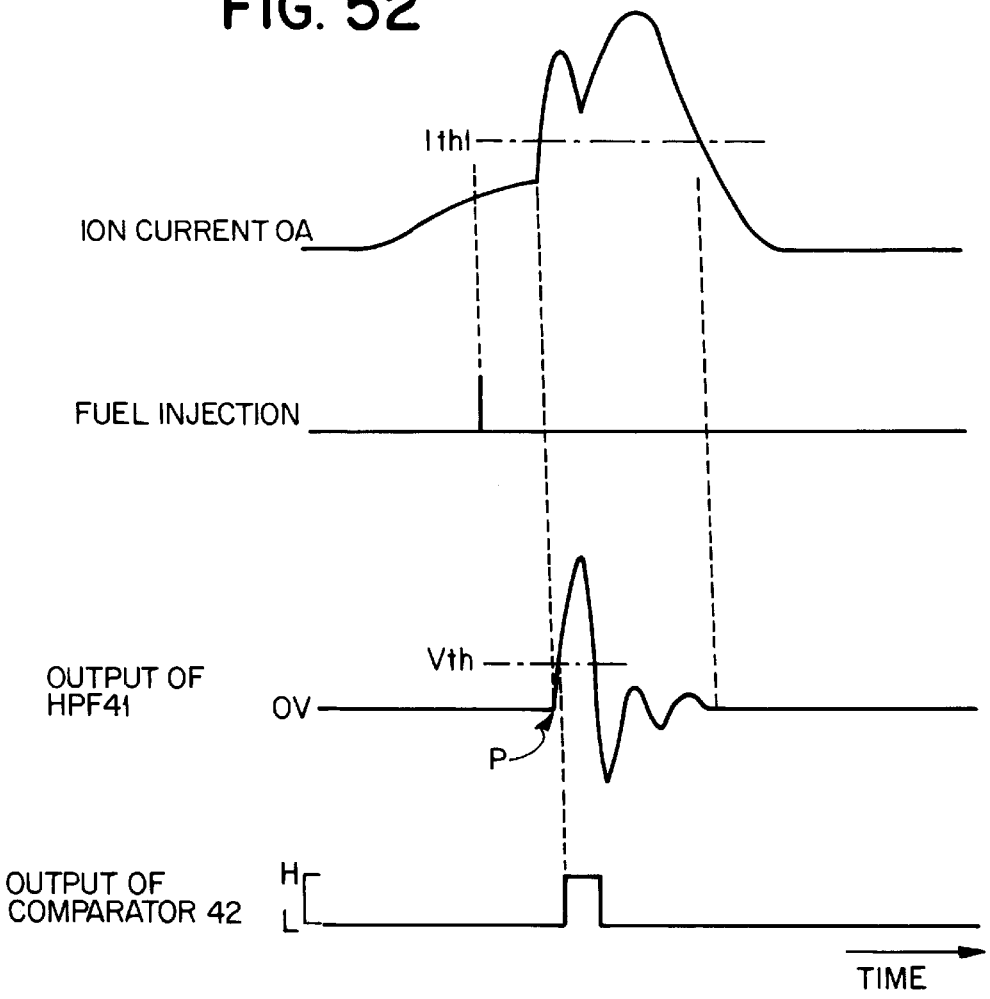
FIG. 52 is a time chart illustrating operation of ion current processing in an 18th embodiment.

Referring next to FIGS. 51 and 52, the 18th embodiment will be described. The embodiment will be described mainly with respect to points different from the seventh embodiment without the detailed description to portions common to those in the seventh embodiment (FIGS. 20 to 33).

FIG. 51 shows general structure of an ion current detecting system according to the 18th embodiment. In the drawing, an HPF (high-pass filter) 81 is connected to a signal output portion of the potentiometer 27. In the embodiment, the HPF 81 is designed to pass frequency signals of about 200 Hz or higher. The output of the HPF 81 is connected to a non-inverting input terminal of a comparator 82 constituting comparison means. The comparator 82 compares the output of the HPF 81 with a threshold voltage Vth input to an inverting input terminal of the comparator 82 to output a binary signal of a logical high level or a logical low level to a data processor or the ECU 30 according to the comparison result.

The ion current detecting system is operated as follows. The control operation executed by the ECU 30 is almost the same as that in the seventh embodiment of FIG. 23 except in that this embodiment sets a threshold Ith to be compared with an ion current value Ip to a value larger than the set value in the seventh embodiment so as to reduce the number of times the switching circuit 25 is operated to switch over to the heating-element running state for removal of adhered carbon. Since the main object of the seventh embodiment is to remove the carbon adhered, the threshold Ith (see step 208 of FIG. 23) for use in comparing and judging a leakage current (ion current value Ip) is set to a relatively small value. In contrast, the embodiment sets the threshold to a value near the maximum value within an acceptable range in which the combustion conditions can be judged from the ion current detected (Ithl of FIG. 52 is larger than Ith of FIG. 6(*b*)).

Then, at step 208 of FIG. 23 executed by the ECU 30, an ion current value Ip detected in the fuel injection stage is compared with the threshold Ithl, and only when Ip≧Ithl, the switching circuit 25 temporarily switches over from the ion current detecting state to the heating-element running state.

As shown in FIG. 52, since the ion current value Ip becomes smaller than the threshold Ithl even when some leakage current flows, the ion current detecting state is maintained. Under this condition, the output of the HPF 81 is input to the comparator 82 and compared with the given threshold voltage Vth. Since the timing at which the output of the HPF 81 rises (timing P in FIG. 52) corresponds to the fuel ignition stage, the output of the comparator 82 (a signal built up to the logical high level) becomes suitable for the fuel ignition stage. The ECU 30 then judges the fuel ignition stage from the output of the comparator 82. If a flame failure occurs, since the output of the comparator 82 is never built up to the logical high level, the ECU 30 will judge therefrom that a flame failure has occurred.

As discussed above, the embodiment shows not only the same effects as those of the seventh embodiment, but also the following effects.

(a) In the embodiment, the ion current detecting system is such that the HPF 81 is provided to the output of the potentiometer 27 that corresponds to the signal output portion of the ion current detector, and the detection signal is input to the ECU 30. Since the HPF 81 is incorporated in the system circuitry, the ion current due to combustion can be separated from leakage current due to a failure of insulation even when the carbon adheres to the ion current detecting electrode 14 of the glow plug, thereby detecting ion current securely. Further, since the combustion condition information such as ignition stage is judged from the output waveform of the HPF 81, the judgment processing becomes easy to perform.

(b) In the embodiment, the threshold Ith1 (see FIG. 52) for use in judging leakage current is set to a value near the acceptable maximum value. It is therefore possible to separate ion current from leakage current even if some leakage current flows. If the threshold Ith1 for use in judging leakage current increases within the acceptable range, the number of times the adhered carbon is burnt off will be reduced. It is therefore possible to detect ion current frequently, and hence to detect the combustion conditions frequently.

(c) The ion current detecting system of the embodiment is such that the output of the HPF 81 is input to the comparator 82, the signal input to the comparator 82 is compared with the threshold voltage Vth for use in detecting combustion conditions, and the comparison result is output to the ECU 30. It is therefore possible to make it easy to detect the combustion conditions. The present invention can also be realized in the following embodiments other than the seventh embodiment.

(1) Although in the seventh embodiment a leakage current (current value Ip) is detected at the fuel injection timing (step 207 of FIG. 23), such a detection of leakage current may be carried out in other stage. For example, the leakage current may be detected at a predetermined crank angle before TDC. The predetermined crank angle is given as timing at which a pulse of a predetermined number is output. The pulse of a predetermined number is determined by a detection signal from the engine speed sensor 32. When some carbon adheres to the outer surface of the glow plug, the insulation resistance between the exposed electrode and the grounded side depends on the pressure in the combustion chamber. For this reason, the detection of leakage current may be carried out at any time as long as the pressure in the cylinder is kept high prior to fuel ignition, i.e., at any time in the compression stage. Although the detection of leakage current are preferably carried out in the compression stage, it is not limited by such a timing period since the leakage current can be observed in any timing periods when a large amount of carbon adheres to the outer surface of the glow plug.

Figure 53:
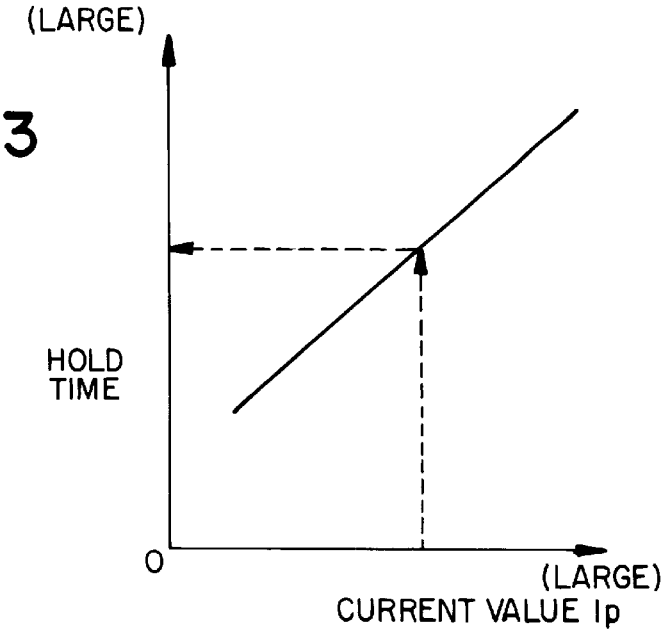
FIG. 53 is a graph for setting the time of temporarily holding the switching circuit in the heating-element running state under the ion current detecting electrode in another embodiment.

(2) In the above embodiment, the switching circuit 25 is held in the heating-element running state for a predetermined period of time (two seconds) at step 210 of FIG. 23, but the hold time may be variable. For example, as shown in FIG. 53, the time the heating-element running state is held (hold time) is set according to the current value Ip read at step 207 of FIG. 23. As apparent from FIG. 53, the hold time is set longer as the current value Ip (leakage current) becomes large. It is therefore possible to remove adhered carbon more securely. The characteristic shown in FIG. 53 can also be found in the form of a non-linear function.

(3) The form of the glow plug may be changed as follow. The heating element 7 and the ion current detecting electrode 14 may be provided separately with establishing an electrical connection therebetween. Any forms are possible as long as an exposed electrode portion is provided at a portion of the heat resisting insulator 8.

Further, although the above embodiment used an all ceramic type glow plug, the glow plug may be other types. For example, a coil-like metal wire (e.g., tungsten wire) may be used as a heating element, which is embedded in a heat resisting insulator made of a ceramic material, with a portion of the metal wire electrically connected to an ion current detecting electrode (exposed electrode portion) exposed to the combustion flame. Even this case can provide an inexpensive glow plug having an ion current detecting function. The heating performance of the heating element can also be maintained for long periods.

(4) In the above embodiments, the switching circuit 25 consisting of two 2-position switches 25 is used for switching over between the heating-element running state and the ion current detecting state. Such switch structure may be changed. For example, a semiconductor switch (transistor, thyristor or the like) capable of handling high current can be used instead as long as the switch has the ability to switch over between the two states.

(5) Although in the above embodiment a common DC power source (vehicle battery 34) is used in both the heating-element running state and the ion current detecting state, two DC power sources may be used. Specifically, a heating-element power source is provided for running the heating element 7 hot and an ion current detecting power source is provided for detecting ion current. For example, a 12-volt DC power source (vehicle battery) is used as the heating-element power source and a 50-volt DC power source is used as the ion current detecting power source.

(6) In the above embodiments, the present invention is applied to the ion current detector for detecting combustion ions in the Diesel engine having the turbulence chamber. However, it may be applied to a so-called direct-injection engine which has a mechanism for directly injecting the fuel into the combustion chamber. The present invention may also be applied to other types of apparatuses. For example, in an apparatus for burning unburnt fuel in an exhaust pipe of a gasoline engine, the ion current detector of the present invention can be used for detecting combustion ions produced by burning the unburnt fuel. In this cases the combustion conditions of the unburnt fuel can be judged from the ion current detected by the ion current detector.

(7) Although in the 18th embodiment the output of the HPF 81 is input to the comparator 82, such an arrangement may be changed. For example, the output of the HPF 81 may be directly input to the ECU 30 in which judgment on the ignition stage or determination of whether a flame failure is present or absent is computed. In this case, the ECU 30 corresponds to comparison means as claimed.

(8) Although in the 18th embodiment the HPF 81 has a cut-off frequency of 200 Hz, such a set value may be changed. The HPF cut-off frequency may be set within a range in which the HPF can separate ion current due to combustion from leakage current due to a failure of insulation. According to the experiment performed by the inventor, it was found that the effects of the present invention became effective within a cut-off frequency of between 50 Hz and 5 kHz, preferably 100 to 500 Hz. Further, the HPF may be replaced by a differentiator constructed by a CR circuit.

<<19th Embodiment>>

Figure 54A:
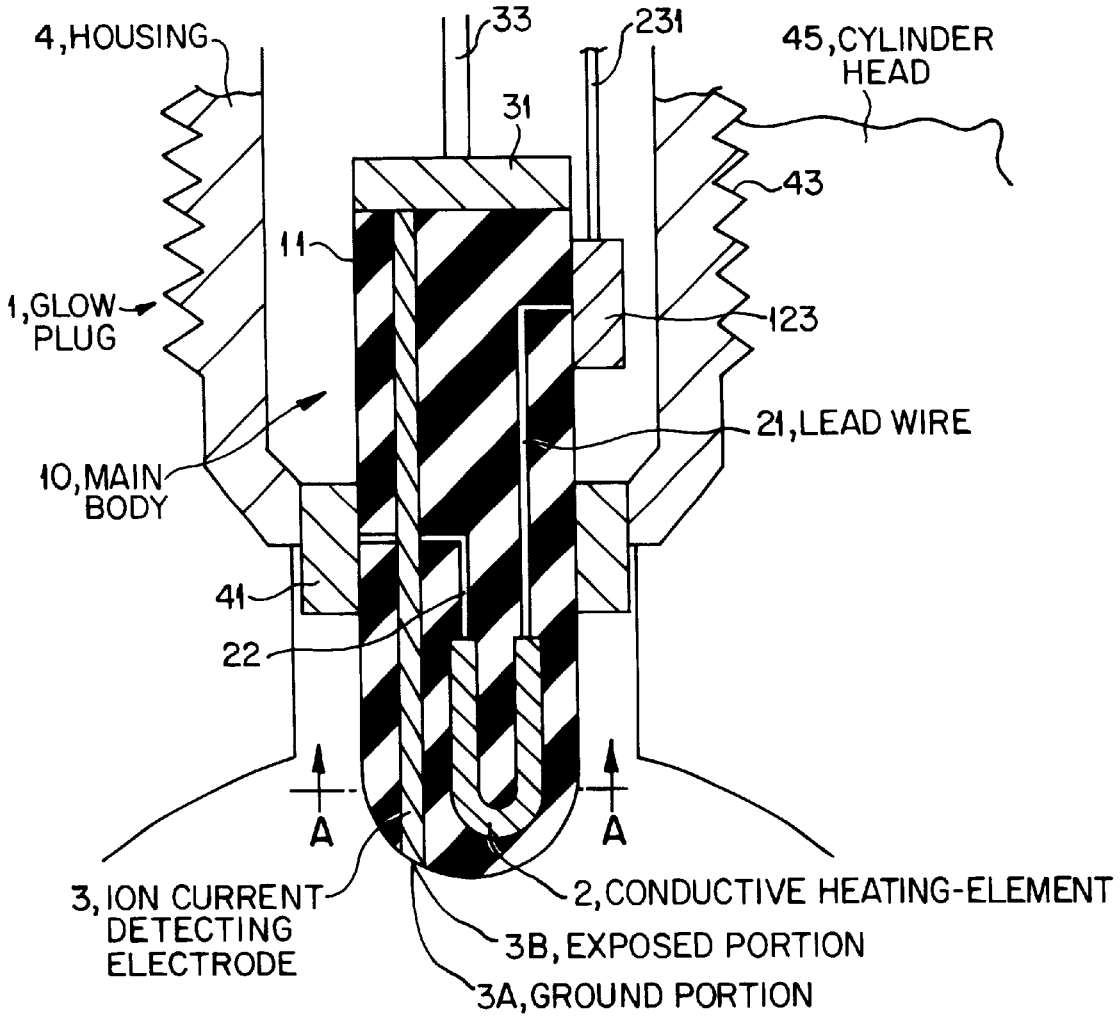
FIG. 54A is a sectional view of a glow plug main body according to a 19th embodiment.
Figure 54B:
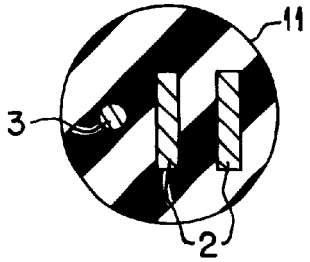
FIG. 54B is a sectional view taken along the line A—A of FIG. 54A.

As shown in FIGS. 54A and 54B, a glow plug 1 of this embodiment is constituted of a main body 10 and a housing 4 for mounting the main body 10. The main body 10 includes an insulator 11; a conductive heating-element 2 embedded in the insulator 11; and a pair of lead wires 21, 22 electrically connected to both ends of the conductive heating-element 2, drawn out to the outside of the insulator.

The main body 10 also includes an ion current detecting electrode 3 provided inside the insulator 11 for detecting an ionization state in the flame.

The ion current detecting electrode 3 of the embodiment has an exposed portion 3B contacting the flame. The entire body of the ion current detecting electrode 3 is made of a conductive mixed-sinter that is constructed by surrounding nonconductive ceramic particles with conductive ceramic particles and adding at least one oxide of rare-earth element as a sintering auxiliary.

As shown in FIGS. 56 to 59, the structure of the mixed sinter is composed of a first crystal phase K (FIG. 59) and a grain boundary phase R. Portion of the grain boundary phase R or the entire grain boundary phase R is crystallized as shown in FIG. 60 and made into a second crystal phase H containing the sintering auxiliary.

Figure 56:
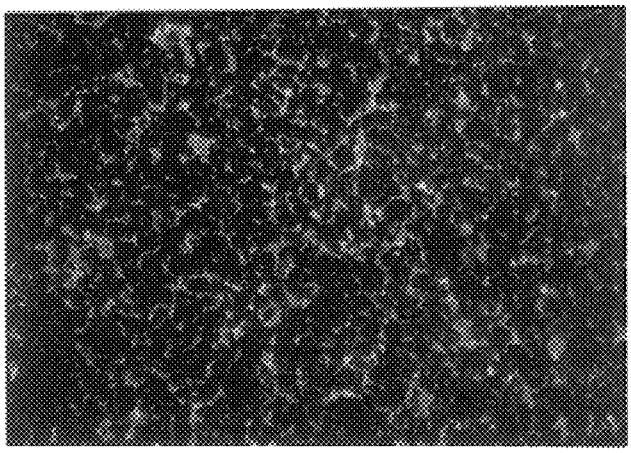
FIG. 56 is a photograph used instead of drawing, which shows the structure of a mixed sinter for an ion current detecting electrode according to the 19th embodiment (with a magnification of 350)
Figure 57:
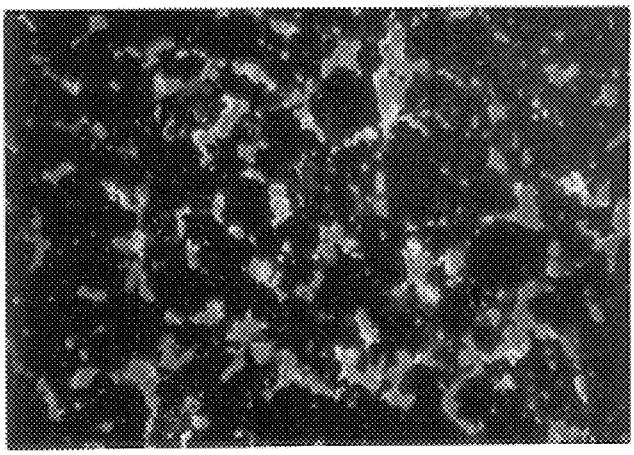
FIG. 57 is a photograph used instead of drawing, which shows the structure of the mixed sinter for the ion current detecting electrode according to the 19th embodiment with a magnification of 1000)
Figure 58:
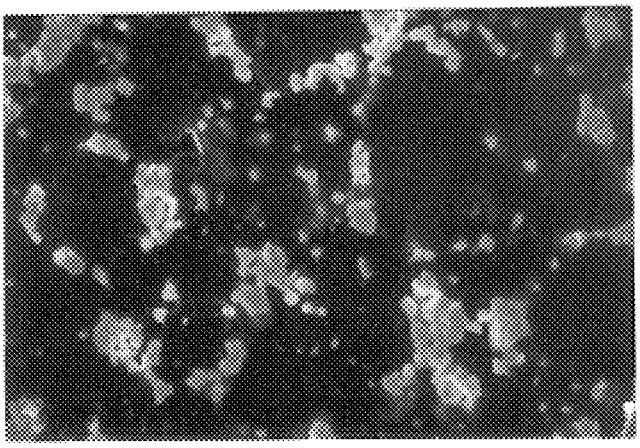
FIG. 58 is a photograph used instead of drawing, which shows the structure of the mixed sinter for the ion current detecting electrode according to the 19th embodiment with a magnification of 2000)

FIGS. 56 to 58 are SEM pictures of the sectional structure of the mixed sinter with magnifications of 350, 1000 and 2000, respectively. In these pictures, black and white portions are the first crystal phases K where the black portions are $Si_3N_4$ crystal phases, the white portions are $MoSi_2$ crystal phases, and several-nanometer boundaries between the black portions and the white portions are the grain boundary phases R.

FIG. 59 is a schematic diagram by which the above structure will be made easy to understand. FIG. 59 shows a state where the grain boundary phase R exists among the three first crystal phases K made of $Si_3N_4$ crystal. FIG. 60 is an enlarged view of portion M in FIG. 59, which shows that the grain boundary is crystallized into the second crystal phase H. As a result of X-ray diffraction, it was found that more than 60% of the grain boundary phase R shown in both drawings was crystallized.

Figure 61:
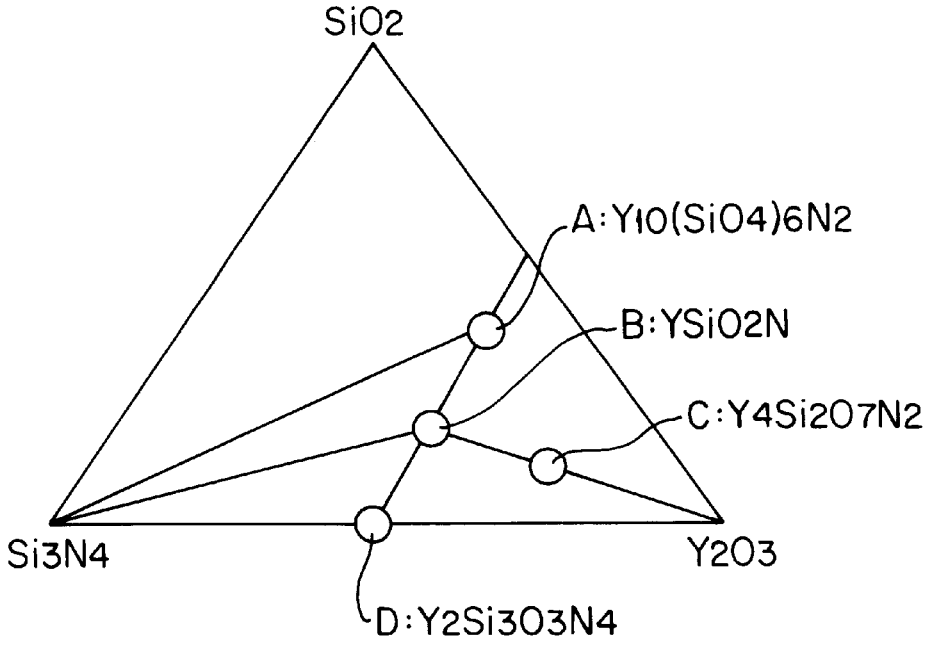
FIG. 61 is a diagram explaining the composition of a second crystal phase in a tri-phase chart of $Si_3N_4$—$SiO_2$—$Y_2O_3$.

Since the embodiment used $Y_2O_3$ as the sintering auxiliary, the crystal is shown in a tri-phase chart of $Si_3N_4$, $SiO_2$ and $Y_2O_3$ of FIG. 61. As apparent from the drawing, the crystal contains at least one of four minerals: apatite ($Y_{10}(SiO_4)_6N_2$) at point A, walestnite ($YSiO_2N$) at point B, YAM ($Y_4Si_2O_7N_2$) at point C and melilite ($Y_2Si_3O_3N_4$) at point D. $SiO_2$ is contained in the conductive ceramic-material $Si_3N_4$ as impurities.

The apatite at point A is preferably contained in the crystal in a high ratio since the apatite could resist oxidation.

The presence or absence of crystallization can be checked through X-ray diffraction and TEM. In the prior art, the grain boundary phase R is a glass phase.

Figure 55:
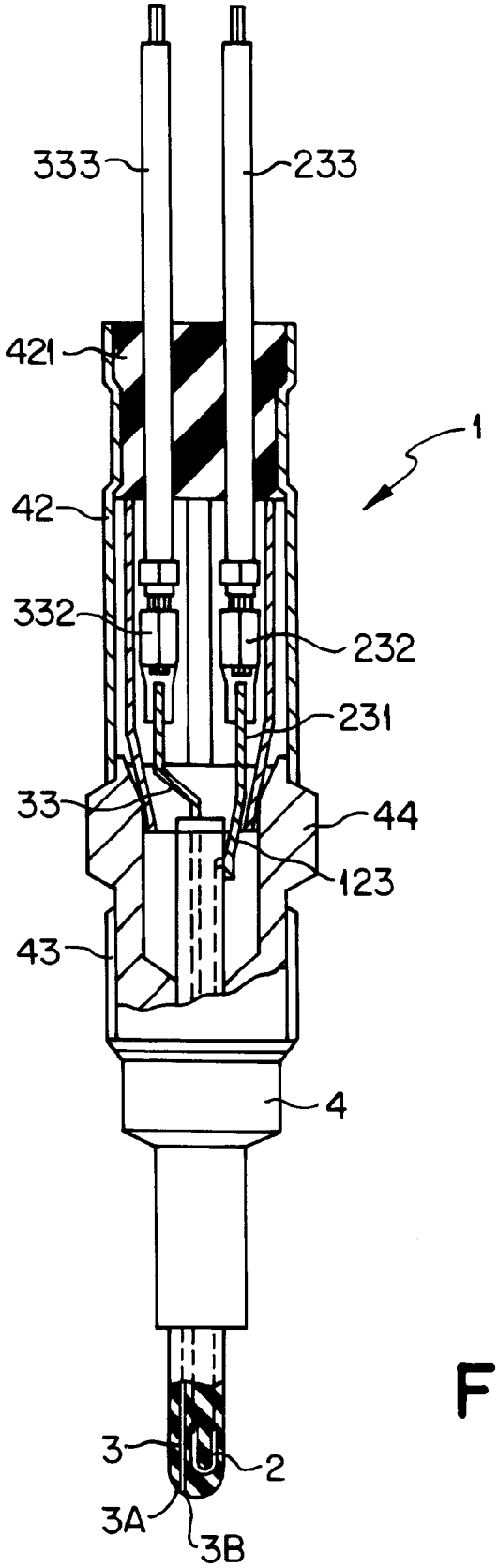
FIG. 55 is a diagram showing general structure of a glow plug according to the 19th embodiment.

As shown in FIGS. 54A and 55, the main body 10 is retained in the metal housing 4 through an annular support 41 made of metal. One lead wire 21 of the conductive heating-element 2 is pull up inside the insulator 11 and electrically connected to an internal lead wire 231 through a conductive terminal portion 123 provided at the side of the main body 10, while the other lead wire 22 is electrically connected to the housing 4 through the annular support 41. The upper portion of the ion current detecting electrode 3 is electrically connected to an internal lead wire 33 through a conductive terminal portion 31 provided at the upper end of the insulator 11.

As shown in FIG. 55, the housing 4 has the annular support 41 and a protection tube 42 provided at the upper side of the housing 4. The housing 4 also has a male screw 43 for mounting the housing 4 in the cylinder head 45 of the engine. A rubber bush 421 is fitted into the upper opening of the protection tube 42. External lead wires 233 and 333 are penetrated through or inserted into the rubber bush 421, and connected to the internal lead wires 231 and 33 through the respective connection terminals 232 and 332. The external lead wires 233 and 333 are thus electrically coupled to one end of the conductive heating-element 2 and the ion current detecting electrode 3, respectively.

As mentioned above, the other end of the conductive heating-element 2 is electrically coupled to the housing 4 through the annular support 41 (FIG. 54A). As shown in FIGS. 54A and 54B, the top portion (lower end portion) of the main body is formed into a semi-spherical shape with the top portion 3B of the ion current detecting electrode 3 exposed therefrom.

Figure 62:
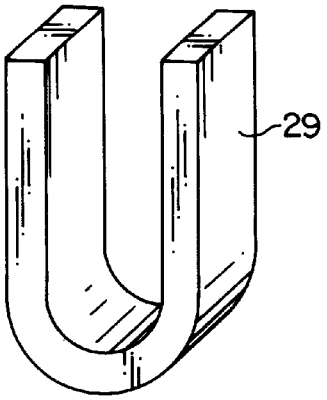
FIG. 62 is a perspective view of a molded part for a conductive heating-element according to the 19th embodiment.
Figure 63:
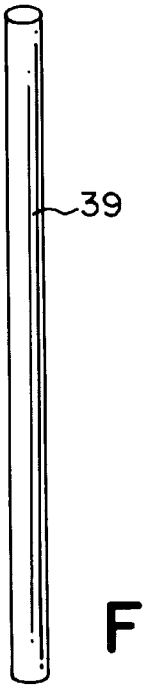
FIG. 63 is a perspective view of a molded part for an ion current detecting electrode according to the 19th embodiment.

In manufacturing the glow plug main body 10, a U-type molded part 29 for the conductive heating-element 2 and a rod-like molded part 39 for the ion current detecting electrode 3 are first prepared as shown in FIGS. 62 and 63. These molded parts 29 and 39 are made up such that the main composition of ceramic powders for the conductive heating-element 2 and the ion current detecting electrode 3 is mixed with paraffin wax and other resin and the mixture is injection-molded, or it is made up by press-molding the powders. The lead wires 21 and 22 are connected in this molding process, which are made of a refractory metal such as molybdenum or its alloy.

The molded parts 29 and 39 are then embedded in ceramic powders for the insulator 11, pressurized and baked integrally by a hot press method. The firing is performed at a pressure of 500 kgf/cm$^2$ under one atmosphere of Ar gas. Although the firing temperature varies according to the change of the sintering auxiliary used, an optimum firing temperature is selected for each condition within a range of 1500 to 1900° C.

The glow plug main body 10 with the conductive heating-element 2 and the ion current detecting electrode 3 built therein is thus obtained.

As the material for the ion current detecting electrode 3 of the embodiment, a mixture of silicon nitride ($Si_3N_4$) as a nonconductive ceramic material, molybdenum silicide ($MoSi_2$) as a conductive ceramic material and yttrium oxide ($Y_2O_3$) as a sintering auxiliary is used. Since the grain size of $Si_3N_4$ is made larger than that of $MoSi_2$, conductive particles of $MoSi_2$ are linked together around a nonconductive particle of $Si_3N_4$, so that the ion current detecting electrode 3 can display conductivity. Specifically, $MoSi_2$ having a mean diameter of 1 $\mu$m and $Si_3N_4$ having a mean diameter of 13 $\mu$m can be used. The conductive heating-element 2 also uses the same materials as the ion current detecting electrode 3.

The insulator 11 is a ceramic sinter that is constructed by adding $Y_2O_3$ as a sintering auxiliary to the main composition of $MoSi_2$ as a conductive ceramic material and $Si_3N_4$ as a nonconductive ceramic material. Since the grain size of $Si_3N_4$ is made equal to or slightly smaller than that of $MoSi_2$, the conductive particles of $MoSi_2$ are surrounded with the nonconductive particles of $Si_3N_4$ and divided into parts, so that the insulator 11 can display nonconductivity. Specifically, $MoSi_2$ having a mean diameter of 0.9 $\mu$m and $Si_3N_4$ having a mean diameter of 0.6 $\mu$m can be used.

For the conductive heating-element 2, the ion current detecting element 3 and the insulator 11, at least one of conductive materials, such as metallic carbide, silicide, nitride and boride other than $MoSi_2$, may be used. The mixing ratio between the conductive ceramic material and the nonconductive ceramic material is selected properly, e.g., in a range of 10–40 to 90–60 (wt %).

It is preferable to select an identical or similar mixing ratio among the conductive heating-element 2, the ion current detecting electrode 3 and the insulator 11 since such a case makes differences small such as in thermal expansion coefficient. For the sintering auxiliary, at least one oxide kind of rare-earth element other than $Y_2O_{31}$ such as one combined with, yttrium, lanthanum and neodymium, may be used.

Figure 64:
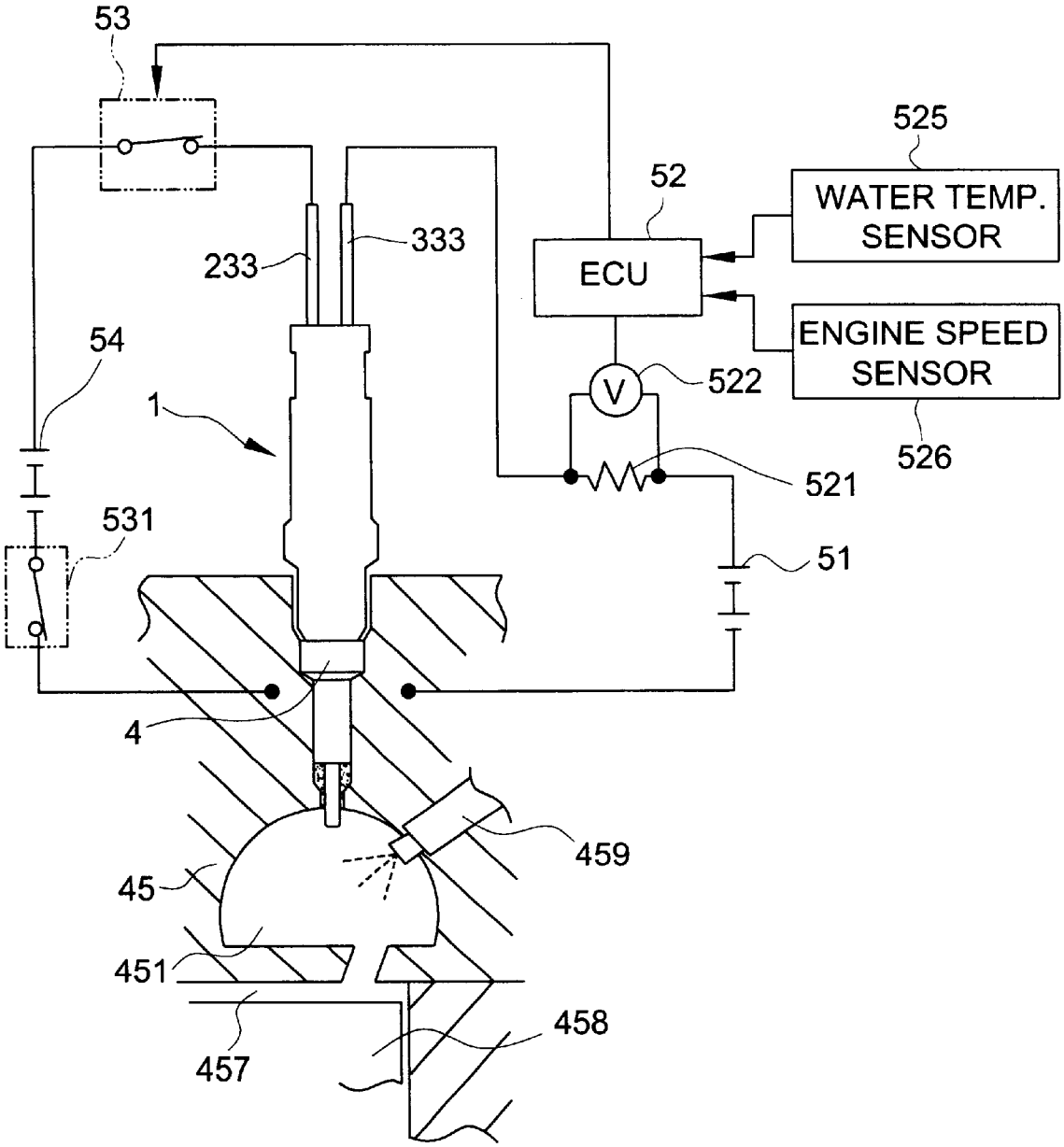
FIG. 64 is a diagram of a glow plug actuator circuit according to the 19th embodiment.

As shown in FIG. 64, the glow plug 1, constituted of the main body 10, the housing 4 and such, is mounted in the cylinder head 45 by fastening the male screw portion of the housing 4. The glow plug is so mounted that the top portion of the glow plug main body 10 will project into a turbulence chamber 451 that forms part of a combustion chamber of the cylinder head 45. In the drawing, reference numeral 457 is a main combustion chamber, 458 a piston and 459 a fuel injection nozzle.

The glow plug 1 is connected to a glow plug actuator circuit as shown in FIG. 64. In other words, the lead wire 21 coupled to one end of the conductive heating-element 2 is connected to the metal cylinder head 45 through the external lead wire 233, glow relays 53, 531 and a 12-volt battery 54, and further, it is connected to the other end of the conductive heating-element 2 through the cylinder head 45, the housing 4, the annular support 41 and the lead wire 22 of the main body 10 (FIG. 54A), thus forming a heating circuit of the conductive heating-element 2.

The external lead wire 333 of the ion current detecting electrode 3 is connected to the cylinder head 45 through an ion current detecting resistor 521 and a DC power source 51. A potentiometer 522 is provided to the ion current detecting resistor 521 for detecting ion current, which is connected to an ECU (electronic control unit) 52. The glow relays 53 and 531, a water temperature sensor 525 for sensing temperature of engine cooling water, and an engine speed sensor 526 are also connected to the ECU 52.

When using the glow plug 1 such as one shown in FIG. 64, the ECU 52 first turns on the glow relays 53 and 531 at the beginning of engine start. Consequently, the battery 54 and the conductive heating-element 2 of the glow plug are closed, and the conductive heating-element 2 of the glow plug main body 10 is energized to generate heat. The glow plug 1 thus becomes heating state to heat the turbulence chamber 451 up to ignition temperature.

Fuel is ignited each time the fuel is injected from the fuel injection nozzle 459. The piston 458 is then operated in each fuel ignition stage to drive the engine.

As mentioned above, since ions are created while burning the fuel, the ion current is detected by using the ion current detecting electrode 3, the ion current detecting resistor 521 and the potentiometer 522.

Stated more specifically, since a voltage is applied between the ion current detecting electrode 3 and the cylinder head 45 by means of the 12-volt DC power source 51, an ion current produced by active ions in the combustion flame in the turbulence chamber 451 flows in a current path through the ion current detecting resistor 521.

The resistance of the ion current detecting resistor 521 is about 500 kΩ. The ion current flowing through the ion current detecting resistor 521 is detected by the potentiometer 522 as a potential difference between both ends of the resistor 521.

The principle of ion current detection will be described in brief. When the fuel is fed to the turbulence chamber 451 through the fuel injection nozzle 459 and a combustion event occurs, a large number of positive and negative ions of ionized gases are created in the flame front due to combustion. Since the battery voltage is applied between the ion current detecting electrode 3 and the cylinder head 45 facing the electrode 3, the negative ions are captured by the ion current detecting electrode 3 and the positive ions are captured by the cylinder head 45.

As a result, such a current path is formed, and an ion current flowing in the current path is detected as a potential difference between both ends of the ion current detecting resistor 521.

The ECU 52 mainly includes a well-known microcomputer and an A/D converter, not shown, the microcomputer including a CPU, a ROM, a RAM, an I/O circuit and such. The ECU 52 receives a detection signal from the potentiometer 522.

The ECU 52 also receives a detection signal from the water temperature sensor 522 for sensing temperature of engine cooling water, and a detection signal from the engine speed sensor 526 for sensing engine speed according to the crank angle of the engine. The ECU 52 thus detects a water temperature Tw and an engine speed Ne based on the detection signals from the sensors 522 and 526, respectively.

When the Diesel engine starts at low temperature, the ECU 52 runs the conductive heating-element 2 of the glow plug 1 to generate heat and to promote ignition and combustion of fuel. The ion current is detected immediately after the Diesel engine has started. Since the glow relays 53 and 531 are in the on state at the beginning of engine start, the conductive heating-element 2 is held in the running state.

Figure 65:
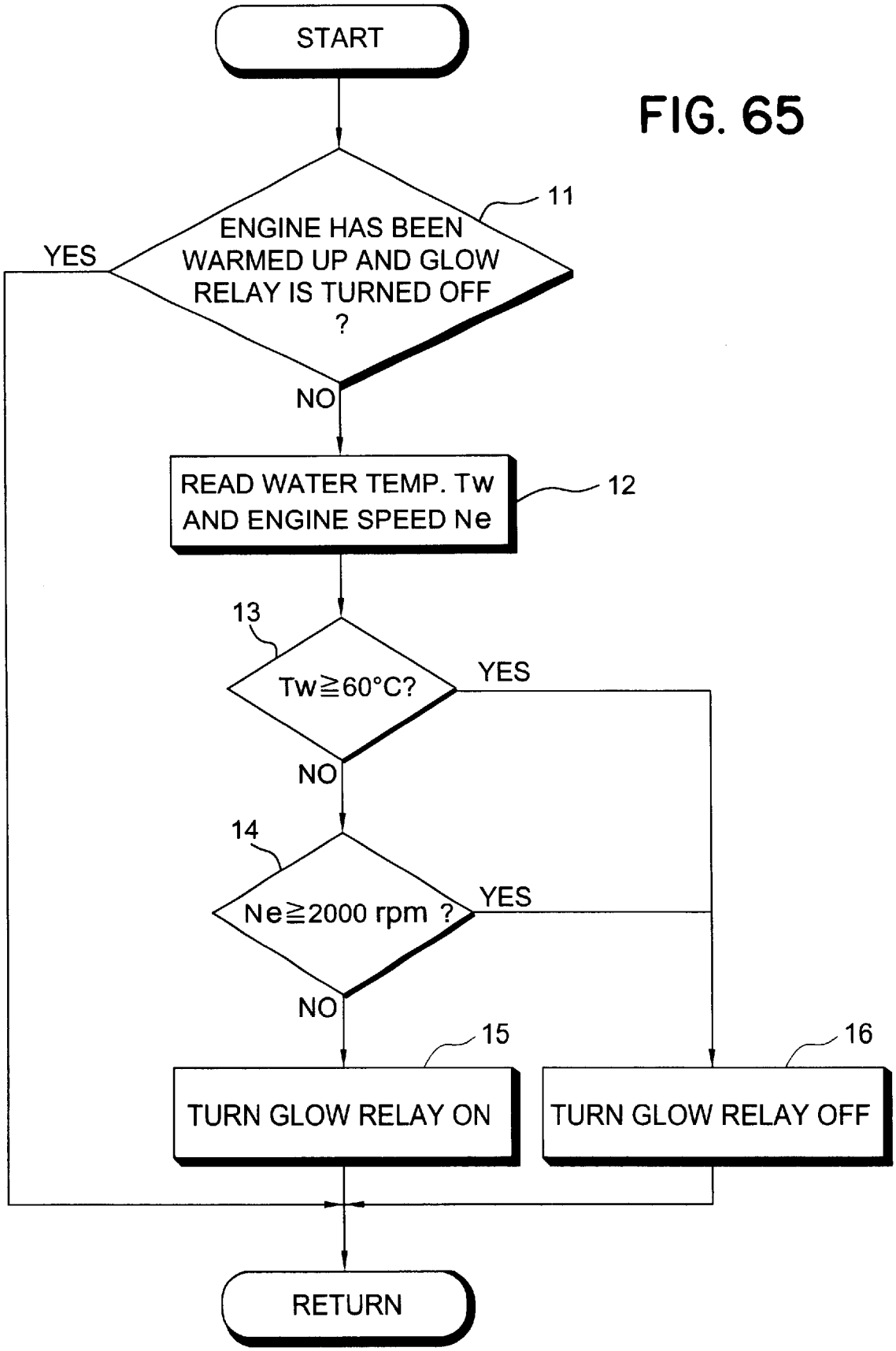
FIG. 65 is a flowchart of glow plug start-up operation in a glow plug actuating system according to the 19th embodiment.

Hereinbelow, the ON/OFF switching process of the glow relays 53 and 531 will be described with reference to a flowchart of FIG. 65. Such a switching action as shown in FIG. 65 is taken by an interrupt occurring at given timing. When starting the processing of FIG. 65, the ECU 52 determines at step 11 whether or not warm-up of the engine has been completed and the glow relays 53 and 531 are off-state. Since a negative determination is made at step 11 at the beginning of engine start, the ECU 52 reads the water temperature Tw and the engine speed Ne at the subsequent step 12.

The ECU 52 then determines at step 13, whether or not the water temperature Tw is higher than a predetermined warm-up temperature (60° C. in the embodiment), and at step 14, whether or not the engine speed Ne reaches a predetermined engine speed (2000 rpm in the embodiment).

If negative determinations are made at both steps 13 and 14, the ECU 52 regards the engine as not warmed up completely so further heating by the conductive heating-element 2 of the glow plug 1 is necessary, and advances the processing to step 15.

If a positive determination is made at either step 13 or step 14, the ECU 52 regards the engine as having been warmed up completely, or the heating by the glow plug 1 as being unnecessary, and advances the processing to step 16.

In the case the processing goes to step 15, the ECU 52 keeps the glow relays 53, 531 in the on state. In this state, ignition and combustion of fuel is continued by the heating action of the glow plug 1. When the processing goes to step 16, the ECU 52 turns off the glow relays 53 and 531.

Figure 66A:
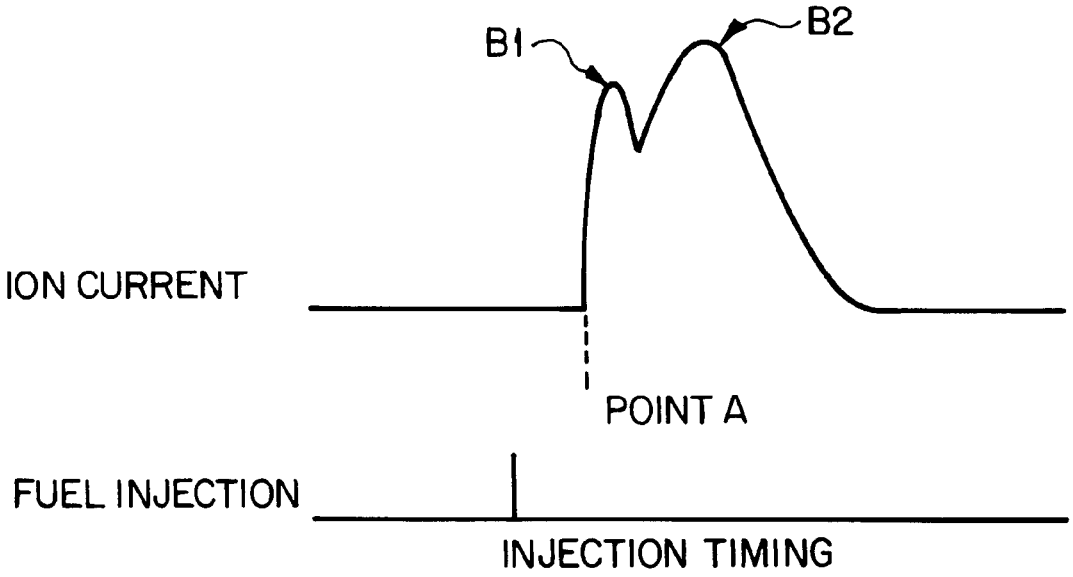
FIG. 66A is a waveform chart showing an ion current detected during normal operation in the 19th embodiment.

FIG. 66A is a chart of a current waveform resulting from the observation of ion current with an oscilloscope, the ion current produced when burning the fuel. In the drawing, a portion of the waveform with the voltage suddenly rising immediately after fuel injection (compression TDC) is of an ion current due to fuel combustion. In this waveform, point A shows a combustion start position, which corresponds to an ignition stage.

The waveform has two peaks: the one, first peak B1, created by active ions in the diffused flame front, is observed early in the combustion event; and the other, second peak B2, created by a re-ionization effect due to an increase in internal pressure of the cylinder, is observed in the middle and late stages of the combustion event.

The ECU 52 detects an actual ignition stage from the first peak B1 of the ion current waveform to perform feedback control of the ignition stage in such a manner that the actual ignition stage detected is made correspondent to a target ignition stage. The ECU 52 also detects a combustion condition, such as abnormal combustion or flame failure, from the second peak B2 of the ion current waveform to reflect the detection result on the fuel injection control. The ion current is thus reflected on the fuel injection control so that the engine operation can be controlled precisely.

Figure 66B:
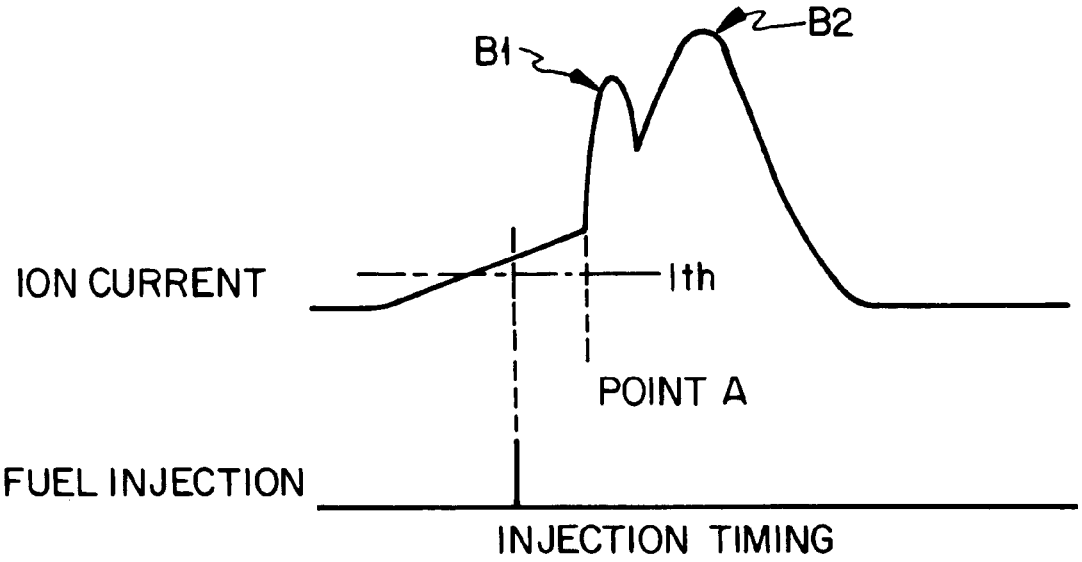
FIG. 66B a diagram showing an ion current detected when smoke or smudge occurs in the 19th embodiment.

When carbon or soot due to fuel combustion adheres to the ion current detecting electrode 3 of the glow plug, i.e., when smoke or smudge occurs, the ion current tends to be kept at low level before the fuel injection stage and to rise after the fuel injection stage as shown in FIG. 66B (compare FIGS. 66A and 66B). In FIG. 66B, Ith is a judgment level (threshold) of wave height, which is used to detect the degree of smoke or smudge and determine whether or not the glow relays 53 and 531 should be turned on.

When such smudge occurs, the glow relays 53 and 531 are turned on to run the conductive heating-element 2 hot, thus burning off the adhered carbon.

Figure 67:
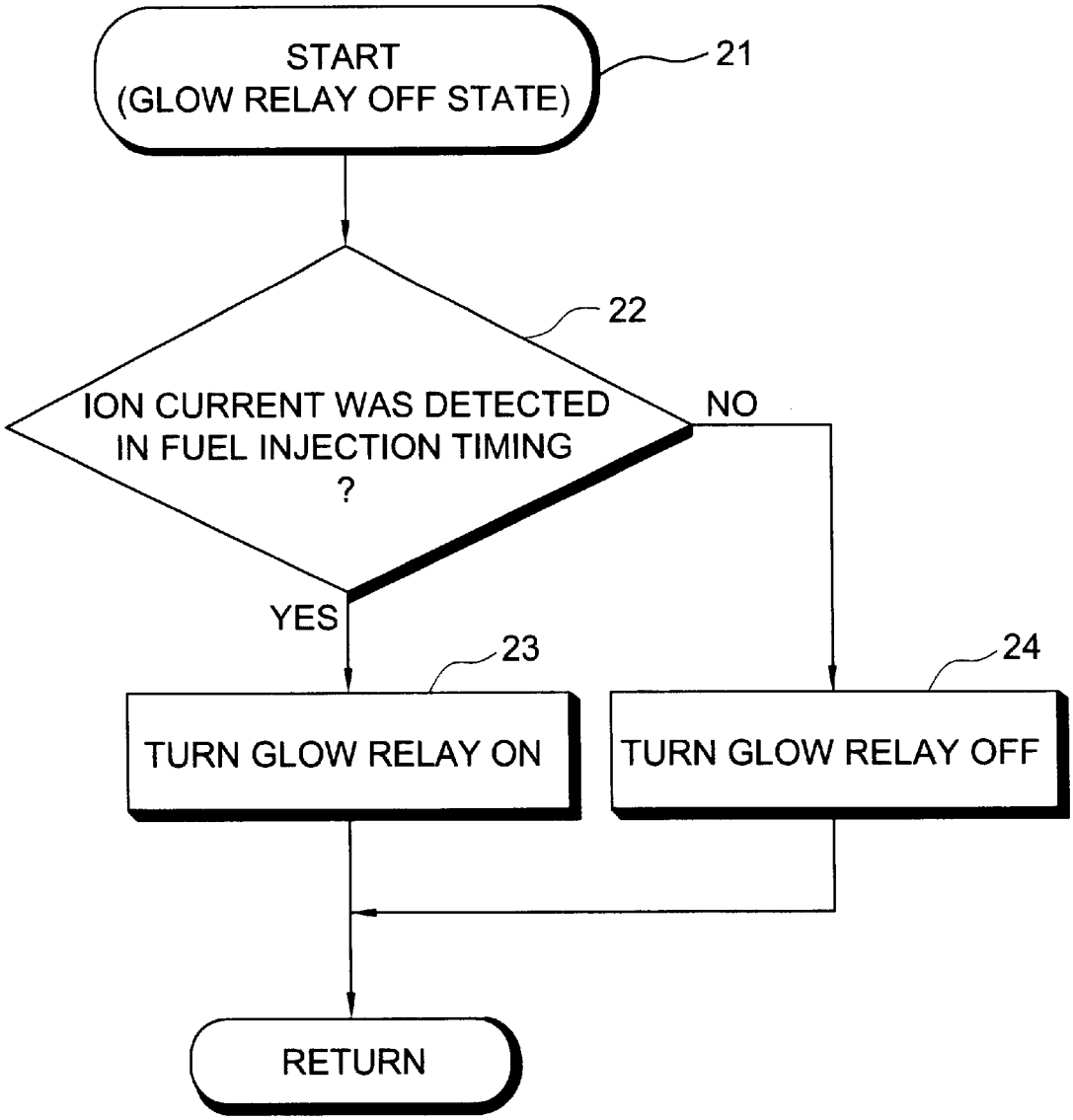
FIG. 67 is a flowchart showing smoke judgment in the 19th embodiment.

FIG. 67 is a flowchart showing the procedure of carbon burn-off operation executed by the ECU 52 in the circuit of FIG. 64.

In the drawing, when the glow relays 53 and 531 are off-state at step 21, the ECU 52 determines whether or not such an abnormal ion current (FIG. 66B) has been detected in the fuel injection stage. If not detected, the ECU 52 advances to step 24 and the glow relays 53 and 531 remain off-state. If such an abnormal ion current has been detected, the ECU 52 advances to step 23 at which the glow relays 53, 531 are turned on and the conductive heating-element 2 of the glow plug is run hot to burn off the carbon.

As discussed above, the glow plug of the embodiment is such that the conductive heating-element 2, the lead wires 21, 22, and the ion current detecting electrode 3 are provided inside the insulator 11 and integrally constructed with the insulator 11. For this reason, the glow action (heating action) of the conductive heating-element 2 and the ion current detection by the ion current detecting electrode 3 can be carried out by one glow plug.

Even when some carbon adhered to the ion current detecting electrode 3, since the conductive heating-element 2 located near the ion current detecting electrode 3 is energized to generate heat, the adhered carbon can be burnt off to return the ion current detecting electrode 3 to the normal state. It is therefore possible to detect ion current precisely. Further, since the top portion of the insulator 11 is made into the semi-spherical shape, thermal shock in the combustion chamber can be absorbed.

Furthermore, the embodiment is such that the grain boundary phase is crystallized into the second crystal phase. For this reason, durability of the ion current detecting electrode of the embodiment can be improved.

When the grain boundary phase is a glass phase, the grain boundary phase may be softened and liquated out at high temperature (the highest temperature is about 1400° C.) under actual operation of the glow plug because the melting point of the glass phase is relatively low. In such a case, if the injected fuel fog is directly hit the glass phase, a crack or cracks can occur on the surface of the ion current detecting electrode because of the thermal shock.

In contrast, the embodiment is such that the majority of the grain boundary phase R is crystallized into the second crystal phase H. Since the second crystal phase has a melting point higher than the glass phase, there is no danger of softening and liquation of the second crystal phase that may occur in the prior art. Such an ion current detecting electrode of the embodiment could resist thermal shock and not suffer any damage.

<<20th Embodiment>>

In this embodiment, the flowing experiments were performed in order to confirm the effects of the present invention.

In the experiments, test samples were first produced. For the insulator, the conductive heating-element and the ion current detecting electrode, the common basic composition of 70 wt % $Si_3N_4$ and 30 wt % $MoSi_2$ was prepared. The insulator used $MoSi_2$ having a mean diameter of 0.9 $\mu$m and $Si_3N_4$ having a mean diameter of 0.6 $\mu$m, while the conductive heating-element and the ion current detecting electrode used $MoSi_2$ having a mean diameter of 0.9 $\mu$m and $Si_3N_4$ having a mean diameter of 13 $\mu$m.

A same amount of $Y_2O_3$ was then added as the sintering auxiliary to the insulator and the conductive heating-element to produce a ceramic glow plug with an ion current detecting electrode such as one described in the 19th embodiment (FIG. 55). The ratio of the amount of $Y_2O_3$ to the total weight of $Si_3N_4$ and $MoSi_2$ was changed within a range of 1 to 30 wt % as shown in Table 1 to produce samples No. 1 to No. 6. A heater with an ion current detecting electrode and an insulator, both constructed of the conventional composition of 7 wt % $Y_2O_3$ and 3 wt % $Al_2O_3$, was also produced for use as a comparative sample (No. 7).

Using the samples No. 1 to No. 7, a thermal test for checking changes in resistance due to repetition of conducting periods was performed with a repeat-cycle of one minute conduction and one minute cutoff. Each heater was initially heated up to a saturation temperature of 1400° C. in conduction and cooled by a fan below 100° C. in cutoff. The same test was performed four times per sample with the life cycle set to the number of cycles the saturation temperature of the heater in conduction was once reduced by 100° C. and became 1300° C. due to a rise of the resistance. The test results are shown in Table 1. The presence or absence of liquation of the glass phase is also shown in Table 1.

Next, an underwater spalling test was performed to check occurrence of a crack. The glow plug was first energized and run hot up to a given saturation temperature. The top portion of the glow plug main body projecting from the annular support was then immersed in the water at temperature of 20° C. to check the presence or absence of a crack on the surface.

Specifically, the underwater spalling test was performed at saturation temperature of 500° C., and when no crack occurred, the saturation temperature is increased by 100° C. and the underwater spalling test was performed again at the saturation temperature of 600° C. The underwater spalling test was repeated until the saturation temperature reached 1400° C. or a crack occurred while increasing the saturation temperature by 100° C. per test. The same test was performed four times per sample. The test results are also shown in Table 1.

In Table 1, all of the samples No. 1 to No. 6 with $Y_2O_3$ added alone improve their life with the thermal test and glass liquation compared to the sample No. 7 of the conventional composition. The life cycle is preferably set to 10000 cycles or more by taking into account reliability in the market. With the samples No. 1 to No. 6, desired results are obtained in 10000 to 15000 cycles.

With occurrence of a crack, the samples No. 1 to No. 6 are also improved compared to the sample No. 7, and particularly, no crack is found in the samples No. 2 to No. 5 with 3–25 wt % $Y_2O_3$ even at the temperature of 1400° C.

As discussed above, the addition of 3–25 wt % $Y_2O_3$ results in a smaller change in resistance at high temperature of 1400° C., thereby obtaining a ceramic glow plug with an ion current detecting electrode that could resist glass liquation and thermal shock.

TABLE 1

| | | | Test result | | |
|---|---|---|---|---|---|
| | Basic | Sintering | Thermal test | | Underwater spalling |
| Sample No. | composition wt % | auxiliary wt % | Life cycle | Glass liquation | Crack development |
| 1 | $70Si_3N_4$— | $1Y_2O_3$ | 10500 | not exist | 1300° C.-one |
| 2 | $30MoSi_2$ | $3Y_2O_3$ | 11500 | not exist | 1400° C.-none |
| 3 | | $10Y_2O_3$ | 15000 | not exist | 1400° C.-none |
| 4 | | $20Y_2O_3$ | 12800 | not exist | 1400° C.-none |
| 5 | | $25Y_2O_3$ | 10700 | not exist | 1400° C.-none |
| 6 | | $30Y_2O_3$ | 10000 | not exist | 1300° C.-two |
| 7 | Same as above | $7Y_2O_3$—$3Al_2O_3$ | 2500 | exist | 1200° C.-two |

<<21st Embodiment>>

In the embodiment, the samples were produced by adding a sintering auxiliary made of $Y_2O_3$ and other oxide of rare-earth element. The basic composition was the same as that in the 20th embodiment but kinds of sintering auxiliary materials and their added amount were changed as shown in Table 2. A same amount of sintering auxiliary was added to the conductive heating-element, the ion current detecting electrode and the insulator. The samples (sample Nos. 8 to 16) were produced and tested in the same way as those in the 20th embodiment. The test results are shown in Table 2.

When comparing the results in Table 2 with the sample No. 7 (Table 1 ) of the conventional composition, all the samples are improved in the thermal test without any glass liquation and crack. Even in such a combination of $Y_2O_3$ and other oxide of rare-earth element, the change in resistance of the conductive heating-element can be reduced by setting the total amount of the sintering auxiliary in a range from 3 to 25 wt %, thus obtaining a ceramic glow plug with an ion current detecting electrode that could resist glass liquation and thermal shock.

TABLE 2

| | | | Test result | | |
|---|---|---|---|---|---|
| Sample | Basic | Sintering | Thermal test | | Underwater spalling |
| No. | composition wt % | auxiliary wt % | Life cycle | Glass liquation | Crack development |
| 8 | $70Si_3N_4$— | $2Y_2O_3$—$1Yb_2O_3$ | 10900 | not exist | None at |
| 9 | $30MoSi_2$ | $10Y_2O_3$—$5Yb_2O_3$ | 16000 | in all | 1400° C. |
| 10 | | $15Y_2O_3$—$10Yb_2O_3$ | 13000 | samples | in all |

TABLE 2-continued

| Sample No. | Basic composition wt % | Sintering auxiliary wt % | Test result: Thermal test: Life cycle | Test result: Thermal test: Glass liquation | Test result: Underwater spalling: Crack development |
|---|---|---|---|---|---|
| 11 | | $2Y_2O_3$—$1La_2O_3$ | 12500 | | samples |
| 12 | | $10Y_2O_3$—$5La_2O_3$ | 13500 | | |
| 13 | | $15Y_2O_3$—$10La_2O_3$ | 11000 | | |
| 14 | | $2Y_2O_3$—$1Nd_2O_3$ | 11500 | | |
| 15 | | $10Y_2O_3$—$5Nd_2O_3$ | 13600 | | |
| 16 | | $15Y_2O_3$—$10Nd_2O_3$ | 12500 | | |

<<22nd Embodiment>>

In the embodiment, samples were produced by adding a sintering auxiliary made of more than one kind of oxide of rare-earth element other than $Y_2O_3$. As such oxides of rare-earth element, $Yb_2O_3$, $La_2O_3$ and $Nd_2O_3$, and their combinaitons were used, and two samples were made for each sintering auxiliary by changing the total amount of addition between 3 wt % and 25 wt %. The basic composition was the same as that in the 20th embodiment, and a same amount of sintering auxiliary was added to the conductive heating-element, the ion current detecting and the insulator. The samples (Nos. 17 to 26) were thus produced and tested in the same way as the 20th embodiment did. The test results are shown in Table 3.

When comparing the results in Table 3 with the sample No. 7 (Table 1) of the conventional composition, all the samples are improved in the thermal test without any glass liquation and crack. As a result of the embodiment, it is found that any oxide of rare-earth element other than $Y_2O_3$ can be used for the sintering auxiliary, and even such a sintering auxiliary can obtain the same effects as long as the total amount of addition is between 3 wt % and 25 wt %.

TABLE 3

| Sample No. | Basic composition wt % | Sintering auxiliary wt % | Test result: Thermal test: Life cycle | Test result: Thermal test: Glass liquation | Test result: Underwater spalling: Crack development |
|---|---|---|---|---|---|
| 17 | $70Si_3N_4$— | $3Yb_2O_3$ | 11200 | not exist | None at |
| 18 | $30MoSi_2$ | $25Yb_2O_3$ | 12800 | in all | 1400° C. in |
| 19 | | $3La_2O_3$ | 11800 | samples | all samples |
| 20 | | $25La_2O_3$ | 13600 | | |
| 21 | | $3Nd_2O_3$ | 14000 | | |
| 22 | | $25Nd_2O_3$ | 11800 | | |
| 23 | | $2Yb_2O_3$—$1La_2O_3$ | 11200 | | |
| 24 | | $20Yb_2O_3$—$5La_2O_3$ | 14200 | | |
| 25 | | $2La_2O_3$—$1Nd_2O_3$ | 11000 | | |
| 26 | | $20La_2O_3$—$5Nd_2O_3$ | 11600 | | |

The 20th to 22nd embodiments teach that more than one kind of oxide of rare-earth element can be used for a sintering auxiliary by setting the total amount of addition in a range of between 3 wt % and 25 wt %. Such a construction can realize a glow plug with an ion current detecting electrode that could resist glass liquation and thermal shock.

<<23rd Embodiment>>

In the embodiment, samples (Nos. 27 to 35) were produced by adding a sintering auxiliary made of 10 wt % $Y_2O_3$ and 0.01–7 wt % $Al_2O_3$ to make the grain boundaries R of Si3N4 into mixed phases of glass and crystal. The samples were produced in the same way as the 20th embodiment did, and the thermal test and the underwater spalling test were performed as is similar to the 20th embodiment. The test results are shown in Table 4. The degree of crystallization was calculated by comparing peak intensity of the crystal phases on X-ray diffraction instruments with its atomic structure on a transmission electron microscope.

As a result of Table 4, it is found that the samples No. 28 to No. 35 that exhibit any degree of crystallization improve their life compared to the conventional composition (sample No. 27) of which the degree of crystallization is 0%. Of all the samples, No. 30 to No. 35 with a degree of crystallization of more than 5% display quite excellent effects. With temperature of crack occurrence in the underwater spalling test, the samples No. 30 to No. 35 with a degree of crystallization of more than 5% also display proper effects.

As discussed above, the samples with a degree of crystallization of more than 5% can especially improve their life, thereby realizing a ceramic glow plug with an ion current detecting electrode that could resist glass liquation and thermal shock.

Although the embodiment used a sintering auxiliary made of $Y_2O_3$ and $Al_2O_3$, the same effects can also be obtained from a different sintering auxiliary made of the other oxides of rare-earth element.

TABLE 4

| Sample No. | Degree of crystallization % | Test result: Thermal test: Life cycle | Thermal test: Glass liquation | Underwater spalling: Crack development |
|---|---|---|---|---|
| 27 | 0 | 2500 | exist | 1200° C.-two |
| 28 | 3 | 7600 | exist | 1300° C.-two |
| 29 | 4 | 9300 | not exist | 1400° C.-one |
| 30 | 5 | 12000 | not exist | 1400° C.-none |
| 31 | 10 | 15500 | not exist | 1400° C.-none |
| 32 | 20 | 27000 | not exist | 1400° C.-none |
| 33 | 30 | 52000 | not exist | 1400° C.-none |
| 34 | 60 | 96000 | not exist | 1400° C.-none |
| 35 | 90 | 11300 | not exist | 1400° C.-none |

<<24th Embodiment>>

Although the 20th to 23rd embodiments used $MoSi_2$ as a conductive ceramic material, the same effects can also be obtained from other kinds of conductive ceramic materials, such as metallic carbide, nitride and boride. To confirm this, the embodiment changed the conductive ceramic material to WC, Tac, TiN and $ZrB_2$ to produce samples. Two samples were further made for each conductive ceramic material by changing the composition of sintering auxiliary and the total amount of addition according to the sample No. 3 ($Y_2O_3$: 10 wt %) and the sample No. 7 ($Y_2O_3$: 7 wt %, $Al_2O_3$: 3 wt %). The samples (sample Nos. 36 to 43) were thus produced and tested in the same way as the 20th embodiment did.

The test results are shown in Table 5. As apparent from Table 5, even when the kind of conductive ceramic material is changed, the change in resistance can be made small by adding 10 wt % $Y_2O_3$ and providing a crystal phase in each grain boundary, thus obtaining a ceramic glow plug with an ion current detecting electrode that could resist glass liquation and thermal shock. It should be noted that the same effects can also be obtained from a different sintering auxiliary made of more than one kind of the other oxides of rare-earth element.

TABLE 5

| Sample No. | Basic composition wt % | Sintering auxiliary wt % | Test result: Thermal test: Life cycle | Thermal test: Glass liquation | Underwater spalling: Crack development |
|---|---|---|---|---|---|
| 36 | $70Si_3N_4$— | $10Y_2O_3$ | 10800 | not exist | 1400° C.-none |
| 37 | 30WC | $7Y_2O_3$—$3Al_2O_3$ | 2800 | exist | 1200° C.-two |
| 38 | $70Si_3N_4$— | $10Y_2O_3$ | 14500 | not exist | 1400° C.-none |
| 39 | 30TaC | $7Y_2O_3$—$3Al_2O_3$ | 1900 | exist | 1200° C.-two |
| 40 | $70Si_3N_4$— | $10Y_2O_3$ | 13000 | not exist | 1400° C.-none |
| 41 | 30TiN | $7Y_2O_3$—$3Al_2O_3$ | 2700 | exist | 1200° C.-two |
| 42 | $70Si_3N_4$— | $10Y_2O_3$ | 10800 | not exist | 1400° C.-none |
| 43 | $30ZrB_2$ | $7Y_2O_3$—$3Al_2O_3$ | 1800 | exist | 1200° C.-two |

<<25th Embodiment>>

Figure 68:
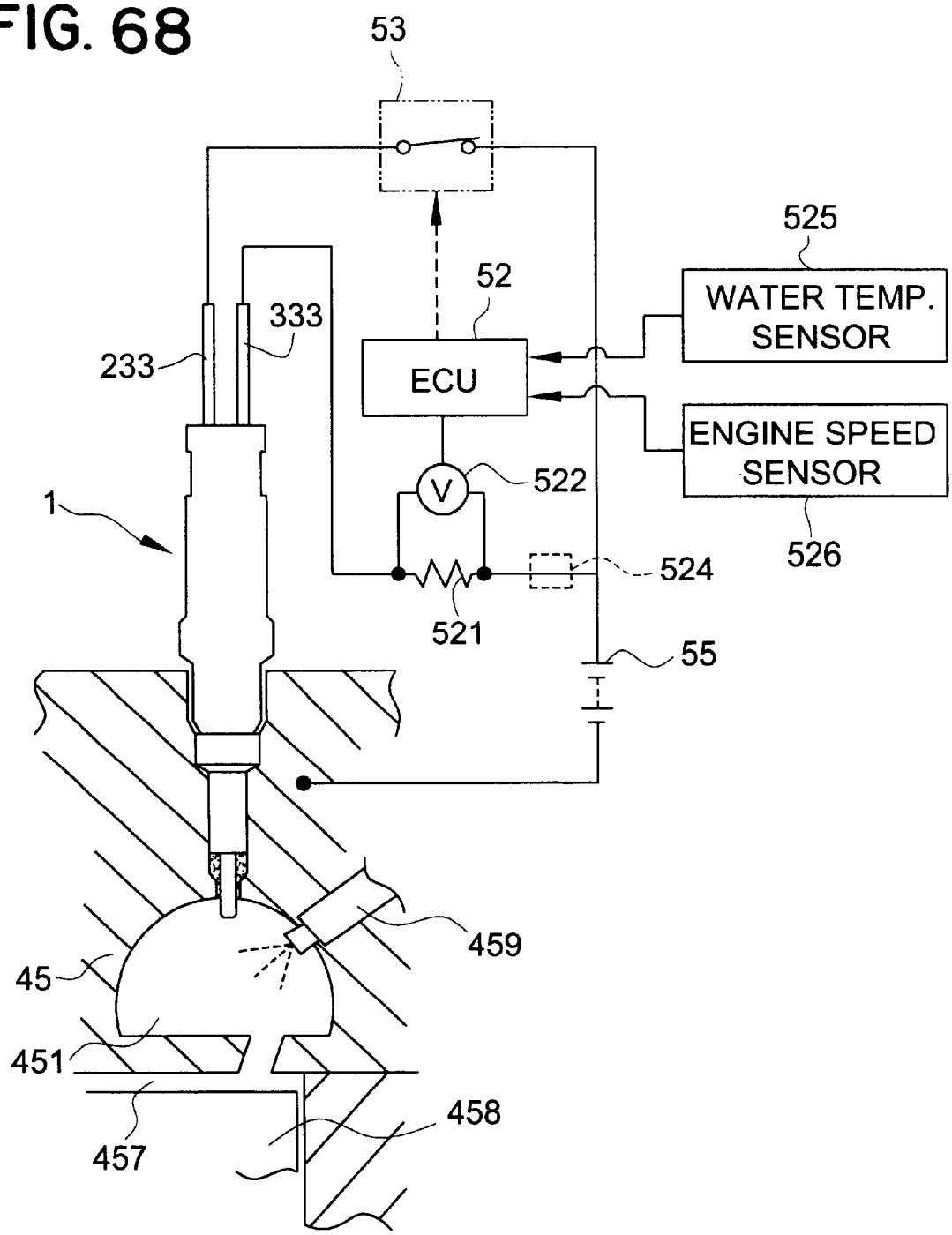
FIG. 68 is a diagram of a glow plug actuator circuit according to a 25th embodiment.

In the embodiment, the glow plug actuator circuit (FIG. 64) of the 19th embodiment is changed to one shown in FIG. 68, i.e., the battery 54 and the DC power source 51 are replaced by a single battery 55.

In such structure, a constant current/voltage circuit 524 can be provided between an ion current detecting electrode 521 and the battery 55 for the purpose of simplification and reduction in cost. The other portions are the same as those in the 19th embodiment.

Even this embodiment can show the effects common to those of the 19th embodiment. In particular, since the embodiment can provide the constant current/voltage circuit 524, it can prevent changes in applied voltage to the ion current detecting electrode due to heating of the glow plug even when using a single battery, thereby maintaining its stable detecting performance.

<<26th Embodiment>>

Figure 69A:
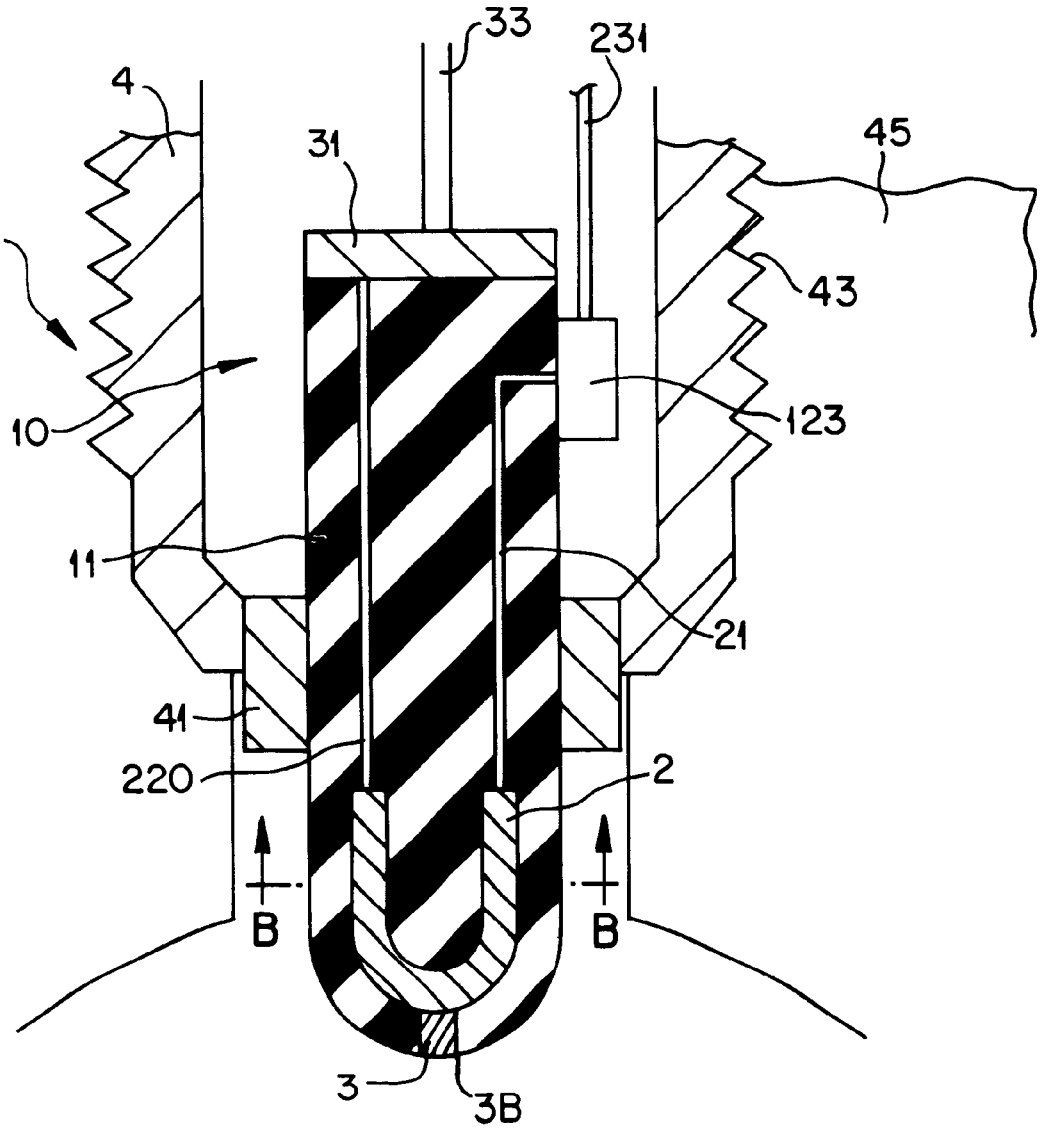
FIG. 69A is a sectional view of a glow plug main body according to a 26th embodiment.
Figure 69B:
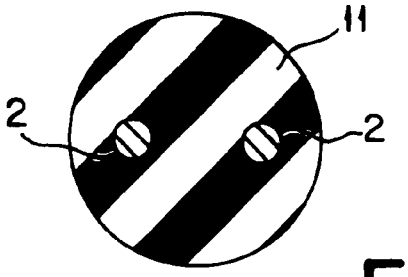
FIG. 69B is a sectional view taken along the line B—B of FIG. 69A.

As shown in FIGS. 69A and 69B, the embodiment shows a case where the ion current detecting electrode 3 is provided at the lower end of the U-type conductive heating-element 2 and integrally formed. In the embodiment, the ion current detecting electrode 3 contains a second crystal phase in each grain boundary as is similar to that in the 19th embodiment. Further, a lead wire 220 coupled to one end of the conductive heating-element 2 is connected to a terminal portion 31 provided at the upper end of the insulator 11. The lead wire 220 and the ion current detecting electrode 3 thus share the terminal portion.

Figure 70:
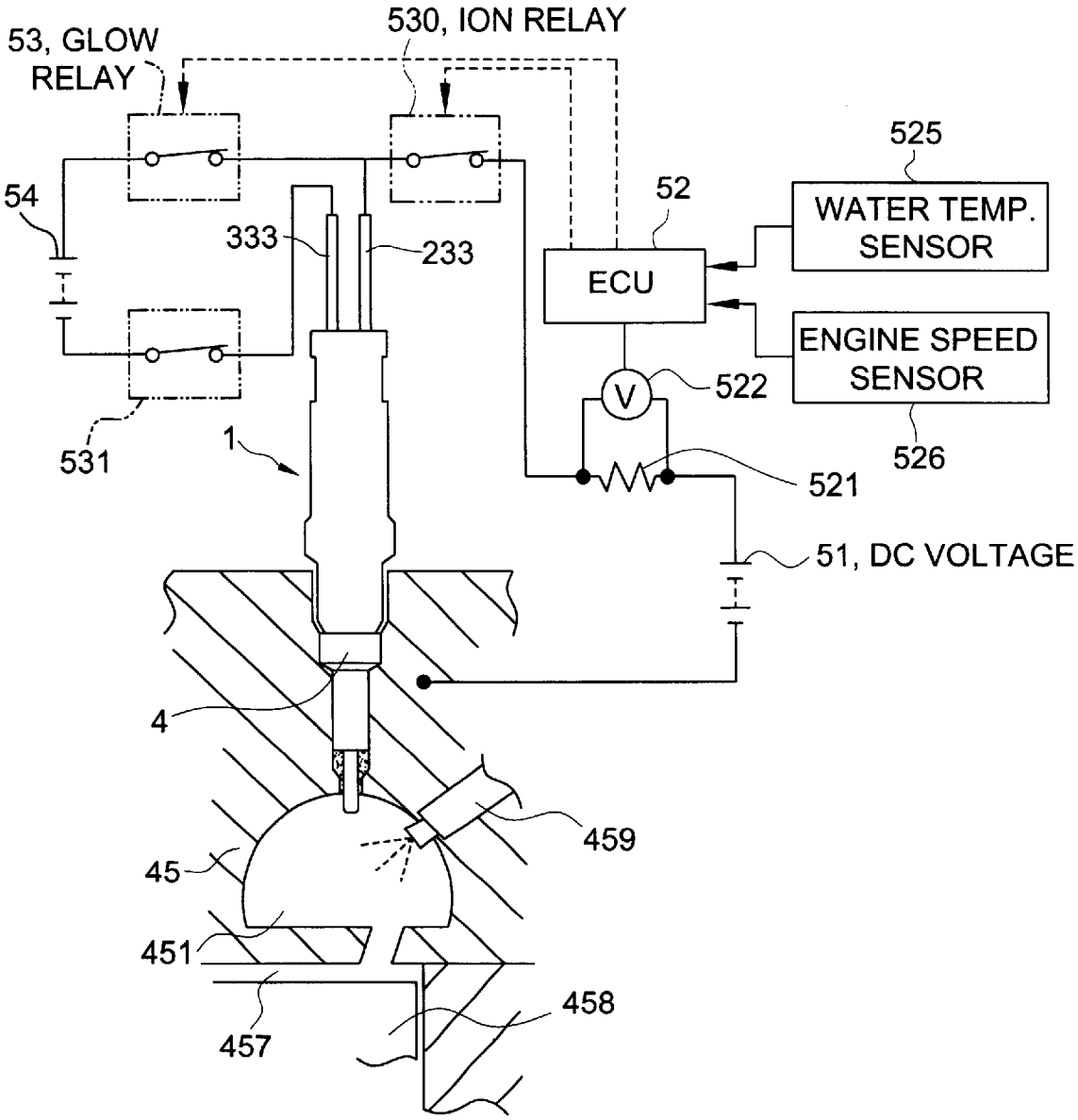
FIG. 70 is a diagram of a glow plug actuator circuit according to the 26th embodiment.

FIG. 70 shows such an actuator circuit. As shown in the drawing, the heating circuit of the conductive heating-element 2 and the ion current detecting circuit are provided with the glow relays 53, 531 and an ion relay 530. These relays are switched by a command signal from the ECU 52. In operation, the system circuitry is switched between the conductive heating-element running state and the ion current detecting state.

Figure 71:
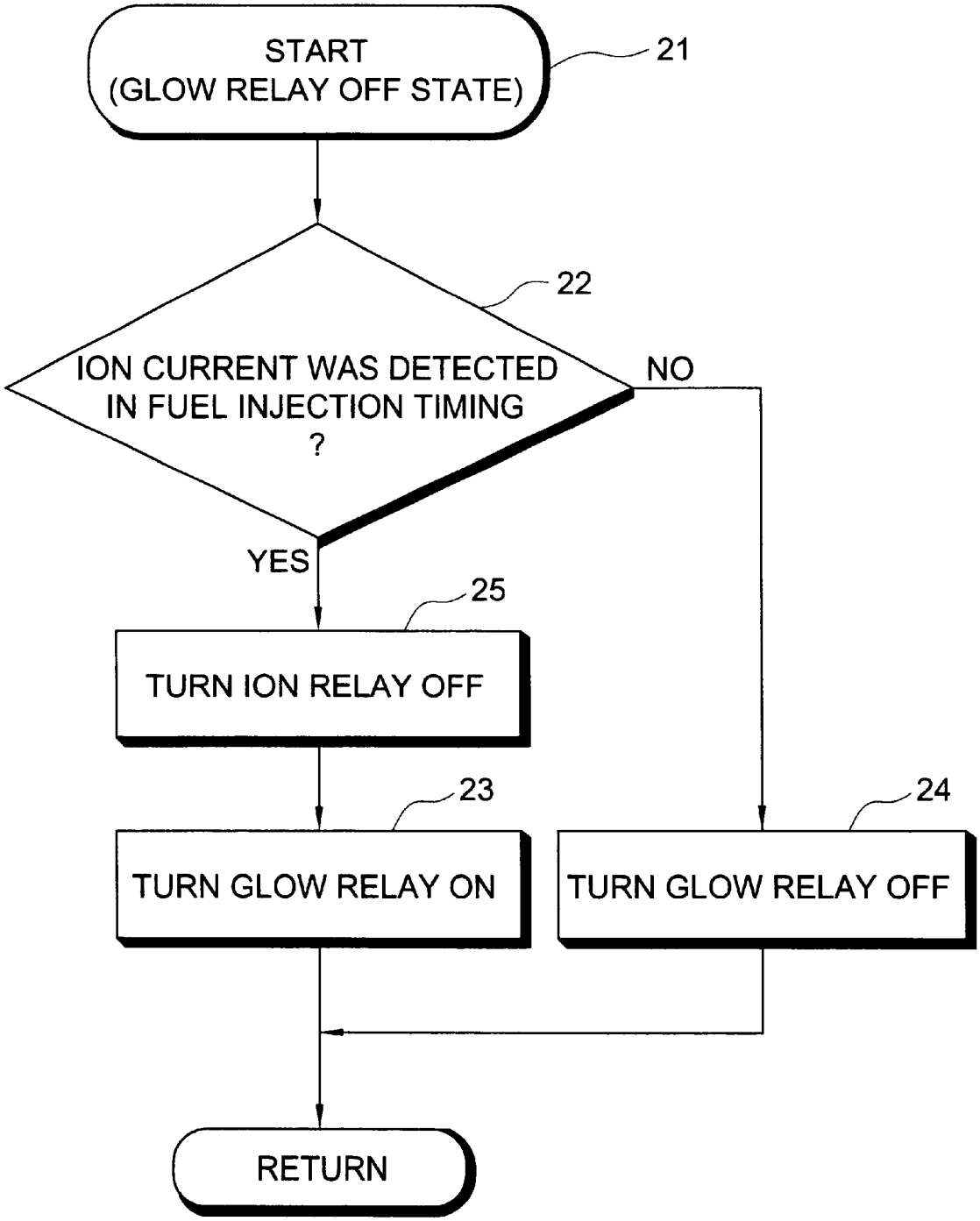
FIG. 71 is a flowchart showing smoke judgment in the 26th embodiment.

FIG. 71 is a flowchart showing the procedure for carbon burn-off operation executed by the ECU 52 in the circuit of FIG. 70. In the drawing, when the glow relays 53, 531 are off-state at step 21, the ECU 52 determines whether or not such an abnormal ion current (FIG. 66B) has been detected in the fuel injection stage. If not detected, the ECU 52 advances to step 24 and the glow relays 53 and 531 remain off-state.

When such an abnormal ion current has been detected, the ECU 52 advances to step 23 at which the glow relays 53, 531 are turned on and the conductive heating-element 2 of the glow plug is run hot to burn off the carbon. Although the embodiment can also obtain the same effects as the 19th embodiment, since it uses the terminal portion 31 as a common terminal portion for the conductive heating-element 2 and the ion current detecting electrode 3, the structure of the embodiment is further simplified.

Figure 72:
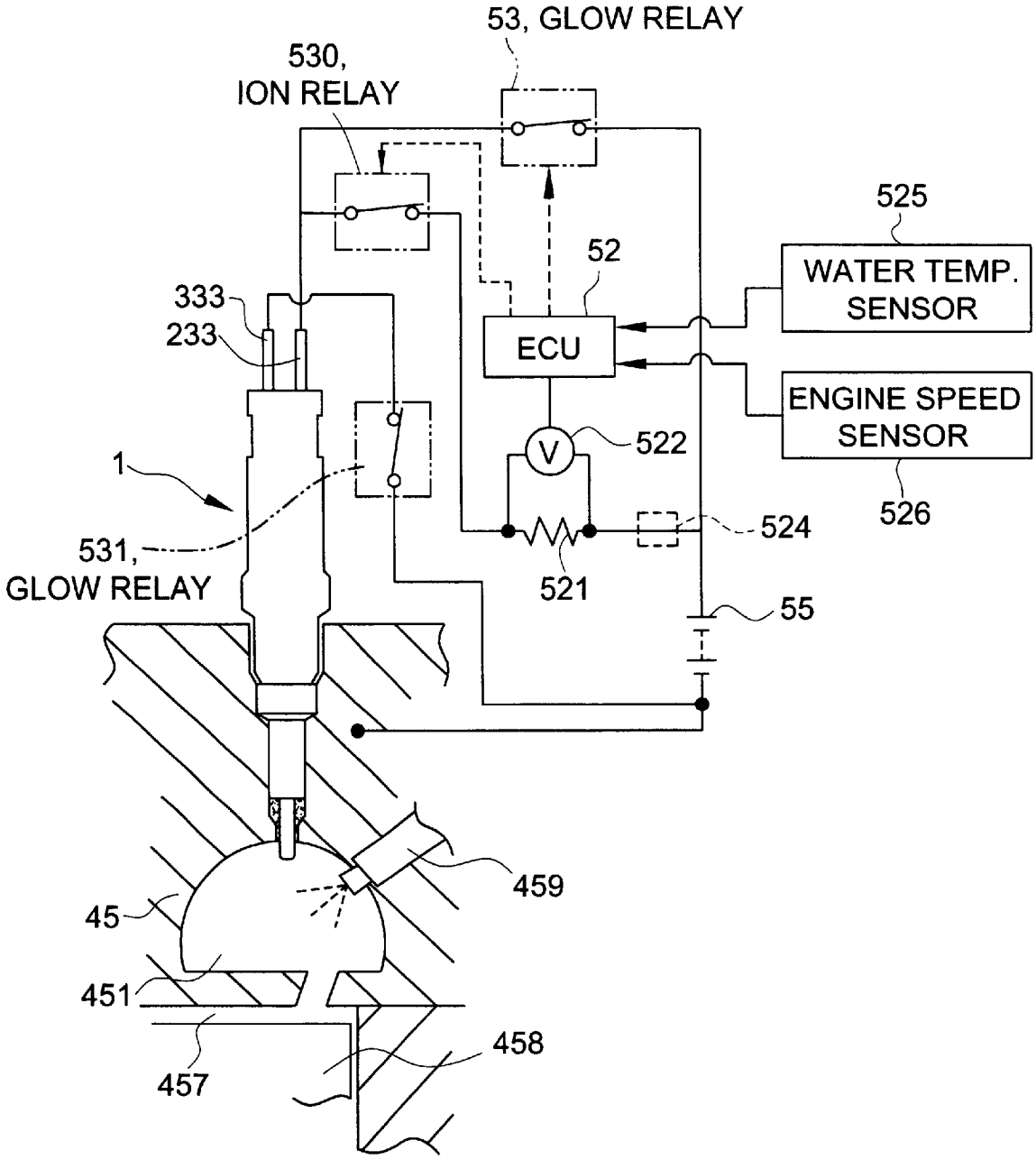
FIG. 72 is a diagram of a glow plug actuator circuit as a modification of FIG. 70.

FIG. 72 shows a modification of FIG. 70. A different point is that a single power source (battery) 55 is used in the circuit structure of FIG. 72 while the glow-plug running power source (battery) 54 and the ion current detecting power source (battery) 51 are separately provided in the circuit structure of FIG. 70. The ion relay 530 and the two glow relays 53, 531 correspond to those in FIG. 70, respectively, and they are turned on or off under control of the ECU 52 in the same procedure as one shown in the flowchart of FIG. 71. When running the conductive heating-element 2 hot, the ion relay 530 is turned off and the glow relays 53, 531 are turned on as shown in the drawing. On the other hand, the ion relay 530 is turned on and the glow relays are turned off when detecting ion current through the ion current detecting electrode 3.

<<27th Embodiment>>

Figure 73:
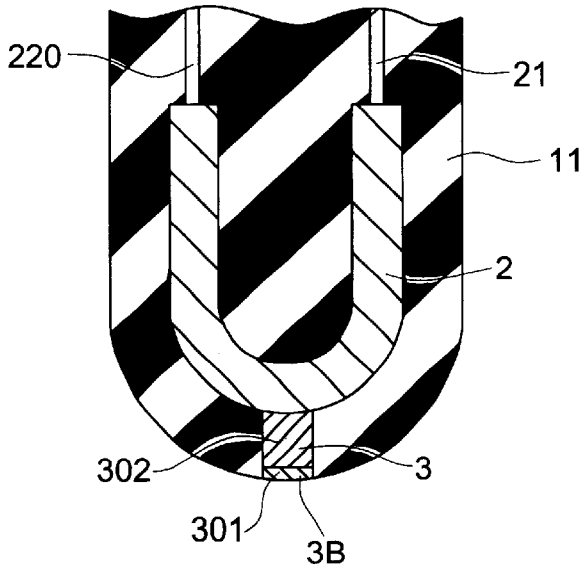
FIG. 73 is a sectional view of a glow plug main body according to a 27th embodiment.

As shown in FIG. 73, the embodiment is such that the grain boundary phases are crystallized only at a top portion 301 including the exposed portion 3B of the ion current detecting electrode 3 in the 22nd embodiment. The grain boundary phases in the portions other than the top portion 301 are made into glass phases in the same way as the prior art. The other structure is the same as that of the 22nd embodiment.

Even in this case, the same effects as in the 22nd embodiment can be obtained without any damage to the exposed portion 3B of the ion current detecting electrode 3.

<<28th Embodiment>>

Since the following 28th to 31st embodiments are modifications of the 19th embodiment (FIGS. 54A, 54B, 55 and such), only points different from the 29th embodiment will be described. As shown in FIG. 54A, the ion current detecting electrode 3 has the exposed portion 3B exposed from the insulator 11 to the flame in the cylinder. The exposed portion 3B also has a ground portion 3A (FIG. 54A) that is ground with a surface roughness Rz of 0.1 to 30 $\mu$m (where Rz is an average roughness of 10 points). In the embodiment, the entire exposed portion 3B of the ion current detecting electrode 3 is ground and made into the ground portion 3A. The grinding is performed with a grindstone of #600. The surface roughness Rz of the ground portion 3A is thus regulated to 4.5 $\mu$m.

Figure 74:
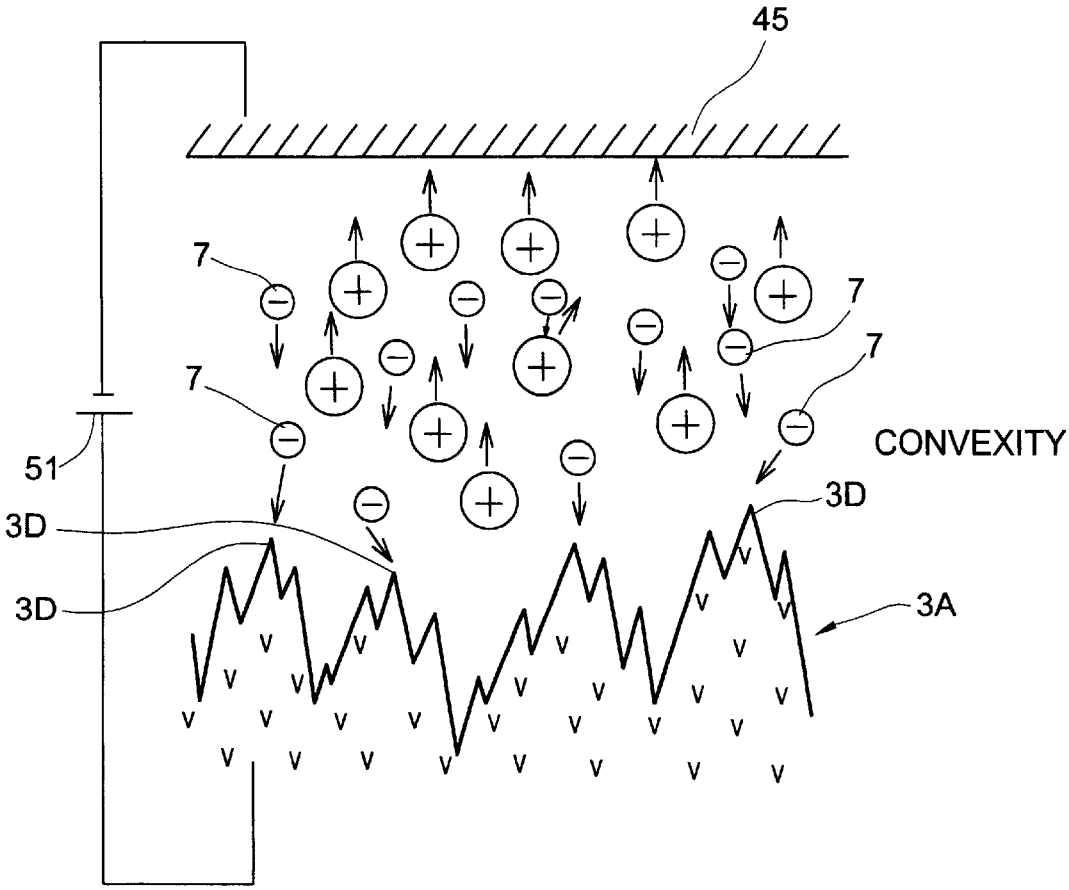
FIG. 74 is a schematic diagram showing an ion current detection effect of a ground portion in a 28th embodiment.

As mentioned above, the surface roughness Rz of the ground portion 3A is from 0.1 to 30 $\mu$m. For this reason, since lots of micron size convexities exist at the ground portion 3A as shown in FIG. 74, electric flux in the electric field between the cylinder head 45 and the ion current detecting electrode 3 is concentrated to the convexities 3D and potential gradients become sharp in the neighborhood of the convexities 3D. Such sharp potential gradients attract negative charged particles of combustion gases into the neighborhood of the convexities 3D of the ion current detecting electrode 3 to make the charged particles 7 active.

It is therefore possible for the ion current detecting electrode 3 with the ground portion 3A to detect ion current more precisely.

<<29th Embodiment: Experimental Example in Comparison with 28th Embodiment>>

To further clarify the effect of the ground portion 3A in the glow plug of the 28th embodiment, an ion detection test was performed using a comparative example. In the comparative example, the ground portion 3A shown in the 28th embodiment was further ground to a surface roughness Rz of 0.01 $\mu$m. The ground portion of the ion current detecting electrode according to the 29th embodiment was made into the same one having the surface roughness of 4.5 $\mu$m as mentioned above.

Figure 75:
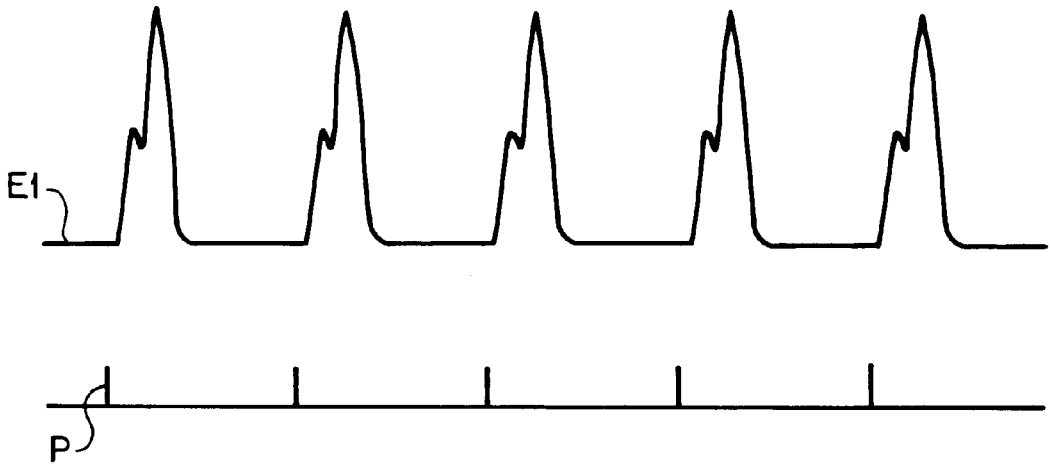
FIG. 75 is a chart showing an ion current waveform in the 28th embodiment.
Figure 76:
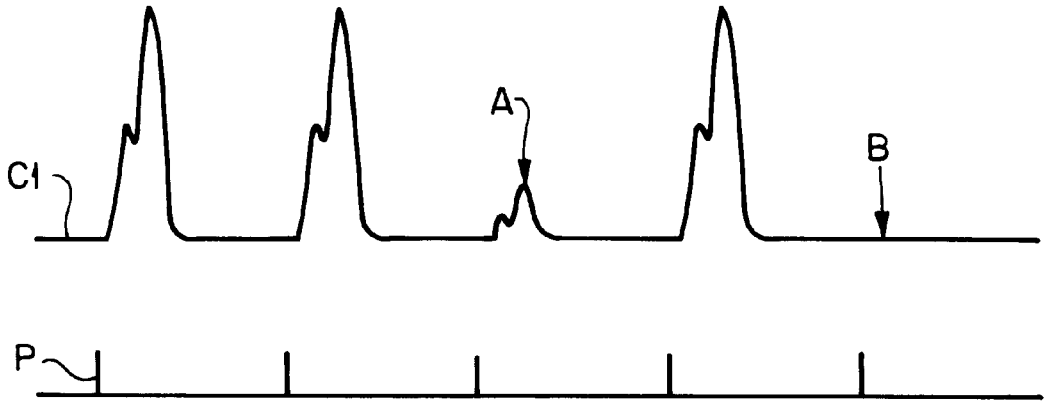
FIG. 76 is a chart showing an ion current waveform in a comparative example to be compared with the 28th embodiment.

An ion current waveform E1 detected by the 28th embodiment is shown in FIG. 75, while an ion current waveform C1 detected by the comparative example is shown in FIG. 76. In FIGS. 75 and 76, time and current value are chosen as abscissa and ordinate respectively, indicating a fuel injection stage by a vertical line P with respect to the abscissa.

A comparison of both diagrams shows that high peak waveforms can be detected precisely at all times in the ion current detector of the 28th embodiment. On the other hand, the comparative example is such that a waveform A detected imprecisely with a very small peak value or no waveform B appeared. As a result, it is found that the accuracy in detecting ion current can be largely improved by providing a ground portion 3A of a specific surface roughness Rz in the exposed portion 3B of the ion current detecting electrode 3.

<<30th Embodiment>>

The 20th embodiment is a modification of the 28th embodiment. In the embodiment, the surface roughness Rz of the ground portion 3A in the glow plug of the 28th embodiment was changed variously and a test was performed for each surface roughness Rz to check the effect on the accuracy in detecting ion current. For the test, plural glow plugs having ground portions 3A of different surface roughnesses Rz ranging from 0.01 to 100 $\mu$m were prepared. Conditions other than the surface roughness Rz of the ground portion 3A were the same as those in the 28th embodiment.

The accuracy in detecting ion current was determined from the number of times the ion current was detected precisely to the number of fuel injection stages when operating a test Diesel engine with each test glow plug at 800 rpm and detecting ion current for a detection cycle of one minute. The determination of whether or not the ion current was detected precisely was made such that the ion current was regarded as detected when the detected current value was a figure more than 0.3 times the mean value of ion current peaks in the engine operating period and as not detected when less than 0.3 times the mean value.

For example, in the case where the fuel had been injected 100 times, the detection accuracy was regarded as 100% when the ion current was detected precisely 100 times and as 50% when detected precisely 50 times.

Figure 77:
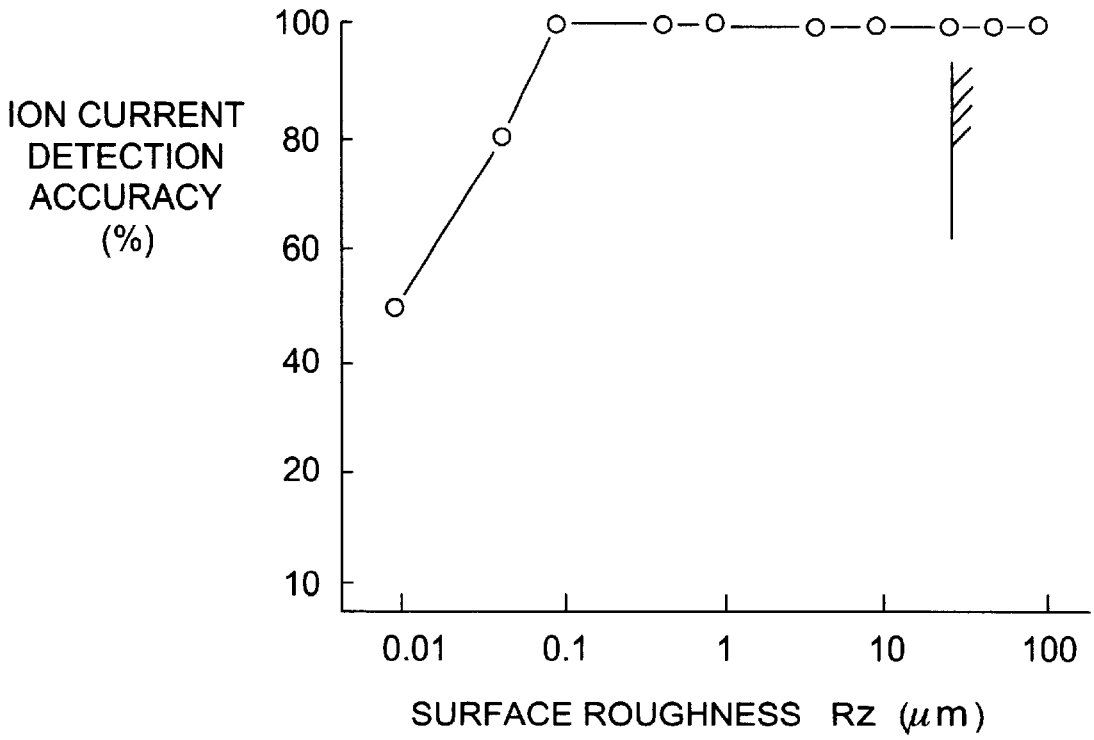
FIG. 77 is a graph showing a relationship between surface roughness Rz at a ground portion and ion current detection accuracy in a 29th embodiment.

The test results are shown in FIG. 77, in which surface roughness Rz of the ground portion 3A and ion current detection accuracy are chosen as abscissa and ordinate respectively. As apparent from FIG. 77, the ion current detection accuracy is 100% when the surface roughness Rz of the ground portion is 0.1 $\mu$m or larger. With the surface roughnesses Rz of less than 0.1 $\mu$m, the detection accuracy is lowered as the surface roughness Rz is reduced.

With the surface roughnesses Rz of more than 30 $\mu$m, a crack or cracks are developed in the ground portion. Such a crack would be developed due to the tendency to concentrate stress to the ground portion when there are large irregularities. According to the measurement results in the 29th embodiment, an optimum surface roughness Rz of the ground portion 3A can be set in a range of between 0.1 $\mu$m and 30 $\mu$m.

<<31st Embodiment>>

Figure 78:
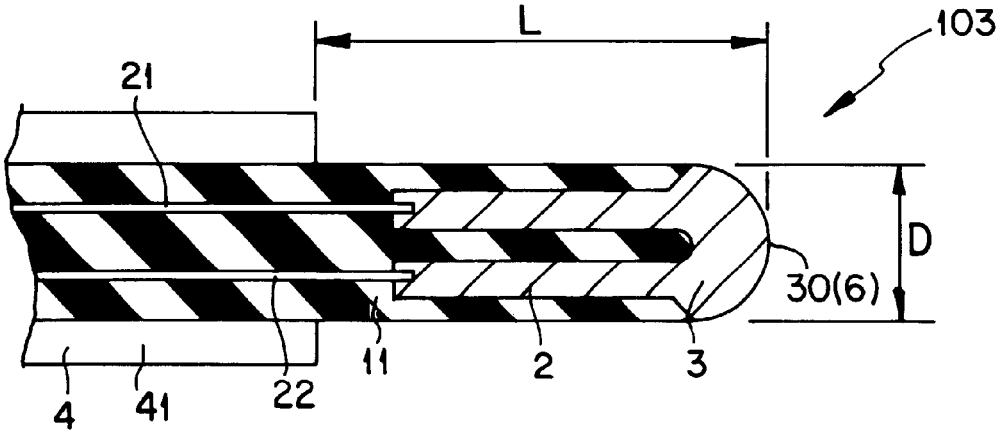
FIG. 78 is a schematic sectional view showing a shape of an ion current detecting electrode according to a 30th embodiment.
Figure 79:
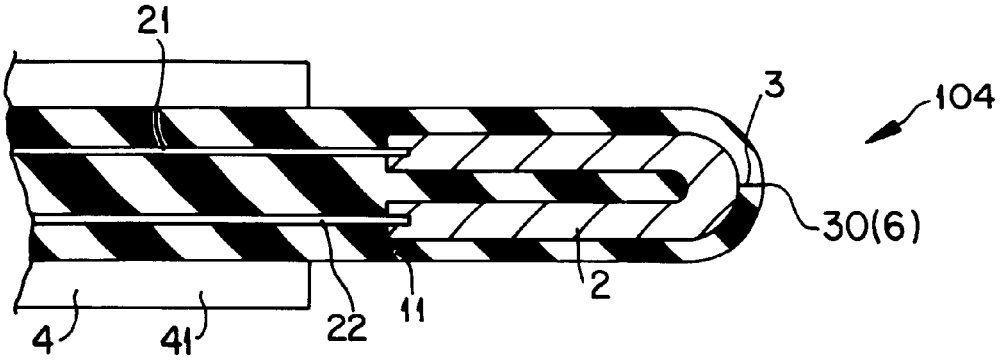
FIG. 79 is a schematic sectional view showing another shape of the ion current detecting electrode according to the 30th embodiment.
Figure 80:
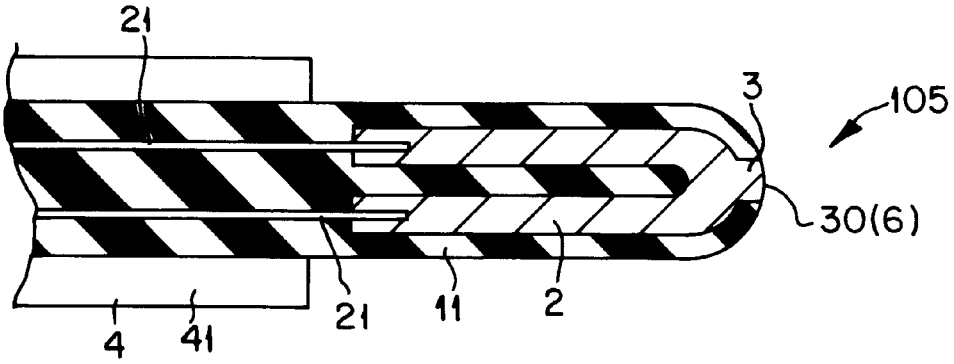
FIG. 80 is a schematic sectional view showing other shape of the ion current detecting electrode according to the 30th embodiment.

In the 31st embodiment, the conductive heating-element 2 and the ion current detecting electrode 3 are electrically connected and integrated as shown in FIGS. 78 to 80.

As shown in FIGS. 78 to 80, the area of the exposed portion 3B of the ion current detecting electrode 3 was changed and a test was performed to check a relationship between area of the exposed portion and ion current detection accuracy. The glow plug main body used for the test was sized such that the diameter D is 3.5 mm and the projection length L from the housing 4 is 10 mm.

In the glow plug 103 shown in FIG. 78, an exposed portion 3B of the ion current detecting electrode 3 was provided on the overall surface of the semi-spherical area in the top portion of the main body 10, and the entire exposed portion 3B was made into a ground portion 3A of a surface roughness of 4.5 $\mu$m. In this case, the area of the exposed portion 3B (the area of the ground portion 3A) is 0.5 $cm^2$.

In the glow plug 104 shown in FIG. 79, the exposed portion 3B of the ion current detecting electrode 3 was reduced as small as possible, and the entire exposed portion 3B was made into a ground portion 3A of a surface roughness of 4.5 $\mu$m. In this case, the area of the exposed portion 3B (the area of the ground portion 3A) is $1\times10^{-6}$ $cm^2$.

In the glow plug 105 shown in FIG. 80, the exposed portion 3B of the ion current detecting electrode 3 was an intermediate between those of FIGS. 78 and 79, and the entire exposed portion 3B was made into a ground portion 3A of a surface roughness of 4.5 $\mu$m. In this case, the area of the exposed portion 3B (the area of the ground portion 3A) is 0.008 $cm^2$.

As an example, FIG. 69A can be used for the general structure with the glow plug of FIG. 80, and FIG. 72 can be used for the circuit used in combination with such structure. As shown in FIG. 69A, if the conductive heating-element 2 and the ion current detecting electrode 3 are integrated, the lead wire 220 provided for the conductive heating-element 2 will be connected to the terminal portion 31 provided at the upper end of the insulator 11. In such structure, the glow plug is mounted in the cylinder head 45 in the same manner as the 28th embodiment.

Since the conductive heating-element 2 and the ion current detecting electrode 3 are integrated, the glow plug actuator circuit of FIG. 72 can be used in the embodiment. As shown in the drawing, the conductive heating-element 2 is run hot by turning off the ion relay 530 while turning on the glow relays 53 and 531. On the other hand, the ion current detecting electrode 3 is operated to detect ion current by turning on the ion relay 530 while turning off the glow relays 53 and 531.

Using the above three glow plugs 103, 104 and 105, the ion current detection accuracy was checked under the same conditions as those of the 31st embodiment. According to the test results, all the glow plugs excellently show the accuracy of 100%. It is therefore considered that the ion current can be detected precisely, even when the area of the exposed portion 3B is changed within a range from $1\times10^{-6}$ to 0.5 $cm^2$, by providing a ground portion of a specific surface roughness Rz in the exposed portion 3B of the ion current detecting electrode 3.

The test results also teach that since the area of the exposed portion 3B can be a very small figure of $1\times10^{-6}$ $cm^2$, any exposed portion 3B is effective as long as it is exposed to the outside.

<<32nd Embodiment>>

The glow plug 1 of the 32nd embodiment is constituted of the main body 10 and the housing 4 for mounting the main body 10. The main body 10 includes the insulator 11; the conductive heating-element 2 provided inside the insulator 11; and the pair of lead wires 21, 22, electrically connected to both ends of the conductive heating-element 2, drawn out on the other end side of the insulator.

The main body 10 also includes an ion current detecting electrode 3 for detecting an ionization state in the flame, which is provided inside the insulator 11 with maintaining electrical insulation from the conductive heating-element 2. A top portion 3C of the ion current detecting electrode 3 is covered with a nonconductive porous layer 38, including the top portion of the insulator 11. The nonconductive porous layer 38 has a communication hole 380 (FIG. 83) open into the flame through the layer 38.

Figure 81A:
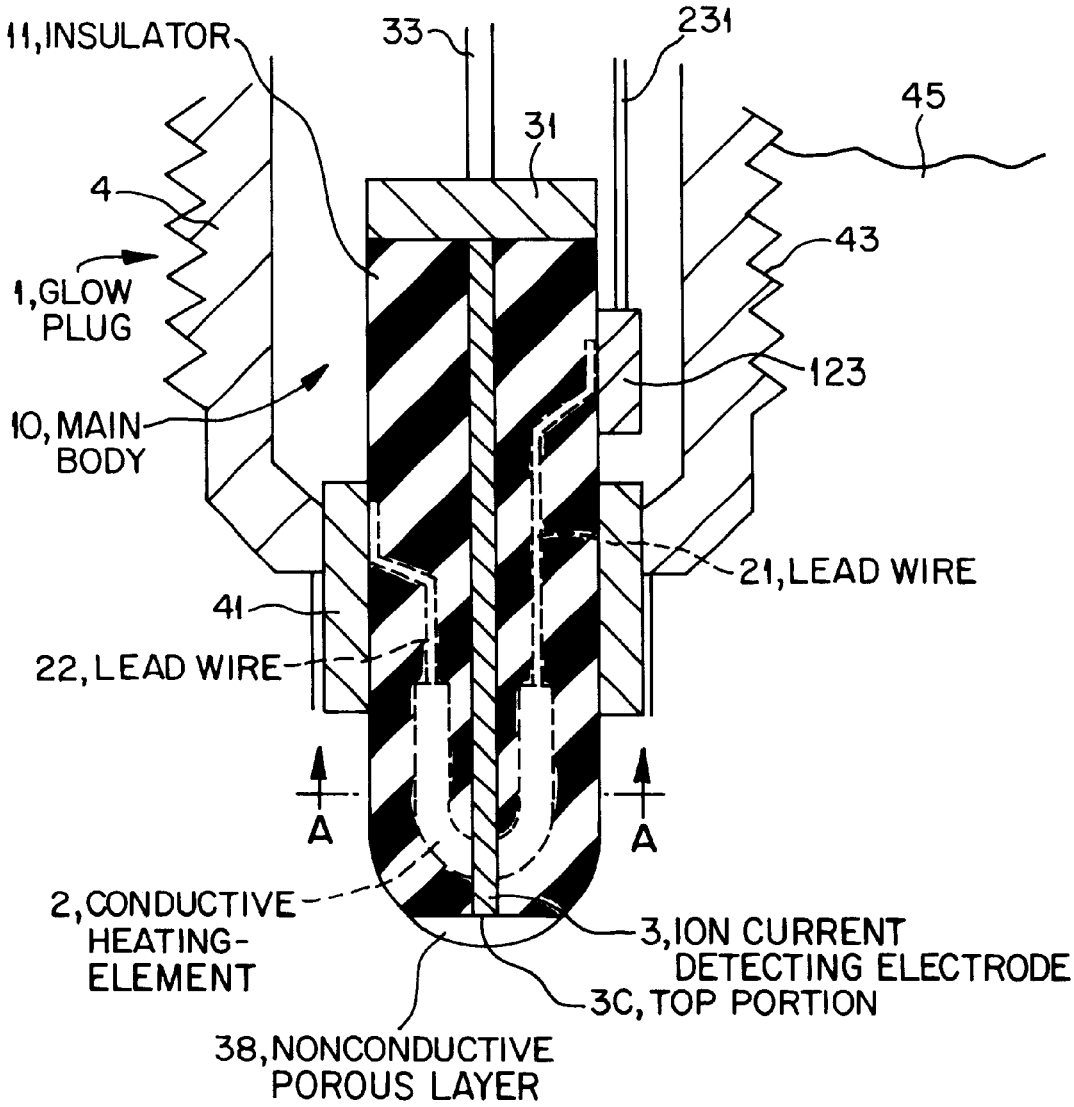
FIG. 81A is a sectional view of a glow plug main body according to a 32nd embodiment.
Figure 81B:
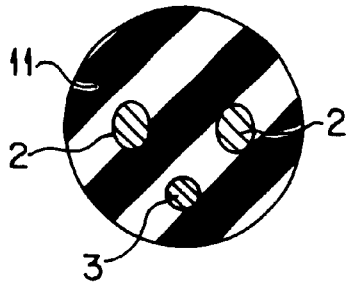
FIG. 81B is a sectional view taken along the line A—A of FIG. 81A.
Figure 82:
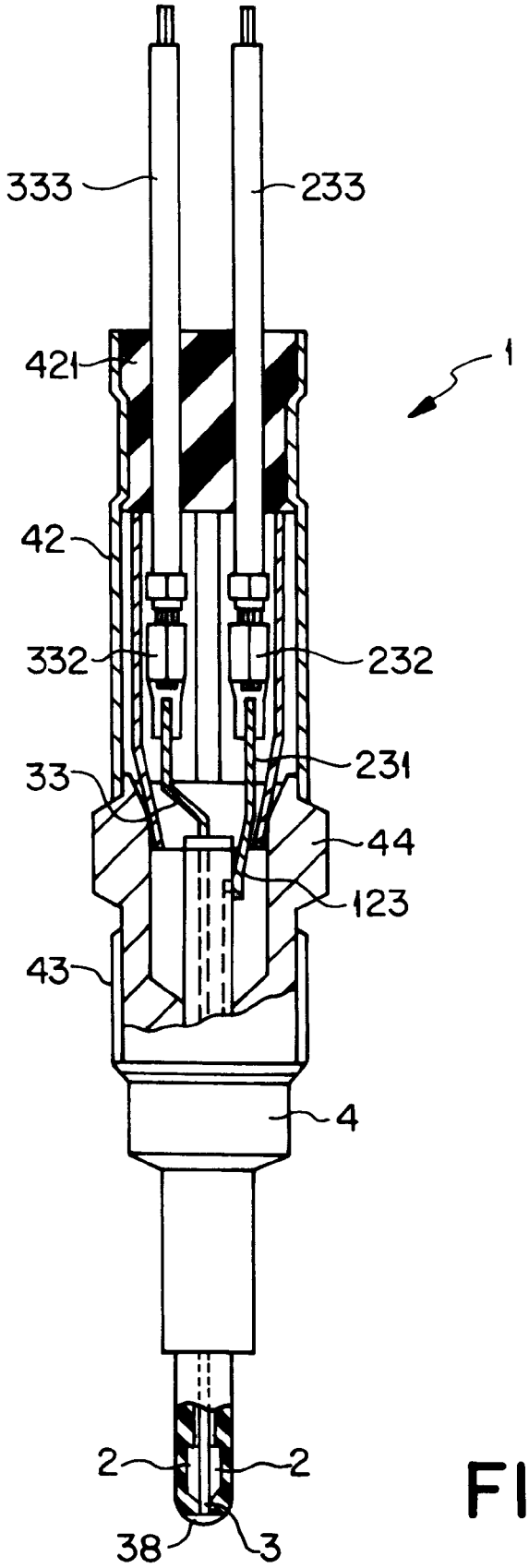
FIG. 82 is a diagram showing general structure of the glow plug according to the 32nd embodiment.

As shown in FIGS. 81A and 82, the main body 10 is retained in the metal housing 4 through the annular support 41 made of metal. One lead wire 21 of the conductive heating-element 2 is pull up inside the insulator 11 and electrically connected to the internal lead wire 231 through the conductive terminal portion 123 provided at the side of the main body 10, while the other lead wire 22 is electrically connected to the housing 4 through the annular support 41. The upper portion of the ion current detecting electrode 3 is electrically connected to the internal lead wire 33 through the conductive terminal portion 31 provided at the upper end of the insulator 11.

As shown in FIG. 82, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 332. The external lead wires 233 and 333 are thus electrically coupled to one end of the conductive heating-element 2 and the ion current detecting electrode 3, respectively.

As mentioned above, the other end of the conductive heating-element 2 is electrically coupled to the housing 4 through the annular support 41 (FIG. 81A). As also shown in FIG. 81A, the top portion (lower end portion) of the main body 10 is formed into a semi-spherical shape with the top portion 3C of the ion current detecting electrode 3 exposed therefrom.

Figure 84A:
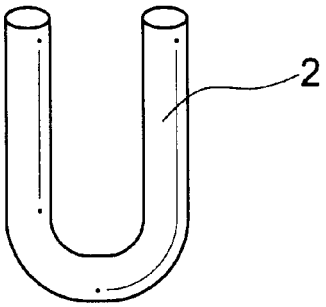
FIG. 84A is a perspective view of a conductive heating-element of the 32nd embodiment.
Figure 84B:
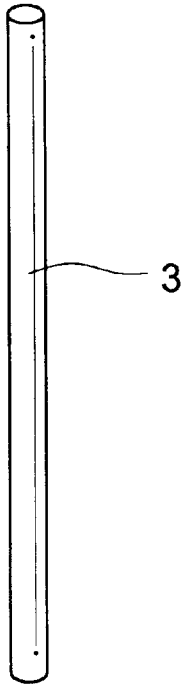
FIG. 84B is a perspective view of an ion current detecting electrode of the 32nd embodiment.

Referring next to FIGS. 84A, 84B and 85, the manufacturing process of the glow plug main body 10 will be described. As FIG. 81A shows, the glow plug main body 10 is constituted of the insulator 11, the conductive heating-element 2 embedded in the insulator 11, the ion current detecting electrode 3 and the nonconductive porous layer 38. In the manufacturing process, the U-type conductive heating-element 2 and the rod-like ion current detecting electrode 3, shown in FIGS. 84A and 84B, are first constructed of conductive ceramic powder.

On the other hand, as shown in FIG. 85, a semicylinder-like lower part 111, a plate-like middle part 112 and a semicylinder-like upper part 113, these constituting the insulator 11, are formed of nonconductive ceramic powder. The upper surface of the lower part 111 and the lower surface of the middle part 112 have U-type grooves 115 and 116, respectively, for accommodating the conductive heating-element 2.

The upper surface of the middle part 112 and the lower surface of the lower part 113 have rod-like grooves 117 and 118, respectively, for accommodating the ion current detecting electrode 3. Then, the conductive heating-element 2 and the ion current detecting electrode 3 are fitted in the U-type grooves 115, 116 and the rod-like grooves 117, 118, respectively, and the parts 111, 112 and 113 are stacked. When stacking the parts, the lead wires 21 and 22 are connected to the conductive heating-element 2.

A laminated body such as one shown in the upper portion of FIG. 86A (A) is thus obtained. After that, the disc-like nonconductive porous layer 382 prepared in advance is joined with adhesive to the top portion 18 of the laminated body. The joined body is then heated and sintered to be an integrated sinter. Further, as shown in FIG. 86A (B), the lower portion of the integrated sinter is cut (along the dotted line of the drawing) to be a semi-spherical shape. The glow plug main body 10 of FIG. 81A is thus obtained.

The glow plug 1 constituted of the above parts such as the main body 10 and the housing 4 is mounted in the cylinder head 45 by fastening the male screw portion of the housing 4. As shown in FIG. 64, the glow plug is so mounted that the top portion of the glow plug main body 10 will project into the turbulence chamber 451 that forms part of a combustion chamber of the cylinder head 45. In the drawing, reference numeral 457 is the main combustion chamber, 458 the piston and 459 the fuel injection nozzle.

As also shown in FIG. 64, the glow plug 1 is connected to the glow plug actuator circuit and its electrical conduction is controlled as discussed above along the flowchart of FIG. 65.

In the glow plug of the embodiment, the conductive heating-element 2 and the lead wires 21, 22 are formed inside the insulator 11, and the ion current detecting electrode 3 is also provided inside the insulator 11. These are thus constructed integrally. For this reason, the glow action (heating action) of the conductive heating-element 2 and the ion current detection by the ion current detecting electrode 3 can be carried out by one glow plug.

Even when some carbon adhered onto the surface of the glow plug main body 10, i.e., the surface of the insulator 11, since the conductive heating-element 2 located near the ion current detecting electrode 3 is energized to generate heat, the adhered carbon can be burnt off to return the ion current detecting electrode 3 to the normal state. It is therefore possible to detect ion current precisely through the communication hole 380 (FIG. 83) of the nonconductive porous layer 38.

Figure 83:
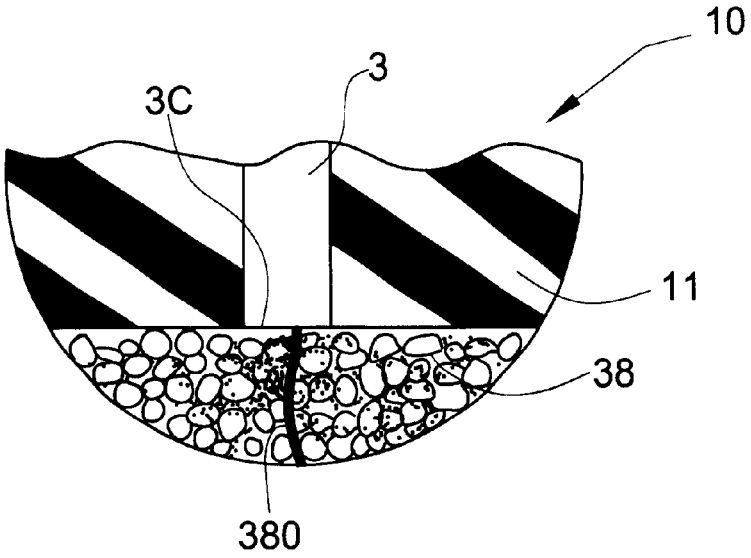
FIG. 83 is a diagram showing a nonconductive porous layer according to the 32nd embodiment.

The important feature of the embodiment is that the top portion 3C of the ion current detecting electrode 3 is covered with the nonconductive porous layer 38 (FIG. 83). In such structure, the ion current detecting electrode 3 is never exposed to the direct fire of the flame. For this reason, the ion current detecting electrode 3 is not subjected to stress concentration due to thermal shock by the hot flame, and hence any damage such as crack development. Further, since the nonconductive porous layer 38 has the communication hole 380, ions flow into a space between the ion current detecting electrode 3 and the cylinder head 45 through the communication hole 380, thereby detecting the ions as an ion current accurately.

Furthermore, since the insulator 11, the conductive heating-element 2, the lead wires 21 and 22, the ion current detecting electrode 3 and the nonconductive porous layer 38 are integrated, the structure of the glow plug is simplified. The conductive heating-element 2, the lead wires 21, 22 and the ion current detecting electrode 3 are also provided inside the insulator 11, so that excellent durability can be obtained without any rust due to oxidation or the like by the combustion gases. Furthermore, since the top portion of the insulator 11 is made into the semi-spherical shape (FIGS. 81A to 83), thermal shock in the combustion chamber can be absorbed.

<<33rd Embodiment>>

Concrete examples of the glow plug such as one shown in the 32nd embodiment will next be shown in Table 6 together with a comparative example. The conductive heating-element was molded into a U-type shape by using small conductive powder of $MoSi_2$ (molybdenum disilicide), large nonconductive powder of $Si_3N_4$ (silicon nitride), a sintering auxiliary of $Y_2O_3$ and an organic binder (FIG. 84A). The ion current detecting electrode was molded into a rod-like shape by using the same materials (FIG. 84B).

The insulator was divided and molded into the upper part 111, the middle part 112 and the lower part 113, as shown in FIG. 85, by using small $Si_3N_4$ powder, and same-sized $MoSi_2$ powder, $Y_2O_3$ and organic binder. On the other hand, the nonconductive porous layer 38 was molded into a plate-like body 382 by using the same materials for the insulator 11 except with the increased content of the organic binder.

These parts were then stacked in such a manner as discussed above, and the plate-like body 382 for the nonconductive porous layer was joined with adhesive as shown in FIG. 86A. The laminated body of these molded parts was pressurized and sintered at 1750° C. for 60 min. after degreasing the organic binder at 450° C. The top portion of the glow plug was cut to be a semi-spherical shape to form the glow plug main body such as one shown in FIG. 81A.

In the glow plug main body 10, the thickness of the nonconductive porous layer 38 was changed variously as shown in Table 6. Since the nonconductive porous layer 38 has the semi-spherical shape at the tip, the maximum thickness is shown in Table 6.

The glow plug was then mounted in the cylinder head 45 of the Diesel engine as shown in FIG. 7 of the 31st embodiment. The engine was started after the conductive heating-element 2 of the glow plug had been electrically conducted to generate heat up to 1200° C., idled for one min. and stopped one min. After one-minute stop of the engine, a sequence of such operatons, namely, conduction, start and stop, was repeated 20,000 times and 30,000 times, thus performing 20,000 engine tests and 30,000 engine tests. During the tests, damage to the top portion of the ion current detecting electrode and the insulator therearound, such as crack development, was observed. The test results are shown in Table 6.

As apparent from Table 6, a sample (No. 1) in which the nonconductive porous layer 38 was not provided shows a chipping phenomenon due to crack development in the 20,000 tests. Further, of all the samples with the nonconductive porous layer 38, samples (Nos.2 and 7) of 0.1 mm thickness and 1.6 mm thickness suffer damage such as crack development in the 30,000 tests. Although the other samples No. 3 to No. 6 especially display excellent durability, the samples No. 2 and No. 7 do not matter in practical application since the above tests were performed under severe conditions.

TABLE 6

| Sample No. | Thickness of nonconductive porous layer (mm) | State of crack development | |
|---|---|---|---|
| | | 20,000 Test | 30,000 Test |
| 1 | 0 | x | x |
| 2 | 0.1 | ○ | Δ |
| 3 | 0.2 | ○ | ○ |
| 4 | 0.5 | ○ | ○ |
| 5 | 1.0 | ○ | ○ |
| 6 | 1.5 | ○ | ○ |
| 7 | 1.6 | ○ | Δ |

○ . . . No crack development
Δ . . . Little crack development
x . . . Chipping occurred due to crack development <<34th Embodiment>>

Figure 87:
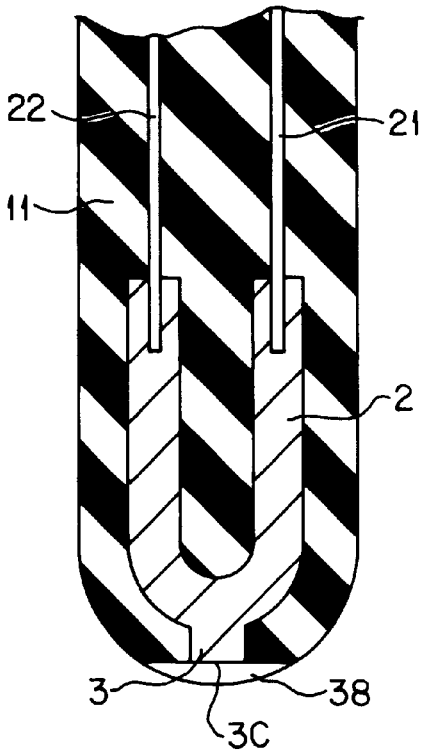
FIG. 87 is a sectional view of a glow plug main body according to a 34th embodiment.

As shown in FIG. 87, in the glow plug main body 10 of the embodiment, the ion current detecting electrode 3 is provided integrally at the lower end of the U-type conductive heating-element 2, and the nonconductive porous layer 38 such as one described in the 31st embodiment is provided in the top portion 3C of the ion current detecting electrode 3. According to the embodiment, since the ion current detecting electrode 3 is provided at the tip of the conductive heating-element 2, the structure is simplified. The other portions are the same as those in the 32nd embodiment, so that the same effects as in the 32nd embodiment can be obtained.

<<35th Embodiment>>

Figure 88:
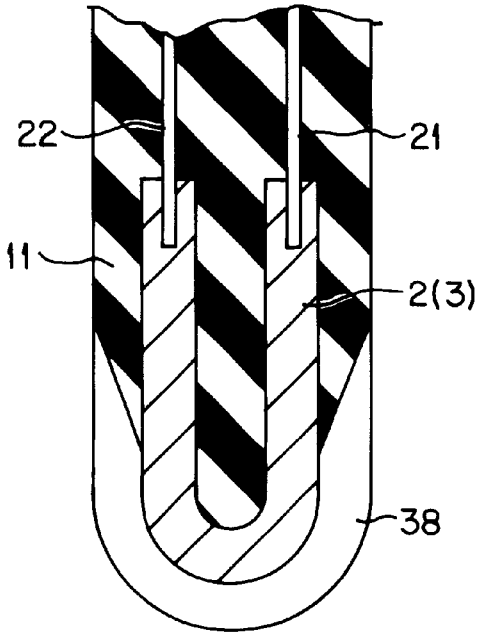
FIG. 88 is a sectional view of a glow plug main body according to a 35th embodiment.

As shown in FIG. 88, the embodiment is such that the U-type conductive heating-element 2 is used for the ion current detecting electrode 3. In the embodiment, the top portion (the lower end of the U-type portion) and the lower side of the ion current detecting electrode 3 are covered with the nonconductive porous layer 38. Since in the embodiment the ion current detecting electrode and the conductive heating-element are combined, the structure is simplified. For the glow plug of the embodiment, an actuator circuit to be used in the following 36th embodiment can be used. Since the other portions are the same as those in the 31st embodiment, the same effects as in the 31st embodiment can be obtained.

<<36th Embodiment>>

Figure 89A:
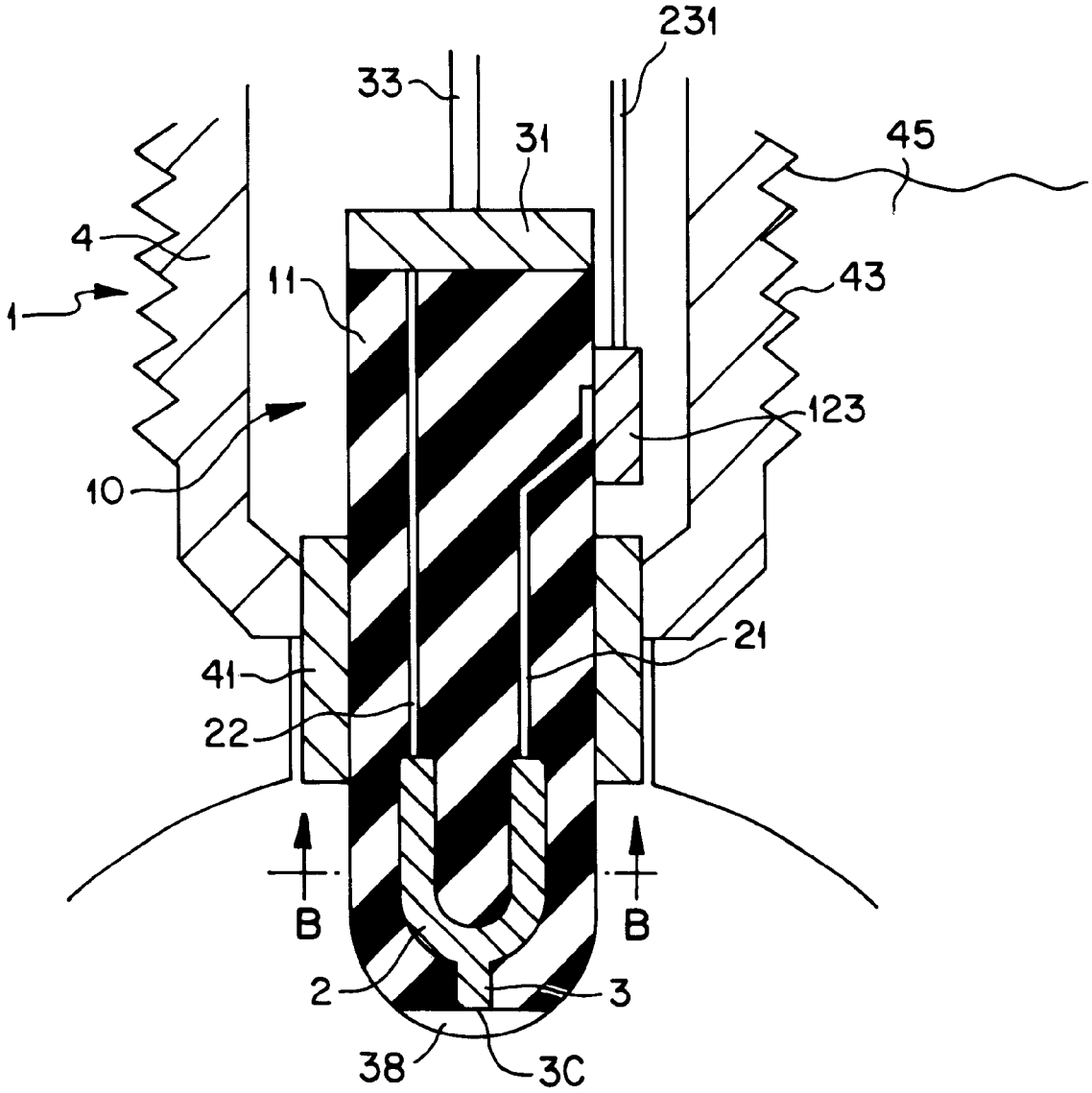
FIG. 89A is a sectional view of a glow plug main body according to a 36th embodiment.
Figure 89B:
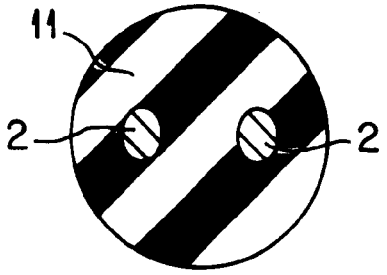
FIG. 89B is a sectional view taken along the line B—B of FIG. 89A.

The embodiment shows a glow plug main body and a glow plug actuator circuit in which the conductive heating-element and the ion current detecting circuit are integrated such as ones shown in the 34th and 34th embodiments. FIGS. 89A is a sectional view of general structure of such a glow plug and FIG. 15 shows such a glow plug actuator circuit. As shown in FIG. 89A, when the conductive heating-element and the ion current detecting circuit are integrated, the lead wire 22 provided for the conductive heating-element 2 is connected to the terminal portion 31 provided at the upper end of the insulator 11.

The glow plug constructed such above is mounted in the cylinder head 45 in the same way as shown in FIG. 11 of the 31st embodiment. In the embodiment, since the conductive heating-element 2 and the ion current detecting electrode 3 are integrated, the glow plug actuator circuit is constructed as shown in FIG. 15.

As shown in the drawing, the conductive heating-element 2 is run hot by turning off the ion relay 530 while turning on the glow relay 53. On the other hand, the ion current detecting electrode 3 is operated to detect ion current by turning on the ion relay 530 while turning off the glow relay 53.

It is therefore possible for this embodiment to obtain the same effects as in the 31st embodiment.

The other portions are the same as those in the 31st embodiment.

<<37th Embodiment>>

The 37th embodiment is a modification of the 26th embodiment (FIG. 69A and others). As shown in FIG. 69A, the glow plug main body 10 includes the insulator 11; the conductive heating-element 2 having a U-type section, which is provided inside the insulator 11; and the pair of lead wires 21, 22 electrically connected to both ends of the conductive heating-element 2, provided inside the insulator 11. The main body 10 also includes one ion current detecting electrode 3 for detecting an ionization state in the flame, which is provided inside the insulator 11 with an electrical connection established to the midway of the conductive heating-element 2. The top portion 3C of the ion current detecting electrode 3 is exposed from the insulator 11 into the flame.

Figure 90:
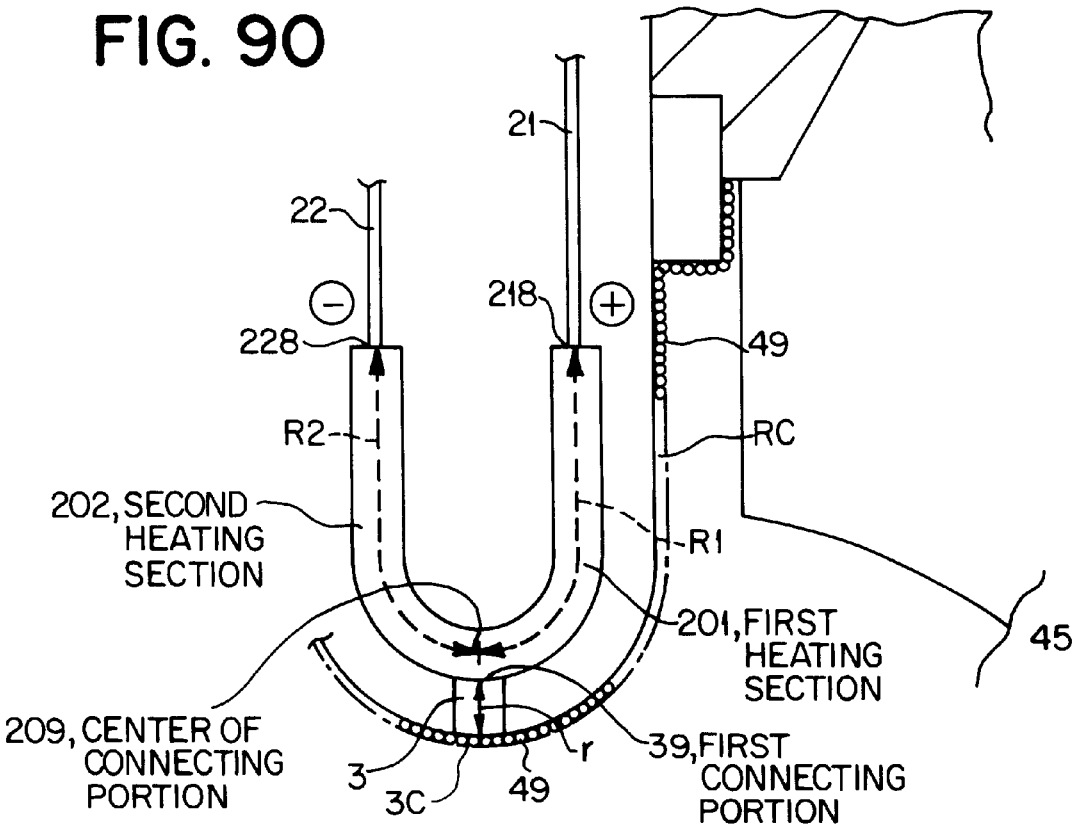
FIG. 90 is a diagram for explaining operation and effects of a 37th embodiment.

As shown in FIG. 90, when R1 denotes electric resistance of a first heating section 201 of the conductive heating-element 2 from a positive end 218, corresponding to a positive side in passing a heating DC current through the conductive heating-element 2, to a center 209 of a first connecting portion 39, at which the ion current detecting electrode 3 is connected to the conductive heating-element 2; R2 denotes electric resistance of a second heating section 202 of the conductive heating-element 2 from the center 209 of the first connecting portion 39 to a negative end 228; and r denotes electric resistance from the first connecting portion 39 to the top portion 3C of the ion current detecting electrode 3, the relationship of R2>r is satisfied.

The ion current detecting electrode 3 is provided integrally with the conductive heating-element 2 at the lower end of the U-type conductive heating-element 2. The top portion 3C is exposed from the insulator 11 with platinum (Pt) coating thereon.

Figure 100:
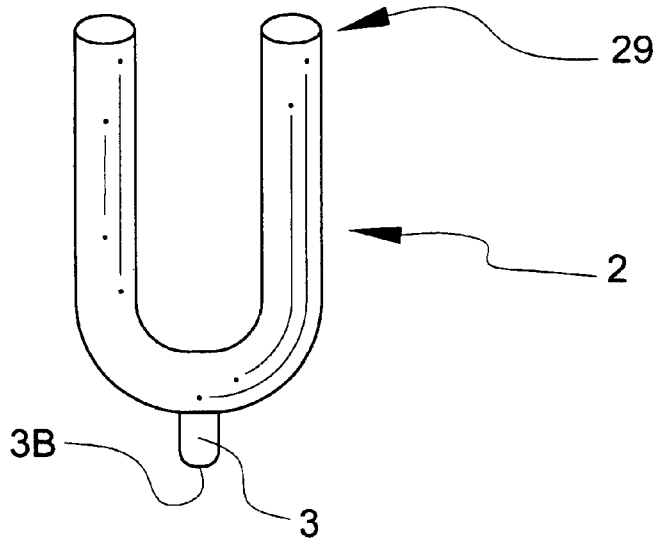
FIG. 100 is a diagram for explaining a glow plug manufacturing method in the 47th embodiment.

In manufacturing the glow plug main body 10, a molded body 29 for the conductive heating-element 2 and the ion current detecting electrode 3, such as one shown in FIG. 100, is first prepared. The molded body 29 is made up such that ceramic powders for the conductive heating-element 2 and the iron current detecting electrode 3 are mixed with a mixed binder of paraffin wax and resin, and the mixture is injection-molded, or it is made up by press-molding the powders.

The molded body 29 is then embedded in the insulator 11, pressurized and baked integrally by a hot press method. The firing is performed at a pressure of 400 kgf/cm$^2$ under one atmosphere of Ar gas. In this case, the molded body 29 is baked at 1800° C. for 60 min. The lead wires 21 and 22 are connected before the molded body 29 is embedded in the insulator 11. The glow plug main body 10 is thus obtained.

As mentioned above, for conductive heating element, the ion current detecting electrode and the insulator, $MoSi_2$ is used as a conductive ceramic material, $Si_3N_4$ is used as a nonconductive ceramic material, and $Y_2O_3$ and $Al_2O_3$ are used as sintering auxiliary materials.

The mixing ratio between the ceramic powders in the conductive heating-element is set as $MoSi_2$:$Si_3N_4$=20:80. The mixing ratio in the ion current detecting electrode is set as $MoSi_2$:$Si_3N_4$=40:60. With the mean diameter of each powder, $MoSi_2$ is 1 $\mu$m and $Si_3N_4$ is 15 $\mu$m. In the insulator, the mixing ratio between the ceramic powders is set as $MoSi_2$:$Si_3N_4$=30:70, where the mean diameter of $MoSi_2$ is 1 $\mu$m and the mean diameter of $Si_3N_4$ is 1 $\mu$m. Among them, a sintering auxiliary of 5 wt % $Y_2O_3$ and 5 wt % $Al_2O_3$, both having a mean diameter of 1 $\mu$m, are externally added.

Although the top portion 3C of the ion current detecting electrode 3 is so exposed that it will contact the combustion gases (FIG. 69A), since an exposed portion 3B is coated with noble metal such as Pt, any insulating material due to oxidation can be prevented from developing on the surface of the ion current detecting electrode. It is therefore possible to secure the conductivity or the initial resistance of the electrode, and hence to prevent lowering of the detection accuracy. Further, since the ion current detecting electrode 3 is provided at the diametrical center of the insulator 11, the ion current can be detected with high accuracy in all directions of the combustion chamber.

<<38th Embodiment>>

As shown in Table 7, the embodiment shows concrete examples of the glow plug main body 10 such as one shown in the 37th embodiment, in which the ratio between the electric resistances R2 and r is changed. In manufacturing the glow plug main body 10, the conductive heating-element 2 and the ion current detecting electrode 3 are previously made into the molded body 29 (FIG. 100) by an injection molding.

On the other hand, two semi-cylindrical parts are prepared for the insulator 11. In the semi-cylindrical parts, U-type grooves for accommodating the molded body 29 are provided on the faces (diameter faces) to be inside the insulator 11 when assembled (see FIG. 69A). The molded body 29 is then fitted in one U-type groove of the insulator 11, and one semi-cylindrical part is covered with the other. After that, they are pressurized and baked. The insulator 11 with the molded body of the conductive heating-element 2 and the ion current detecting electrode 3 built therein is thus obtained as shown in FIG. 69A.

The conductive heating-element 2 was constructed of a mixture of conductive ceramic powder $MoSi_2$ of 35% (per weight) and nonconductive ceramic powder $Si_3N_4$ of 65%, so that the electric resistance R2 of the second heating section became 0.8 Ω. On the other hand, various types of ion current detecting electrodes 3 were constructed by changing the mixing ratio between $MoSi_2$ and $Si_3N_4$ powders properly according to the change in the electric resistance r as cited in Table 7. The insulator 11 was constructed of a mixture of $Si_3N_4$ and $MoSi_2$ powders. The mixing ratio of $Si_3N_4$ to $MoSi_2$ was 80% to 20%. A sintering auxiliary of 5 wt % $Y_2O_3$ and 5 wt % $Al_2O_3$ was externally added to all the conductive heating-element, the ion current detecting electrode and the insulator. The mean diameter of each material was set to the one for the 37th embodiment. The pressure firing was then performed at 1800° C. for 60 min.

The glow plugs variously constructed were mounted in the cylinder head 45 in the same way as the 37th embodiment did. Then, a carbon burn-off (destruction) quality test was performed under the condition that the carbon had adhered to the surface of the insulator 11 as shown in FIG. 90.

The test results are shown in Table 7.

TABLE 7

| Test | Electric resistance(Ω) | | | State of carbon |
|---|---|---|---|---|
| No. | R2 | r | Carbon | burn-off |
| 1 | 0.8 | 0.1 | 0.2 | ○ |
| 2 | 0.8 | 0.2 | | ○ |
| 3 | 0.8 | 0.4 | | ○ |
| 4 | 0.8 | 0.5 | | Δ |
| 5 | 0.8 | 0.8 | | x |
| 6 | 0.8 | 1.0 | | x |

※ ○ . . . excellent burn-off
Δ . . . good burn-off
x . . . disabled burn-off

As apparent from Table 7, the carbon can be burnt off in the tests with a resistance ratio of R2>r (Nos. 1 to 4), especially in the tests with a resistance ratio of R2≧2r (Nos. 1 to 3), excellent carbon burn-off results can be obtained. In case of R2≦r (the tests No. 5 and No. 6), since no or less DC current flows through the carbon, the carbon can not be burnt off.

<<39th Embodiment>>

In the 38th embodiment, $MoSi_2$ was used as a conductive ceramic material for the conductive heating-element and the ion current detecting electrode. However, the same effects can be obtained from other conductive ceramic materials such as metallic carbide, nitride and boride.

To confirm this, the embodiment changed the conductive ceramic material to WC, $Mo_2C$, TiN, $Mo_{4.8}Si_3C_{0.6}$, $WSi_2$, MoB, $TiB_3$ and $ZrB_2$, as cited in Table 8 and Table 9. Two samples were further made for each material by using different resistance levels corresponding to the tests No. 3 and No. 6 in the 38th embodiment. The carbon burn-off test was then performed for these samples. The mean diameter of each material is set from 1 to 3 μm. The other conditions are the same as those in the 38th embodiment.

The test was also performed for samples in which different conductive ceramic materials were used for the conductive heating-element and the ion current detecting electrode. Further, it was performed for samples in which other nonconductive ceramic materials $Al_2O_3$ and BN were used instead of $Si_3N_4$. The other conditions are the same as those in the 38th embodiment. The test results are shown in Table 8 and Table 9.

Table 10 shows test results of samples in which only the conductive ceramic material was used for both the conductive heating-element and the ion current detecting electrode. As apparent from Tables 8 to 10, the carbon can be completely destroyed by fire in the scope of the present invention.

TABLE 8

| | Conductive ceramic | | Nonconductive ceramic conductive heating- | State of | |
|---|---|---|---|---|---|
| | Conductive heating- | Ion current detecting | element/Ion current detecting | carbon burn-off | |
| No. | element | electrode | electrode | No. 3 | No. 6 |
| 7 | WC | WC | $Si_3N_4$ | ○ | x |
| 8 | $Mo_2C$ | $Mo_2C$ | $Si_3N_4$ | ○ | x |
| 9 | TiN | TiN | $Si_3N_4$ | ○ | x |
| 10 | $WSi_2$ | $WSi_2$ | $Si_3N_4$ | ○ | x |
| 11 | $Mo_{4.8}Si_3C_{0.6}$ | $Mo_{4.8}Si_3C_{0.6}$ | $Si_3N_4$ | ○ | x |
| 12 | MoB | MoB | $Si_3N_4$ | ○ | x |
| 13 | $TiB_2$ | $TiB_2$ | $Si_3N_4$ | ○ | x |
| 14 | $ZrB_2$ | $ZrB_2$ | $Si_3N_4$ | ○ | x |
| 15 | WC | $MoSi_2$ | $Si_3N_4$ | ○ | x |
| 16 | $Mo_2C$ | $MoSi_2$ | $Si_3N_4$ | ○ | x |
| 17 | TiN | $MoSi_2$ | $Si_3N_4$ | ○ | x |
| 18 | $WSi_2$ | $MoSi_2$ | $Si_3N_4$ | ○ | x |
| 19 | $Mo_{4.8}Si_3C_{0.6}$ | $MoSi_2$ | $Si_3N_4$ | ○ | x |
| 20 | MoB | $MoSi_2$ | $Si_3N_4$ | ○ | x |
| 21 | $TiB_2$ | $MoSi_2$ | $Si_3N_4$ | ○ | x |
| 22 | $ZrB_2$ | $MoSi_2$ | $Si_3N_4$ | ○ | x |

TABLE 9

| | Conductive ceramic | | Nonconductive ceramic conductive heating- | State of | |
|---|---|---|---|---|---|
| | Conductive heating- | Ion current detecting | element/Ion current detecting | carbon burn-off | |
| No. | element | electrode | electrode | No. 3 | No. 6 |
| 23 | $Mo_2C$ | $MoSi_2$ | $Al_2O_3$ | ○ | x |
| 24 | WC | WC | $Al_2O_3$ | ○ | x |
| 25 | $Mo_2C$ | $Mo_2C$ | $Al_2O_3$ | ○ | x |
| 26 | TiN | TiN | $Al_2O_3$ | ○ | x |
| 27 | $WSi_2$ | $WSi_2$ | $Al_2O_3$ | ○ | |
| 28 | $Mo_{4.8}Si_2C_{0.6}$ | $Mo_{4.8}Si_3C_{0.6}$ | $Al_2O_3$ | ○ | x |
| 29 | MoB | $MoSi_2$ | $Al_2O_3$ | ○ | x |
| 30 | $TiB_2$ | $MoSi_2$ | $Al_2O_3$ | ○ | x |
| 31 | $ZrB_2$ | $MoSi_2$ | $Al_2O_3$ | ○ | x |
| 32 | $MoSi_2$ | $MoSi_2$ | BN | ○ | x |
| 33 | WC | WC | BN | ○ | x |
| 34 | $Mo_2C$ | $Mo_2C$ | BN | ○ | x |
| 35 | TiN | TiN | BN | ○ | x |
| 36 | $WSi_2$ | $WSi_2$ | BN | x | |
| 37 | $Mo_{4.8}Si_3C_{0.6}$ | $Mo_{4.8}Si_2C_{0.6}$ | BN | ○ | x |
| 38 | MoB | $MoSi_2$ | BN | x | |
| 39 | $TiB_2$ | $MoSi_2$ | BN | ○ | x |
| 40 | $ZrB_2$ | $MoSi_2$ | BN | ○ | x |

TABLE 10

| No. | Conductive ceramic: Conductive heating-element | Conductive ceramic: Ion current detecting electrode | Nonconductive ceramic | State of carbon burn-off No. 3 | State of carbon burn-off No. 6 |
|---|---|---|---|---|---|
| 41 | WC | WC | No addition | ○ | x |
| 42 | $Mo_2C$ | $Mo_2C$ | No addition | ○ | x |
| 43 | TiN | TiN | No addition | ○ | x |
| 44 | $WSi_2$ | $WSi_2$ | No addition | ○ | x |
| 45 | $Mo_{4.8}Si_3C_{0.6}$ | $Mo_{4.8}Si_3C_{0.6}$ | No addition | ○ | x |
| 46 | MoB | MoB | No addition | ○ | x |
| 47 | $TiB_2$ | $TiB_2$ | No addition | ○ | |
| 48 | $ZrB_2$ | $ZrB_2$ | No addition | ○ | x |
| 49 | $MoSi_2$ | $MoSi_2$ | No addition | ○ | |

<<40th Embodiment>>

Next, description will be made to a case where a wire material of refractory metal was used for the ion current detecting electrode and a case where a mixed material of refractory metal and nonconductive ceramic was used for the ion current detecting electrode.

At first, the case where a wire material of refractory metal was used for the ion current detecting electrode is shown. As mentioned above, the refractory metal denotes metal having a melting point of 1200° C. or higher. For such refractory metal, Cr, Co, Fe, Mo, Ni, Re, Ti, W and Zr may be cited. Their alloy such as Fe—Ni—Cr, Ni—Co, Fe—Co and W—Re can also be used.

The same composition as shown in the 38th embodiment was used for the conductive heating-element, while a wire material such as one shown above was used for the structure of the ion current detecting electrode instead of that of the ion current detecting electrode 3 shown in FIG. 69A of the 37th embodiment. In either case, the carbon burn-off test was performed for two resistance levels corresponding to the tests No. 3 and No. 6 in the 38th embodiment. The other conditions are the same as those in the 38th embodiment. The test results are shown in Table 11. As apparent from Table 11, the carbon can be destroyed by fire in the scope of the present invention.

Next, the case where a mixed material of refractory metal and conductive ceramic was used for the ion current detecting electrode is shown. In manufacturing the glow plug, powder of the above metal was used instead of conductive $MoSi_2$ for the ion current detecting electrode of the 38th embodiment. The mean diameter of each material was set from 1 to 10 $\mu$m. The other conditions are the same as those in the 38th embodiment. The test results are shown in Table 12.

As apparent from the Table 12, the carbon can be destroyed by fire in the scope of the present invention.

TABLE 11

| No. | Conductive ceramic: Conductive heating-element | Conductive ceramic: Ion current detecting electrode | Ion current detecting electrode | State of carbon burn-off No. 3 | State of carbon burn-off No. 6 |
|---|---|---|---|---|---|
| 50 | $MoSi_2$ | $Si_3N_4$ | W | ○ | x |
| 51 | $MoSi_2$ | $Si_3N_4$ | Mo | ○ | x |
| 52 | $MoSi_2$ | $Si_3N_4$ | Ni | ○ | x |
| 53 | $MoSi_2$ | $Si_3N_4$ | Ti | ○ | x |
| 54 | $MoSi_2$ | $Si_3N_4$ | Fe-Cr-Ni | ○ | x |
| 55 | $MoSi_2$ | $Si_3N_4$ | Ni-Co | ○ | x |
| 56 | $MoSi_2$ | $Si_3N_4$ | Fe-Co | ○ | x |
| 57 | $MoSi_2$ | $Si_3N_4$ | W-Re | ○ | x |

TABLE 12

| No. | Conductive ceramic: Conductive heating-element | Conductive ceramic: Ion current detecting electrode | Non conductive ceramic: Conductive ceramic | Non conductive ceramic: Non conductive ceramic | State of carbon burn-off No. 3 | State of carbon burn-off No. 6 |
|---|---|---|---|---|---|---|
| 58 | $MoSi_2$ | $Si_3N_4$ | W | $Si_3N_4$ | ○ | x |
| 59 | $MoSi_2$ | $Si_2N4$ | Mo | $Si_3N_4$ | ○ | x |
| 60 | $MoSi_2$ | $Si_3N_4$ | Ni | $Si_3N_4$ | ○ | x |
| 61 | $MoSi_2$ | $Si_3N_4$ | Ti | $Si_3N_4$ | ○ | x |
| 62 | $MoSi_2$ | $Si_3N_4$ | Fe-Cr-Ni | $Si_3N_4$ | ○ | x |
| 63 | $MoSi_2$ | $Si_3N_4$ | Ni-Co | $Si_3N_4$ | ○ | x |
| 64 | $MoSi_2$ | $Si_3N_4$ | Fe-Co | $Si_2N4$ | ○ | x |

<<41st Embodiment>>

Figure 91:
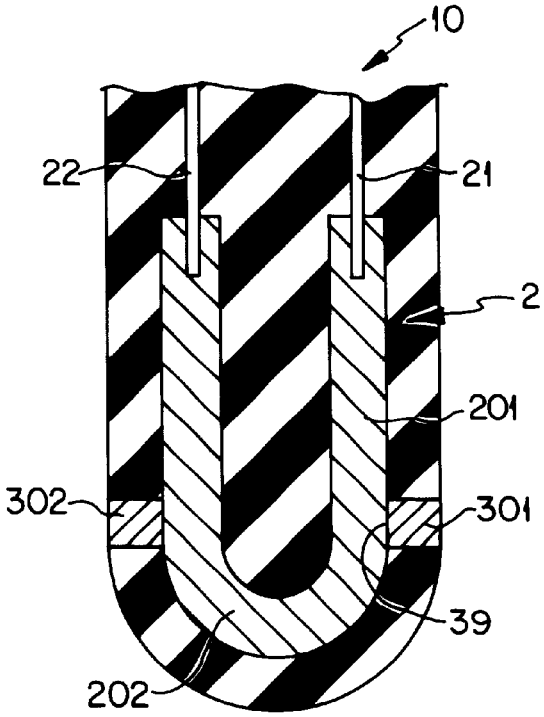
FIG. 91 is a diagram showing general structure of a glow plug according to the 41st embodiment.

As shown in FIG. 91, the embodiment is such that two ion current detecting electrode 301 and 302 are provided on the left and right sides of the U-type conductive heating-element, respectively. In the embodiment, since the ion current detecting electrode 301 is located in a position closer to the positive end of the conductive heating-element 2, the first connecting portion 39 between the conductive heating-element 2 and the ion current detecting electrode 301 is provided in this position. For this reason, the second heating section 202 is defined from the first connecting portion 39 to the negative end with a connection to the ion current detecting electrode 103 established at the first connecting portion 39.

When burning off the carbon, DC current for burning off the carbon flows from the ion current detecting electrode 301 to the carbon adhered on the surface of the insulator 11. Since in the embodiment two ion current detecting electrodes are provided, ion current can be detected more precisely. The other portions are the same as those of the 37th embodiment, and the same effects as in the 37th embodiment can be obtained.

<<42nd Embodiment>>

Figure 92A:
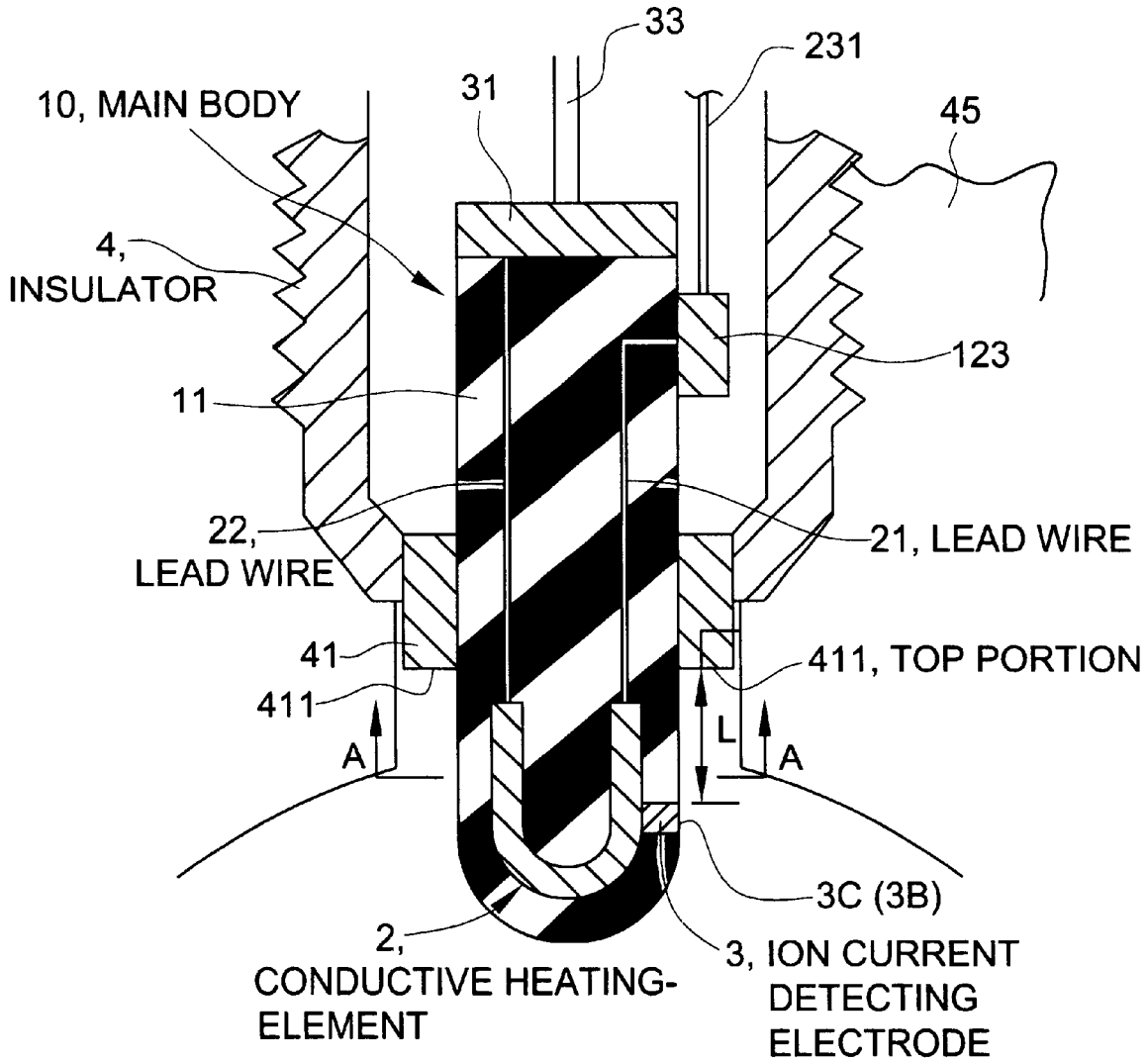
FIG. 92A is a sectional view of a glow plug main body according to a 42nd embodiment.
Figure 92B:
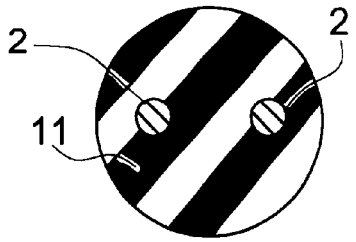
FIG. 92B is a sectional view taken along the line A—A of FIG. 92A.
Figure 93:
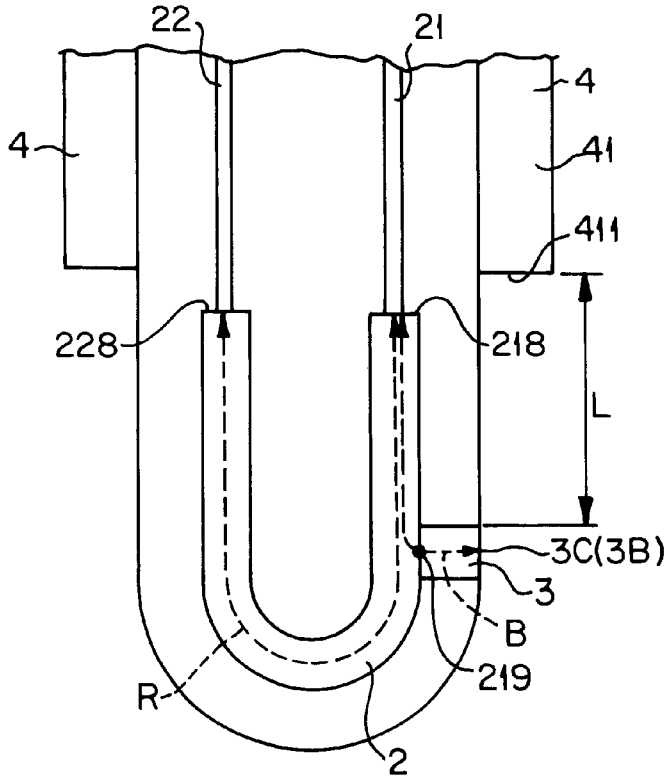
FIG. 93 is a diagram showing electric resistances R (Ω) and B (Ω) in the 42nd embodiment.

Referring to FIGS. 92A, 92B and 93, a glow plug according to the embodiment will be described. Since the glow plug is a modification of that of the 26th embodiment (FIG. 69 and others), only different points will be described. As shown in FIGS. 92A and 92B, the glow plug 1 of the embodiment is a ceramic glow plug constituted of the main body 10 and the housing 4 for supporting the main body 10. The main body 10 includes the insulator 11; the conductive heating-element 2 provided inside the insulator 11; and the pair of lead wires 21, 22 electrically connected to both ends of the conductive heating-element 2, drawn out on the other end side of the insulator 11. The main body 10 also includes an ion current detecting electrode 3 for detecting an ionization state in the flame, which is provided inside the insulator 11. The ion current detecting electrode 3 is electrically connected to the midway of the conductive heating-element 2, and the tip 3C of the ion current detecting electrode 3 is exposed from the insulator 11 into the flame to form the exposed portion 3B.

Further, as shown in FIGS. 92A and 93, the top portion 3C of the ion current detecting electrode 3 is positioned more than 2 mm away from the top portion 411 of the housing 4. In the embodiment, when R (Ω) denotes the total electric resistance R of the conductive heating-element 2 and B (Ω) denotes the electric resistance from the positive end 218 of the conductive heating-element 2 to the tip of the ion current detecting electrode 3, the relationship of B (Ω)≧R (Ω)/3 is exhibited, where the total electric resistance R of the conductive heating-element 2 is resistance between both ends 218 and 228.

As also shown in FIG. 92A, the main body 10 is retained in the housing 4 through the metal annular support 41. One lead wire 21 of the conductive heating-element 2 is pull up inside the insulator 11 and electrically connected to the internal lead wire 231 through the conductive terminal portion 123 provided at the side of the main body 10, while the other lead wire 22 is electrically connected to the internal lead wire 33 through the conductive terminal portion 31 provided at upper end of the insulator 11. The external lead wire 231 is used as a common lead wire for the conductive heating-element 2 and the ion current detecting electrode 3.

As shown in FIG. 82 of the 31st embodiment, which has general structure similar to this embodiment except the arrangement of the ion current detecting electrode 3, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 332.

The external lead wires 233 and 333 are thus electrically coupled to one end of the conductive heating-element 2 and the other end of the conductive heating-element 2, respectively. As shown in FIG. 92A, the top portion (the lower end portion) of the main body 10 is formed into a semi-spherical shape with the top portion 3C of the ion current detecting electrode 3 exposed therefrom.

Figure 94:
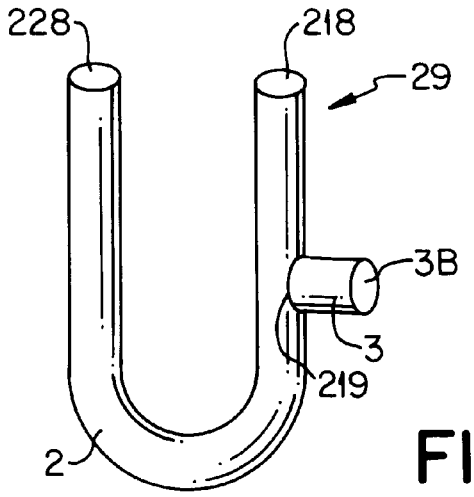
FIG. 94 is a diagram for explaining a glow plug manufacturing method in the 42nd embodiment.

In manufacturing the glow plug main body 10, a molded body 29 for the conductive heating-element 2 and the ion current detecting electrode 3, such as one shown in FIG. 94, is first prepared. The molded body 29 is made up by injection molding or press molding a mixture of ceramic powders for the conductive heating-element 2 and the ion current detecting electrode 3. The molded body 29 is then embedded in the insulator 11, integrally molded by a hot press method. The lead wires 21 and 22 are connected before the molded body 29 is embedded in the insulator 11. The glow plug main body 10 is thus obtained.

The conductive heating element, the ion current detecting electrode and the insulator are all constructed of the main composition of a nonconductive ceramic material and a conductive ceramic material. The mixing ratio between the nonconductive ceramic material and the conductive ceramic material, and the grain size of each material are regulated among the conductive heating-element 2, the ion current detecting electrode 3 and the insulator 11 so as to adjust the coefficient of linear expansion and physical characteristics such as electric resistance among them.

In the embodiment, silicon nitride ($Si_3N_4$) is used as the nonconductive ceramic material and molybdenum silicide ($MoSi_2$) is used as the conductive ceramic material. Other nonconductive ceramic materials such as $Al_2O_3$, BN and AlN and other conductive ceramic materials such as $Mo_5Si_3$, WC and TiN can also be used.

The electric resistances R (Ω) and B (Ω) can be adjusted by changing the connect position of the ion current detecting electrode 3 with maintaining the distance L of more than 2 mm. In other words, the relationship of B (Ω)≧R (Ω)/3 is realized by adjusting the conduction length.

The glow plug 1 constituted of the above parts such as the main body 10 and the housing 4 is mounted in the cylinder head 45 by fastening the male screw portion of the housing 4. As described with respect to FIG. 70, the glow plug is so mounted that the top portion of the glow plug main body 10 will project into the turbulence chamber 451 that forms part of a combustion chamber of the cylinder head 45. In the drawing, reference numeral 457 is the main combustion chamber, 458 the piston and 459 the fuel injection nozzle.

The glow plug 1 can be connected to the glow plug actuator circuit of FIG. 70, in which the ECU 52 controls the glow relay in the procedure as discussed above along the flow chart of FIG. 65 so as to control the conduction.

Since in the embodiment the distance L between the top portion 3C of the ion current detecting electrode 3 and the top portion 411 of the housing 4 is 2 mm or more, the ion current can be detected securely even when some carbon (soot) is accumulated on the glow plug main body during fuel combustion. However, when the carbon (soot) due to fuel combustion has adhered to the ion current detecting electrode 3 of the glow plug, i.e., when smoke or smudge has occurred, the ion current tends to be kept at low level before the fuel injection stage and to rise after the fuel injection stage as shown in FIG. 66B (compare FIGS. 66A and 66B). In FIG. 66B, Ith is a judgment level (threshold) of wave height, which is used to detect the degree of smoke or smudge and determine whether or not the glow relays 53 and 531 should be turned on.

When such smudge has occurred, the glow relays 53 and 531 are turned on to run the conductive heating-element 2 hot, thus burning off the adhered carbon. Since such operation was described above along the flowchart of FIG. 67, the description will not be repeated.

As apparent from FIG. 93, the important feature is that the total electric resistance R (Ω) of the conductive heating-element 2 and the electric resistance B (Ω) from the positive end 218 of the conductive heating-element 2 to the top portion 3C of the ion current detecting electrode 3 exhibit the relationship of B (Ω)≧R (Ω)/3.

For this reason, an optimum current can flow even when the carbon has been so accumulated that a simulated short will occur between the ion current detecting electrode 3 and the housing 4.

In other words, an optimum current can be passed through a circuit among the conductive heating-element, the ion current detecting electrode and the adhered carbon even when the carbon has been accumulated on the glow plug main body 10 and a simulated short occurs. For this reason, the carbon can be burnt off by the conductive heating-action of this circuit. After such a simulated short is relieved, the current flows through the conductive heating-element to further promote the carbon burn-off.

If the electric resistance B (Ω) is very large, the resistance of the circuit among the conductive heating-element, the ion current detecting electrode and the adhered carbon becomes large. In this case, almost normal current flows through the entire conductive heating-element and the adhered carbon can be burnt off by the heating action of the conductive heating-element even if the adhered carbon exists.

In the glow plug of the embodiment, the conductive heating-element 2, the lead wires 21, 22 and the ion current detecting electrode 3 are integrally provided inside the insulator 11. For this reason, the glow action (heating action) of the conductive heating-element 2 and the ion current detection by the ion current detecting electrode 3 can be carried out by one glow plug, thereby making the glow plug compact.

Even when some carbon adhered onto the ion current detecting electrode 3 and the surface of the glow plug, since the conductive heating-element 2 is energized to generate heat, the adhered carbon can be burnt off to return the ion current detecting electrode 3 to the normal state. It is therefore possible to detect ion current precisely.

Further, since the conductive heating-element 2, the lead wires 21, 22 and the ion current detecting electrode 3 are provided inside the insulator 11, excellent durability can be obtained without any rust due to oxidation or the like by the combustion gases. Furthermore, since the top portion of the insulator 11 is made into the semi-spherical shape, thermal shock in the combustion chamber can be absorbed.

Figure 95:
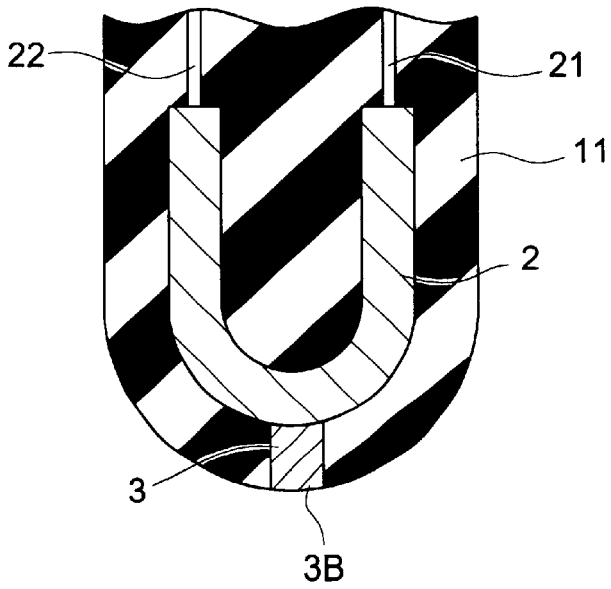
FIG. 95 is a diagram showing an example in which the position of the ion current detecting electrode of the 42nd embodiment is changed.

The top portion 3C of the ion current detecting electrode 3 is so exposed that it will contact the combustion gases (FIG. 92A). The ion current detecting electrode 3 can also be positioned in the top portion of the insulator 11 as shown in FIG. 95. In this case, the ion current can be detected with high accuracy in all directions of the combustion chamber.

<<43rd Embodiment>>

Figure 96:
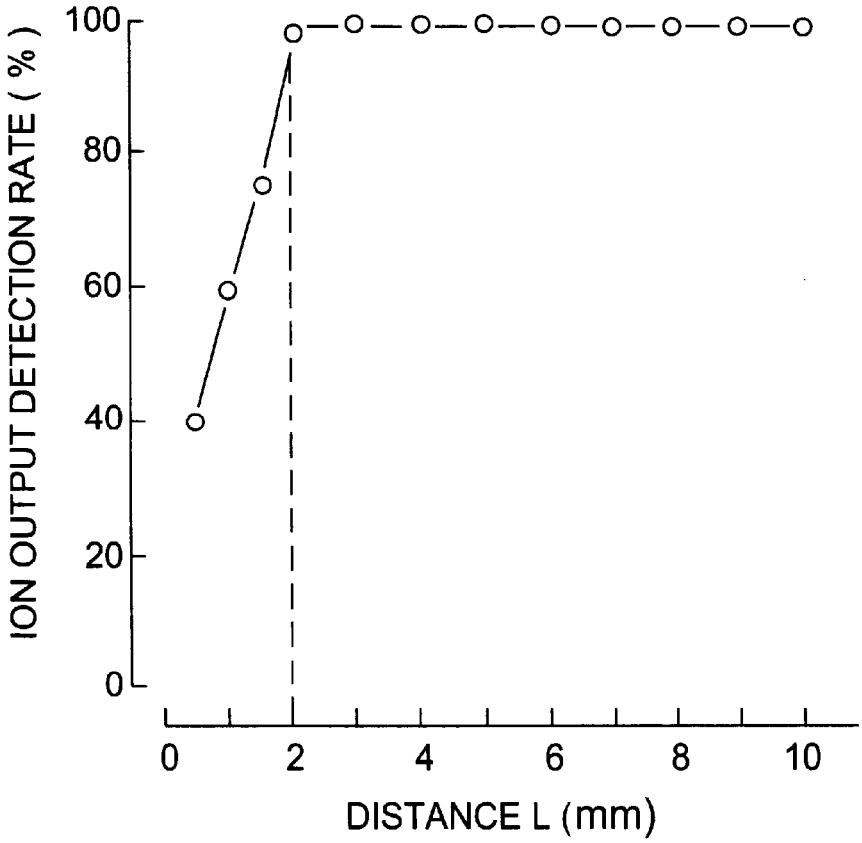
FIG. 96 is a diagram showing a relationship between distance L and ion output detection rate in a 43rd embodiment.

As shown in FIG. 96, the embodiment shows an experimental result in the glow plug main body 10 such as one shown in the 42nd embodiment, indicating a correlation between ion output detection rate and distance L between the tip 3C of the ion current detecting electrode 3 and the top portion 411 of the housing 4. In manufacturing the glow plug main body 10, the ion current detecting electrode 3 is variously put in positions corresponding to respective distances L to prepare various molded bodies 29 using an injection molding (FIG. 94). The molded bodies 29 are then embedded in the ceramic powder, and hot-pressed to produce each individual insulator 11 with the conductive heating-element 2 and the ion current detecting electrode 3 built therein. The glow plugs different in the distance L from each other are thus produced and prepared for the experiment.

The ion output detection rate is defined as follow. When ion current is continuously sampled during engine operation, the wave height of the ion current waveform shown in FIG. 66A is not kept constant and non-uniformity at each combustion event or due to deterioration in its output caused by carbon adhesion occurs. For this reason, a mean value h of wave heights H detected for a fixed period under fixed operating conditions is determined, and an ion current waveform having a wave height more than 0.3 times the mean value h is selected for one with proper detection accuracy. Thus, the ion output detection rate is represented by the incidence of wave heights having more than 0.3 times the mean value h in all the combustion events.

Using a four-cylinder, 2000 cc Diesel engine, the experiment was formed to check ion current detecting situations by operating the Diesel engine to accumulate carbon on the glow plug main body.

The carbon accumulation was performed by repeating an operating cycle 30 times, the operating cycle consisting of 800 rpm idling of the engine for two min. and 4000 rpm operation of the engine for two min. The operating cycle was further repeated 10 more cycles for which ion current detection was performed to measure the ion current detecting situations.

The measurement results are shown in FIG. 96, in which distance L (mm) and ion output detection rate (%) are chosen as abscissa and ordinate respectively. As apparent from the drawing, the ion output detection rate is 100% when the distance L is 2 mm or more. On the other hand, the ion output detection rate is reduced gradually as the distance is less than 2 mm.

<<44th Embodiment>>

As shown in Table 13, the embodiment shows an experimental result in the glow plug main body 10 such as one shown in the 42nd embodiment. The experiment was performed by variously changing the relationship between the total electric resistance R (Ω) of the conductive heating-element 2 (FIG. 93) and the electric resistance B (Ω) from the positive end 218 of the conductive heating-element 2 to the tip 3C of the ion current detecting electrode 3 (FIG. 93). The variation of the electric resistance B (Ω) was made by changing the position of the ion current detecting electrode 3 in the molded body for the conductive heating-element 2 and the ion current detecting electrode 3 in the same manner as the 43rd embodiment did. As shown in Table 13, 8 glow plugs (samples No. C1 to No. C3 and No. E1 to No. E5), each value B (Ω) of which was changed with keeping the total electric resistance R (Ω) of the conductive heating-element 2 at constant value, were prepared for the experiment. The glow plug manufacturing process, the other arrangements and such are the same as those in the 42nd embodiment.

Using a four-cylinder Diesel engine, the conductive heating-element 2 was started in conduction in the stop state of the engine and stopped after two min. When 5 min. had elapsed after starting conduction of the conductive heating-element 2, the engine was started with 800 rpm idling of the engine for one min., operated at 4000 rpm for two min., idled again at 800 rpm for one min., and stopped. Such an operating cycle from starting conduction of the conductive heating-element 2 to the engine stop was then repeated 500 times for the endurance test.

The test results are shown in Table 13. As apparent from Table 13, when B (Ω)<R (Ω), the fuses are early destroyed in any samples (C1 to C3). The results show that the tip 3C of the ion current detecting electrode 3 and the top portion 411 of the housing 4 become a simulated short to form a short circuit in a path with the lead wire on the positive side. Under such a condition, the conductive heating-element is placed in conduction to pass a current large enough to destroy the fuse. On the other hand, when B (Ω)≧R (Ω)/3, no failure occurs in the samples (E1 to E5) during 500 cycles.

TABLE 13

| Sample No. | Electric resistance | Test result |
|---|---|---|
| C1 | 0.10 × R | Fuse blew in 180th cycle |
| C2 | 0.20 × R | Fuse blew in 190th cycle |
| C3 | 0.30 × R | Fuse blew in 22~0th cycle |
| E1 | 0.35 × R | No failure |
| E2 | 0.40 × R | No failtire |
| E3 | 0.50 × R | No failure |
| E4 | 0.70 × R | No failure |
| E5 | 1.00 × R | No failure |

<<45th Embodiment>>

Since the embodiment is a modification of the 26th embodiment (FIG. 69A and others), only different points will be described. As shown in FIG. 69A, the glow plug 1 is constituted of the main body 10 and the housing 4 for mounting the main body 10. The main body 10 includes the insulator 11; the conductive heating-element 2 provided inside the insulator 11; and the pair of lead wires 21 and 22 electrically connected to both ends of the conductive heating-element 2, drawn out on the other end side of the insulator 11. The main body 10 also includes an ion current detecting electrode 3 for detecting an ionization state in the flame, which is provided inside the insulator 11. The ion current detecting electrode 3 is provided at the diametrical center of the insulator 11, with the tip exposed at the top portion of the insulator 11 so that it will contact the flame.

In the embodiment, when K denotes the coefficient of linear expansion of the ion current detecting electrode 3, H denotes the coefficient of linear expansion of the conductive heating-element 2 and S denotes the coefficient of linear expansion of the insulator, the relationship among the coefficients exhibits H≧S and H≧K. The adjustment among the coefficients K, H and S was carried out by adjusting the mixing ratio between the nonconductive ceramic material and the conductive ceramic material used as materials for each element, as will be described later.

In manufacturing the glow plug main body 10, a molded body 29 for the conductive heating-element 2 and the ion current detecting electrode 3, such as one shown in FIG. 100, described later, is first prepared. The molded body 29 is made by injection molding or press molding a mixture of ceramic powders for the conductive heating-element 2 and the ion current detecting electrode 3. The molded body 29 is then embedded in the insulator 11, and baked integrally by a hot press method. After that, the shape of insulator is cut to be a cylindrical shape with round tip. The lead wires 21 and 22 are connected before embedded in the insulator 11. The glow plug main body 10 is thus obtained.

For conductive heating element 2, the ion current detecting electrode 3 and the insulator 11, silicon nitride ($Si_3N_4$) was used as a nonconductive ceramic material and molybdenum silicide ($Mosi_2$) was used as a conductive ceramic material, with adding a sintering auxiliary. Since the coefficient of linear expansion is changed according to the change of the mixing ratio between $Si_3N_4$ and $MoSi_2$, as will be described later with respect to FIG. 97, the coefficients H, K and S were adjusted properly to realize the relationship of H≧K and H≧S.

The insulation resistances of the conductive heating-element 2, the ion current detecting electrode 3 and the insulator 11 were adjusted by regulating the grain size of each ceramic material.

As discussed above, in the embodiment, the relationship among the coefficients of linear expansion K, H and S of the ion current detecting electrode 3, the conductive heating-element 2 and the insulator 11 exhibits H≧S and H≧K. In other words, the conductive heating-element 2 completely embedded inside has a coefficient of linear expansion larger than the ion current detecting electrode 3 and the insulator 11 exposed on the surface of the main body 10. For this reason, the glow plug 1 of the embodiment can maintain compressive stress on the surface of the main body 10 when in use, thereby improving the durability.

<<46th Embodiment>>

In the embodiment, a test was performed to check the relationship between mixing ratio and coefficient of linear expansion by changing the mixing ratio between the nonconductive ceramic material $Si_3N_4$ and the conductive ceramic material $MoSi_2$ for the conductive heating-element 2, the ion current detecting electrode 3 and the insulator 11 according to the 45th embodiment. In the embodiment, glow plugs with the coefficients of linear expansion H, K and S changed were also prepared for the endurance test to check the effectiveness of the present invention.

With the relationship between the mixing ratio of $Si_3N_4$ and $MoSi_2$ and the coefficient of linear expansion, sinters were produced by changing the rate of addition of $Mosi_2$ from 0 to 100% with every 10% per 100 of $Si_3N_4$ to measure individual coefficients of the linear expansion. Then, a 10 wt % sintering auxiliary of $Y_2O_3$ and $Al_2O_3$ was externally added to the sinters. the measurement results are shown in FIG. 97, in which addition ratio of $MoSi_2$ to $Si_3N_4$ and coefficient of linear expansion are chosen as abscissa and ordinate respectively.

Figure 97:
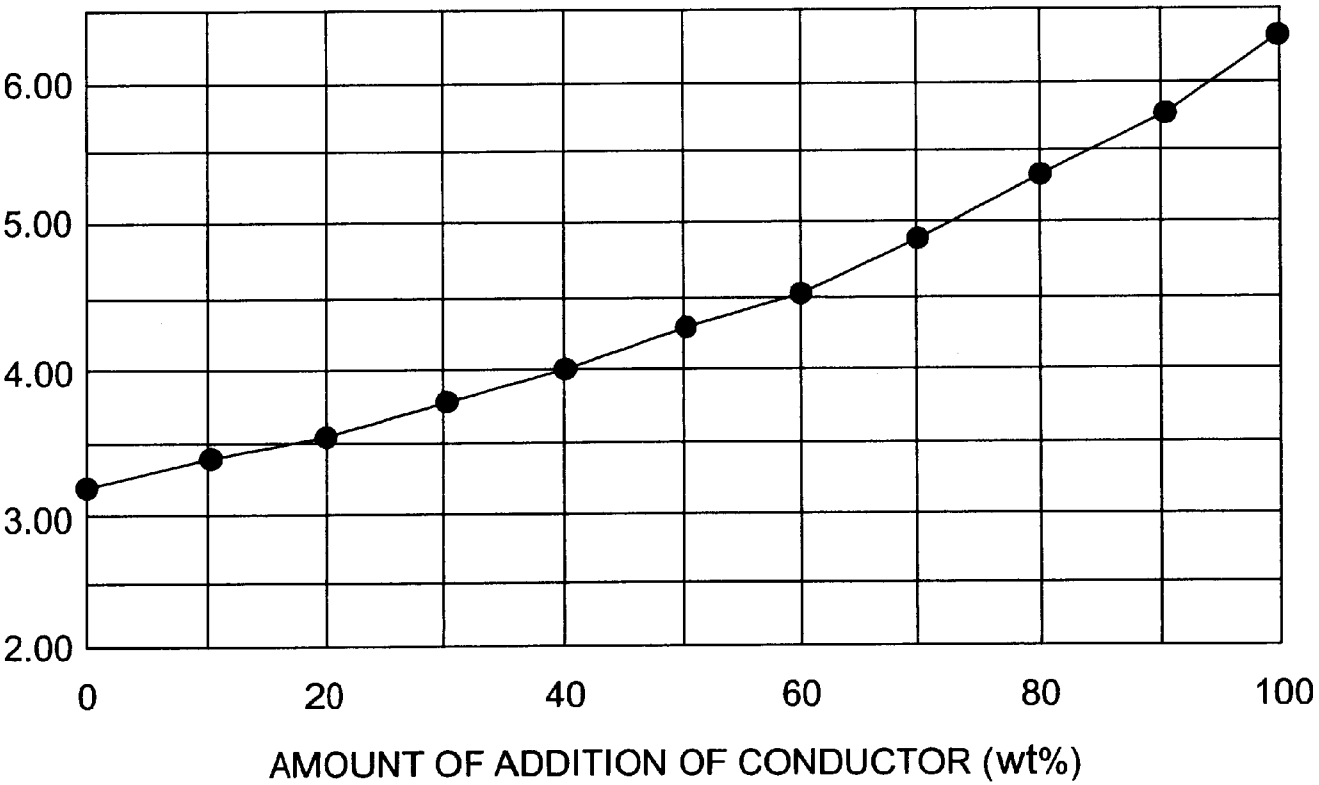
FIG. 97 is a diagram showing a relationship of coefficient of linear expansion with the amount of conductor to be added to nonconductive ceramic in a 46th embodiment.

As apparent from FIG. 97, the coefficient of linear expansion increases as the addition ratio of $MoSi_2$ increases. As is well known, the coefficient of linear expansion is determined substantially by the mixing ratio alone without no or less effect of the other conditions such as grain size. For this reason, if the mixing ratio between $Si_3N_4$ and $MoSi_2$ is the same, the conductive heating-element, the ion current detecting electrode and the insulator must have the same coefficient of linear expansion.

Using the characteristics shown in FIG. 97, various glow plugs having different coefficients of linear expansion were next prepare by variously changing the mixing ratio between $Si_3N_4$ and $MoSi_2$ for the endurance test. For easy understanding, the coefficients of linear expansion K and S of the ion current detecting electrode and the insulator were made identical constantly in the embodiment.

Table 14 shows a difference of coefficient of linear expansion [H−K(S)] in each glow plug prepared (samples No. E1 to No. E13, and No. C1 to No. C6). The samples No. E1 to No. 13 are products according to the present invention while the samples No. C1 to No. C6 are comparative examples. The endurance test was performed by repeating the engine operation up to 10000 cycles to check the cycle of crack development, the rate of resistance rise in the conductive heating-element and the possibility of ion current detection.

The test results are shown in Table 14. As apparent from Table 14, the samples No. C1 to No. C6 develop cracks in the glow plug main body before 10000 cycles and the ion current detection is made impossible due to the crack development. In contrast, the samples No. E1 to No. E13 develop no crack during 10000 cycles and normal ion current detection can be performed constantly. The 1000-cycle normal detection is considered to meet reliability in the market.

The rate of resistance rise in the conductive heating-element gradually increased when the difference of coefficient of linear expansion [H−K(S)] was $2.0\times10^{-6}$ or more. Since such a rise of the resistance of the conductive heating-element causes a reduction in the heating temperature and hence slow-down of the fast-response heating action, the difference of coefficient of linear expansion [H−K(S)] is preferably $2.0\times10^{-6}$ or less.

TABLE 14

| Sample No. | Difference of coefficient of linear expansion H − K(S) × $10^{-6}$(/° C.) | Cycle of crack development | Rate of resistance rise in conductive heating-element | Possibility of ion current detection |
|---|---|---|---|---|
| C1 | −3.0 | 4200 | 20% or less | Impossible after crack development |
| C2 | −2.0 | 5600 | ↑ | ↑ |
| C3 | −1.0 | 6800 | ↑ | ↑ |
| C4 | −0.5 | 7800 | ↑ | |
| C5 | −0.3 | 9100 | ↑ | ↑ |
| C6 | −0.1 | 9600 | ↑ | ↑ |
| E1 | 0.0 | No crack development | ↑ | Always possible |
| E2 | 0.1 | ↑ | ↑ | ↑ |
| E3 | 0.3 | ↑ | ↑ | ↑ |
| E4 | 0.5 | ↑ | ↑ | ↑ |
| E5 | 1.0 | ↑ | ↑ | ↑ |
| E6 | 1.5 | ↑ | ↑ | ↑ |
| E7 | 1.7 | ↑ | ↑ | ↑ |
| E8 | 1.9 | ↑ | ↑ | ↑ |
| E9 | 2.0 | ↑ | ↑ | ↑ |
| E10 | 2.1 | ↑ | 22% | ↑ |
| E11 | 2.3 | ↑ | 26% | ↑ |

TABLE 14-continued

| Sample No. | Difference of coefficient of linear expansion H − K(S) × $10^{-6}$(/° C.) | Cycle of crack development | Rate of resistance rise in conductive heating-element | Possibility of ion current detection |
|---|---|---|---|---|
| E12 | 2.5 | ↑ | 34% | ↑ |
| E13 | 3.0 | ↑ | 48% | ↑ |

<<47th Embodiment>>

Figure 98A:
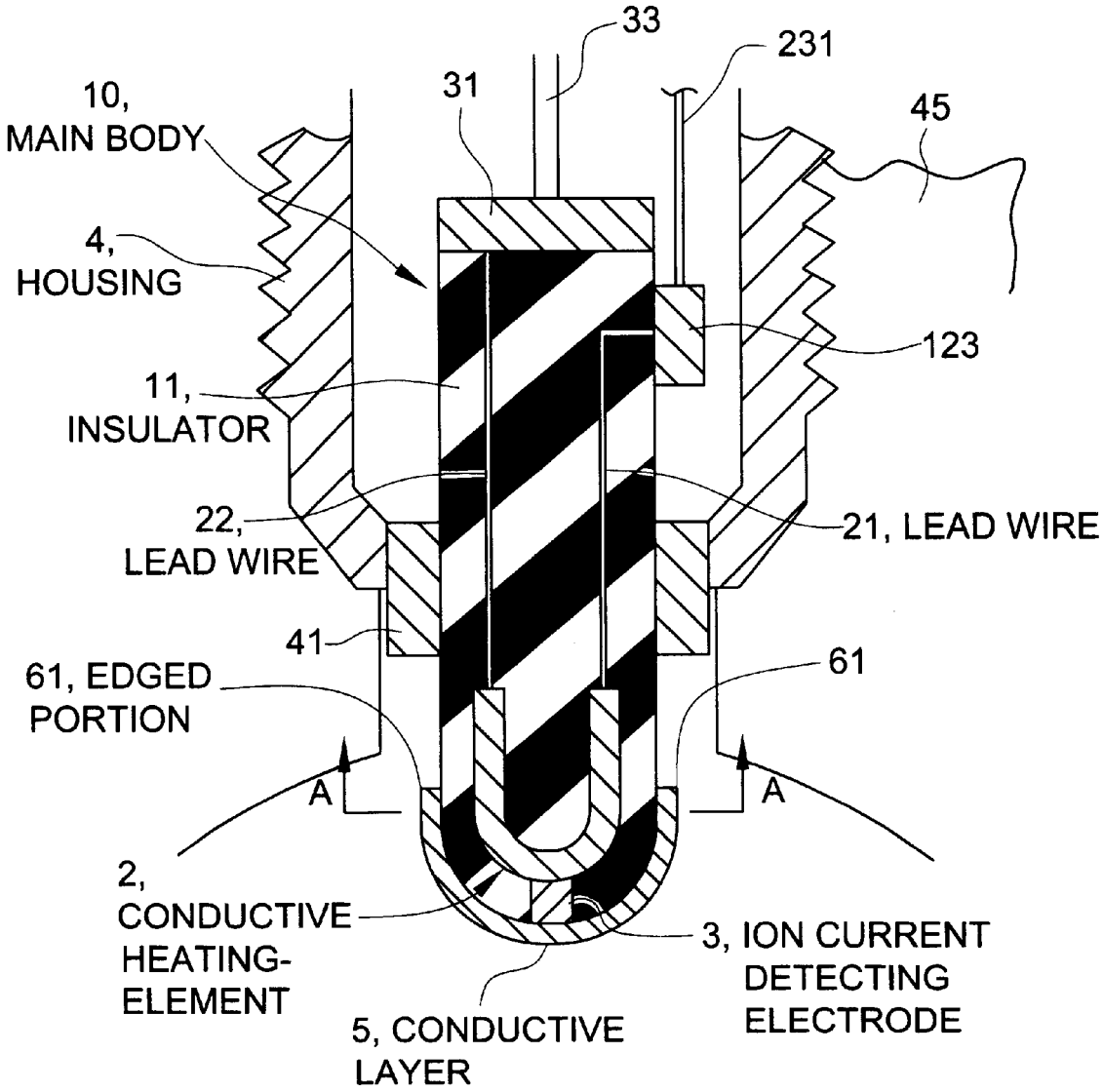
FIG. 98A is a sectional view of a glow plug main body according to a 47th embodiment.
Figure 98B:
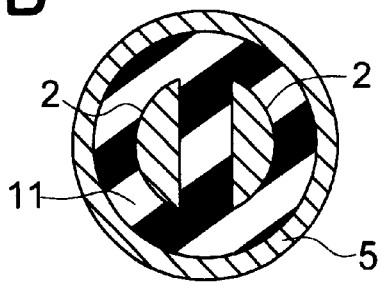
FIG. 98B is a sectional view taken along the line A—A of FIG. 98A.
Figure 99:
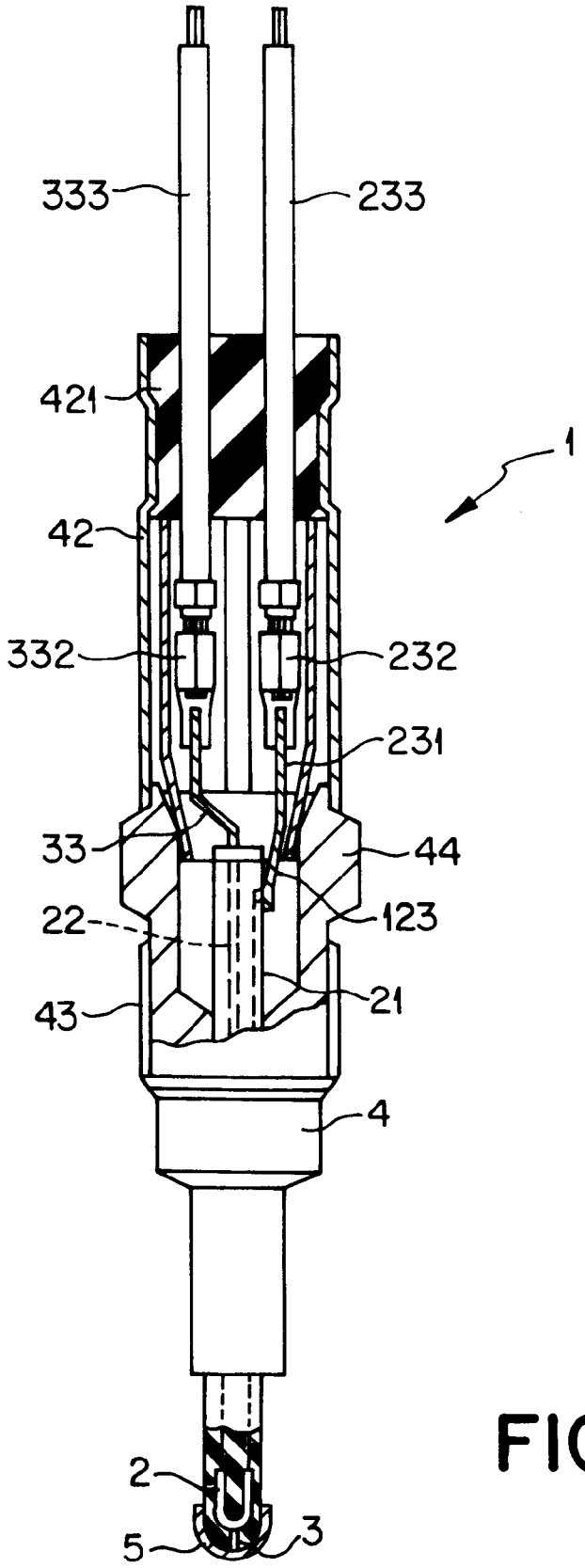
FIG. 99 is a diagram showing general structure of a glow plug according the 47th embodiment.

Referring next to FIGS. 98A to 101, the embodiment will be described. As shown in FIGS. 98A and 98B, the glow plug 1 of the embodiment is constituted of the main body 10 and the housing 4 for mounting the main body 10. The main body 10 includes the insulator 11; the conductive heating-element 2 provided inside the insulator 11; and the pair of lead wires 21 and 22 electrically connected to both ends of the conductive heating-element 2, drawn out on the other end side of the insulator 11.

The main body 10 also includes the ion current detecting electrode 3 for detecting an ionization state in the flame, which is provided inside the insulator 11. On the surface of the insulator 11, a conductive layer 5 is provided, which has a rectangular-edged potion 61 around the outer edge with establishing an electrical connection to the ion current detecting electrode 3. As shown in FIG. 98A, the conductive layer 5 of the embodiment is so shaped that it will cover the tip of the glow plug main body 10 like a cap, which is made into a solid layer with the edged portion 61 provided only at the upper end.

As is similar to FIGS. 69A and 82, both showing other embodiments described above, the main body 1 is retained in the metal housing 4 through the annular support 41 made of metal. One lead wire 21 of the conductive heating-element 2 is pull up inside the insulator 11 and electrically connected to the internal lead wire 231 through the conductive terminal portion 23 provided at the side of the main body 10, while the other lead wire 22 is electrically connected to the internal lead wire 33 through the conductive terminal portion 31 provided at the upper end of the insulator 11. The external lead wire 231 is used as a common wire for the conductive heating-element 2 and the ion current detecting electrode 3.

As shown in FIG. 69A, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 332.

The external lead wires 233 and 333 are thus electrically coupled to one end of the conductive heating-element 2 and the other end of the conductive heating-element 2, respectively. The top portion (lower end portion) of the main body 10 is formed into a semi-spherical shape as shown in FIG. 98A.

In manufacturing the glow plug main body 10, a molded body 29 for the conductive heating-element 2 and the ion current detecting electrode 3, such as one shown in FIG. 100, is first prepared. The molded body 29 is made by injection molding or press molding a mixture of ceramic powders for the conductive heating-element 2 and the ion current detecting electrode 3. The molded body 29 is then embedded in the insulator 11, and baked integrally by a hot press method. The lead wires 21 and 22 are connected before embedded in the insulator 11. The insulator 11 with the conductive heating-element 2 and the ion current detecting electrode 3 built therein is thus obtained.

The conductive layer 5 is formed on the surface of the insulator 11 as follows: A material for the conductive layer is printed on the surface of the insulator 11 after roughing up the surface. Such a roughing process is first performed by an etching with phosphoric acid or the like. With portion of the insulator 11 to be cut into a cylinder shape, a rough grindstone of #300 or less can be used so that the surface roughness will increase. Such a high surface roughness increases adhesion of the conductive layer 5 to the insulator 11.

The material for the conductive layer is then printed on the spherical portion of the tip of the glow plug main body 10 by a pat printing method and on the cylindrical portion by a cylindrical screen printing method. Printing on these portions is so performed that the material for the conductive layer will contact the exposed portion of the ion current detecting electrode. After that, the conductive layer is baked at 90° C. or higher in an atmosphere of vacuum or nitrogen gas. The conductive layer 5 is thus formed on the surface of the insulator 11 as shown in FIG. 98A. In the embodiment, a material mainly containing metal is used as the material for the conductive layer. Specifically, a mixture of 93 wt % Au, 5 wt % Ni and 2 wt % V was used for forming a conductive layer of 10 $\mu$pm thickness.

Further in the embodiment, the conductive layer 5 is provided on the surface of the insulator 11 with the edged portion 61 provided at the upper end. For this reason, the area of the exposed portion of the ion current detecting electrode can be extended, while the ion current detection accuracy and the responsiveness can be improved by the edge effect of the edged portion 61.

Figure 101:
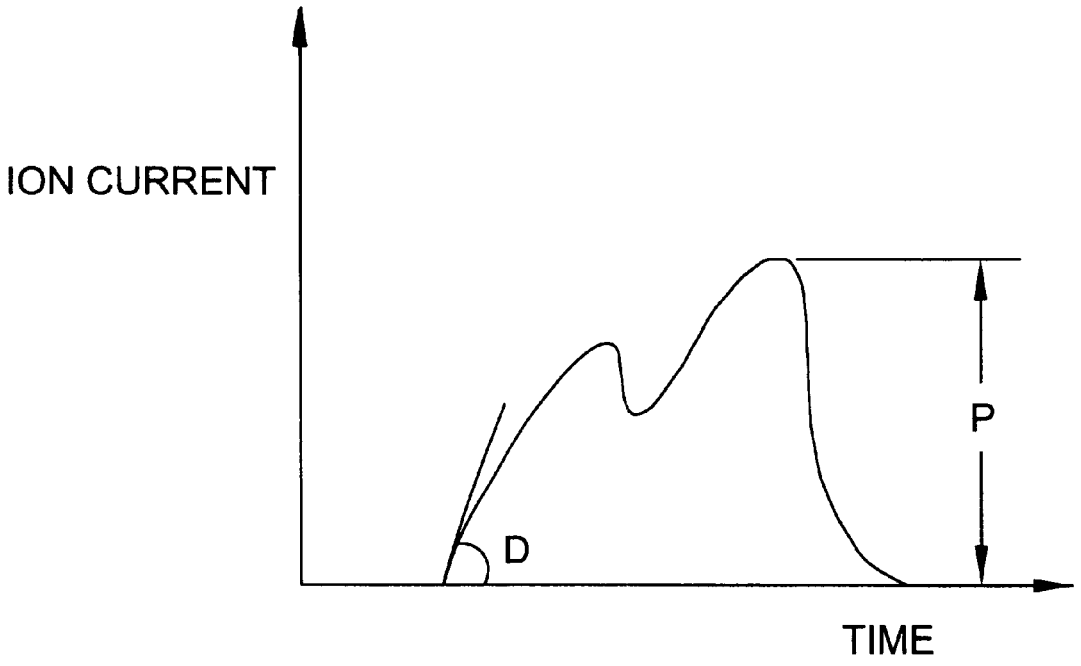
FIG. 101 is a diagram for explaining important points when detecting ion current in the 47th embodiment.

As shown in FIG. 101, the angle of leading edge D and the peak value P are important at the beginning of the ion current detection stage. Since in the embodiment the conductive layer 5 is provided, a sharp angle of leading edge D can be obtained with a very large peak value P. It is therefore possible to further improve the ion current detection accuracy and hence to control fuel combustion conditions more precisely. Although in the embodiment the edged portion 61 has a rectangular shape, even round shape can obtain substantially the same effects as long as it has an edged portion or portions.

<<48th Embodiment>>

Figure 102A:
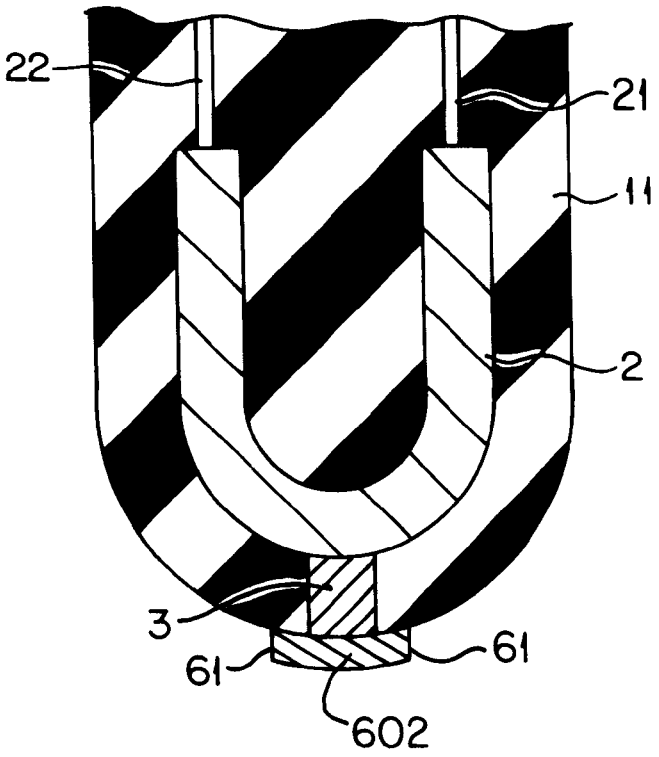
FIG. 102A is a sectional view showing an arrangement of a conductive layer according to a 48th embodiment.
Figure 102B:
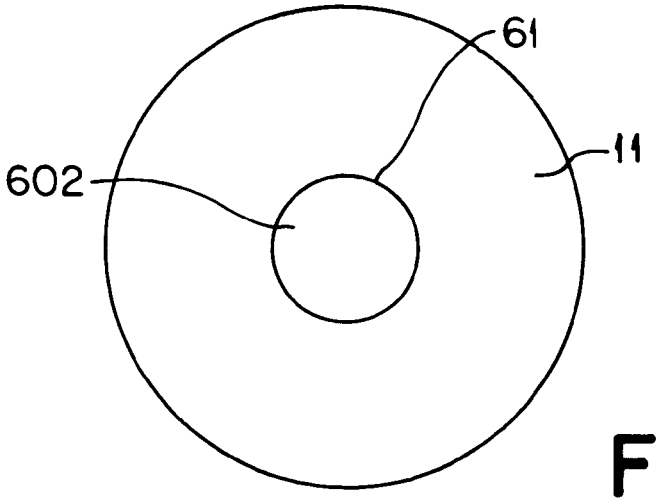
FIG. 102B is a sectional view showing an arrangement of a conductive layer according to the 48th embodiment.

To clarify the effects of the conductive layer in the glow plug of the 47th embodiment, an ion current detection test was performed in the embodiment. The following samples were prepared. Specifically, three samples, namely, the glow plug with the conductive layer 5 that has a cap-like large solid layer such as one described in the 47th embodiment (sample No. E1), a glow plug with a conductive layer 502 that has a dish-like small solid layer such as one shown in FIGS. 102A and 102B (sample No. E2), and a glow plug having no conductive layer (sample No. C1) were prepared. In these samples, portions other than the conductive layer are the same as those in the 47th embodiment.

The test was performed by mounting each glow plug in an identical Diesel engine and measuring ion current under the same conditions. The ion current detection accuracy and the responsiveness were then evaluated by comparing resultant ion current waveforms based on the angle of leading edge D and the peck value P. The larger the angle of leading edge D or the larger the peak value P, the more the detection accuracy and the responsiveness are improved.

The valuation results are shown in Table 15. As apparent from Table 15, the glow plugs with the conductive layers 5 and 6 (E1 and E2) exhibit excellent characteristics in both the angle of leading edge D and the peak value P compared to the glow plug with no conductive layer (C1). As a result, it is found that the ion current detection accuracy and the responsiveness can be considerably improved by providing a conductive layer 5 or 602. Although a large difference can not be found between the samples E1 and E2, the sample E1 with the conductive layer which has a slightly wider area and a larger edged portion 61 is superior to the sample E2.

TABLE 15

| Sample No. | Conductive layer | Angle D of leading edge | Peak value |
|---|---|---|---|
| E1 | solid layer (cap-like) | 78° | 1.4 |
| E2 | solid layer (dish-like) | 76° | 1.2 |
| C1 | No layer | 71° | 0.8 |

<<49th Embodiment>>

Figure 103:
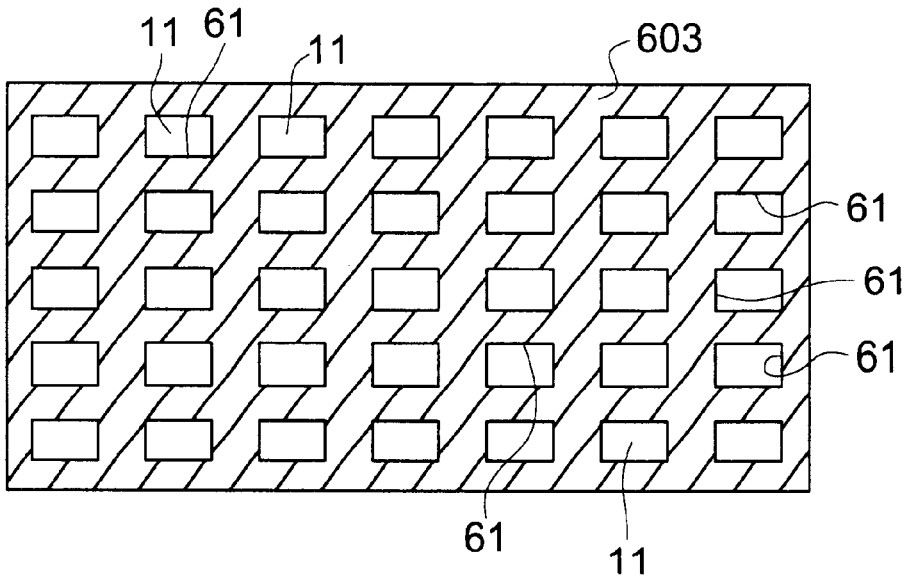
FIG. 103 is a diagram showing a pattern of a conductive layer according to a 49th embodiment.
Figure 104:
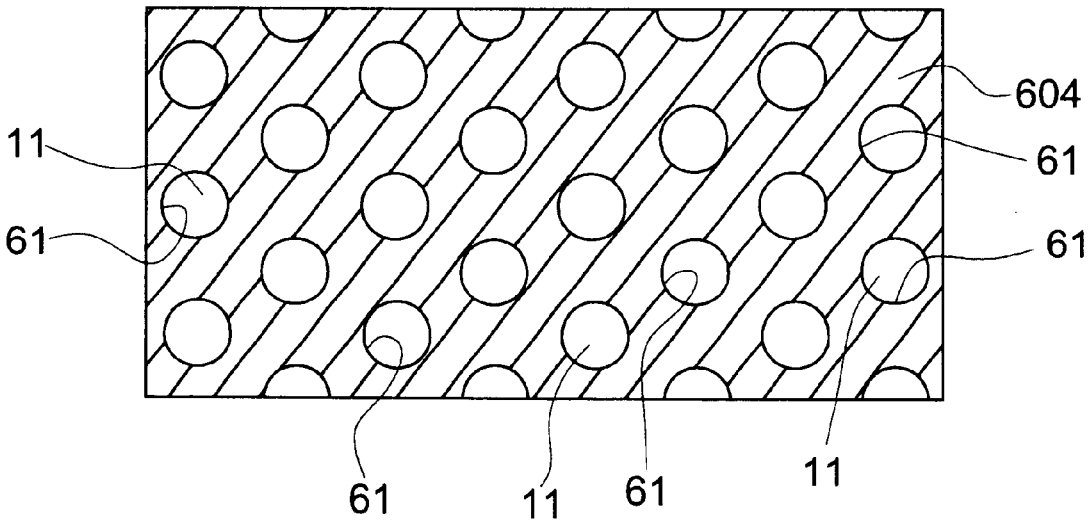
FIG. 104 is a diagram showing another pattern of the conductive layer according to the 49th embodiment.
Figure 105:
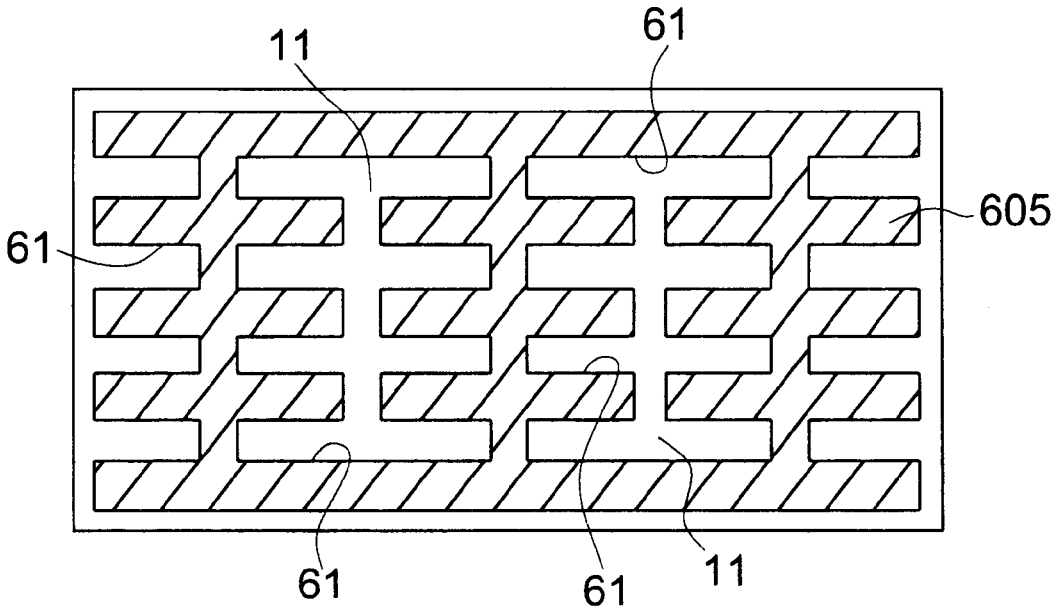
FIG. 105 is a diagram showing other pattern of the conductive layer according to the 49th embodiment.

In the embodiment, the conductive layer 5 in the glow plug of the 47th embodiment was changed in pattern of through holes on the conductive layer 5, as shown in FIGS. 103 to 105, to prepare various samples (Nos. E3 to E5) for testing the influence of change in the pattern. Each conductive layer was formed into a cap-like shape with the same dimensions such as one described in the 47th embodiment. In each sample (E3–E5), portions other than the conductive layer were the same as those of the 47th embodiment. With the testing, the same method as the 48th embodiment used was conducted.

Changed patterns of the conductive layer are shown in FIGS. 103 to 105. In should be noted that FIGS. 103 to 105 show a micron size portion of the insulator 11, not the outline of the conductive layer 5. FIG. 103 illustrates the sample No. E3 with a conductive layer 603 of a lattice-like mesh pattern. As shown in FIG. 103, the conductive layer 603 is such that the insulator 11 is partially exposed from meshes of the net with edged portions 61 provided on the top face (opposite side of the insulator 11) of through holes constituting each mesh.

Figure 106:
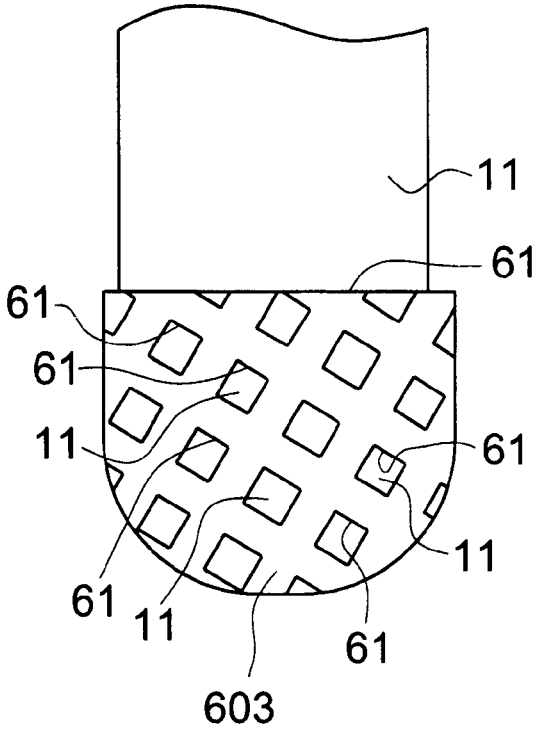
FIG. 106 is a diagram showing other pattern of the conductive layer according to the 49th embodiment.

FIG. 104 illustrates the sample No. E4 with a conductive layer 604. The conductive layer 604 is such that the shape of exposed portion of the insulator 11 in the sample E3 is changed to a dot-like shape with the edged portions 61 provided on the boundary. FIG. 105 illustrates the sample E5 with a conductive layer 605. The conductive layer 605 has a comb-like pattern of through hole portions with the insulator 11 exposed from such comb-like through holes. In the conductive layer 605, the edged portions 61 are provided on the top face. Although FIG. 106 shows the main body 10 with the conductive layer 603 mounted thereon when viewed from the front side, the main bodies 10 with the conductive layers 604 and 605 exhibit the same outline as in FIG. 106 except the pattern.

Using glow plugs with conductive layers of such various patterns, the angle of leading edge D and the peak value P were determined in the same manner as the 48th embodiment did. The test results are shown in Table 16 together with the result for the sample E1. As apparent from Table 16, the angle of leading edge D and the peak value P are further improved in all the samples (E3 to E5) with conductive layers of various patterns compared to the sample E1 with no pattern. Such improvements are considered to be caused by adding a pattern to expose the insulator 11, such as ones shown in FIGS. 103 to 105, so that the edged portions 61 can increase, thereby displaying the edge effect more securely.

Figure 107:
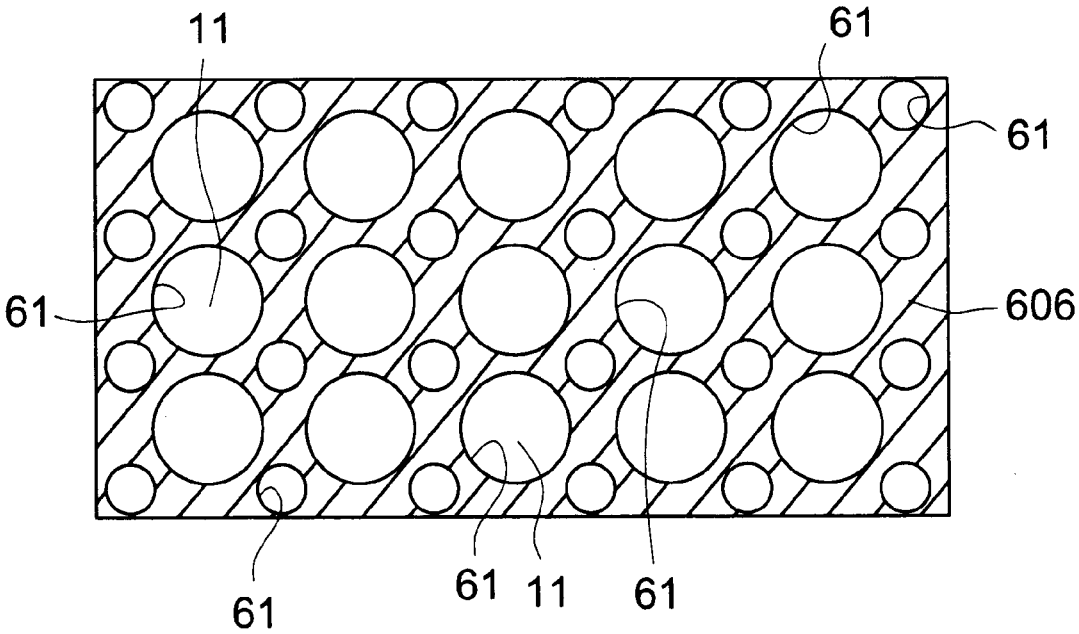
FIG. 107 is a diagram showing a pattern of a conductive layer according to another embodiment.
Figure 108:
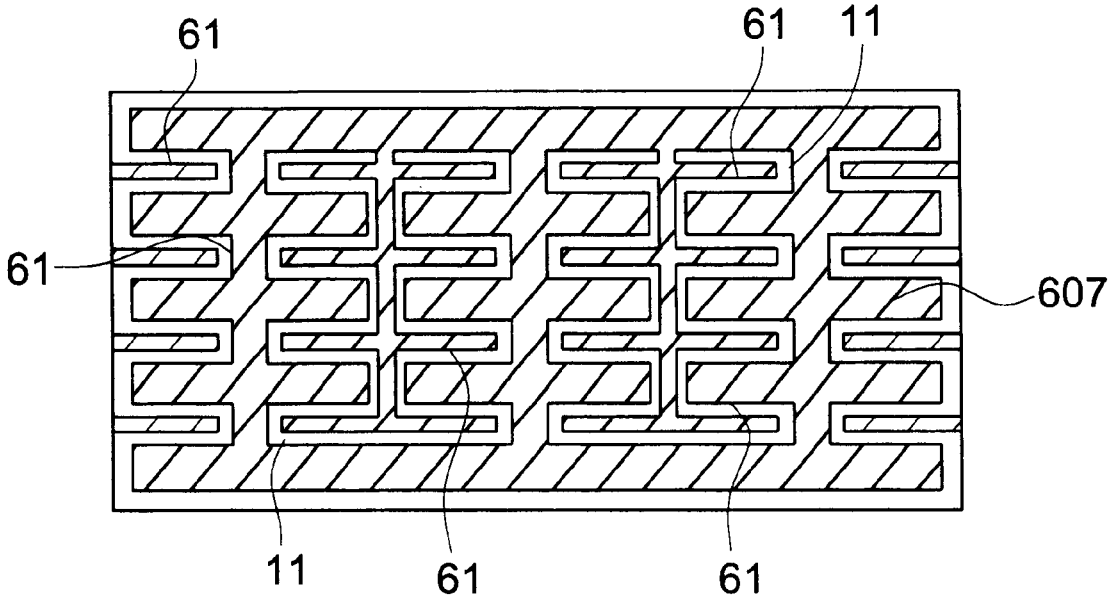
FIG. 108 is a diagram showing a pattern of a conductive layer according to still another embodiment.

Although in the embodiment the conductive layers of three patterns are evaluated, the same effects can be obtained by conductive layers of any other patterns, such as conductive layers 606 and 607 having patterns shown in FIGS. 107 and 108.

TABLE 16

| Sample No. | Conductive layer | Angle D of leading edge | Peak value |
|---|---|---|---|
| E1 | Solid layer (cap-like) | 78° | 1.4 |
| E3 | Mesh pattern (Lattice) | 88° | 2.6 |
| E4 | Mesh pattern (Dot) | 85° | 2.0 |
| E5 | Wedge pattern | 87° | 2.2 |

<<50th Embodiment>>

Figure 109A:
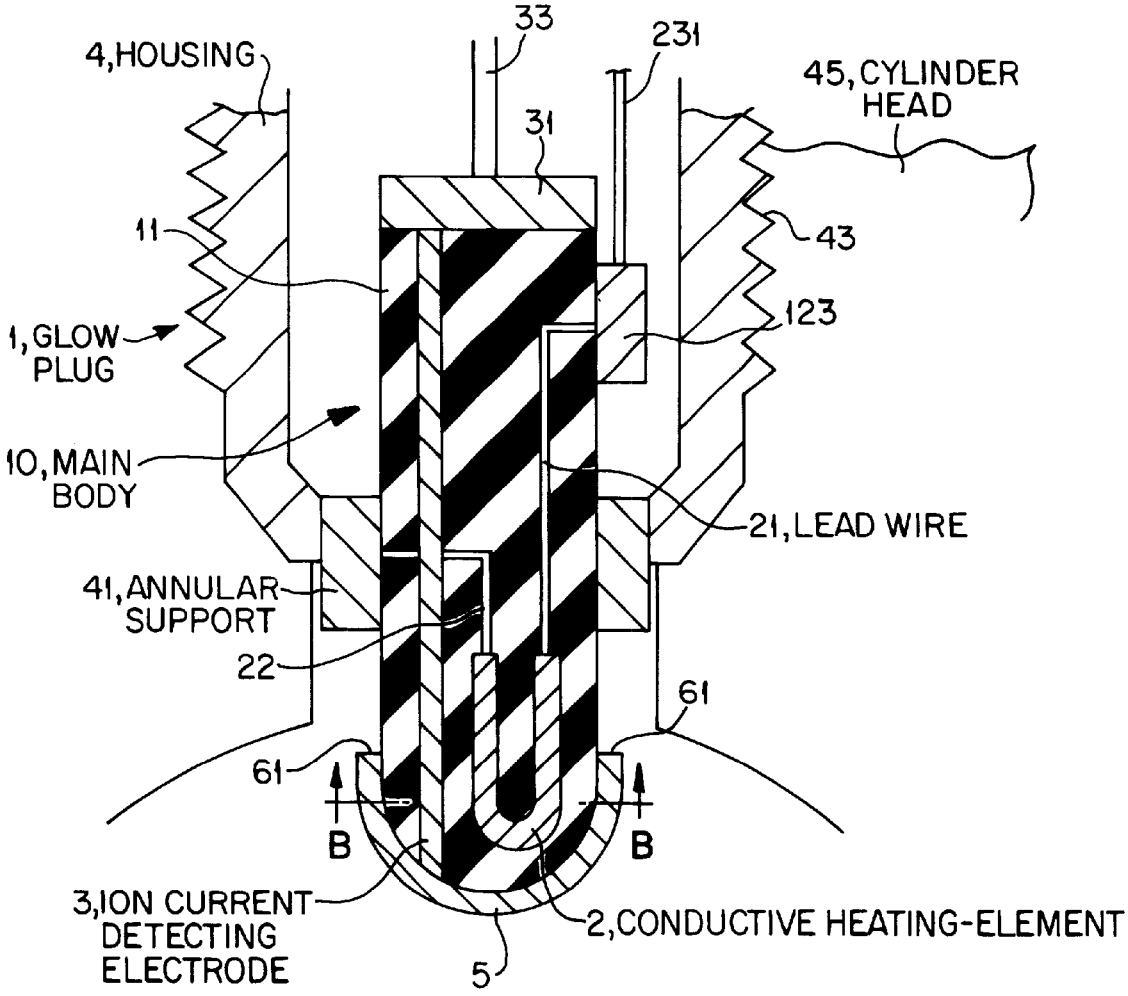
FIG. 109A is a sectional view of a glow plug main body according to a 50th embodiment.
Figure 109B:
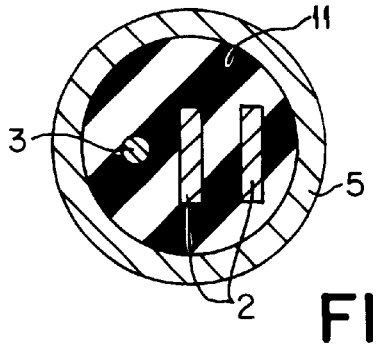
FIG. 109B is a sectional view taken along the line B—B of FIG. 109A.

The embodiment is to apply the 47th embodiment to a case as described some of the above embodiments, where the conductive heating-element 2 and the ion current detecting electrode 3 are separately provided and embedded in an insulator 12A respectively with electrical insulation established therebetween. As shown in FIGS. 109A and 109B, the cap-like conductive layer 5 such as one described in the 47th embodiment is provided at the tip of the main body 10 in the same manner as in FIG. 98A. The other portions are the same as those of the 47th embodiment. Even in the embodiment, the same effects as in the 47th embodiment can be obtained. The 48th and 49th embodiments can also be applied to the case, such as one shown in FIG. 109A, where the conductive heating-element 2 and the ion current detecting electrode 3 are separately provided and embedded in the insulator 12A respectively with electrical insulation established therebetween.

<<51st Embodiment>>

Figure 110A:
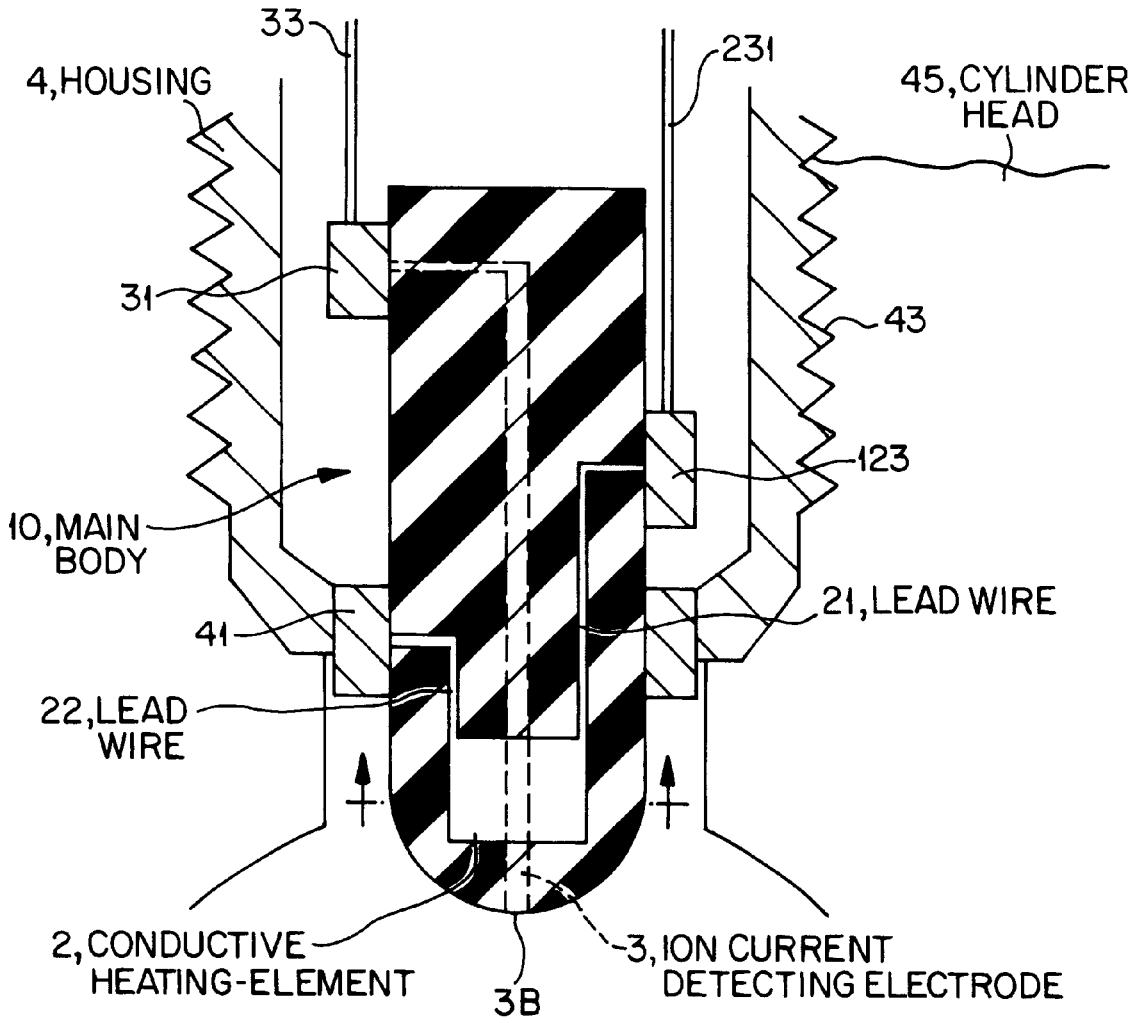
Figure 110B:
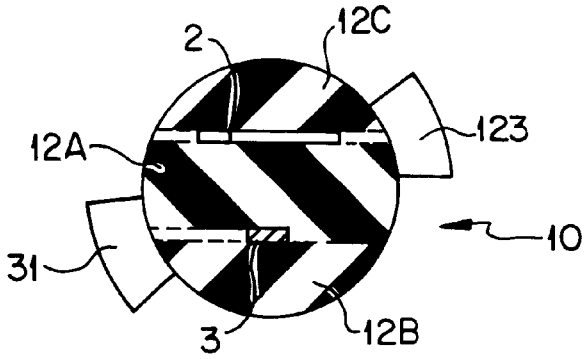

Referring next to FIGS. 110A to 114, a glow plug according to the embodiment will be described. The glow plug of the embodiment is a ceramic glow plug for use as starting aids of a Diesel engine, which is constituted of the main body 10 and the housing 4 for mounting the main body 10 (FIGS. 110A and 110B). As shown in FIG. 110A, the main body 10 includes a first insulating substrate 12A; a conductive heating-element 2 printed on one end side of the front face of the first insulating substrate 12A; a pair of lead wires 21 and 22 electrically connected to both ends of the conductive heating-element 2, drawn out on the other end side of the first insulating substrate.

The main body 10 also includes a covering insulating substrate 12C provided on the front face of the first insulating substrate 12A so as to cover the conductive heating-element 2 and the lead wires 21, 22, and a second insulating substrate stacked on the back face of the first insulating substrate 12A. Further, an ion current detecting electrode 3 is provided on the front face of the second insulating substrate 12B for detecting an ionization state in the flame with electrical insulation from the conductive heating-element 2 established. The ion current detecting electrode 3 is provided substantially at the diametrical center of the main body 10. As will be described later, the above parts are integrally sintered.

Figure 111:
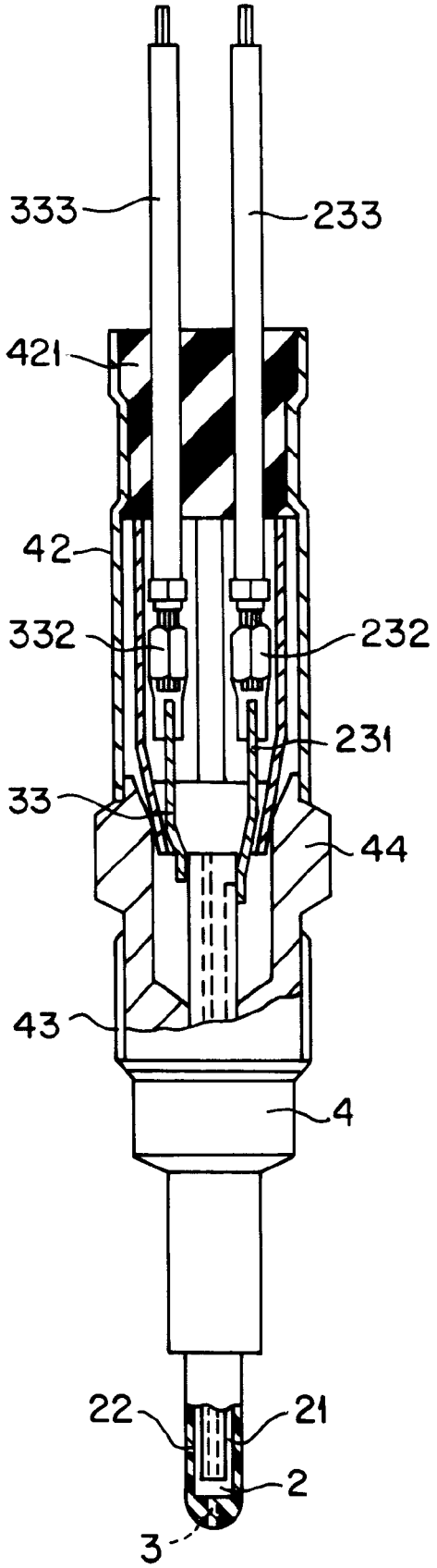

As shown in FIGS. 110A and 111, the main body 10 is retained in the metal housing 4 through the annular support 41 made of metal.

One lead wire 21 of the conductive heating-element 2 is pull up inside the insulator 11 and electrically connected to the internal lead wire 231 through the conductive terminal portion 123 provided at the side of the main body 10, while the other lead wire 22 is electrically connected to the housing 4 through the annular support 41. The upper portion of the ion current detecting electrode 3is electrically connected to the internal lead wire 33 through the conductive terminal portion 31 provided at the upper side of the insulator 11.

As shown in FIG. 111, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 332. The external lead wires 233 and 333 are thus electrically coupled to one end of the conductive heating-element 2 and the ion current detecting electrode 3, respectively.

As discussed above, the other end of the conductive heating-element 2 is electrically coupled to the housing 4 through the annular support 41 (FIG. 110A). The top portion (lower end portion) of the main body 10 is formed into a semi-spherical shape as also shown in FIG. 110A, from which the tip 3C of the ion current detecting electrode 3 is exposed.

Referring next to FIGS. 112 to 114, the process of manufacturing the glow plug main body 10 will be described. A plate-like molded part 110 for the first insulating substrate, a second molded part 120 for the second insulating substrate and a third molded part 130 for the covering insulating substrate are first prepared. Curved surface portions 121 and 131 are formed on the lower surface of the second molded part 120 and the upper surface of the third molded part 130, respectively. The three molded parts are products (green sheets) of nonconductive ceramic material.

In other words, the molded parts 110, 120 and 130 are constructed by mixing raw materials such as ceramic material and resin binder and press molding the mixture into the respective forms (FIG. 112 (*a*), (*b*) and (*c*)). Then, a conductive heating-element portion 20 is printed on the front face of the first molded part 110 with a conductive paste for the conductive heating-element by a screen printing (FIG. 112 (*d*)). Lead wire portions 210 and 220 are also printed in the same way (FIG. 112 (*e*)). Further, an ion current detecting electrode portion 30 is printed on the front face of the second molded part 120 with a conductive paste for the ion current detecting electrode (FIG. 112 (*f*)).

Next, as shown in FIG. 113 (A), the first molded part 110 is overlaid on the second molded part 120, and the molded part 130 is overlaid on the first molded part 110. The overlaid parts are degreased by preheating and baked by heating to form one unit. The molded parts are thus made into the first insulating substrate 12A, the second insulating substrate 12B and the covering insulating substrate 12C, respectively.

Using the semi-cylindrical covered surface portions 121 and 131 of the second and third molded parts, the sinter is cut and a glow plug having a circular cross section is produced. The end of the lead wire 210 is plated with Cu and Ni to form the terminal portion 123 (FIGS. 113 (C) and 110A). Further, as shown in FIG. 114, the internal lead wire 231 (FIG. 110A) is brazed to the terminal portion 123, plating the surface with Ni. The terminal 31 is formed in the same way to connect it to the internal lead wire 33. The glow plug main body 10 such as one shown in FIGS. 110A and 114 is thus obtained.

A concrete example of the glow plug main body 10 is shown. As raw materials for the first insulating substrate 12A, the second insulating substrate 12B and the covering insulating substrate 12C, 63% $Si_3N_4$ (silicon nitride) powder (per weight), 18% $Mosi_2$ (molybdenum disilicide) powder, 4% $Y_2O_3$ (yttria) powder, 3% $Al_2O_3$ (alumina), and a 12% composite binder containing paraffin wax as a main component were used. For the conductive heating-element portion 20, a paste of W (tungsten) and Re (rhenium) was used. As a conductive paste for printing formation of the lead wire portions 210 and 220, a paste of W (tungsten) was used. A conductive paste for printing formation of the ion current detecting electrode portion 30 was of W (tungsten) and Re (rhenium).

Firing of the laminated body (FIG. 113 (A)) was performed at 1700 to 1800° C. in an atmosphere of argon or nitrogen for one or two hr. by hot pressing.

The diameter of the main body 10 obtained was 3.5 mm. Further, the surface of the exposed portion 3B (FIG. 110A) of the top portion 3C of the ion current detecting electrode 3 was coated with Pt.

As discussed above, the glow plug of the embodiment is such that the conductive heating-element 2 and the lead wires 21 and 22 are formed inside the main body 10 by a printing technique while the ion current detecting electrode 3 is provided inside the main body. Since the conductive heating-element 2, the lead wires 21 and 22 and the ion current detecting electrode 3 are integrally formed with the main body, the glow action (heating action) of the conductive heating-element 2 and the ion current detection by the ion current detecting electrode 3 can be carried out by one glow plug.

Even when some carbon adhered onto the ion current detecting electrode 3, since the conductive heating-element 2 located near the ion current detecting electrode 3 can be energized to generate heat, the adhered carbon can be burnt off to return the ion current detecting electrode 3 to the normal state. It is therefore possible to detect ion current precisely.

Further, since the conductive heating-element 2 and the lead wires 21, 22 are formed by a printing technique, they are made thin and hence the glow plug main body can be made with compact structure. Furthermore, the first, second and covering insulating substrates 12A, 12B and 12C, the conductive heating-element 2, the lead wires 21, 22 and the ion current detecting electrode 3 are integrated, so that the glow plug is made simplified and easy to manufacture.

Furthermore, since the conductive heating-element 2, the lead wires 21, 22 and the ion current detecting electrode 3 are provided inside the insulator, excellent durability can be obtained without any rust due to oxidation or the like by the combustion gases. Furthermore, since the top portion of the main body 10 is made into the semi-spherical shape (FIG. 110A), thermal shock in the combustion chamber can be absorbed.

The top portion 3C of the ion current detecting electrode 3 is so exposed that it will contact the combustion gases (FIG. 110A). Since the exposed portion is coated with noble metal such as Pt, any insulating material due to oxidation can be prevented from developing on the surface of the ion current detecting electrode. It is therefore possible to secure the conductivity or the initial resistance of the electrode, and hence to prevent lowering of the detection accuracy.

Further, since the ion current detecting electrode 3 is provided nearby the diametrical center of the main body 10, the ion current can be detected with high accuracy in all directions of the combustion chamber.

The above insulating substrates can use $Al_2O_3$, Si—Al—O—N (sialon) other than $Si_3N_4$. Further, for the conductive paste used when the conductive heating-element and the like is formed by a printing technique, W, Mo, Re and W/Mo, or a mixture of resin with W/Re, WC and WC/Re are cited.

<<52nd Embodiment>>

As shown in FIGS. 115A and 115B, the embodiment shows an example of a glow plug main body 10 in which the terminal portion 31 is used as a common terminal portion for one lead wire 220 of the conductive heating-element 2 and the ion current detecting electrode 3 by connecting the lead wire 220 to the terminal portion 31 provided at the upper side of a rod-like insulator 12A. In this case, a heating circuit of the conductive heating-element 2 and an ion current detecting circuit are switched by a command signal from the ECU 52, and the system circuitry is connected to either of the conductive heating-element running state and the ion current detecting state constantly when in use. The other portions are the same as those of the 51st embodiment and the same effects as in the 51st embodiment can be obtained.

In the embodiment, since the terminal portion 31 is shared, the structure is simplified. Further, since in the ion current detecting state the conductive heating-element itself acts on the ion current detecting electrode, the area of the ion current detecting electrode can be effectively extended. It is therefore possible to detect ion current in a wide range and hence to improve the detection accuracy.

<<53rd Embodiment>>

As shown in FIGS. 116A and 116B, the embodiment is such that the conductive heating-element 2 and the ion current detecting electrode 3 are printed on an identical front-face of the second insulating substrate 12B. Further, a common terminal portion 31 is provided at the upper end of the glow plug main body 10, and one lead wire 22 of the conductive heating-element 2 and the ion current detecting electrode 3 are connected with the common terminal portion 31. The tip 3C of the ion current detecting electrode 3 is exposed to form an exposed portion 3B. The other portions are the same as those in the 51st embodiment.

According to the embodiment, the conductive heating-element 2, the lead wires 21, 22 and the ion current detecting electrode 3 are all formed on the second insulating substrate 12B by a printing technique, so that the printing formation can be made easy. Further, since two molded parts for the second insulating substrate 12B and the first insulating substrate 12A have only to be prepared, the glow plug can be manufactured easily at low cost. The same effects as in the 51st embodiment can also be obtained.

<<54th Embodiment>>

As shown in FIG. 117A, the embodiment is such that a semi-cylindrical concavity 120 and a semi-cylindrical concavity 110 are provided on the front face of the second insulating substrate 12B and on the back face of the first insulating substrate 12A, respectively, for inserting a cylindrical ion current detecting electrode therebetween.

The first insulating substrate 12A, the second insulating substrate 12B and the covering insulating substrate 12C are all made into a plate-like shape. For this reason, the glow plug main body 10 has a rectangular shape in cross section differently from the 51st embodiment (FIG. 117B). As shown in FIG. 117A, a paste-like conductive material 124 is provided inside the second insulating substrate 12B by a printing technique so that the ion current detecting electrode 3 can contact the conductive material 124. One end 125 of the conductive material 124 is exposed on the side face of the second insulating substrate 12B so that an unillustrated lead wire can contact the end 125.

The substrates are then baked and cut to be a rod-like shape in the same way as the 51st embodiment did. Even in the embodiment, the same effects as in the 51st embodiment can be obtained. Further, since in the embodiment the ion current detecting electrode 3 is a molded body having a semi-cylindrical shape, it is easy to secure the electrode surface area for ion current detection largely and effectively, thereby particularly improving the ion current detection accuracy.

<<55th Embodiment>>

As shown in FIGS. 118A to 119, the embodiment is such that two U-type conductive heating-elements 28, 29 are provided. In the glow plug shown in FIGS. 118A and 118B, one conductive heating-element 28 is provided between a first insulating substrate 11 and a covering insulating substrate 13, while the other conductive heating-element 29 is provided between an inner insulating substrate 115 and a second insulating substrate 12. The ion current detecting electrode 3 is arranged between the first insulating substrate 11 and the inner insulating substrate 115. Both ends of the conductive heating-elements 28, 29 are connected to the terminal portion 123 and the annular support 41 through the lead wires 21, 22 respectively in the same way as the 51st embodiment did.

In the glow plug shown in FIG. 119, the conductive heating-elements 28, 29 are provided between the first insulating substrate 11 and the covering insulating substrate 13 and between the first insulating substrate 11 and the inner insulating substrate 115 respectively, with the ion current detecting electrode 3 provided between the inner insulating substrate 115 and the second insulating substrate 12. The other portions are the same as those of the glow plug shown in FIG. 118A.

In either case of the embodiment, since two conductive heating-element system is provided, the glow plug can be heated up quickly and uniformly to considerably reduce the carbon burn-off time when smoke or smudge occurs due to carbon adhesion to the ion current detecting electrode 3, so that recovery of the ion current detecting state can be speeded up, thereby detecting ion current more precisely. The other portions are the same as those in the 51st embodiment and the same effects as in the 51st embodiment can also be obtained.

<<56th Embodiment>>

As shown in FIGS. 120A and 120B, the glow plug 1 of the embodiment is constituted of the main body 10 and the housing for mounting the main body 10. The main body 10 includes a rod-like insulator 11; a conductive heating-element 2 provided inside the rod-like insulator 11 by printing it on one end side of the insulator; and a pair of lead wires 21, 22 electrically connected to both ends of the conductive heating-element 2, drawn out on the other end side of the rod-like insulator 11.

The main body 10 also includes an ion current detecting electrode 3 for detecting an ionization state in the flame, which is provided inside the insulator 11 with electrical insulation from the conductive heating-element 2 established. The ion current detecting electrode 3 is provided at the diametrical center of the rod-like insulator.

As shown in FIGS. 120A and 121, the main body 10 is retained in the metal housing 4 through the annular support 41 made of metal. One lead wire 21 of the conductive heating-element 2 is pull up inside the rod-like insulator 11 and electrically connected to the internal lead wire 231 through the conductive terminal portion 123 provided at the side of the main body 10, while the other lead wire 22 is electrically connected to the housing 4 through the annular support 41. The upper portion of the ion current detecting electrode 3 is electrically connected to the internal lead wire 33 through the conductive terminal portion 31 provided at the upper side of the rod-like insulator 11.

As shown in FIG. 121, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 33.

The external lead wires 233 and 333 are thus electrically coupled to one end of the conductive heating-element 2 and the ion current detecting electrode 3, respectively.

As discussed above, the other end of the conductive heating-element 2 is electrically coupled to the housing 4 through the annular support 41 (FIG. 120A). The top portion (lower end portion) of the main body 10 is formed into a semi-spherical shape as shown in FIG. 120A, from which the tip 3C of the ion current detecting electrode 3 is exposed and the exposed portion 3B is formed.

Referring next to FIG. 122, the process of manufacturing the glow plug main body 10 will be described. The following outlines the manufacturing process. At first, a product for a core shaft 13 having a hollow portion 131, composed of electrically nonconductive ceramic material, is prepared, and the ion current detecting electrode 3 is inserted into the hollow portion 131. On the other hand, the conductive heating-element and the lead wires are printed out on a sheet 15 as a product for an insulating substrate composed of electrically nonconductive ceramic material. The product of the core shaft 13 is placed on the printed surface of the insulating substrate, and the insulating substrate is wrapped around the outer core shaft. The roll of the core shaft and the insulating substrate are then heated and baked.

In other words, as shown in FIG. 122, the core shaft 13 is constructed by mixing raw materials such as ceramic material and resin binder (FIG. 122(*a*)) and extrusion molding the mixture (FIG. 122(*b*)) into the product of a cylindrical shape having a hollow portion 131 axially penetrating through the product. The rod-like ion current detecting electrode 3 having electrical conductivity is then inserted into the hollow portion 131 of the core shaft 13 (FIG. 122(*c*)).

On the other hand, the insulating substrate is constructed by mixing raw materials such as ceramic material and resin binder (FIG. 122(*d*)) and making a thin-plate like sheet 15 (FIG. 122(*e*)). Then, through holes are provided in the sheet 15 for formation of terminal portions (FIG. 122(*f*)), and a conductive heating-element portion 20 is formed on the front face of the sheet 15 with a conductive paste for the conductive heating-element by a screen printing (FIG. 122 (*g*)). Lead wire portions 210, 220 are printed in the same way so as to be connected to the respective through holes (FIG. 122(*h*)).

Further, terminal portions 230 are printed on the back face of the sheet 15 with a conductive paste and coupled to the through holes 151 respectively (FIG. 122(*i*)).

Next, a coating material, composed of a ceramic material and a resin binder, is coated on the front face of the sheet 15 (FIG. 122(*j*)). Such coating is to smooth step heights between the sheet surface and the printed portions such as the conductive heating-element portion 20, and hence to improve adhesion of the sheet 15 to the core shaft 13 in the winding process.

The core shaft 13 with the ion current detecting electrode 3 inserted therein is placed on the surface of the sheet 15 on which portions such as the conductive heating-element portion 20 are formed by a printing technique, and the sheet 15 is wound around the core shaft 13 (FIG. 122(*k*)).

The sheet 15 and the core shaft 13, both composed of ceramic material, are then integrally baked by heating after degreasing by preheating (FIG. 122(*l*)). Since the sheet 15 and the core shaft 13 shrink due to firing, both are adhered and joined together tightly. The ion current detecting electrode 3 is also adhered and joined tightly due to shrinking of the core shaft 13 by firing.

Next, the terminal portions 230 are plated with Cu and Ni (FIG. 122(*m*)), the internal lead wire 231 is brazed to one terminal portion 230 (FIG. 122(*n*)) and the surface is further plated with Ni (FIG. 122(*o*)). The top portion of the rod-like insulator 11 is cut to be a semi-spherical shape as shown in FIG. 120. The glow plug main body 10 such as one shown in FIG. 120 is thus obtained.

A concrete example of the glow plug main body 10 is shown. The core shaft 13 has an outside diameter of 3.9 mm and an inside diameter of 0.7 mm in which the hollow portion 131 is formed. The sheet 15 is 0.3 mm in thickness, 11.5 mm in width and 54 mm in length. The outside diameter of the roll is 4.5 mm, while the diameter of the ion current detecting electrode 3 inserted in the hollow portion 131 is 0.7 mm.

As raw materials for the core shaft 13, 63% $Si_3N_4$ (silicon nitride) powder (per weight), 18% $MoSi_2$ (molybdenum disilicide) powder, 4% $Y_2O_3$ (yttria) powder, 3% $Al_2O_3$ (alumina), and a 12% composite binder containing paraffin wax as a main component were used.

As raw materials for the sheet 15, 70% $Si_3N_4$ (silicon nitride) powder (per weight), 20% $MoSi_2$ (molybdenum disilicide) powder, and a 10% composite binder containing paraffin wax as a main component were used.

For the conductive heating-element portion 20, a paste of W (tungsten) and Re (rhenium) was used. As a conductive paste for printing formation of the lead wire portions 210, 220 and the terminal portions 230, a paste of W (tungsten) was used. The ion current detecting electrode 3 was formed of $MoSi_2$ (molybdenum disilicide).

Firing of the roll (FIG. 122) was performed at 1700 to 1800° C. in an atmosphere of argon or nitrogen for two through four hr. In this firing process, the core shaft 13 shrank to decrease its outside diameter from 3.9 mm to 3.1 mm, while the ion current detecting electrode 3 shrank to decrease its diameter from 0.7 mm to 0.6 mm. Further, the surface of the exposed portion 3B (FIG. 120A) of the ion current detecting electrode 3 was coated with Pt.

The glow plug 1 constituted of the above parts such as the main body 10 and the 4 is mounted in the cylinder head 45 by fastening the male screw portion of the housing 4 as shown in FIG. 64. The glow plug 1 can be connected to the glow plug actuator circuit such as one shown in FIG. 64 or FIG. 68. In this case, since the same operation is performed as discussed above, the description will be omitted.

As described above, the glow plug of the embodiment is such that the conductive heating-element 2 and the lead wires 21, 22 are formed inside the rod-like insulator 11 by printing while the ion current detecting electrode 3 is provided inside the rod-like insulator 11. Since these parts are integrated, the glow action (heating action) of the conductive heating-element 2 and the ion current detection by the ion current detecting electrode 3 can be carried out by one glow plug.

Even when some carbon adhered onto the ion current detecting electrode 3, since the conductive heating-element 2 located near the ion current detecting electrode 3 can be energized to generate heat, the adhered carbon can be burnt off to return the ion current detecting electrode 3 to the normal state. It is therefore possible to detect ion current precisely.

Further, since the conductive heating-element 2 and the lead wires 21, 22 are formed by a printing technique, they are made thin and hence the glow plug main body can be made with compact structure. Furthermore, the rod-like insulator 11, the conductive heating-element 2, the lead wires 21, 22 and the ion current detecting electrode 3 are integrated, so that the structure is simplified. Furthermore, since the conductive heating-element 2, the lead wires 21, 22 and the ion current detecting electrode 3 are provided inside the rod-like insulator 11, excellent durability can be obtained without any rust due to oxidation or the like by the combustion gases.

The glow plug main body 10 of the embodiment is manufactured by printing the conductive heating-element and the lead wires on the sheet 15 for the insulating substrate, placing thereon the core shaft 13 with the ion current detecting electrode 3 inserted therein, wrapping the sheet 15 around the core shaft 13 and baking them. For this reason, the glow plug main body can be manufactured easily. Further, since the top portion of the rod-like insulator 11 is made into the semi-spherical shape, thermal shock in the combustion chamber can be absorbed.

The top portion 3C of the ion current detecting electrode 3 is so exposed that it will contact the combustion gases (FIG. 120A). Since the exposed portion is coated with noble metal such as Pt, any insulating material due to oxidation can be prevented from developing on the surface of the ion current detecting electrode. It is therefore possible to secure the conductivity or the initial resistance of the electrode, and hence to prevent lowering of the detection accuracy.

Further, since the ion current detecting electrode 3 is provided at the diametrical center of the rod-like insulator 11, the ion current can be detected with high accuracy in all directions of the combustion chamber.

The above rod-like insulator can use $Al_2O_3$, Si—Al—O—N (sialon) other than $Si_3N_4$. Further, for the conductive paste used when the conductive heating-element and the like is formed by a printing technique, W, Mo, Re, WC and W/Mo, or a mixture of resin with W/Re are cited.

Although the embodiment teaches that the ion current detecting electrode 3 is inserted into the hollow portion 131 of the core shaft 13 before firing (FIG. 122), the ion current detecting electrode 3 can be inserted in and joined with adhesive to the core shaft after firing (see the lower right portion of FIG. 122).

<<57th embodiment>>

As shown in FIG. 123A, the embodiment shows an example of a glow plug main body 10 in which the terminal portion 31 is used as a common terminal portion for one lead wire 220 of the conductive heating-element 2 and the ion current detecting electrode 3 by connecting the lead wire 220 to the terminal portion 31 provided at the upper side of a rod-like insulator 11. In this case, a heating circuit of the conductive heating-element 2 and an ion current detecting circuit are switched by a command signal from the ECU 52, and the system circuitry is connected to either of the conductive heating-element running state and the ion current detecting state constantly when in use. The other portions are the same as those of the 56th embodiment and the same effects as in the 51st embodiment can be obtained.

In the embodiment, since the terminal portion 31 is shared, the structure is simplified. Further, since in the ion current detecting state the conductive heating-element itself acts on the ion current detecting electrode, the area of the ion current detecting electrode can be effectively extended. It is therefore possible to detect ion current in a wide range and hence to improve the detection accuracy.

<<58th Embodiment>>

Referring next to FIGS. 124A to 7, a glow plug according to the embodiment will be described. The glow plug of the embodiment is a ceramic glow plug for use as starting aids of a Diesel engine, which is constituted of the main body 10 and the 4 for mounting the main body 10 as shown in FIGS. 124A and 124B. The main body 10 includes the rod-like insulator 11; the conductive heating-element 2 provided inside the rod-like insulator 11 by printing it on one end side of the insulator; and the pair of lead wires 21, 22 electrically connected to both ends of the conductive heating-element 2, drawn out on the other end side of the rod-like insulator 11.

The main body 10 also includes an ion current detecting electrode 3 for detecting an ionization state in the flame, which is provided inside a groove 150 with electrical insulation from the conductive heating-element 2 established, the groove 150 provided axially on the outer surface of the rod-like insulator 11.

As shown in FIGS. 124A and 125, the main body 10 is retained in the metal 4 through the annular support 41 made of metal. One lead wire 21 of the conductive heating-element 2 is pull up inside the rod-like insulator 11 and electrically connected to the internal lead wire 231 through the conductive terminal portion 123 provided at the side of the main body 10, while the other lead wire 22 is electrically connected to the housing 4 through the annular support 41.

The upper portion of the ion current detecting electrode 3 is electrically connected to the internal lead wire 33 through the conductive terminal portion 31 provided at the upper side of the rod-like insulator 11.

As shown in FIG. 125, the housing 4 has the annular support 41 and the protection tube 42 provided at the upper side of the housing 4. The housing 4 also has the male screw 43 for mounting the housing 4 in the cylinder head 45 of the engine. The rubber bush 421 is fitted into the upper opening of the protection tube 42. The external lead wires 233 and 333 are penetrated through or inserted into the rubber bush 421, and connected to the internal lead wires 231 and 33 through the respective connection terminals 232 and 332. The external lead wires 233 and 333 are thus electrically coupled to one end of the conductive heating-element 2 and the ion current detecting electrode 3, respectively.

As discussed above, the other end of the conductive heating-element 2 is electrically coupled to the housing 4 through the annular support 41 (FIG. 124A). The top portion (lower end portion) of the main body 10 is formed into a semi-spherical shape as shown in FIG. 124A, from which the tip 3C of the ion current detecting electrode 3 is exposed and the exposed portion 3B is formed.

Referring next to FIGS. 126A to 126D, the process of manufacturing the glow plug main body 10 will be described. At first, a thin-plate like sheet 15 is made up by mixing raw materials such as ceramic material and resin binder (FIG. 126A). Then, a conductive heating-element portion 20 is screen-printed on the front face of the sheet 15 with a conductive paste for the conductive heating-element, while lead wire portions 210 and 220 are formed by the same printing technique (FIG. 126B).

Further, a terminal portion (not shown) is printed on the back face of the sheet 15 with a conductive paste and so as to be coupled to the lead wire 210. A coating material, composed of a ceramic material and a resin binder, is next coated on the front face of the sheet 15. Such coating is to smooth step heights between the sheet surface and the printed portions such as the conductive heating-element portion 20, and hence to improve adhesion of the sheet 15 to the core shaft 13 in the winding process. On the other hand, a cylindrical core shaft 13 is prepared using the same materials as for the sheet 15. The core shaft 13 is placed on the surface of the sheet 15 on which portions such as the conductive heating-element portion 20 are formed, and the sheet 15 is wound around the core shaft 13 (FIG. 126C).

In this winding process, the groove 150 is formed axially among both of rolled-directional end surfaces 152, 153 of the sheet 15 and the core shaft 13. Such a groove 150 can be formed by setting the width of the sheet 15 to be small enough to form a space between both end surfaces 152 and 153. Alternatively, the groove portion 150 may be formed such that, after both end surfaces 152 and 153 have been joined together, one end surface is cut axially to be small in width.

Next, as shown in FIG. 126D, the cylindrical ion current detecting electrode 3 is put in the groove 150 and the groove 150 is filled with a coating material 19 composed of ceramic material. The sheet 15 and the core shaft 13 are then integrally baked by heating after degreasing by preheating. Since the sheet 15 and the core shaft 13 shrink due to firing, both are adhered and joined together tightly. The ion current detecting electrode 3 is also fixed tightly since the groove 150 narrows due to shrinking of the core shaft 13 by firing.

Next, the terminal portion 123 is plated with Cu and Ni as shown in FIG. 126D, while the internal lead wire 231 (FIG. 124A) is brazed to the terminal portion 123 and the surface is further plated with Ni. The top portion of the rod-like insulator 11 is cut to be a semi-spherical shape as shown in FIG. 124A. The glow plug main body 10 such as one shown in FIG. 124A is thus obtained.

A concrete example of the glow plug main body 10 is shown. The core shaft 13 has an outside diameter of 3.9 mm. The sheet 15 is 0.8 mm in thickness, 11.5 mm in width and 54 mm in length. The outside diameter of the roll is 4.5 mm. The diameter of the ion current detecting electrode 3 inserted in the groove 150 is 0.8 mm, while the groove 150 is 0.7 mm in width.

As raw materials for the core shaft 13, 63% $Si_3N_4$ (silicon nitride) powder (per weight), 18% $MoSi_2$ (molybdenum disilicide) powder, 4% $Y_2O_3$ (yttria) powder, 3% $Al_2O_3$ (alumina), and a 12% composite binder containing paraffin wax as a main component were used.

As raw materials for the sheet 15, 70% $Si_3N_4$ (silicon nitride) powder (per weight), 20% $MoSi_2$ (molybdenum disilicide) powder, and a 10% composite binder containing paraffin wax as a main component were used.

For the conductive heating-element portion 20, a paste of W (tungsten) and Re (rhenium) was used. As a conductive paste for printing formation of the lead wire portions 210, 220 and the terminal portions 123, a paste of W (tungsten) was used. The ion current detecting electrode 3 was formed of $MoSi_2$ (molybdenum disilicide). Further, the nonconductive coating material 19 filled in the groove 150 was formed of ceramic materials composed of 63% $Si_3N_4$ (silicon nitride) powder, 18% $MoSi_2$ (molybdenum disilicide) powder, 4% $Y_2O_3$ (yttria) powder, 3% $Al_2O_3$ (alumina), and a 12% composite binder containing paraffin wax as a main component.

Firing of the roll (FIG. 126D) was performed at 1700 to 1800° C. in an atmosphere of argon or nitrogen for two through four hr. In this firing process, the roll (rod-like insulator) shrank to decrease its outside diameter from 4.5 mm to 3.6 mm, while the ion current detecting electrode 3 shrank to decrease its diameter from 0.7 mm to 0.6 mm. Further, the surface of the exposed portion 3B (FIG. 120A) of the ion current detecting electrode 3 was coated with Pt.

The glow plug 1 constituted of the above parts such as the main body 10 and the housing 4 is mounted in the cylinder head 45 by fastening the male screw portion of the housing 4 as shown in FIG. 64. The glow plug 1 can be connected to the glow plug actuator circuit such as one shown in FIG. 64 or FIG. 68. In this case, since the same operation is performed as discussed above, the description will be omitted.

As described above, the glow plug of the embodiment is such that the ion current detecting electrode 3 is formed in the groove 150 of the rod-like insulator 11 while the conductive heating-element 2 and the lead wires 21, 22 are provided inside the rod-like insulator 11. Since these parts are integrated, the glow action (heating action) of the conductive heating-element 2 and the ion current detection by the ion current detecting electrode 3 can be carried out by one glow plug. Even when some carbon adhered around the ion current detecting electrode 3, since the conductive heating-element 2 located near the ion current detecting electrode 3 can be energized to generate heat, the adhered carbon can be burnt off to return the ion current detecting electrode 3 to the normal state. It is therefore possible to detect ion current precisely.

Further, since the conductive heating-element 2 and the lead wires 21, 22 are formed by a printing technique, they are made thin and hence the glow plug main body can be made with compact structure. Furthermore, the rod-like insulator 11, the conductive heating-element 2, the lead wires 21, 22 and the ion current detecting electrode 3 are integrated, so that the structure is simplified. Furthermore, since the conductive heating-element 2, the lead wires 21, 22 and the ion current detecting electrode 3 are provided inside the rod-like insulator 11, excellent durability can be obtained without any rust due to oxidation or the like by the combustion gases.

The glow plug main body 10 of the embodiment is manufactured by printing the conductive heating-element and the lead wires on the nonconductive sheet 15, placing thereon the core shaft 13, wrapping the sheet 15 around the core shaft 13 with the groove 150 formed thereamong, putting the ion current in the groove 150 and baking them. For this reason, the glow plug main A body can be manufactured easily. Further, since the top portion of the rod-like insulator 11 is made into the semi-spherical shape, thermal shock in the combustion chamber can be absorbed.

The top portion 3C of the ion current detecting electrode 3 is so exposed that it will contact the combustion gases (FIG. 124A). Since the exposed portion is coated with noble metal such as Pt, any insulating material due to oxidation can be prevented from developing on the surface of the ion current detecting electrode. It is therefore possible to secure the conductivity or the initial resistance of the electrode, and hence to prevent lowering of the detection accuracy.

In addition, the above rod-like insulator can use $Al_2O_3$, Si—Al—O—N (sialon) other than $Si_3N_4$. Further, for the conductive paste used when the conductive heating-element and the like is formed by a printing technique, W, Mo, Re, W/Mo, Wc and Wc/Re, or a mixture of resin with W/Re are cited.

<<59th Embodiment>>

As shown in FIG. 127, the embodiment is to provide a laminated glow plug main body 10. In the embodiment, an upper sheet 16 made of the same material as the core shaft 13 is stacked on the sheet 15 (FIGS. 126A through 126D)

having the printed portions such as the conductive heating-element portion 20 thereon as described in the 58th embodiment. The sheet 16 has a groove 160 for placing the ion current detecting electrode 3. A plate-like ion current detecting electrode 3 is then inserted in the groove 160 and filled with a nonconductive coating material 19 such as one mentioned in the 58th embodiment. After that, heating and firing, or hot pressing is performed in the same manner as the 58th embodiment did.

The conductive heating-element 2 and the lead wires (not shown) are provided between the electrically nonconductive sheets 15 and 16 constituting the rod-like insulator as shown in FIG. 127, thus obtaining the glow plug main body 10 with the ion current detecting electrode provided inside the groove 160. Since the embodiment uses a laminating method, the manufacturing process can be made simpler. After laminating, the glow plug main body is cut to be a desired form. The other portions are the same as those of the 58th embodiment and the same effects as in the 58th embodiment can also be obtained.

Industrial Applicability

As described above, the glow plug according to the present invention is effective for internal combustion engines, particularly in promoting ignition and combustion of fuel in Diesel engine. Since the glow plug is able to monitor combustion conditions by detecting ion current in the combustion chamber, it is also effective for engine control. Further, according to the ion current detector of the present invention, precise ion current detection can be realized. Furthermore, according to the glow plug manufacturing method of the present invention, a precise glow plug with simple structure can be manufactured.

What is claimed is:

1. A glow plug with a portion exposed into a combustion chamber for burning fuel comprising:

an insulator;

a heating element embedded in the insulator and energized through a pair of lead wires to generate heat; and an ion current detecting electrode embedded in said insulator, with a portion of the ion current detecting electrode exposed to a flame in a combustion chamber so that an ionization state in the flame can be detected.

2. A glow plug as set forth in claim 1, wherein said heating element and said ion current detecting electrode is electrically connected to each other.

3. A glow plug as set forth in claim 2, wherein said heating element and said ion current detecting electrode are integrally formed.

4. A glow plug as set forth in claim 2, wherein lead wires reside between said heating element and said ion current detecting electrode.

5. A glow plug as set forth in claim 2, wherein connecting portions to a power source is provided at both ends of said heating element, said ion current detecting electrode is electrically connected to the midway of said conductive heating-element, and when R1 denotes electric resistance of a first heating section of said heating element from the first end of said heating element, corresponding to a positive side in passing a DC current through said heating element, to a center of a first connecting portion, at which said ion current detecting electrode is first connected to said heating element; R2 denotes electric resistance of a second heating section of said heating element from the center of the first connecting portion, where a connection between said heating element and said ion current detecting electrode is first established, to the second end of said heating element corresponding to a negative side in passing a DC current through the heating element; and r denotes electric resistance between the first connecting portion and the opening end of said ion current detecting electrode, it satisfies the relationship of R2>r.

6. A glow plug as set forth in claim 5, wherein the relationship between the electric resistance R2 and the electric resistance r exhibits $R2 \geqq r$.

7. A glow plug as set forth in claim 5 or 6, wherein said ion current detecting electrode is constructed of the main composition of a conductive ceramic material made of more than one kind of metallic silicide, carbide, nitride or boride, or a mixture of a conductive ceramic material and a nonconductive ceramic material.

8. A glow plug as set forth in claim 5, wherein said ion current detecting electrode is constructed of the main composition of a material made of one kind of refractory metal having a melting point of 1200° C. or higher, or a mixture of the refractory metal material and a nonconductive ceramic material.

9. A glow plug as set forth in claim 5, wherein the exposed portion of said ion current detecting electrode exposed from said insulator is provided with a portion made of more than one kind of noble metal such as Pt, Ir, Rh, Ru and Pd.

10. A glow plug as set forth in claim 2, wherein said insulator and said ion current detecting electrode forms said main body retained in the housing, and the tip of said ion current detecting electrode is exposed from said insulator into the flame with positioning it more than 2 mm away from the tip of said housing.

11. A glow plug as set forth in claim 10, wherein when R (Ω) denotes the total electric resistance of said conductive heating-element and B (Ω) denotes the electric resistance from the positive end of said conductive heating-element to the tip of said ion current detecting electrode, the relationship between the resistances R and B satisfies $$B \geqq R(\Omega)/3.$$

12. A glow plug as set forth in claim 1, wherein said heating element and said ion current detecting electrode are insulated from each other.

13. An ion current detector using the glow plug of claim 5 for detecting ion current resulting from fuel combustion, comprising:

switching means for turning on or off the power supply to said heating element;

leakage current detection means for detecting a leakage current from said ion current detecting electrode in a predetermined stage before fuel combustion; and operation means for operating said switching means to temporarily energize said heating element when the leakage current detected by said leakage current detection means is larger than a predetermined threshold.

14. An ion current detector as set forth in claim 13, wherein said leakage current detection means is operated to detect the leakage current when pressure in the combustion chamber rises.

15. A glow plug as set forth in claim 1, wherein at least the portion of said ion current detecting electrode exposed to the flame is made of a conductive ceramic material.

16. A glow plug as set forth in claim 1, wherein said heating element and said ion current detecting electrode are produced dividedly from each other by using mixtures having different components or different particle sizes.

17. A glow plug as set forth in claim 1, wherein at least the exposed portion of said ion current detecting electrode that contacts the flame has a conductive mixed-sinter that is constructed by surrounding a nonconductive ceramic particle with conductive ceramic particles, with an sintering auxiliary of more than one kind of oxide of rare-earth element contained therein, the structure of the mixed sinter composed of a first crystal phase and a grain boundary phase between the first crystal phases with portion of the grain boundary phase or the entire grain boundary phase crystallized into a second crystal phase.

18. A glow plug as set forth in claim 17, wherein the content of said sintering auxiliary to the total weight of said conductive ceramic material and said nonconductive ceramic material is between 3 wt % and 25 wt %.

19. A glow plug as set forth in claim 17 or 18, wherein said second crystal phase exists in said grain boundary phase of said ion current detecting electrode with a degree of crystallization of more than 5%.

20. A glow plug as set forth in claim 17, wherein said nonconductive ceramic material is silicon nitride and said conductive ceramic material is more than one kind of materials such as metallic carbide, silicide, nitride and boride.

21. A glow plug as set forth in claim 1, wherein the exposed portion of said ion current detecting electrode exposed from said insulator into the flame has a surface roughness Rz ranging from 0.1 to 30 $\mu$m (mean value of 10 points).

22. A glow plug as set forth in claim 21, wherein the area of the exposed portion provided at the tip of said ion current detecting electrode is set in a range from $1\times10^{-6}$ to 0.5 $cm^2$.

23. A glow plug as set forth in claim 21 or 22, wherein said ion current detecting electrode is electrically connected to said conductive heating-element.

24. A glow plug as set forth in claim 1, wherein at least top portion of said ion current detecting electrode is covered with a nonconductive porous layer having a communication hole through which said ion current detecting electrode can be opened into the flame.

25. A glow plug as set forth in claim 24, wherein the thickness of said nonconductive porous layer is between 0.2 mm and 1.5 mm.

26. A glow plug as set forth in claim 24 or 25, wherein said nonconductive porous layer and said insulator are made of the same material.

27. A glow plug as set forth in claim 24, wherein said ion current detecting electrode can be used for said conductive heating-element.

28. A glow plug as set forth in claim 1, wherein when K denotes the coefficient of linear expansion of said ion current detecting electrode, H denotes the coefficient of linear expansion of said conductive heating-element and S denotes the coefficient of linear expansion of said insulator, the relationship among K, H and S satisfies $$H \geqq S, \text{ and } H \geqq K.$$

29. A glow plug as set forth in claim 28, wherein the coefficients of linear expansion K, H and S further satisfies the following relationship:

$$0 \leqq H-S \leqq 2.0\times10^{-6}(/^\circ\text{ C.}),$$

and $$0 \leqq H-K \leqq 2.0\times10^{-6}(/^\circ\text{ C.}).$$

30. A glow plug as set forth in claim 28 or 29, wherein said ion current detecting electrode is constructed of the main composition of a conductive ceramic material made of more than one kind of metallic silicide, carbide, nitride or boride, or a mixture of a conductive ceramic material and a nonconductive ceramic material.

31. A glow plug as set forth in claim 28, wherein said ion current detecting electrode is constructed of the main composition of a material made of one kind of refractory metal having a melting point of 1200° C. or higher, or a mixture of the refractory metal material and a nonconductive ceramic material.

32. A glow plug as set forth in claim 1, wherein a conductive layer is further provided on the surface of said insulator so as to cover the exposed portion of said ion current detecting electrode exposed from said insulator into the flame, with establishing an electrical connection to said ion current detecting electrode.

33. A glow plug as set forth in claim 32, wherein said conductive layer has a through hole for partially exposing said insulator so that an edged portion will be formed on the side of the through hole exposed into the flame.

34. A glow plug as set forth in claim 33, wherein the edged portion has a rectangular shape in cross section.

35. A glow plug as set forth in claim 32, wherein said conductive layer has net structure so that the surface of said insulator will be exposed from meshes of the net.

36. A glow plug as set forth in claim 32, wherein said conductive layer is made of metal or conductive ceramic material.

37. A glow plug as set forth in claim 32, wherein said conductive layer is between 1 $\mu$m and 20 $\mu$m in thickness.

38. A glow plug as set forth in claim 1, wherein said insulator includes a first insulating substrate, a covering insulating substrate provided on the front face of the first insulating substrate, and a second insulating substrate stacked on the back face of the first insulating substrate, said heating element is formed by printing between the front face of the first insulating substrate and the covering insulating substrate, said pair of lead wires are formed by printing between the front face of the first insulating substrate and the covering insulating substrate so as to be connected to both ends of said heating element, and said ion current detecting electrode is provided between the first and second insulating substrates.

39. A glow plug as set forth in claim 38, wherein each outer surface of the first insulating substrate and the covering insulating substrate has a curved surface portion.

40. A glow plug as set forth in claim 38, wherein said ion current detecting electrode is formed by printing on the front face of the second insulating substrate.

41. A glow plug as set forth in claim 38, wherein said ion current detecting electrode is made of a conductive wire and provided between the front face of the second insulating substrate and the back face of the first insulating substrate.

42. A glow plug as set forth in claim 38, wherein the tip of said ion current detecting electrode is exposed at the top portion of the second insulating substrate so as to be exposed into the flame.

43. A glow plug as set forth in claim 38, wherein said ion current detecting electrode is made of more than one kind of ceramic materials $MoSi_2$, WC and TiN.

44. A glow plug as set forth in claim 38, wherein said ion current detecting electrode is made of refractory metal containing more than one kind of metals W, Mo and Ti.

45. A glow plug as set forth in claim 38, wherein the exposed portion of said ion current detecting electrode exposed from the second insulating substrate is provided with more than one kind of noble metal such as Pt, Ir, Rh, Ru and Pd.

46. A glow plug as set forth in any one of claims 38 through 45, wherein the top portion of said glow plug itself is made into a semi-spherical shape.

47. A glow plug as set forth in claim 1, wherein said insulator has a first insulating and a second insulating substrate, and said conductive heating-element, said lead wires connected to both ends of said conductive heating-element and said ion current detecting electrode are sandwiched between the first insulating and the second insulating substrate.

48. A glow plug as set forth in claim 1, wherein said insulator is a rod-like insulator, said heating element is formed by printing inside the rod-like insulator, said pair of lead wires are electrically connected to both ends of said heating element and drawn out to the outside of the rod-like insulator, and said ion current detecting electrode is provided inside said rod-like insulator with electrical insulation from said heating element established.

49. A glow plug as set forth in claim 48, wherein said the tip of said ion current detecting electrode is exposed at the top portion of said rod-like insulator so as to be exposed into the flame.

50. A glow plug as set forth in claim 49, wherein the exposed portion of said ion current detecting electrode exposed from said rod-like insulator is provided with more than one kind of noble metals Pt, Ir, Rh, Ru and Pd.

51. A glow plug as set forth in claim 48, wherein said ion current detecting electrode is made of more than one kind of ceramic materials $MoSi_2$, WC and TiN.

52. A glow plug as set forth in claim 51, wherein the exposed portion of said ion current detecting electrode exposed from said rod-like insulator is provided with more than one kind of noble metals Pt, Ir, Rh, Ru and Pd.

53. A glow plug as set forth in claim 48, wherein said ion current detecting electrode is made of refractory metal containing more than one kind of metals W, Mo and Ti.

54. A glow plug as set forth in claim 53, wherein the exposed portion of said ion current detecting electrode exposed from said rod-like insulator is provided with more than one kind of noble metals Pt, Ir, Rh, Ru and Pd.

55. A glow plug as set forth in claim 48, wherein the top portion of said rod-like insulator is made into a semi-spherical shape.

56. A glow plug as set forth in claim 1, wherein said insulator is a rod-like insulator constituted of an electrically insulating core shaft with a hollow portion therein and an insulating substrate covering the outer core shaft, said heating element is formed by printing between the core shaft and the insulating substrate inside said rod-like insulator, said pair of lead wires are electrically connected to both ends of said heating element and drawn out to the outside of said rod-like insulator, and said ion current detecting electrode is inserted in and fixed to the hollow portion of the core shaft with electrical insulation from said heating element established.

57. A glow plug as set forth in claim 56, wherein said heating element is formed by printing on the inside surface of the insulating substrate.

58. A glow plug as set forth in claim 1, wherein said insulator is a rod-like insulator; said heating element is provided inside the rod-like insulator; said pair of lead wires are electrically connected to both ends of said heating element and drawn out to the outside of said rod-like insulator; and said ion current detecting electrode is put in a groove with electrical insulation from the heating element established, the groove provided axially on the outer surface of said rod-like insulator.

59. A glow plug as set forth in claim 58, wherein the groove with said ion current detecting electrode therein is filled with a nonconductive coating material so that said ion current detecting electrode can be covered therewith.

60. A glow plug as set forth in claim 58 or 59, wherein said heating element and said lead wires are formed by printing.

61. An ion current detector comprising:

a glow plug provided with a heating element projecting into a combustion chamber, the heating element supplied with power from a power source to generate heat;

ion current detection means using said glow plug for detecting ion current produced when burning fuel;

switching means for switching over between a heating-element running state of said glow plug and an ion current detecting state of said ion current detection means;

operation means for operating said switching means to temporarily switch over to the ion current detecting state at least immediately after fuel ignition stage under the heating-element running state of said glow plug.

62. An ion current detector as set forth in claim 61, wherein said operation means operates said switching means to switch over to the ion current detecting state for a predetermined period of time after each stage of fuel injection into the combustion chamber.

63. An ion current detector as set forth in claim 61, wherein said operation means operates at a predetermined frequency to switch over between the heating-element running state and the ion current detecting state.

64. An ion current detector as set forth in claim 61, wherein said glow plug comprising a pair of lead wires for producing current through said heat element, an insulator embedding said heating element therein, and an ion current detecting electrode integrally formed with said heating element, and said ion current detector uses said glow plug for detecting ion current produced when burning fuel.

65. An ion current detector as set forth in claim 61, further comprising:

leakage current detection means for detecting a leakage current flowing from the exposed electrode portion in a predetermined stage before fuel ignition under the ion current detecting state of said glow plug; and second operation means for operating said switching means to temporarily switch over from the ion current detecting state to the heating-element running state when the leakage current detected by said leakage current detection means is larger than a given threshold.

66. An ion current detector as set forth in claim 65, wherein said leakage current detection means detects a leakage current when pressure in the combustion chamber rises.

67. An ion current detector as set forth in claim 65, wherein said leakage current detection means detects a leakage current in response to the timing of fuel injection into the combustion chamber.

68. An ion current detector as set forth in claim 65, wherein said second operation means holds said switching means in the heating-element running state for a period of time according to the leakage current value detected by said leakage current detection means.

69. An ion current detector as set forth in claim 65, further comprising a high-pass filter responsible to the ion current detected, wherein an output signal of said high-pass filter is supplied to a processor as an ion current detection signal.

70. An ion current detector as set forth in claim 69, wherein a threshold for use in judging the level of the leakage current is set to a value near the acceptable maximum value.

71. An ion current detector as set forth in claim 69 or 70, further comprising comparison means responsible to the output signal of said high-pass filter, which uses a threshold for use in detecting combustion conditions as the threshold value to be compared with the output signal of said high-pass filter.

72. An ion current detector that uses a glow plug having a heating element energized through a pair of conductive wires to generate heat, comprising:

switching means for switching over between a first state and a second state, the first state for applying a supply voltage from a power source to the conductive wire pair, and the second state for shutting an electric path between said conductive wire pair and said power source and applying the supply voltage between said heating element and a wall portion of a combustion chamber; and ion current detection means for detecting ion current resulting from fuel combustion by using the voltage supplied from said power source in the second state.

73. An ion current detector as set forth in claim 72, wherein said power source is connected through said switching means to the electric path between said heating element and the wall portion of said combustion chamber.

74. An ion current detector as set forth in claim 72, wherein said power source is directly connected to the electric path between said heating element and the wall portion of said combustion chamber.

75. An ion current detector as set forth in claim 72, wherein the power source for applying voltage to said conductive wire pair in the first state and the power source for applying voltage between said heating element and the wall portion of said combustion chamber in the second state are provided separately.

76. An ion current detector as set forth in claim 72, wherein the power source for applying voltage to said conductive wire pair in the first state and the power source for applying voltage between said heating element and the wall portion of said combustion chamber in the second state are constructed by a common power source.

77. An ion current detector as set forth in claim 72, said ion current detector used in a Diesel engine, wherein one end of said power source is connected to one conductive wire coupled to said heating element while the other is connected to a cylinder head of the Diesel engine for holding said glow plug.

78. An ion current detector as set forth in claim 72, wherein a constant voltage circuit is provided between said power source and one wire of said conductive wire pair for regulating the supply voltage of said power source to a constant value.

79. An ion current detector as set forth in claim 72, wherein a plurality of glow plugs are connected in parallel and power-supply paths to individual glow plugs are switched at the same time by said switching means.

80. An ion current detector as set forth in claim 72, wherein a voltage detector for ion current detection is provided between one conductive wire of said glow plug and the ground contact.

81. An ion current detector as set forth in claim 72, wherein a capacitor is provided between one conductive wire of said glow plug and said voltage detector.

82. An ion current detector as set forth in claim 72, wherein an ion current detecting resistor is provided on the grounded side of said power source separately provided, and ion current is detected from a potential difference between both terminals of the ion current detecting resistor.

83. A glow plug used in said ion current detector as set forth in claim 72, wherein a heating element portion having a heating element is so provided that it projects into a combustion chamber for burning fuel, and an ion current detecting electrode to the inner wall of said combustion chamber is formed in said heating element.

84. A glow plug used in said ion current detector as set forth in claim 72, comprising a heating element portion provided with a heat resisting insulator and a heating element embedded in the heat resisting insulator, wherein a portion of said heating element is exposed from said heat resisting insulator and the exposed portion is used as an ion current detecting electrode to the inner wall of said combustion chamber.

85. A glow plug as set forth in claim 83 or 84, wherein said heating element is made of a ceramic material.

86. A method of manufacturing said glow plug of claim 56, comprising the steps of:

preparing a product of the core shaft having the hollow portion and composed of electrically nonconductive ceramic material, and inserting said ion current detecting electrode into the hollow portion, forming said heating element and said lead wires on the surface of the product of the insulating substrate composed of electrically nonconductive ceramic material by using a printing technique, placing the product of the core shaft on the printed surface of the insulating substrate and winding the insulating substrate around the outer core shaft, and heating and baking the core shaft and the insulating substrate.

* * * * *